US011471366B2

(12) United States Patent
Bobey et al.

(10) Patent No.: US 11,471,366 B2
(45) Date of Patent: Oct. 18, 2022

(54) PERCUSSION THERAPY APPARATUS AND METHODS THEREOF

(71) Applicant: HILL-ROM SERVICES PTE. LTD., Singapore (SG)

(72) Inventors: John A. Bobey, Daniel Island, SC (US); Bryan Chng, Singapore (SG); Kok Boon R. Ong, Singapore (SG); Harold M. Cabral, Singapore (SG); Deny D. Barilea, Singapore (SG); Suresha Ventakaraya, Singapore (SG); Wei T. Tan, Singapore (SG); Clementine Pirio, Nantes (FR); Nicholas Mann, Cincinnati, OH (US); Chad M. Boerst, North Oaks, MN (US); Mary J. Rossini, Fridley, MN (US); Denis Sin, Singapore (SG); Vinay Joshi, Singapore (SG); Dirk Tjepkema, Enschede (NL); Sytze A. Spijksma, Haaksbergen (NL); Petrus J. van den Oever, Enschede (NL); Ari T. Adler, Cambridge, MA (US); William C. Stewart, Ipswich, MA (US); Jason Robinson, Tewksbury, MA (US); Timothy R. Proulx, Nashua, NH (US); Alex Staudt, Brooklyn, NY (US); Petrus T. Rutgers, Hengelo (NL)

(73) Assignee: HILL-ROM SERVICES PTE. LTD., Singapore (SG)

( * ) Notice: Subject to any disclaimer, the term of this patent is extended or adjusted under 35 U.S.C. 154(b) by 1094 days.

(21) Appl. No.: 15/672,346

(22) Filed: Aug. 9, 2017

(65) Prior Publication Data

US 2018/0049939 A1 Feb. 22, 2018

Related U.S. Application Data

(60) Provisional application No. 62/478,864, filed on Mar. 30, 2017, provisional application No. 62/435,919,
(Continued)

(51) Int. Cl.
*A61H 9/00* (2006.01)
*A61H 23/02* (2006.01)
(Continued)

(52) U.S. Cl.
CPC ..... *A61H 9/005* (2013.01); *A61H 7/004* (2013.01); *A61H 23/006* (2013.01);
(Continued)

(58) Field of Classification Search
CPC ..... A61H 9/005; A61H 7/004; A61H 23/006; A61H 23/0218; A61H 2023/002;
(Continued)

(56) References Cited

U.S. PATENT DOCUMENTS 1,646,590 A 10/1927 Mildenberg
2,486,667 A 11/1949 Meister
(Continued)

FOREIGN PATENT DOCUMENTS

CA 2563723 8/2011
DE 202008015893 U1 6/2009
(Continued)

OTHER PUBLICATIONS

International Biophysics Corporation; AffloVest Instructions for Use and Owner's Manual; Jun. 13, 2013; AffloVest.com (Year: 2013 ).*

(Continued)

*Primary Examiner* — Joseph D. Boecker
*Assistant Examiner* — Thomas W Greig
(74) *Attorney, Agent, or Firm* — Barnes & Thornburg LLP

(57) ABSTRACT

Devices, systems, and methods for percussion therapy of a patient's torso area provide percussive force to release and/or dislodge mucous from respiratory airways of a human patient. Such devices, systems, and methods may include a torso covering for securing to a patient's torso, percussive devices coupled to the torso covering, and an attachment assembly for supporting the torso covering. The
(Continued)

percussive devices may include a percussion frame, an electromechanically actuated percussor for controlled movement between end positions, and resilient members attached to opposite ends of the percussion frame for assisting controlled movement of the percussor. The devices, systems, and methods disclosed herein provide efficient and comfortable high-frequency percussive force to a patient's torso, reducing stress on the patient and improving patient experience.

19 Claims, 84 Drawing Sheets

Related U.S. Application Data filed on Dec. 19, 2016, provisional application No. 62/377,984, filed on Aug. 22, 2016.

(51) Int. Cl.
*A61H 23/00* (2006.01)
*A61H 7/00* (2006.01)

(52) U.S. Cl.
CPC ... *A61H 23/0218* (2013.01); *A61H 2023/002* (2013.01); *A61H 2201/0134* (2013.01); *A61H 2201/123* (2013.01); *A61H 2201/165* (2013.01); *A61H 2201/1664* (2013.01)

(58) Field of Classification Search
CPC .... A61H 2201/0134; A61H 2201/0123; A61H 2201/1664; A61H 23/00; A61H 23/008; A61H 23/02; A61H 23/04; A61H 9/00; A61H 9/0071; A61H 9/0078; A61H 23/0245
See application file for complete search history.

(56) References Cited

U.S. PATENT DOCUMENTS 3,053,250 A 9/1962 Stubbs
3,291,123 A 12/1966 Terauchi
3,310,050 A 3/1967 Goldfarb
3,460,531 A 8/1969 Gardner
3,802,417 A 4/1974 Lang
3,955,563 A 5/1976 Maione
4,069,816 A 1/1978 Yamamura et al.
4,079,733 A 3/1978 Denton et al.
4,098,266 A 7/1978 Muchisky et al.
4,102,334 A 7/1978 Muchisky
4,216,766 A 8/1980 Duykers et al.
4,387,708 A 6/1983 Davis
4,397,306 A 8/1983 Weisfeldt et al.
4,453,538 A 6/1984 Whitney
4,508,107 A 4/1985 Strom et al.
4,512,339 A 4/1985 McShirley
4,530,349 A 7/1985 Metzger
4,624,244 A 11/1986 Taheri
4,697,580 A 10/1987 Terauchi
4,838,263 A 6/1989 Warwick et al.
4,887,594 A 12/1989 Siegel
4,977,889 A 12/1990 Budd
5,018,517 A 5/1991 Liardet
5,056,505 A 10/1991 Warwick et al.
5,167,226 A 12/1992 Laroche et al.
5,181,504 A 1/1993 Ono et al.
5,235,967 A 8/1993 Arbisi et al.
5,261,394 A 11/1993 Mulligan et al.
5,334,131 A 8/1994 Omandam et al.
5,451,190 A 9/1995 Liardet
5,453,081 A 9/1995 Hansen
5,455,159 A 10/1995 Mulshine et al.
5,496,262 A 3/1996 Johnson, Jr. et al.
5,569,170 A 10/1996 Hansen
5,716,131 A * 2/1998 Breeding ..... E04G 21/066 224/265
5,738,637 A 4/1998 Kelly et al.
5,769,797 A 6/1998 Van Brunt et al.
5,769,800 A 6/1998 Gelfand et al.
5,891,062 A 4/1999 Schock et al.
6,022,328 A 2/2000 Hailey
6,036,662 A 3/2000 Van Brunt et al.
6,098,222 A 8/2000 Hand et al.
6,174,295 B1 1/2001 Cantrell et al.
6,176,235 B1 1/2001 Benarrouch et al.
6,190,337 B1 2/2001 Nedwell
6,193,677 B1 2/2001 Cady
6,193,678 B1 2/2001 Brannon
6,254,556 B1 7/2001 Hansen et al.
6,290,660 B1 9/2001 Epps et al.
6,352,518 B1 3/2002 nee Wolf
D456,591 S 5/2002 Hansen
D461,897 S 8/2002 Hansen et al.
6,478,755 B2 11/2002 Young
D469,876 S 2/2003 Hansen et al.
6,547,749 B2 4/2003 Hansen
D478,989 S 8/2003 Hansen et al.
6,676,614 B1 1/2004 Hansen et al.
6,702,769 B1 3/2004 Fowler-Hawkins
6,736,785 B1 5/2004 Van Brunt
6,958,047 B2 10/2005 DeVlieger
6,984,214 B2 1/2006 Fowler-Hawkins
7,074,200 B1 7/2006 Lewis
7,128,811 B2 10/2006 Watanabe
D531,728 S 11/2006 Helgeson
7,207,953 B1 4/2007 Goicaj
7,232,417 B2 6/2007 Plante
D547,718 S 7/2007 Helgeson et al.
7,278,978 B1 10/2007 Hansen et al.
7,343,916 B2 3/2008 Biondo et al.
7,374,550 B2 5/2008 Hansen et al.
7,416,536 B2 8/2008 DeVlieger
7,425,203 B2 * 9/2008 Van Brunt ..... A61H 9/0078 601/150
7,445,607 B2 11/2008 Plante
D585,991 S 2/2009 Helgeson et al.
7,537,575 B2 5/2009 Hansen et al.
7,597,670 B2 10/2009 Warwick et al.
7,618,384 B2 11/2009 Nardi et al.
7,713,219 B2 5/2010 Helgeson et al.
7,736,324 B1 6/2010 Helgeson
7,762,967 B2 7/2010 Warwick et al.
7,785,280 B2 8/2010 Kivisto
7,798,982 B2 9/2010 Zets et al.
7,927,293 B1 4/2011 Ignagni et al.
7,931,607 B2 4/2011 Biondo et al.
D639,954 S 6/2011 Helgeson et al.
7,981,066 B2 7/2011 Lewis
8,108,957 B2 2/2012 Richards et al.
8,192,381 B2 6/2012 Nozzarella
8,197,428 B2 6/2012 Helgeson et al.
8,202,237 B2 6/2012 Helgeson et al.
8,241,233 B2 8/2012 Litton et al.
8,257,288 B2 9/2012 Hansen et al.
8,273,039 B1 9/2012 Ignagni
8,460,223 B2 6/2013 Huster et al.
8,584,279 B2 11/2013 Richards et al.
D697,197 S 1/2014 Hansen et al.
8,734,370 B1 5/2014 Ignagni
8,740,824 B2 6/2014 Hansen et al.
8,777,880 B2 7/2014 Davis et al.
8,790,285 B2 7/2014 Bisera et al.
8,801,643 B2 8/2014 Deshpande et al.
9,549,869 B2 1/2017 DeVlieger et al.
9,744,097 B2 8/2017 DeVlleger et al.
2002/0014235 A1 2/2002 Rogers et al.
2002/0016560 A1 2/2002 Hansen
2002/0111571 A1 8/2002 Warwick et al.
2002/0121273 A1 * 9/2002 Nyilas ..... A41D 13/1245 128/99.1
2002/0195144 A1 12/2002 Hand et al.
2004/0069304 A1 4/2004 Jam

(56) References Cited

U.S. PATENT DOCUMENTS

| | | | | |
|---|---|---|---|---|
| 2004/0097842 | A1 | 5/2004 | Van Brunt et al. | |
| 2004/0097843 | A1 | 5/2004 | Van Brunt et al. | |
| 2004/0097844 | A1 | 5/2004 | Van Brunt et al. | |
| 2004/0097845 | A1 | 5/2004 | Van Brunt | |
| 2004/0097846 | A1 | 5/2004 | Van Brunt et al. | |
| 2004/0097847 | A1 | 5/2004 | Van Brunt et al. | |
| 2004/0097849 | A1* | 5/2004 | Van Brunt | A61H 9/0078 601/44 |
| 2004/0097850 | A1 | 5/2004 | Plante | |
| 2004/0133133 | A1 | 7/2004 | Driemann | |
| 2004/0158177 | A1 | 8/2004 | Van Brunt et al. | |
| 2005/0150720 | A1 | 7/2005 | Tudor et al. | |
| 2005/0234372 | A1 | 10/2005 | Hansen et al. | |
| 2005/0235988 | A1 | 10/2005 | Hansen et al. | |
| 2006/0005306 | A1 | 1/2006 | Call et al. | |
| 2006/0015045 | A1 | 1/2006 | Zets et al. | |
| 2006/0089575 | A1 | 4/2006 | DeVlieger | |
| 2007/0239087 | A1 | 10/2007 | Kivisto | |
| 2008/0108914 | A1 | 5/2008 | Brouqueyre et al. | |
| 2008/0221489 | A1 | 9/2008 | Madsen et al. | |
| 2008/0300515 | A1 | 12/2008 | Nozzarella et al. | |
| 2009/0069728 | A1 | 3/2009 | Hoffmann et al. | |
| 2009/0221944 | A1 | 9/2009 | Hobson et al. | |
| 2009/0255022 | A1 | 10/2009 | Smith et al. | |
| 2010/0113993 | A1 | 5/2010 | Davis | |
| 2010/0242955 | A1 | 9/2010 | Hansen | |
| 2010/0249634 | A1 | 9/2010 | Hansen | |
| 2011/0125068 | A1 | 5/2011 | Hansen et al. | |
| 2011/0166486 | A1 | 7/2011 | Kumanomido | |
| 2012/0067322 | A1 | 3/2012 | Andersson et al. | |
| 2012/0259255 | A1 | 10/2012 | Tomlinson et al. | |
| 2012/0291798 | A1 | 11/2012 | Park et al. | |
| 2013/0261518 | A1 | 10/2013 | Hansen et al. | |
| 2013/0331747 | A1 | 12/2013 | Helgeson et al. | |
| 2014/0005579 | A1* | 1/2014 | Drlik | A61H 23/0218 601/111 |
| 2014/0012167 | A1* | 1/2014 | DeVlieger | A61H 23/02 601/111 |
| 2014/0276271 | A1 | 9/2014 | Stryker et al. | |
| 2016/0095789 | A1* | 4/2016 | Baxter | A61F 7/00 601/18 |
| 2016/0095790 | A1* | 4/2016 | Shockley, Jr. | A61H 23/0218 601/46 |
| 2016/0166463 | A1* | 6/2016 | Douglas | A61H 9/0092 601/150 |
| 2017/0027246 | A1* | 2/2017 | Inzer | A41D 13/0015 |
| 2018/0027891 | A1* | 2/2018 | Thrane | A41D 27/08 |

FOREIGN PATENT DOCUMENTS

| | | |
|---|---|---|
| GB | 1136896 | 12/1968 |
| GB | 2 068 737 A | 2/1981 |
| WO | 2011/094883 | 8/2011 |
| WO | WO 2016/057527 A1 | 4/2016 |

OTHER PUBLICATIONS

Extended European Search Report for European Patent Application No. 17187129.6 dated May 18, 2018; 10 pages.

The "VibraVest" by OxyCare GmbH, VibraVest_engl_web.pdf, Nov. 23, 2011 (3 pages).

International Biophysics Corporation—"AffloVest Answering Needs: The Role of the AffloVest in the Respiratory Market," AffloVest White Paper; 12 pages.

Rubin, Bruce K.; "Emerging Therapies for Cystic Fibrosis Lung Disease;" Chest 1999; 115:1120-1126 (7 pages).

AffloVest Instructions for Use and Owner's Manual, AffloVest.com; document created Jun. 24, 2013 (18 pages).

Clinical Study of the AffloVest, Mar. 2013 (6 pages).

Extended European Search Report for European Patent Application No. 20185497.3 dated Nov. 2, 2020 (8 pages).

Partial European Search Report for European Patent Application No. 1718729.6, dated Feb. 12, 2018; 13 pages.

* cited by examiner 96,134,1096,1134
92,130,1092,1130
14,16,1014,1016,2014,2016
26,28,1026,1028
226
455
410
464
94,132,1094,1132
18,1018,2018,3018,4018
228,2228,3228,4228
SEE FIG.65C 26,28,1026,1028
466
470
464

26,28,1026,1028
460
462
458
454
452
456
455
228,2228, 3228,4228
226
14,16,1014, 1016,2014,2016
464
470
92,130, 1092,1130
96,134,1096,1134
94,132,1094,1132
410
30
470
18,1018,2018,3018,4018

PERCUSSION THERAPY APPARATUS AND METHODS THEREOF

The present application claims the benefit, under 35 U.S.C. § 119(e), of U.S. Provisional Application No. 62/377,984, filed Aug. 22, 2016, U.S. Provisional Application No. 62/435,919, filed Dec. 19, 2016, and U.S. Provisional Application No. 62/478,864, filed Mar. 30, 2017, each of which is hereby incorporated by reference herein in its entirety.

BACKGROUND

The present disclosure relates to devices, systems, and methods for percussion therapy. More specifically, the present disclosure relates to devices, systems, and methods for percussion therapy for a patient's torso.

Patient respiratory systems can experience build-up of phlegm, mucous, and similar substances. Typically, healthy patients can expectorate such build-ups naturally. Certain respiratory ailments and other conditions affecting respiratory function can create excessive build-up and/or make expectoration more difficult. Chronic suffers of excessive build-up and/or reduced expectoration ability, such as, for example, those with cystic fibrosis, may require assistance to remove such build-up.

Percussive therapy can assist in dislodging mucous and other build up from respiratory systems. However, proper manual percussive therapy generally requires a trained practitioner to perform the therapy on the patient. Moreover, manual percussive therapy can be time consuming and physically demanding for the practitioner, as well as uncomfortable and ineffective for the patient-recipient.

SUMMARY

The present application discloses one or more of the features recited in the appended claims and/or the following features which, alone or in any combination, may comprise patentable subject matter:

According to an aspect of the disclosure, a percussion therapy apparatus for thoracic percussion therapy may include a torso covering for securing to a patient's torso, the torso covering including a front panel having an interior side for engaging the patient's chest and a rear panel having an interior side for engaging the patient's back, a number of percussive devices coupled to the torso covering to provide percussive force to the patient's torso, and an attachment assembly for supporting the torso covering, the attachment assembly including a number of straps each having a first end connected to one of the front and the rear panels and a second end connected to the other of the front and the rear panels, at least one of the number of straps defines a cavity therein that extends between the respective first and second ends for receiving at least one cable therethrough to electrically communicate between the front and rear panels of the torso covering.

In some embodiments, the front panel of the torso covering may include a first section and a second section releasably coupled to each other at a medial intersection.

In some embodiments, the first and second sections may be releasably coupled at the medial intersection by a zipper assembly having first and second zipper portions attached to the first and second sections, respectively, the first and second zipper portions each having a top end and bottom end and each being angled between its respective top and bottom ends within the range of about 1 to about 5 degrees from the sagittal plane in opposite lateral directions.

In some embodiments, the percussion therapy apparatus may further include a user interface configured to receive user input for adjusting percussive force of the percussive devices and a power source for providing power to the percussive devices, the control interface being releasably coupled to the front panel and the power source being releasably coupled to the rear panel.

In some embodiments, adjusting the percussive force includes at least one of adjusting an intensity of percussive force, a frequency of percussive force, and a duration of a percussion cycle.

In some embodiments, the percussion therapy apparatus may further include a break button for pausing a percussion cycle of the number of percussive devices. In some embodiments, the break button may be coupled to the front panel and in communication with the number of percussive devices.

In some embodiments, the number of straps may include a number of shoulder straps for arrangement over a patient's shoulders in a direction from back to chest and the attachment assembly may include a number of side straps each having a first end connected to one of the front and the rear panels and a second end connected to the other of the front and the rear panels and disposed on opposite lateral sides of the torso covering.

In some embodiments, the front panel may include an inner pane, an outer pane, and a frame pane disposed between the inner and outer panes, at least one of the inner, outer, and frame panes including a groove defined therein for receiving cabling between adjacent panes. In some embodiments, the inner and outer panes may include compression foam and the frame pane may include semi-rigid plastic.

In some embodiments, the rear panel may include an inner pane, an outer pane, and a frame pane disposed between the inner and outer panes. In some embodiments, the inner and outer pane comprise a compression foam and the frame pane comprises a semi-rigid plastic.

In some embodiments, at least one of the inner, outer, and frame panes including a groove defined therein for receiving cabling between adjacent panes.

In some embodiments, the apparatus may include a control pack coupled with the rear panel to provide power and communication to the percussive devices.

In some embodiments, the control pack may be coupled with the rear panel at location near a center of the control pack and a center of the rear panel.

In some embodiments, the control pack may be attached to the frame pane through an opening in the outer pane.

In some embodiments, the rear panel may include a receiver assembly for housing the control pack, and the receiver assembly may include a flange extending along an exterior side of the rear panel to define a receiver space and receiver trim connected with the flange and defining a lip.

In some embodiments, the receiver assembly may include a pack cover configured to engage with the lip of the receiver trim to couple the pack cover with the rear panel and enclose the receiver space.

In some embodiments, the lip may include at least two outwardly extending sections and the outer cover includes a skirt adapted to extend over the at least two outwardly extending sections and to cinch about the lip to secure the pack cover thereto.

In some embodiments, the rear panel may include a number of openings defined therethrough for receiving the percussive devices to provide percussive force to the patient's back. In some embodiments, the number of openings may include four openings arranged in a trapezoidal shape.

In some embodiments, the number of percussive devices may each include a housing defining a cavity therein, a percussion assembly arranged within the cavity to produce percussive force, and an actuator arranged for selective actuation of the percussion assembly.

In some embodiments, the housing may include a basin and a cap coupled to the basin to enclose the cavity.

In some embodiments, the basin may include an outer circumferential wall extending about a central axis, an end wall arranged to close an end of the cavity defined by the basin, and a mount wall arranged within the cavity and extending from the end wall about the central axis to a support end thereof for supporting the actuator.

In some embodiments, the basin may include a bus duct for receiving cabling therethrough for electrical connection of the actuator. In some embodiments, the mount wall may include reinforcement ribs arranged circumferentially about the central axis.

In some embodiments, the percussion assembly may include a percussion frame for supporting percussive force, a percussor for controlled movement between a first end position and a second end position, and a number of resilient members for assisting controlled movement of the percussor.

In some embodiments, the percussion frame may include an annular base strut formed about a central axis and a number of anchors arranged about the central axis and each having a fastener hole defined therethrough for securing the frame to the housing. In some embodiments, the annular base strut may be arranged around the percussive device.

In some embodiments, the percussor may include a percussor body extending about the central axis and defining an interior space, a magnet secured within the interior space, and a percussor cap attached to the percurssor body at one end to secure the magnet within the interior space.

In some embodiments, the percussor body may include a circumferential wall that extends around the central axis, an end wall extending orthogonally from the circumferential wall on one axial end of the percussor body, and a central hub extending axially from the end wall within the interior space.

In some embodiments, the central hub and the end wall may collectively define a hub passage extending axially therethrough.

In some embodiments, the number of resilient members may include a first resilient member attached to the percussor cap and a second resilient member attached to the percussor body on a side opposite the percussor cap.

In some embodiments, the number of resilient members may each include a plate spring including a plurality of coplanar hoops arranged concentrically about the central axis and each having a diameter that successively increases from an innermost hoop to an outermost hoop of the plurality.

In some embodiments, each hoop of the plurality may be attached to at least one radially adjacent-hoop of the plurality at connection points distributed about the central axis, the connection points of radially adjacent-hoops of the plurality being angularly offset from the connection points of the successively next pair of radially adjacent-hoops of the plurality to permit flexible extension of the plurality of hoops along the central axis.

In some embodiments, the outermost hoop may be attached to the percussion frame and the innermost hoop is attached to the percussor.

In some embodiments, the number of resilient members may each include a plate spring having an inner ring and a number of fingers extending from connection with the inner ring with curvature equal to each other in the same direction about the central axis to an outer end to provide flexible extension along the central axis.

In some embodiments, each finger may be coupled with the percussor near its connection with the inner ring and is coupled with the percussion frame at its outer end.

In some embodiments, the attachment system may include a number of side strap assemblies each including a cam buckle coupled to the front panel having a base and a cam lever pivotably coupled to the base and operable between an open position to loosen the side strap assembly and a closed position to tighten the side strap assembly.

In some embodiments, the cam lever may include a cam arranged to contact the base when the cam lever is in the closed position to maintain the cam lever in the closed position and out of contact with the base when the cam lever is in the open position.

In some embodiments, the side strap assemblies may each include a D-ring and a cam strap coupled at each end to the cam buckle and threaded through an opening in the D-ring.

In some embodiments, the side strap assemblies may each include a main strap coupled to the rear panel, the main straps each including a number of loops arranged for selectively receiving an arm of the D-ring therethrough to couple the front and rear panels together.

In some embodiments, the side strap assemblies may each include a main strap and a cam strap, each extending from one of the front and rear panels, and at least one of the cam strap and main strap is substantially stretchable.

In some embodiments, the number of straps may include at least one shoulder strap that is substantially stretchable and defines the cavity for receiving cabling therethrough. In some embodiments, the cabling may extend through the cavity with a serpentine path. In some embodiments, the at least one shoulder strap may overlie a hook-and-loop connection formed between shoulder portions of the front and rear panels.

According to another aspect of the present disclosure, a percussion therapy apparatus for providing percussion therapy to a patient's body may include a torso covering for securing to a patient's torso, the torso covering including a front panel having an interior side for engaging the patient's chest and a rear panel having an interior side for engaging the patient's back and a number of percussive devices coupled to the torso covering to provide percussive force to the patient's torso. The percussion therapy apparatus may include a user interface releasably coupled to the torso covering and in communication with the number of percussive devices and configured to receive user input for adjusting percussive force of the number of percussive devices.

In some embodiments, the front panel of the torso covering may include a first section and a second section coupled to each other at a medial intersection. In some embodiments, the first and second sections may be releasably coupled at the medial intersection by a zipper assembly having first and second zipper portions attached to the first and second sections, respectively. In some embodiments, the first and second zipper portions may each have a top end and bottom end and may each be angled between its respective top and bottom ends within the range of about 1 to about 5 degrees from the sagittal plane in opposite lateral directions.

In some embodiments, the user interface may be releasably coupled to the front panel. In some embodiments, the percussion therapy apparatus may include a power source releasably coupled to the rear panel. In some embodiments, the user interface may be releasably coupled to the first section.

In some embodiments, a break button for pausing a percussion cycle of the number of percussive devices may be coupled to the second section. In some embodiments, a power port may be coupled to the second section.

In some embodiments, the percussion therapy apparatus may include a break button for pausing a percussion cycle of the number of percussive devices. In some embodiments, the break button may be coupled to the front panel and in communication with the number of percussive devices.

In some embodiments, at least one of the front panel and the rear panel may include an inner pane, an outer pane, and a frame pane disposed between the inner and outer panes. In some embodiments, the inner and outer pane may include compression foam and the frame pane may include semi-rigid plastic. In some embodiments, at least one of the inner, outer, and frame panes may include a groove defined therein for receiving cabling between adjacent panes.

According to another aspect of the present disclosure, a percussion therapy apparatus for providing percussion therapy to a patient's body may include a torso covering for securing to a patient's torso, the torso covering including a front panel having an interior side for engaging the patient's chest and a rear panel having an interior side for engaging the patient's back and a number of percussive devices coupled to the torso covering to provide percussive force to the patient's torso. The percussion therapy apparatus may include a break button in communication with the number of percussive devices to pause percussive force.

In some embodiments, the break button may be coupled to the chest panel. In some embodiments, the chest panel may include first and second sections connected at the medial intersection. In some embodiments, the break button may be coupled to the second section. In some embodiments, a power port may be coupled to the second section. In some embodiments, the power port may receive connection to provide electric power to a control pack coupled to the rear panel. In some embodiments, the power port may be a recharging port for receiving electric connection for recharging a battery of the percussion therapy apparatus.

In some embodiments, a user interface may be releasably coupled to the first section.

In some embodiments, the first and second sections are releasably coupled at the medial intersection by a fastener assembly having first and second fastener portions attached to the first and second sections, respectively. In some embodiments, the fastener assembly may be a zipper assembly having first and second zipper portions attached to the first and second sections, respectively.

According to another aspect of the present disclosure, a percussion therapy apparatus for providing percussion therapy to a patient's body may include a torso covering for securing to a patient's torso, the torso covering including a front panel having an interior side for engaging the patient's chest and a rear panel having an interior side for engaging the patient's back and a number of percussive devices coupled to the torso covering to provide percussive force to the patient's torso. The percussion therapy apparatus may include a power port for receiving connection of electric power, the power port coupled to the front panel.

In some embodiments, the front panel may include first and second sections connected at the medial intersection and the power port is coupled to one of the first and second sections of the front panel.

In some embodiments, the power port may be a recharging port for receiving electric connection for recharging a battery of the percussion therapy apparatus.

In some embodiments, the percussion therapy apparatus may include a user interface configured to receive user input for adjusting percussive force of the number of percussive devices, the user interface coupled to one of the first and second sections of the front panel.

In some embodiments, the power port may be coupled to an opposite one of the first and second sections from the user interface.

In some embodiments, the first and second sections may be releasably coupled at the medial intersection by a fastener assembly having first and second fastener portions attached to the first and second sections, respectively. In some embodiments, the fastener assembly may be a zipper assembly having first and second zipper portions attached to the first and second sections, respectively.

In some embodiments, the power port may receive connection to provide electric power to a control pack coupled to the rear panel.

In some embodiments, the power port may be a recharging port for receiving electric connection for recharging a battery of the percussion therapy apparatus.

According to another aspect of the present disclosure, a percussion therapy apparatus for providing percussion therapy to a patient's body may include a torso covering for securing to a patient's torso, the torso covering including a front panel having an interior side for engaging the patient's chest and a rear panel having an interior side for engaging the patient's back and a number of percussive devices coupled to the torso covering to provide percussive force to the patient's torso. The percussion therapy apparatus may include a control pack having a control housing and circuitry arranged within the control housing and in communication to provide power and communication to the percussive devices. The control pack may be coupled with the rear panel at location near a center of the control pack and a center of the rear panel. At least one of a user interface, a break button, and a power port may be coupled to the chest panel.

In some embodiments, the rear panel may include an inner pane, an outer pane, and a frame pane disposed between the inner and outer panes, and the control pack is attached to a frame pane of the rear panel through an opening in the outer pane.

In some embodiments, the rear panel may include a receiver assembly for housing the control pack. The receiver assembly may include a flange extending along an exterior side of the rear panel to define a receiver space and receiver trim connected with the flange and defining a lip. In some embodiments, the receiver assembly may include a pack cover configured to engage with the lip of the receiver trim to couple the pack cover with the rear panel and enclose the receiver space.

In some embodiments, the lip may include at least two outwardly extending sections and the pack cover may include a skirt adapted to extend over the at least two outwardly extending sections and to cinch about the lip to secure the pack cover thereto. In some embodiments, the pack cover may be generally triangular.

In some embodiments, the rear panel may include a number of openings defined therethrough for receiving the percussive devices to provide percussive force to the patient's back. In some embodiments, the number of openings may include four openings arranged in a trapezoidal shape. In some embodiments, at least two of the openings are arranged within the receiver space. In some embodiments, at least two of the openings are arranged outside of the receiver space.

According to another aspect of the present disclosure, a percussive device for generating percussive force for administration of percussion therapy to a patient's body to assist expectoration may include a housing defining a cavity therein, a percussion assembly including a percussion frame secured to the housing, a percussor arranged for actuated movement, and a magnet, each arranged within the cavity for producing percussive force to encourage expectoration, and an actuator arranged for selective actuation of the percussion assembly.

In some embodiments, the housing may include a basin and a cap coupled to the basin to enclose the cavity. The basin may include an outer circumferential wall extending about a central axis, an end wall arranged to close an end of the cavity defined by the basin, and a mount wall arranged within the cavity and extending from the end wall about the central axis to a support end thereof for supporting the actuator.

In some embodiments, the basin may include a bus duct for receiving cabling therethrough for electrical connection of the actuator.

In some embodiments, the mount wall may include reinforcement ribs arranged circumferentially about the central axis.

In some embodiments, the percussion assembly may include a percussion frame for supporting percussive force and a percussor for controlled movement between a first end position and a second end position.

In some embodiments, the percussion frame may include an annular base strut formed about a central axis and a number of anchors arranged about a central axis and each having a fastener hole defined therethrough for securing the frame to the housing. In some embodiments, the annular base strut may be arranged around the percussor.

In some embodiments, the percussor may include a percussor body extending about a central axis and defining an interior space, a magnet secured within the interior space, and a percussor cap attached to the percussor body at one end to secure the magnet within the interior space.

In some embodiments, the percussor body may include a circumferential wall that extends around the central axis, an end wall extending orthogonally from the circumferential wall on one axial end of the percussor body, and a central hub extending axially from the end wall within the interior space.

In some embodiments, the central hub and the end wall may collectively define a hub passage extending axially there through.

In some embodiments, the percussion assembly may include a number of resilient members including a first resilient member attached to the percussor cap and a second resilient member attached to the percussor body on a side opposite the percussor cap.

In some embodiments, the percussion assembly may include a number of resilient members each comprising a plate spring including a plurality of coplanar hoops arranged concentrically about a central axis and each having a diameter that successively increases from an innermost hoop to an outermost hoop of the plurality. In some embodiments, each hoop of the plurality may be attached to at least one radially adjacent-hoop of the plurality at connection points distributed about the central axis. In some embodiments, the connection points of radially adjacent-hoops of the plurality may be angularly offset from the connection points of the successively next pair of radially adjacent-hoops of the plurality to permit flexible extension of the plurality of hoops along the central axis.

In some embodiments, the outermost hoop of each of the number of resilient members may be attached to the percussion frame and the innermost hoop of each of the number of resilient members may be attached to the percussor.

In some embodiments, the percussion assembly may include a number of resilient members each comprising a plate spring including an inner ring and a number of fingers extending from connection with the inner ring with curvature equal to each other in the same direction about a central axis to an outer end to provide flexible extension along the central axis.

In some embodiments, each finger may be coupled with the percussor near its connection with the inner ring and may be coupled with the percussion frame at its outer end.

According to another aspect of the present disclosure, a percussive device for generating percussive force for administration of percussion therapy on a patient's body to assist expectoration may include a housing defining a cavity therein, a percussion assembly arranged within the cavity to produce percussive force to encourage expectoration, the percussion assembly including a percussion frame secured with the housing and a percussor supported by the percussion frame for controlled movement between a first end position and a second end position relative to the percussion frame, and an actuator arranged for selective actuation of the percussion assembly.

In some embodiments, the housing may include a basin and a cap coupled to the basin to enclose the cavity, the basin including an outer circumferential wall extending about a central axis, an end wall arranged to close an end of the cavity defined by the basin, and a mount wall arranged within the cavity and extending from the end wall about the central axis to a support end thereof for supporting the actuator.

In some embodiments, the basin may include a bus duct for receiving cabling therethrough for electrical connection of the actuator.

In some embodiments, the mount wall may include reinforcement ribs arranged circumferentially about the central axis.

In some embodiments, the percussion frame may include an annular base strut formed about a central axis and a number of anchors arranged about the central axis and each having a fastener hole defined therethrough for securing the frame to the housing. In some embodiments, the annular base strut may be arranged around the percussor.

In some embodiments, the percussor may include a percussor body extending about a central axis and defining an interior space, a magnet secured within the interior space, and a percussor cap attached to the percussor body at one end to secure the magnet within the interior space.

In some embodiments, the percussor body may include a circumferential wall that extends around the central axis, an end wall extending orthogonally from the circumferential wall on one axial end of the percussor body, and a central hub extending axially from the end wall within the interior space.

In some embodiments, the central hub and the end wall may collectively define a hub passage extending axially therethrough.

In some embodiments, the percussion assembly may include a number of resilient members including a first resilient member attached to the percussor cap and a second resilient member attached to the percussor body on a side opposite the percussor cap.

In some embodiments, the percussive device may include a number of resilient members each including a plate spring including a plurality of coplanar hoops arranged concentrically about a central axis and each having a diameter that successively increases from an innermost hoop to an outermost hoop of the plurality.

In some embodiments, each hoop of the plurality may be attached to at least one radially adjacent-hoop of the plurality at connection points distributed about the central axis. The connection points of radially adjacent-hoops of the plurality may be angularly offset from the connection points of the successively next pair of radially adjacent-hoops of the plurality to permit flexible extension of the plurality of hoops along the central axis.

In some embodiments, the outermost hoop may be attached to the percussion frame and the innermost hoop may be attached to the percussor.

In some embodiments, the percussion assembly may include a number of resilient members each including a plate spring having an inner ring and a number of fingers extending from connection with the inner ring.

In some embodiments, the number of fingers may each extend coplanar with the inner ring with curvature equal to each other in the same direction about a central axis to an outer end to provide flexible extension along the central axis.

In some embodiments, each of the number of fingers may be coupled with the percussor near its connection with the inner ring and is coupled with the percussion frame at its outer end.

According to another aspect of the present disclosure, a percussion therapy apparatus for providing percussion therapy to a patient's body may include a torso covering for securing to a patient's torso, the torso covering including a front panel having an interior side for engaging the patient's chest and a rear panel having an interior side for engaging the patient's back, and a number of percussive devices coupled to the torso covering to provide percussive force to the patient's torso. The percussion therapy assembly may include a control pack arranged in communication with the number of percussive devices to govern operation of the percussive devices in providing percussion therapy, and a receiver assembly for housing the control pack, the receiver assembly including a flange extending from the rear panel and a pack cover secured with the flange.

In some embodiments, the flange may extend along an exterior side of the rear panel to define at least a portion of a receiver space and the receiver assembly includes receiver trim connected with the flange and defining a lip.

In some embodiments, the pack cover may engage with the lip of the receiver trim coupling the pack cover with the rear panel to enclose the receiver space. In some embodiments, the lip may include at least two outwardly extending sections.

In some embodiments, the pack cover may include a skirt adapted to extend over the at least two outwardly extending sections and to cinch about the lip to secure the pack cover thereto.

In some embodiments, the rear panel may include a number of openings defined therethrough for receiving the percussive devices to provide percussive force to the patient's back. In some embodiments, the number of openings may include four openings arranged in a trapezoidal shape.

In some embodiments, the rear panel may include a number of openings defined therethrough for receiving the percussive devices to provide percussive force to the patient's back. The number of openings may include at least one opening positioned with the receiver space and at least one opening positioned outside the receiver space.

In some embodiments, the number of openings may include at least four openings arranged in a trapezoidal shape.

According to another aspect of the present disclosure, a percussion therapy apparatus for providing percussion therapy to a patient's body may include a torso covering for securing to a patient's torso, the torso covering including a front panel having an interior side for engaging the patient's chest and a rear panel having an interior side for engaging the patient's back, and a number of percussive devices coupled to the torso covering to provide percussive force to the patient's torso. The percussion therapy apparatus may include an attachment system including a number of side strap assemblies each including a cam buckle coupled to the front panel and having a base and a cam lever pivotably coupled to the base.

In some embodiments, the cam lever may be operable between an open position to loosen the side strap assembly and a closed position to tighten the side strap assembly.

In some embodiments, the cam lever illustratively includes a cam arranged to contact the base when the cam lever is in the closed position to maintain the cam lever in the closed position and out of contact with the base when the cam lever is in the open position.

In some embodiments, the side strap assemblies may each include a D-ring and a cam strap coupled at each end to the cam buckle and threaded through an opening in the D-ring.

In some embodiments, the side strap assemblies may each include a main strap coupled to the rear panel, the main straps each including a number of loops arranged for selectively receiving an arm of the D-ring therethrough to couple the front and rear panels together.

In some embodiments, at least one of the main strap and the cam strap may be substantially stretchable.

In some embodiments, the number of side strap assemblies may be attached to the front and rear panels and extend therebetween beneath a patient's arm.

According to another aspect of the present disclosure, a percussion therapy apparatus for providing percussion therapy to a patient's body may include a torso covering for securing to a patient's torso, the torso covering including a front panel having an interior side for engaging the patient's chest and a rear panel having an interior side for engaging the patient's back, and a number of percussive devices coupled to the torso covering to provide percussive force to the patient's torso. The percussion therapy device may include an outer liner releasably attached to the torso covering for protection against contaminants.

In some embodiments, the outer liner may be shaped complimentary to the front panel. In some embodiments, the outer liner may include snaps for releasable attachment to the torso covering. In some embodiments, the outer liner may include leashes for wrapping around the torso covering and/or portions attached with the torso covering to secure the outer liner thereto.

In some embodiments, the outer liner may be attached to an outer surface of the front panel to enclose at least one of the number of percussive devices. In some embodiments, a user interface may couple with the front panel on an outer side of the outer liner. In some embodiments, the outer liner may include at least one hole defined therein for receiving extension of a coupler therethrough to couple the user interface with the front panel on the outer side of the outer liner.

In some embodiments, the outer liner may enclose a break button coupled to the front panel and operable through the outer liner to pause percussive impact of the number of percussive devices.

In some embodiments, the front panel of the torso covering may include a first section and a second section releasably coupled to each other and the outer liner includes corresponding first and second sections releasably coupled to the corresponding first and second sections of the front panel.

According to another aspect of the present disclosure, a percussion therapy apparatus for providing percussion therapy to a patient's body may include a torso covering for securing to a patient's torso, the torso covering including a front panel having an interior side for engaging the patient's chest and a rear panel having an interior side for engaging the patient's back, and a number of percussive devices adapted to provide percussive force to the patient's torso. The percussion therapy apparatus may include a mounting assembly for coupling the number of percussive devices with the torso covering. The mounting assembly may include a number of mounting brackets attached to the torso covering, each mounting bracket defining an opening for receiving one of the number of percussive devices.

In some embodiments, each mounting bracket may include a number of fairings each having a stopper surface adapted for engagement with a housing of a respective one of the number of percussive devices, the number of fairings defining receptacles therebetween.

In some embodiments, the stopper surface of each fairing may include an inclined section and a rest section, the inclined section forming a ramp between one of the receptacles and the rest section.

In some embodiments, the housing of the respective one of the number of percussive devices may include at least one wing adapted for insertion within the one of the receptacles such that rotation of the housing engages the wing to be wedged by the ramped section into seated contact with the rest section.

In some embodiments, the percussion therapy apparatus may include a number of contact pads for engagement between the number of percussive devices and the patient's body. Each of the number of contact pads including a head arranged on a contact side and a collar extending from the head for connection with the torso covering.

In some embodiments, the percussion therapy device may include a number of retainers each attached to the torso covering for engagement with the collar of one of the number contact pads.

In some embodiments, each retainer may include a tab and each collar may include a groove adapted to receive the tab of the corresponding retainer for connection of the number of contact pads to the torso covering.

According to another aspect of the present disclosure, a percussion therapy apparatus for thoracic percussion therapy may include a torso covering for securing to a patient's torso, the torso covering including a front panel having an interior side for engaging the patient's chest and a rear panel having an interior side for engaging the patient's back, and a number of percussion devices coupled to the torso covering to provide percussive force to the patient's torso. At least one of the front panel and rear panels may include a groove defined therein for receiving cabling for connection with the number of percussive devices.

In some embodiments, the front panel may include an inner pane, an outer pane, and a frame pane disposed between the inner and outer panes, and the inner and outer pane comprise compression foam and the frame pane comprises semi-rigid plastic.

In some embodiments, the rear panel may include an inner pane, an outer pane, and a frame pane disposed between the inner and outer panes, and the inner and outer pane comprise compression foam and the frame pane comprises semi-rigid plastic.

In some embodiments, the groove may be defined in at least one of the inner and outer panes.

In some embodiments, the percussion therapy apparatus may include a control pack coupled with the rear panel to provide power and communication to the percussive devices.

In some embodiments, the control pack may be coupled with the rear panel at location near a center of the control pack and a center of the rear panel.

In some embodiments, the control pack may be attached to the frame pane through an opening in the outer pane.

In some embodiments, the rear panel may include a receiver assembly for housing the control pack, the receiver assembly comprising a flange extending along an exterior side of the rear panel to define a receiver space and receiver trim connected with the flange and defining a lip.

In some embodiments, the receiver assembly may include a pack cover configured to engage with the lip of the receiver trim to couple the pack cover with the rear panel and enclose the receiver space.

In some embodiments, the lip may include at least two outwardly extending sections and the outer cover may include a skirt adapted to extend over the at least two outwardly extending sections and to cinch about the lip to secure the pack cover thereto.

In some embodiments, the rear panel may include a number of openings defined therethrough for receiving the percussion devices to provide percussive force to the patient's back.

In some embodiments, the number of openings may include four openings arranged in a trapezoidal shape. In some embodiments, at least two of the number of openings may be arranged within the receiver space. In some embodiments, at least two the openings may be arranged outside of the receiver space.

In some embodiments, the front panel may include an exterior side opposite the interior side, and a number of slider pipings secured with the front panel on the exterior side for connecting accessories with the front panel. In some embodiments, the number of slider pipings may be configured for connection with an outer covering as an accessory for protecting the chest panel.

According to another aspect of the present disclosure, a percussion therapy apparatus for providing percussion therapy to a patient's body may include a torso covering for securing to a patient's torso, the torso covering including a front panel having an interior side for engaging the patient's chest and a rear panel having an interior side for engaging the patient's back, and a number of percussive devices secured to the torso covering and adapted to provide percussive force to the patient's torso. The percussion therapy device may include a number of contact pads for engagement between the number of percussive devices and the patient's body. Each of the number of contact pads may include a head arranged on a contact side and a collar extending from the head for connection with the torso covering.

In some embodiments, the percussion therapy apparatus may include a number of retainers each attached to the torso covering for engagement with the collar of one of the number contact pads.

In some embodiments, each retainer may include a tab and each collar may include a groove adapted to receive the tab of the corresponding retainer for connection of the number of contact pads to the torso covering.

In some embodiments, each retainer may receive the collar of a corresponding one of the contact pads arranged to have the head projecting from the interior side of one of the chest and rear panels.

According to another aspect of the present disclosure, a percussion apparatus for thoracic percussion therapy may include a torso covering for securing to a patient's torso. The torso covering may include a front panel that may have an interior side for engaging the patient's chest and a rear panel that may have an interior side for engaging the patient's back. A number of percussion devices may be coupled to the torso covering to provide percussive force to the patient's torso. The number of percussion devices may comprise at least one voice coil. Circuitry may be provided to control the percussion devices to provide percussion therapy to a person that may be wear the percussion therapy apparatus and to play music through the at least one voice coil.

In some embodiments, the music may be transmitted by an electronic device that may communicate wirelessly with the circuitry or that may communicate with the circuitry via a wired connection. Optionally, a user interface of the percussion therapy apparatus may store one or more music files that are playable through the one or more of the number of percussion devices. Such music files may be played, under the user's selective control. For example, the music may be played when percussion devices are not being used to perform percussion therapy.

In some embodiments, the user interface may include volume controls, song selection controls, forward and reverse controls, pause controls, and start and stop controls. Alternatively or additionally, one or more other electronic devices may link with the circuitry of the percussion therapy apparatus to play music files through the one or more of the percussion devices. Such other electronic devices may link wirelessly with the circuitry of the percussion therapy apparatus in some embodiments. Alternatively or additionally, such other electronic devices may link with the circuitry of the percussion therapy apparatus via a wired connection. The other electronic devices may include, for example, smart phones, iPods, tablet computers, smart watches, and MP3 players.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION

Figure 1:
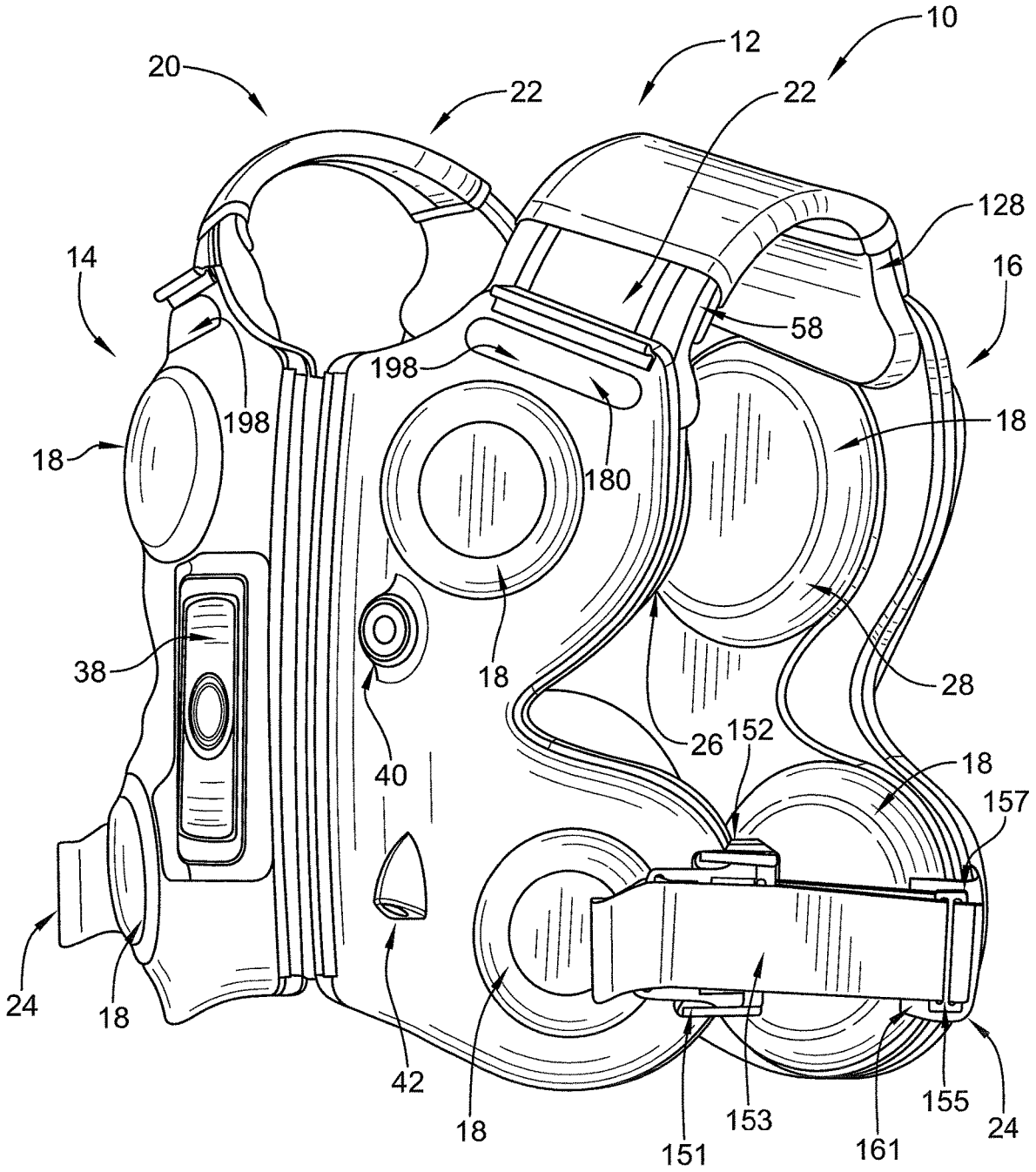
FIG. 1 is a perspective view of a percussion therapy apparatus for percussion therapy showing that the apparatus includes a covering for a patient's torso having chest panel with left and right sections (according to the patient's perspective, respectively, right and left sides of FIG. 1), and a back panel, a number of percussive devices for providing percussive force attached to each of the chest and back panels, and an attachment system including shoulder straps and side strap assemblies for securing the covering to a patient's torso.

For the purposes of promoting an understanding of the principles of the disclosure, reference will now be made to a number of illustrative embodiments illustrated in the drawings and specific language will be used to describe the same.

Generally, healthy persons can expectorate their normal build-up of mucous, phlegm, and/or the like within their respiratory systems. Suffers of excessive respiratory build-up and/or reduce expectoration capacity can require assistance in properly freeing such build-up from respiratory systems. Physically freeing, dislodging, and/or loosening the build-up can assist in proper expectoration.

Percussive therapy can effectively assist proper expectoration in an efficient and comfortable manner. Percussive therapy includes repeated percussive force to the patient to physically assist dislodging of the build-up. Manual percussive force should be performed only by a trained practitioner and can be physical demanding to the practitioner. Moreover, percussive force can be tiring and/or uncomfortable to the patient. Efficient and precise administration of percussive force can improve the patient's comfort and endurance in receiving percussion therapy and can improve the effectiveness of percussion therapy to dislodge build-up.

In the illustrative embodiment of FIG. 1, a percussion therapy apparatus 10 is shown. The percussion therapy apparatus 10 illustratively includes a covering 12 having a chest panel 14 and a back panel 16, and percussive devices 18 that are attachable to the covering 12 to engage with the patient's torso to provide thoracic percussion therapy. The percussion therapy apparatus 10 illustratively includes an attachment assembly 20 comprising shoulder straps 22 and side strap assemblies 24 for securing the covering 12 to the patient's torso.

In the illustrative embodiment of FIG. 1, the percussion therapy apparatus 10 is formed as a sleeveless garment, or vest, to be worn by the patient for receiving percussion therapy. The chest panel 14 and the back panel 16 are illustratively embodied include and adapt for curvature to conform generally to the form of a patient's torso. Properly fitting the percussion therapy apparatus 10 to the patient provides more efficient application of percussive therapy and reduces the negative effects to the patient.

Figure 2:
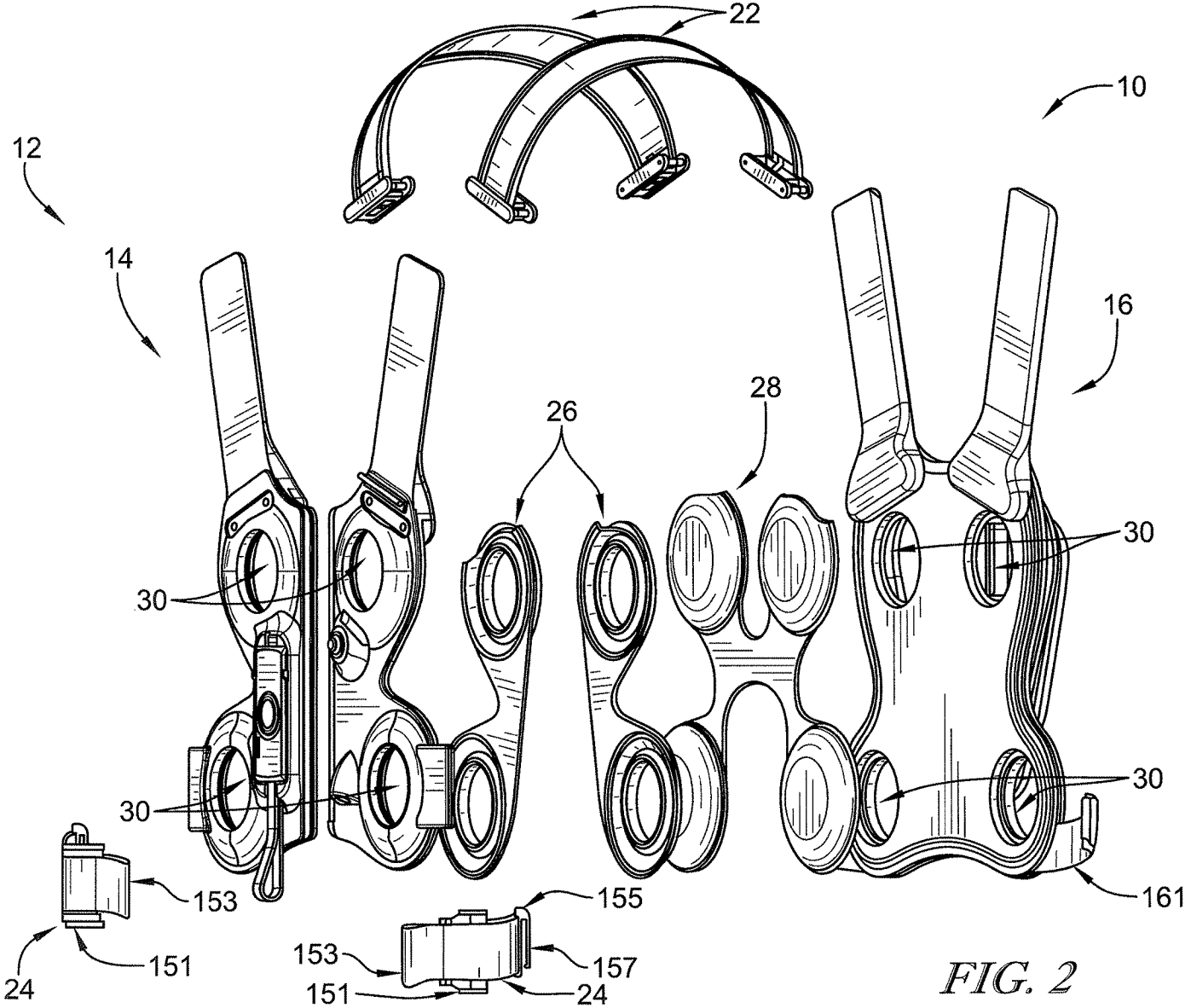
FIG. 2 is an exploded perspective view of the percussion therapy apparatus of FIG. 1 showing that the chest and back panels each includes interior padding for engagement with the patient's torso, and showing that the shoulder straps include a cavity for receiving cabling to communicate between the chest and back panels.

As shown in FIG. 2, the percussion therapy apparatus 10 illustratively includes contact padding 26, 28 arranged inside of the chest and back panels 14, 16 as an interface between the respective panel 14, 16 and the patient's torso. The chest and back panels 14, 16 each illustratively includes openings 30 defined therethrough for receiving the percussive devices 18 for providing the percussive force to the patient. The contact padding 26, 28 is illustratively arranged between the percussive devices 18 and the patient's torso to provide comfort in application of the percussive force of the percussive devices 18.

Figure 3:
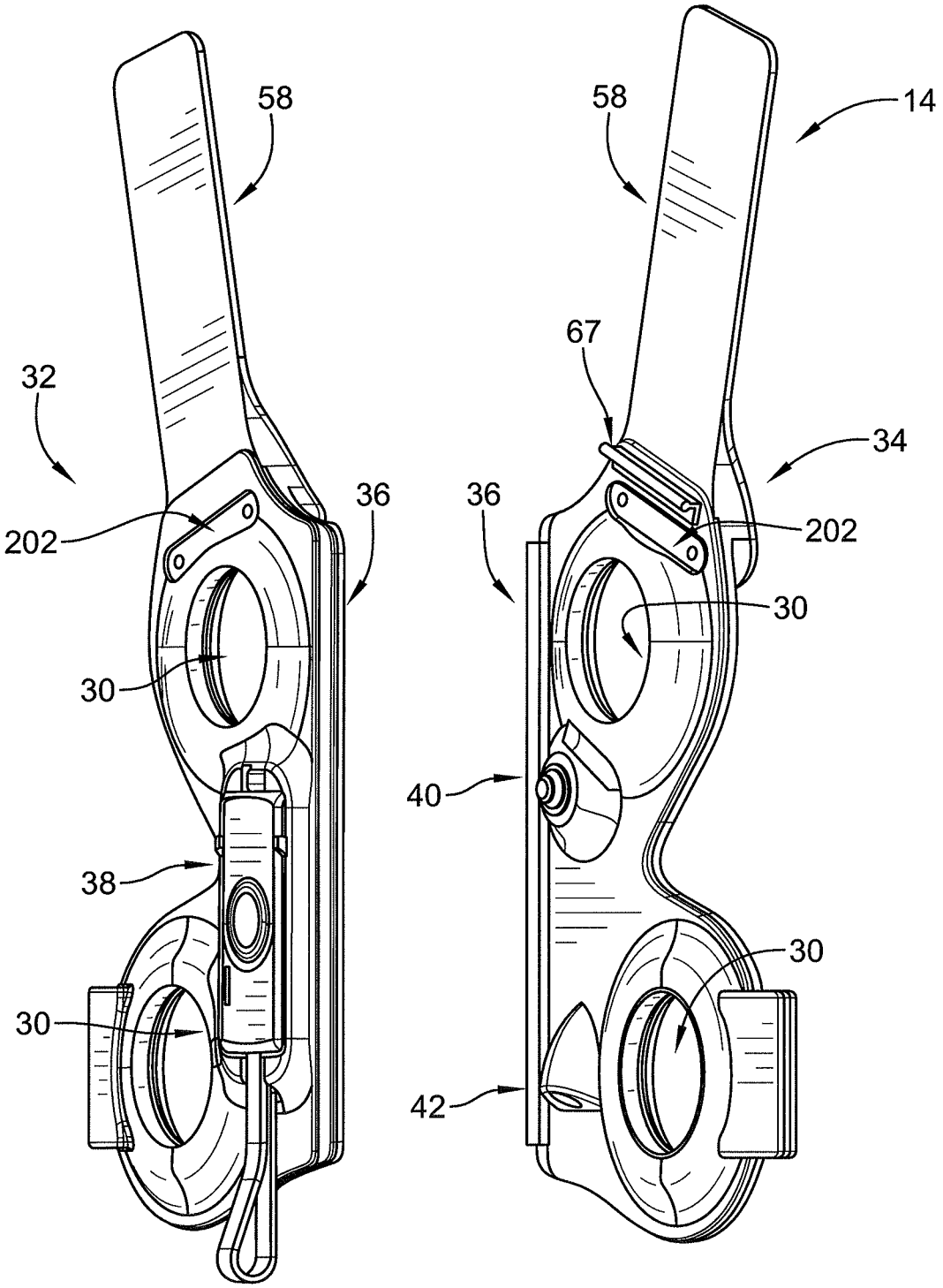
FIG. 3 is a perspective view of the chest panel of the percussion therapy apparatus of FIGS. 1 and 2 showing that the (patient) right section includes a user interface controller mounted on a front side for receiving user input to adjust the percussive force of the percussive devices, and showing that the (patient) left section includes a break button for pausing operation of the percussive devices to allowing cough and/or other break time.
Figure 4:
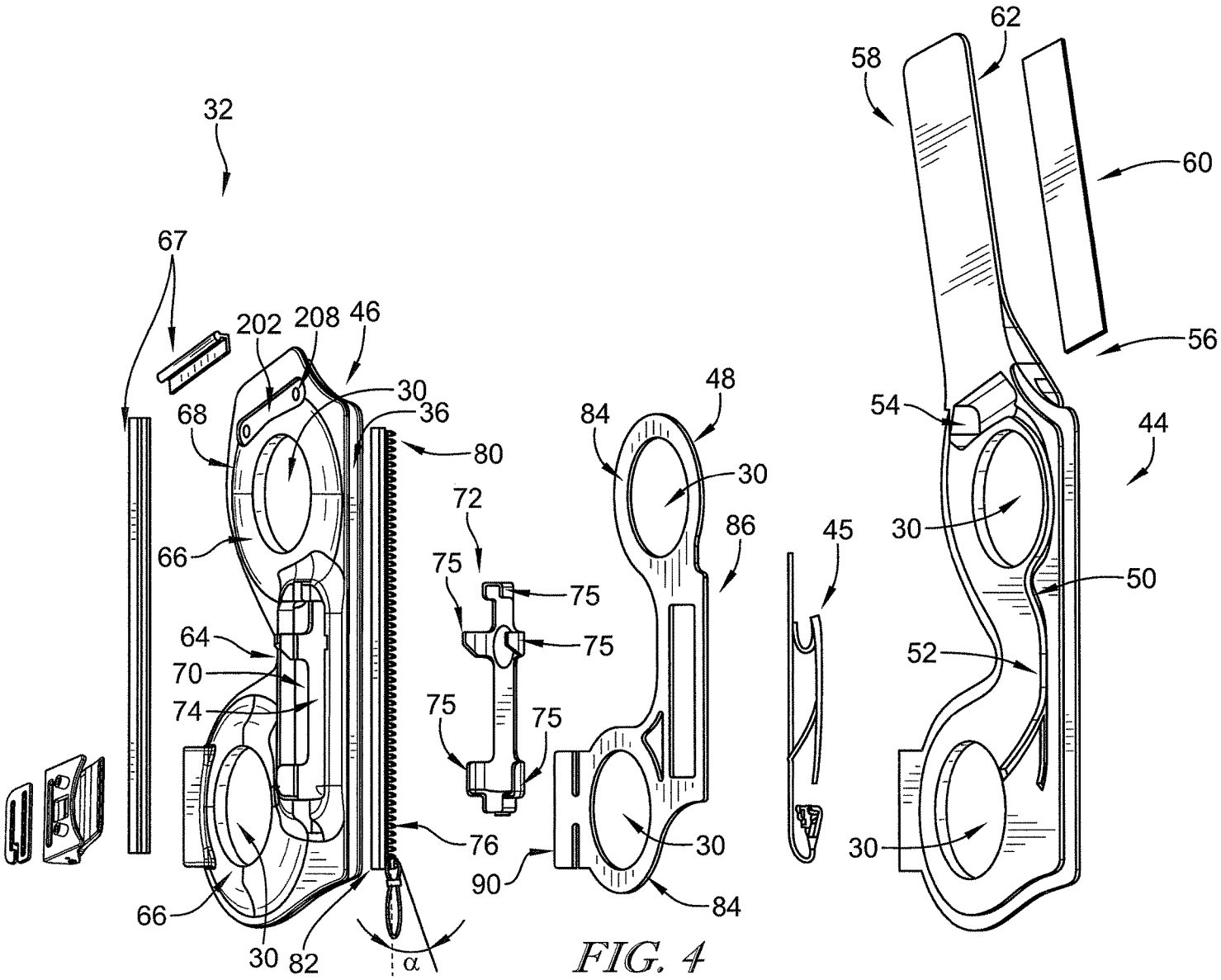
FIG. 4 is an exploded perspective view of the (patient) right section of the percussion therapy apparatus of FIGS. 1-3 showing that the section includes inner and outer panes and a frame pane disposed between the inner and outer panes, and showing that the inner pane includes a groove defined therein for receiving cabling between itself and the frame pane.
Figure 5:
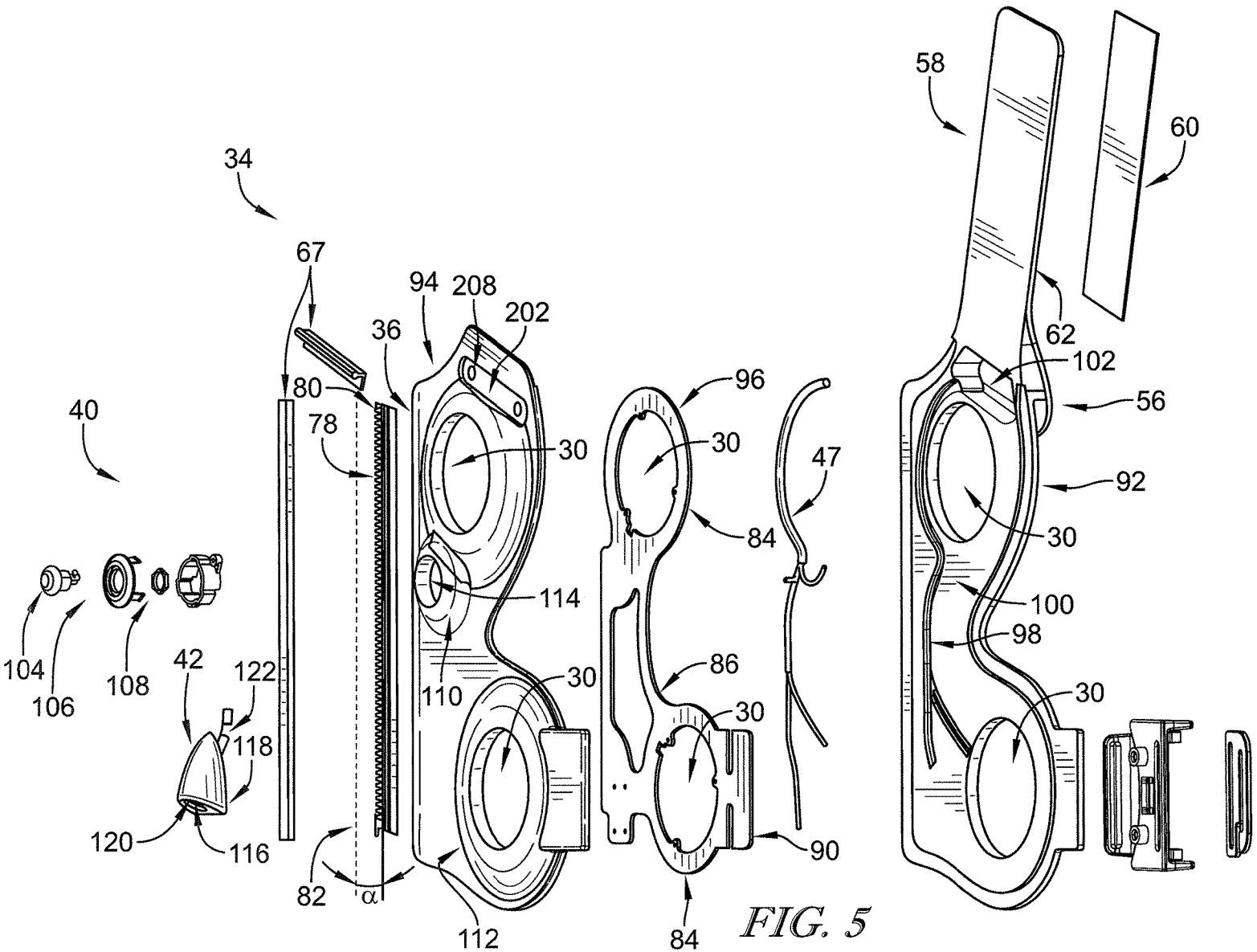
FIG. 5 is an exploded perspective view of the (patient) left section of the percussion therapy apparatus of FIGS. 1-3 showing that the left section includes inner and outer panes and a frame pane disposed between the inner and outer panes, and showing that the inner pane includes a groove defined therein for receiving cabling between itself and the frame pane, and further showing that the left section includes a power port for receiving electrical power.

As shown in FIGS. 3-5, the chest panel 14 illustratively includes a right section 32 and a left section 34 each respectively arranged on the right and left side of the patient's chest when the apparatus 10 is worn. The right and left sections 32, 34 illustratively form an hour glass-shape, each defining one half thereof and each generally having an outline that is a mirror image of the other. The right and left sections 32, 34 each illustratively include a straight edge 36 on a medial side thereof for releasably coupling to one another as explained herein.

As shown in FIG. 3, the right section 32 illustratively includes a user interface 38. The user interface 38 illustratively provides a communication interface for the user to operate the percussive devices 18 as described in more detail below. The left section 34 illustratively includes a break button 40 for user controlled impromptu pausing of the percussive operation of the percussive devices 18 during a percussion therapy cycle. The left section 34 illustratively includes a power port 42 for connection with a power cord to receive electric power for charging and/or operation.

Referring to FIG. 4, the right section 32 of the chest panel 14 illustratively includes an inner pane 44, an outer pane 46, and a frame pane 48 arranged between the inner and outer panes 44, 46. Each of the panes 44, 46, 48 illustratively includes openings 30 defined therein to receive the percussive devices 18. The inner pane 44 illustratively includes a groove 50 defined in a front side 52 thereof. The groove 52 illustratively extends vertically with curvature to accept cabling 45 therein for positioning between the inner pane 44 and the frame pane 48.

As shown in FIG. 4, the groove 50 illustratively connects with a space 54 of the inner pane 44 located near the top end 56 thereof. The inner pane 44 illustratively includes a shoulder portion 58 extending from the top end 56 thereof for connection with the back panel 16. The shoulder portion 58 illustratively includes an attachment device 60 embodied as one portion of hook and unbreakable loop fasteners attached to a rear side 62 thereof for connection with the back panel 16.

The outer pane 46 illustratively includes a user interface mount 64 and percussion mounts 66 (comprising raised sections for ergonomics) and slider piping 67 for attachment on an outer surface 68 thereof as shown in FIG. 4. The slider piping 67 illustratively receives complimentary slider receivers for attachment of accessories to the outer pane 46, for example but without limitation, an outer liner for protection and aesthetics. The user interface mount 64 illustratively includes a depression 70 formed in the outer surface 68 that receives a pendant 72 for coupling with the user interface 38 to the right section 32. The pendant 72 illustratively includes a number of arms 75 for releasably securing about the user interface 38. The pendant 72 illustratively extends through an opening 74 defined through the outer pane 46 and the depression 70 for attachment with the frame pane 48 as discussed below.

As shown in FIG. 4, the outer pane 46 illustratively includes the straight edge 36 formed on the medial side thereof. The straight edge 36 includes a zipper portion 76 of a zipper assembly 76, 78 attached thereto for releasable coupling between the right and left sections 32, 34. In the illustrative embodiment, the zipper portion 76 illustratively includes a top end 80 and a bottom end 82 and is attached to the straight edge 36 along its entire length between its ends 80, 82. The zipper portion 76 is illustratively attached to the outer pane 46 and is angled between its top and bottom ends 80, 82 such that its bottom end 82 is positioned farther from the sagittal plane (of the patient when wearing the percussion therapy apparatus) than its top end 80. In the illustrative embodiment, the zipper portion 76 is arranged at an angle $\alpha$ relative to the sagittal plane within the range of about 1 degree to about 5 degrees, for example but without limitation, about 1.8 degrees, or about 3 degrees.

The frame pane 48 illustratively provides a substructure for the right section 32 as shown in FIG. 4. The frame pane 48 is illustratively embodied as a sheet of material including rings 84 that define the openings 30 and a stem 86 extending between the rings 84. The frame pane 48 illustratively includes a side tab 90 extending from the (lower) ring 84 for connection with the respective side strap assembly 24.

Referring to FIG. 5, the left section 34 of the chest panel 14 illustratively includes an inner pane 92, an outer pane 94, and a frame pane 96 arranged between the inner and outer panes 92, 94. The panes 92, 94, 96 each illustratively include openings 30 defined therein to receive the percussive devices 18. The inner pane 92 illustratively includes a groove 98 defined in a front side 100 thereof. The groove 98 illustratively extends vertically with curvature to accept cabling 47 therein for positioning between the inner pane 92 and the frame pane 96.

As shown in FIG. 5, the groove 98 illustratively connects with a space 102 of the inner pane 92 located near the top end 56 thereof. The inner pane 92 illustratively includes a shoulder portion 58 extending from the top end 56 of the inner pane 92 for connection with the back panel 16. The shoulder portion 58 of the inner pane 92 illustratively includes an attachment device 60 embodied as one portion of hook and loop material attached to a rear side 62 thereof for connection with the back panel 16.

As mentioned above, the outer pane 94 illustratively includes the break button 40 for pausing operation of the percussive devices 18 and the power port 42 for connection with a power cord as shown in FIG. 5. The break button 40 illustratively includes a button assembly 104 including an actuator button 106 and housing 108 for receiving the actuator button 106. A raised section 110 is disposed on the front side 112 of the outer pane 94 and defines a hole 114 therethrough for receiving the button assembly 104. The cabling 47 illustratively connects with the actuator button 106 to provide communication with the percussive devices 18. A user can depress the actuator button 106 to operate the break button 40 to pause operation of the percussive devices 18 to allow the patient to cough without experiencing the percussive force. In the illustrative embodiment, the actuator button 106 is embodied as a linear actuator, but in some embodiments may be any suitable style of actuator to operate the break button 40 for pausing.

In the illustratively embodiment, the power port 42 illustratively includes a power terminal 116 housed within a port housing 118 for connecting a power cord to receive electric power to charge and/or operate the apparatus 10 as shown in FIG. 5. The port housing 118 illustratively connects with the frame pane 96 through the outer pane 94 for structural support. The power terminal 116 is illustratively received within an interior of the port housing 118 and is embodied as a 5-pin connector accessible through an opening 120 in a lower face of the port housing 118. The power terminal 116 illustratively includes wiring 122 that extends from a rear side of the port housing 118 for connection with the cabling 47. In some embodiments, the power terminal 116 may include an suitable type and/or arrangement of connector for receiving power for charging and/or operating the apparatus 10.

As shown in FIG. 5, the outer pane 94 illustratively includes slider piping 67 attached to the outer surface 112 thereof. The slider piping 67 illustratively receives complimentary slider receivers for attachment of accessories to the outer pane 94, for example but without limitation, an outer liner for protection and aesthetics.

As shown in FIG. 5, the outer pane 94 illustratively includes the straight edge 36 formed on a medial side thereof. The straight edge 36 includes a zipper portion 78 of a zipper assembly 76, 78 attached thereto for releasable coupling with the zipper portion 76 of the right section 32. In the illustrative embodiment, the zipper portion 78 illustratively includes a top end 80 and a bottom end 82 and is attached to the straight edge 36 of the outer pane 94 along its entire length between its ends 80, 82. The zipper portion 78 is illustratively attached to the outer pane 94 and is angled between its top and bottom ends 80, 82 such that its bottom end 82 is positioned farther from the sagittal plane (of the patient when wearing the percussion therapy apparatus) than its top end 80, in the opposite direction of the zipper portion 76 of the right section 32. In the illustrative embodiment, the zipper portion 78 is arranged at an angle $\alpha$ relative to the sagittal plane, in the opposite direction of the zipper portion 76 of the right section 32, within the range of about 1 degree to about 5 degrees, for example but without limitation, about 1.8 degrees, or about 3 degrees. Angling the zipper assembly 76, 78 as described provides a conforming fit to the patient upon coupling with the right section 32, reducing slack and improving engaging with the patient's torso.

The frame pane 96 illustratively provides a substructure for the left section 34 as shown in FIG. 5. The frame pane 96 is illustratively embodied as a sheet of material including rings 84 that define the openings 30 and a stem 86 extending between the rings 84. The frame pane 96 illustratively includes a side tab 90 extending from the (lower) ring 84 for connection with the side strap assembly 24.

In the illustrative embodiments of FIGS. 3-5, the inner panes 44, 92 and outer panes 46, 94 of each of the chest panel 14 and back panel 16, respectively, are formed of a relatively soft but firm material such as compression foam, and the frame panes 48, 96 are formed of a semi-rigid polymer that flexes more easily in certain directions to provide support to the panels 14, 16 while permitting snug contact of the percussive devices 18 with the patient's torso and generally allowing movement of the patient while wearing the percussive therapy apparatus 10. In some embodiments, any number of suitable materials may be used for each of the panes 44, 46, 48, 92, 94, 96.

Figure 6:
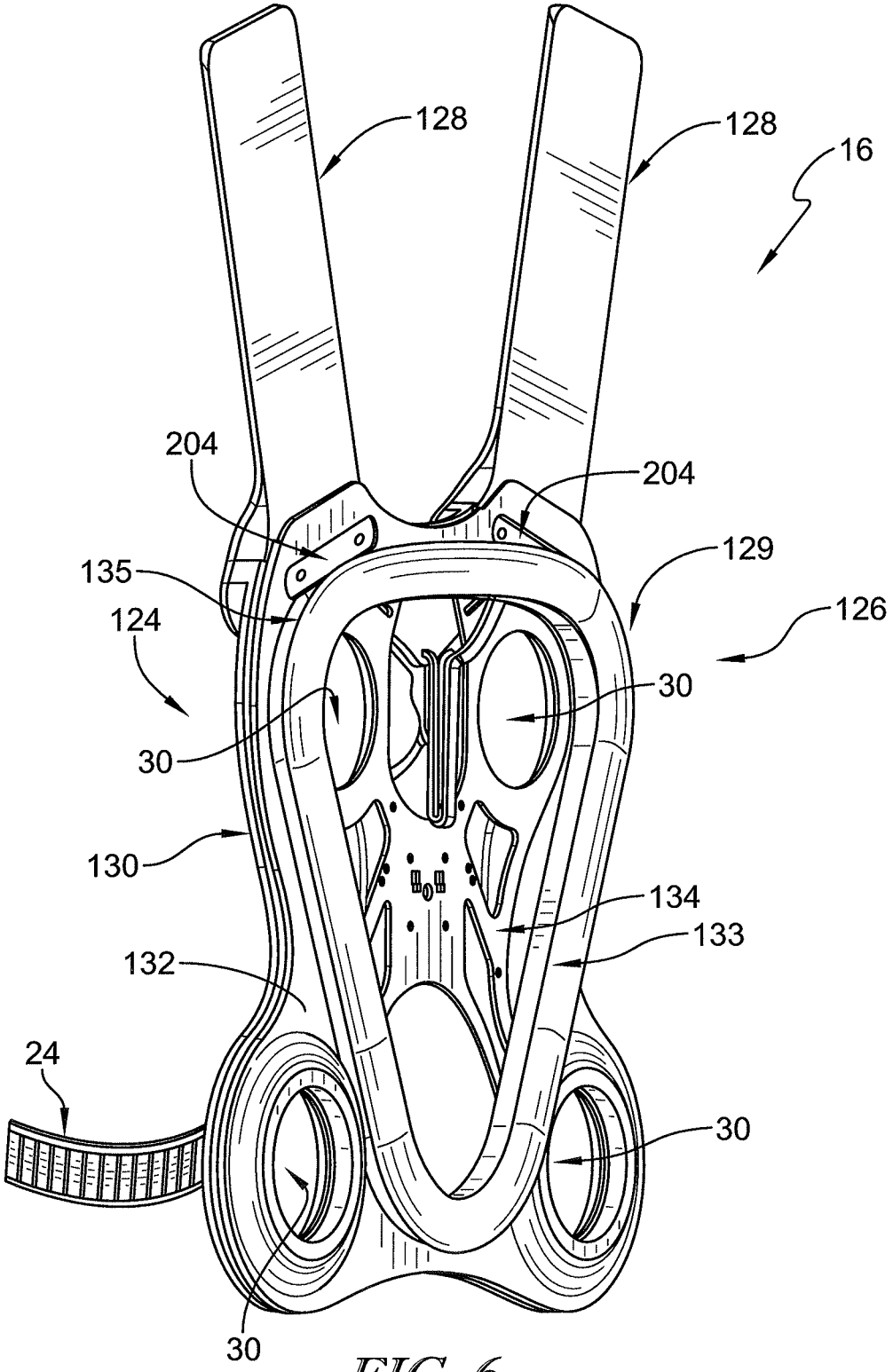
FIG. 6 is a perspective view of the back panel of the percussion therapy apparatus of FIGS. 1-5 from a rear side showing that the back panel includes a receiver assembly for coupling a control pack (having a control device and a power source) with the back panel.

In the illustrative embodiment of FIG. 6, the back panel 16 includes a single section having an interior side 124 for engagement with the patient's back and an exterior side 126 opposite the interior side 124. The back panel 16 illustratively includes shoulder portions 128 extending therefrom for connection with the chest panel 14. In the illustrative embodiment as shown in FIG. 6, on the exterior side 126, the back panel 16 includes depressions 204 for connection of the shoulder straps 22 and a receiver 129 disposed for receiving a control pack for control and power of the percussive devices 18.

Figure 7:
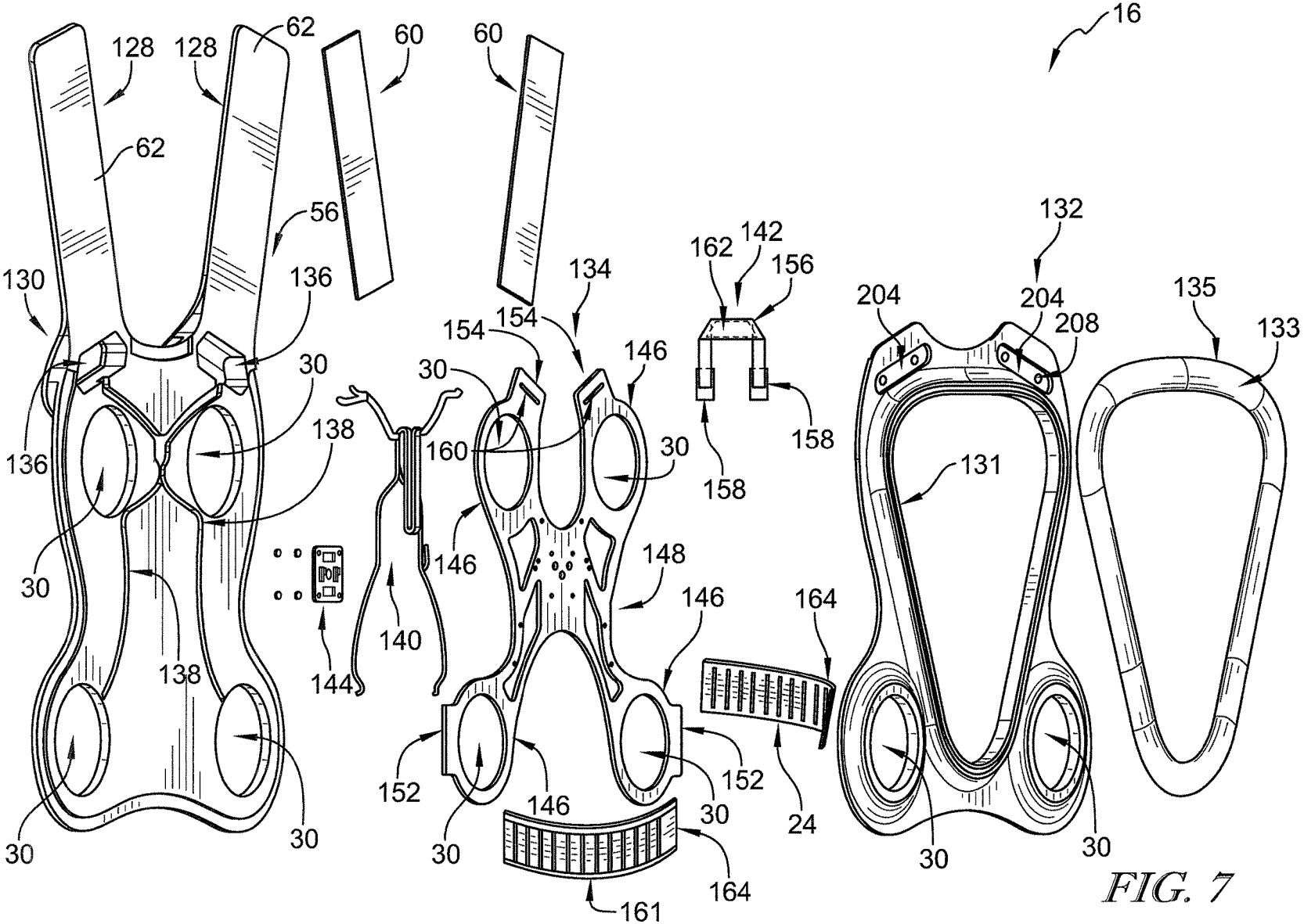
FIG. 7 is an exploded perspective view of the back panel of the percussion therapy apparatus of FIGS. 1-6 showing that the back panel includes an inner pane, an outer pane, and a frame pane disposed between the inner and outer panes, and showing that the outer pane includes a groove defined in an interior side to receive cabling between itself and the frame pane.

As shown in the illustrative embodiment of FIG. 7, the back panel 16 illustratively includes an inner pane 130, an outer pane 132, and a frame pane 134 arranged between the inner and outer panes 130, 132. Each of the panes 130, 132, 134 illustratively include openings 30 defined therein to receive the percussive devices 18. The outer pane 132 illustratively includes spaces 136 for receiving couplers 180 of the shoulder straps 22 (as discussed below), and grooves 138 extending between the spaces 136 and the openings 30 for receiving cabling 140 between the inner pane 130 and the frame pane 134. The outer pane 132 illustratively includes the receiver 129 comprising a ridge 131 extending outward and a rim 133 attached to the ridge 131 to provide a ledge 135 that faces radially outward to receive a cover of the control pack. The cover can illustratively extend over the ledge 135 to releasably affix the control pack thereto.

As shown in FIG. 7, the frame pane 134 provides a sub-structure for the back panel 16. The frame pane 134 is illustratively connected with each of a handle 142, the side strap assemblies 24, and a mounting bracket 144. The frame pane 134 is illustratively embodied as a sheet of material including rings 146 that define the openings 30 and a stem 148 extending between the rings 146. The frame pane 134 illustratively includes a side tab 152 extending from each (lower) ring 146 for connection with the respective side strap assembly 24 and a handle tab 154 extending from each (upper) ring 146 for connection with the handle 142.

As shown in FIG. 7, the handle 142 illustratively includes a strap body 156 and plates 158 pivotably attached at opposite ends of the strap body 156. The strap body 156 illustratively attaches to the center of each plate 158. The handle tabs 154 each illustratively includes a slot 160 extending therethrough to receive the handle 142. The plates 158 are each passed through a respective slot 160 and pivoted on the strap body 156 to prevent removal from the slots 160. The strap body 156 is thus coupled to the frame pane 134 through the slots 160 of the handle tabs 154 which can only pass through the slots 160 in certain (flat) orientation. The strap body 156 illustratively includes padding 162 disposed therein for comfortable handling. Upon supporting the apparatus 10 using the handle 142, the loading is generally directed to the frame pane 134 reducing stress concentration on the less rigid components.

Returning briefly to FIG. 1, each side strap assembly 24 illustratively includes a cam buckle 151 attached to the respective side tab 152, a cam strap 153 coupled to the cam buckle 151, a D-ring 155 coupled to the cam strap 153 and having a hook arm 157, and a main strap 161 attached to the side tab 152 of the back panel 16 for coupling with the D-ring to secure the chest and back panels 14, 16 together with adjustable fit of the covering 12 to the patient's torso. Returning to FIG. 7, the side tabs 152 extend from their respective rings 146 in opposite directions for connection with the respective side strap assembly 24. The main strap 161 of each side strap assembly 24 illustratively includes an end 164 attached to the respective side tab 152 of the frame pane 134 of the back panel 16. The main straps 161 illustratively extend from the respective side tab 152 of the frame pane 134 out from between the inner and outer panes 130, 132 to couple with the chest panel 14.

Figure 8A:
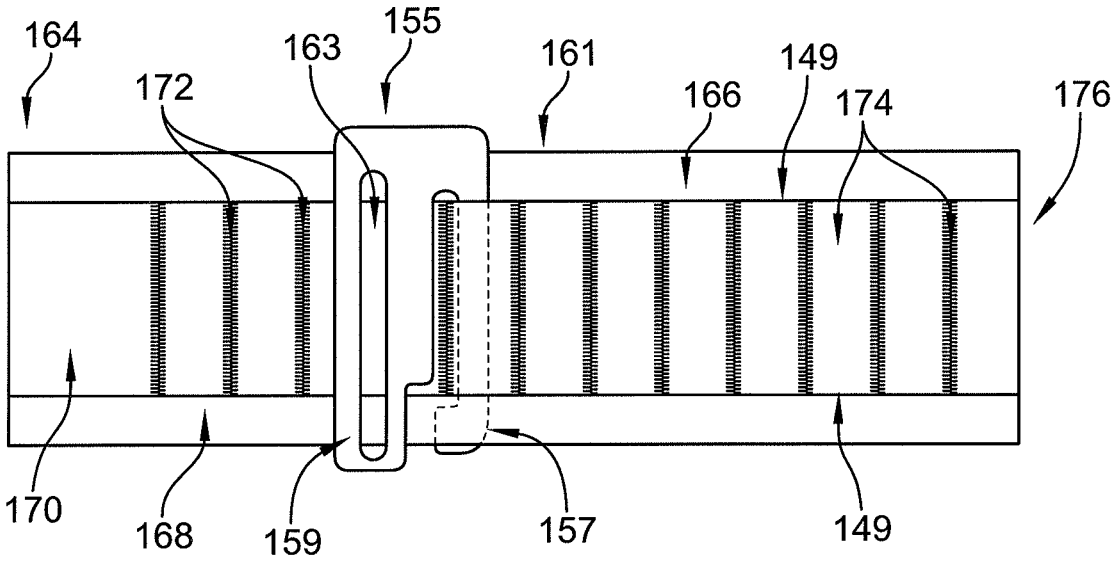
FIG. 8A is an elevation view of the side strap of the attachment system of the percussion therapy apparatus of FIGS. 1-7 showing that the side strap includes pockets (loops) formed at intervals for receiving a D-ring.
Figure 8B:
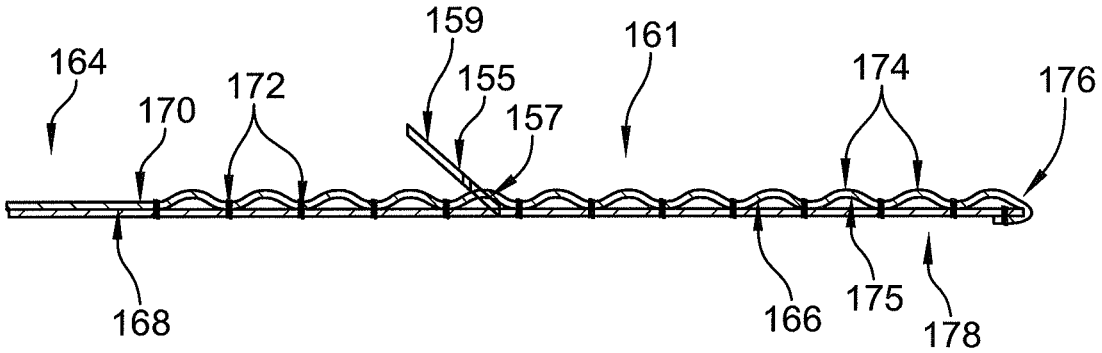
FIG. 8B is an bottom view of the side strap of FIG. 8A showing that the side strap includes two sheets stitched together at intervals to form the pockets (loops)

As shown in FIGS. 8A and 8B, the main straps 161 each illustratively includes a strap body 166 comprising sheets 168, 170 arranged to overlap each other and illustratively stitched together at seams 172. The seams 172 are illustratively arranged at spaced apart intervals to define loops 174 with open ends 149 between the seams 172. The loops 174 each illustratively comprise pockets for selectively receiving the hook arm 157 of the D-ring therethrough as shown in FIG. 8A. At an end 176 of the main strap 161 opposite to the end 164, the sheet 170 wraps around the sheet 168 and is stitched to the sheet 168 on a side 178 of the main strap 161 opposite the loops 174 as best shown in FIG. 8B.

Figure 9A:
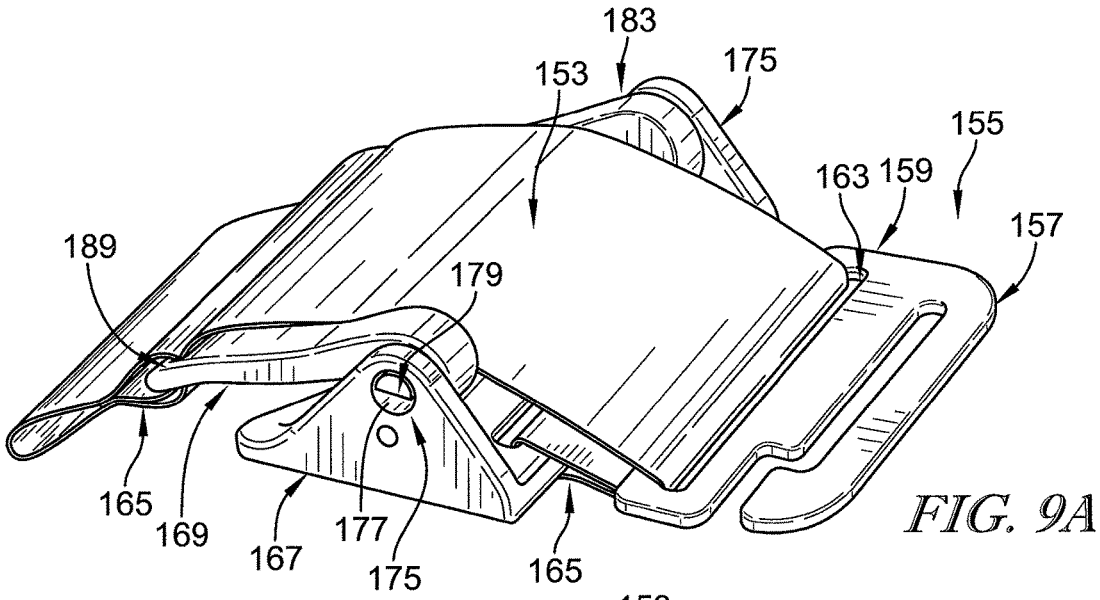
FIG. 9A is a perspective view of the side strap assembly of the percussion therapy apparatus of FIGS. 1-7 showing that the side strap assembly includes a cam buckle and a cam strap connected to the cam buckle and threaded through the D-ring.
Figure 9B:
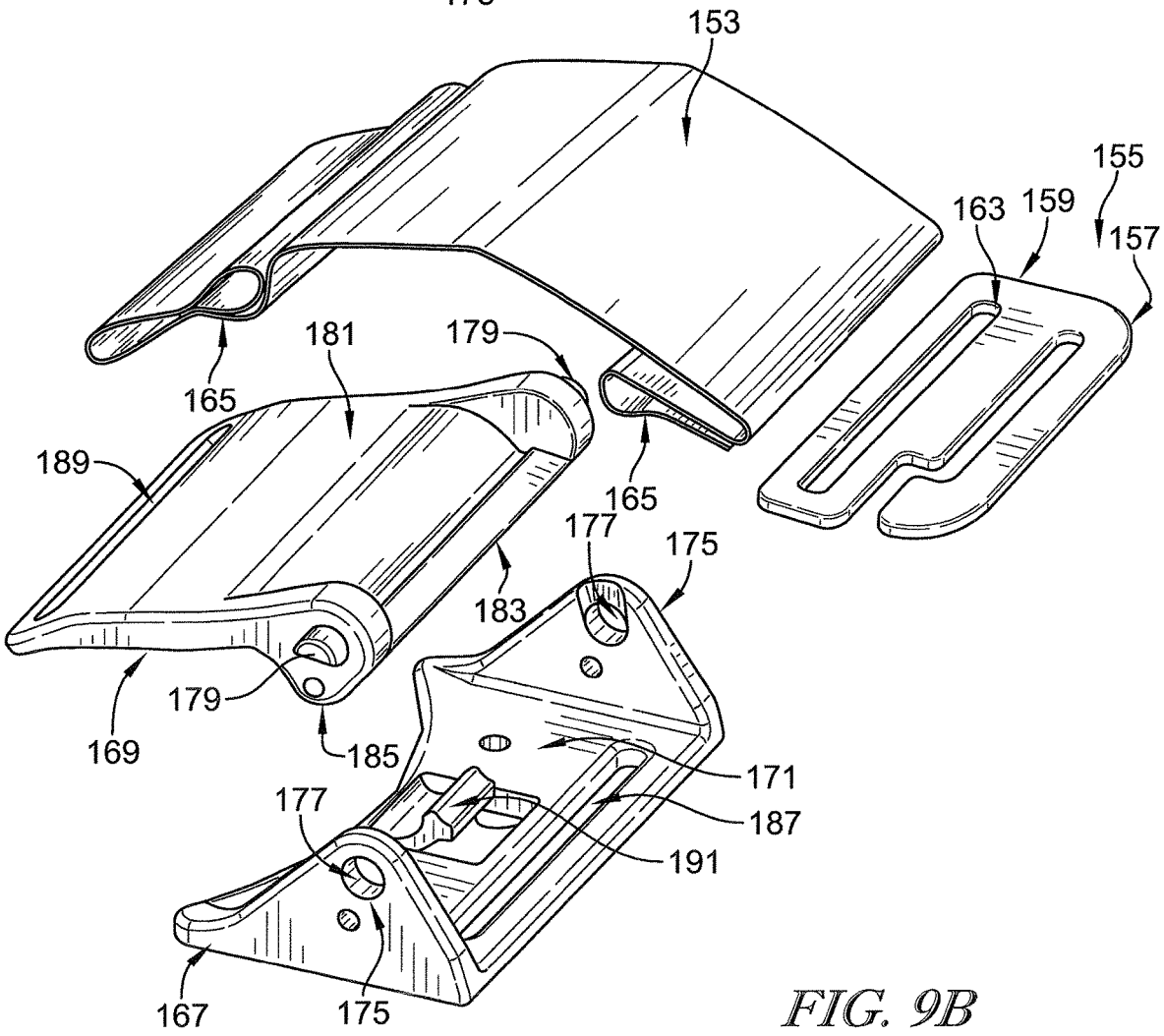
FIG. 9B is an exploded perspective view of the side strap assembly of FIG. 9A that provides adjustable fit of the percussion therapy apparatus to the patient's torso.

As best shown in FIGS. 9A and 9B, the D-ring 155 illustratively includes a body 159 from which the hook arm 157 extends. The body 159 illustratively includes a slot 163 defined therein for receiving the cam strap 153. The cam strap 153 is illustratively threaded through the slot 163 to couple with the D-ring 155 and is attached at each of its ends 165 to the cam buckle 151. The cam buckle 151 illustratively includes a base 167 and a cam lever 169 pivotably attached to the base 167 between a closed position (as shown in FIGS. 9A and 9C, and in dashed line in FIG. 9D) and an open position (as shown in solid line in FIG. 9D).

Figure 9C:
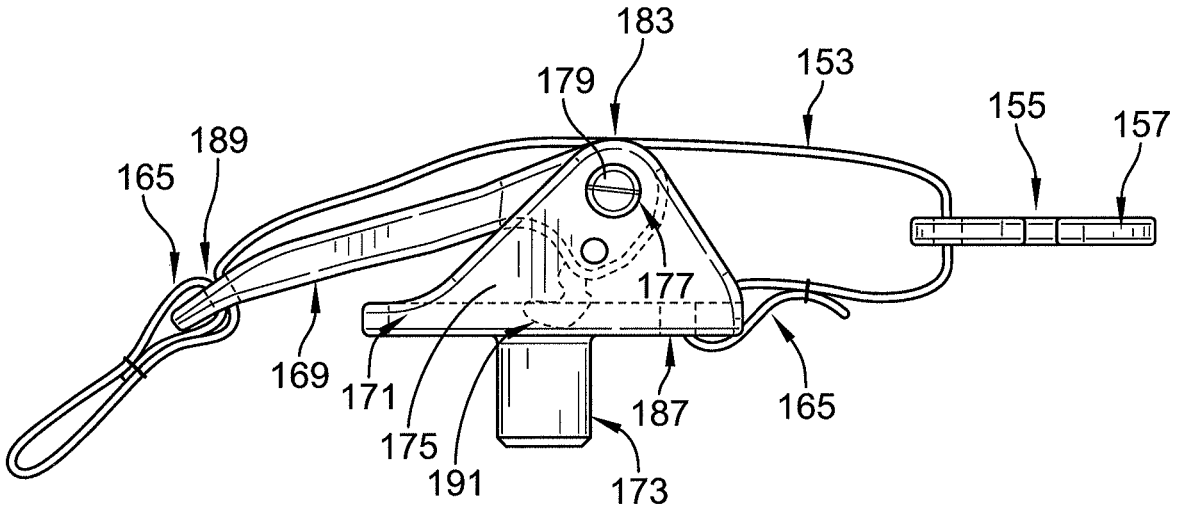
FIG. 9C is an elevation view of the side strap assembly of FIGS. 9A and 9B showing that the cam buckle includes a base and a cam lever pivotably connected to the base, and showing that the cam lever is positioned in a closed position to tighten the cam strap.

The base 167 illustratively includes a plate 171 having fastener mounts 173 extending therefrom for receiving fasteners (illustratively portions of connectors 180 discussed hereafter) to connect the base 167 to the respective side tab 152 as best shown in FIGS. 9A-9C. The base 167 illustratively includes a pair of wings 175 extending from opposite ends of the plate 171 in a direction opposite to the fastener mounts 173. Each wing 175 illustratively includes a pivot hole 177 penetrating therethrough to receive a respective pivot arm 179 of the cam lever 169. The plate 171 illustratively includes a slot 187 defined therethrough for receiving connection of one end 165 the cam strap 153 and a stem 191 extends with resilience from the plate 171 for engagement with the cam lever 169 in the closed position.

As shown in FIGS. 9A-9D, the cam lever 169 illustratively includes a body 181 formed as a plate having ergonomic curvature and the pair of pivot arms 179 that extend from opposite lateral sides of the body 181 near a pivot end 183 for rotatable connection within the pivot hole 177 of the respective wing 175. The body 181 illustratively includes a slot 189 defined therethough on an end opposite the pivot end 183 for connection of the other end 165 of the cam strap 153. A cam 185 extends along the body 181 near the pivot end 183 and protrudes from the body 181 in a direction perpendicular to the extension of the pivot arms 179. The cam 185 engages the plate 171 when the cam lever 169 is in the closed position to discourage unintended release from the closed position.

Figure 9D:
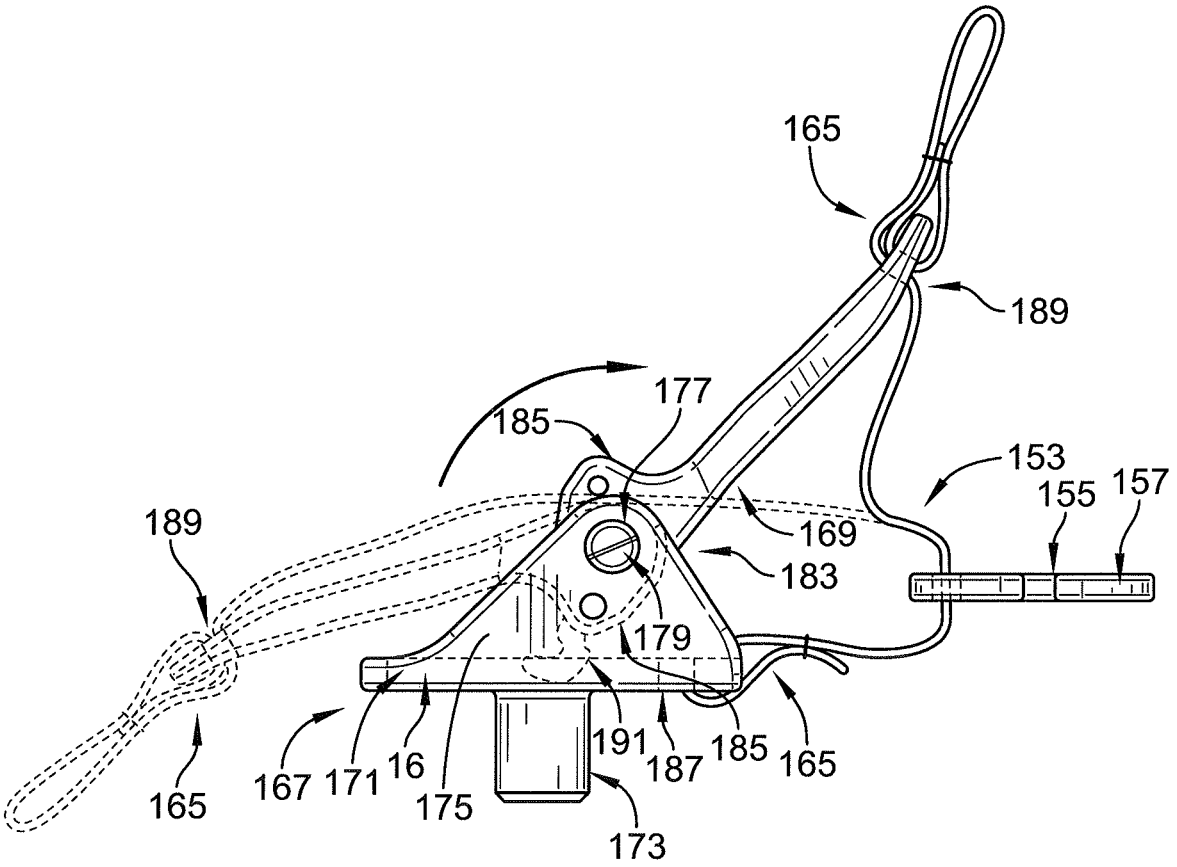
FIG. 9D is an elevation view of the side strap assembly of FIGS. 9A-9C showing that the cam lever is positioned in an open position (as shown in solid line) to loosen the cam strap.

The cam 185 illustratively contacts the stem 191 of the plate 171 of the base 167 in the closed position to maintain the closed position as shown in FIG. 9C. As shown in FIG. 9D, a user can remove the cam 185 from contact with the stem 191 of the base 167 by rotating the cam lever 169 from the closed position (broken line) and towards the open position (solid line). The stem 191 resiliently flexes under the force of the cam movement to allow the cam lever 169 to release from the closed position. Rotating the cam lever 169 out of the closed position moves the ends 165 of the cam strap 153 closer together releasing slack to the D-ring 155 for fit adjustment of the side strap assembly 24. Rotating the cam lever 169 into the closed position distances the ends 165 of the cam strap 153 from each other tightening the cam strap 153 and retracting the D-ring 155.

With reference to FIGS. 8A-9D, in the illustrative embodiment, a user can adjust the side strap assemblies 24 to fit the patient's torso. With the cam lever 169 in the open position, the user can insert the hook arm 157 of the D-ring into one of the loops 174 of the main strap 161 and rotate the cam lever 189 into the closed position. If the fit is correct, no further adjustment is necessary. If the fit is too lose or too tight, the user can place the cam lever 189 in the open position, place the hook arm 157 into a different loop 174 of the main strap 161, and return the cam lever 189 into the closed position, repeating as necessary. In the illustrative embodiment, the cam strap 153 and main strap 161 are generally not stretchable, but some embodiments, at least one of the cam strap 153 and main strap 161 may include some limited elasticity to provide comfort in adjustment.

Returning now to FIG. 7, the inner pane 130 illustratively includes shoulder portions 128 extending from a top end 56 thereof. The shoulder portions 128 each illustratively include an attachment device 60 (embodied as another portion of hook and loop material complimentary that of the shoulder portions 58 of the chest panel 14) attached to a rear side 62 thereof for connection with the chest panel 14. As shown in FIG. 1, the shoulder portions 128 overlap with the shoulder portions 58 to fasten their attachment devices 60 together, illustratively as hook and loop joining. In some embodiments, the attachment devices 60 may include any suitable fastening system.

Figure 10:
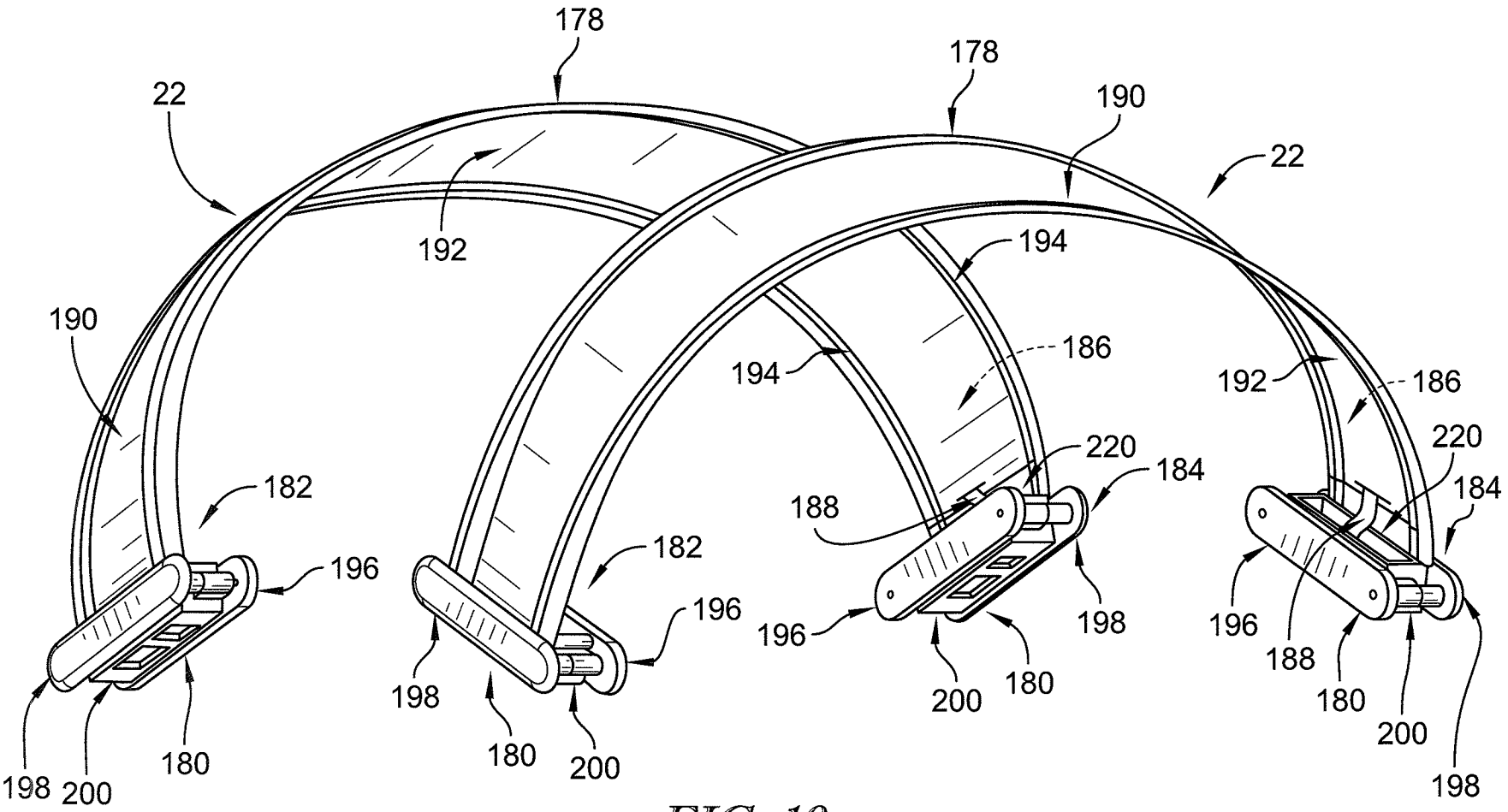
FIG. 10 is a perspective view of the shoulder straps of the percussion therapy apparatus of FIGS. 1-7 showing that each shoulder strap includes a strap body extending between opposites ends and a coupler arranged at each end for attachment to each of the chest and back panels, and showing that cabling extends through the couplers and the strap body to provide communication between the chest and back panels.
Figure 11:
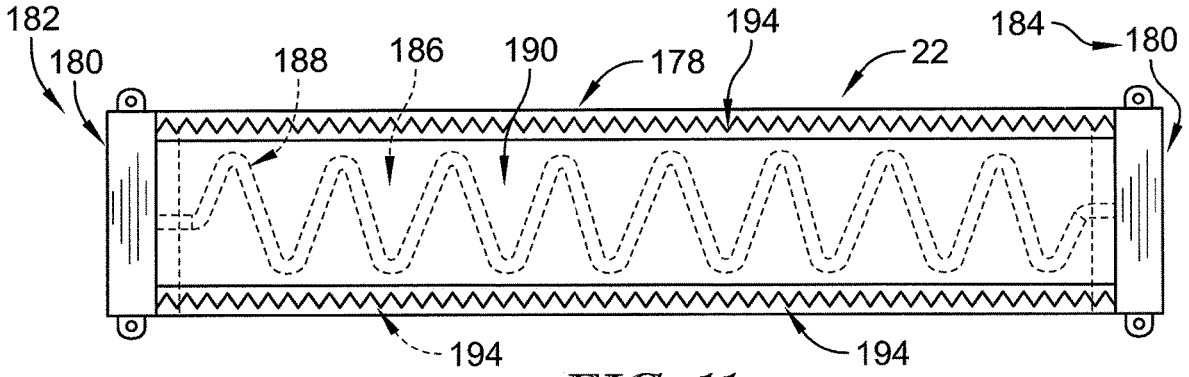
FIG. 11 is an overhead view plan of one of the shoulder straps of FIG. 10 showing that the cabling extends through a cavity within the strap body in a serpentine pattern between the couplers.

In the illustrative embodiment as shown in FIGS. 10 and 11, the shoulder straps 22 extend between opposite ends 182, 184 thereof and define a cavity 186 therethrough for receiving cabling 188 for communication between the chest and back panels 14, 16. Each shoulder strap 22 illustratively includes a strap body 178 and couplers 180 disposed at each opposite end 182, 184 for attachment to the chest and rear panels 14, 16. Each strap body illustratively includes an upper sheet 190 and a lower sheet 192 attached together along seams 194 near their outer edges to create a portion of the cavity 186 therebetween. The shoulder straps 22 are illustratively formed of fabric and the couplers 180 are illustratively formed of plastic, but in some embodiments each may comprise any suitable materials. As shown in FIG. 11, the cabling 188 illustratively extends through the cavity 186 in a serpentine arrangement to permit extension between the ends 182, 184 to relieve stress on the cabling 188 upon movement of the shoulder straps 22.

Figure 12:
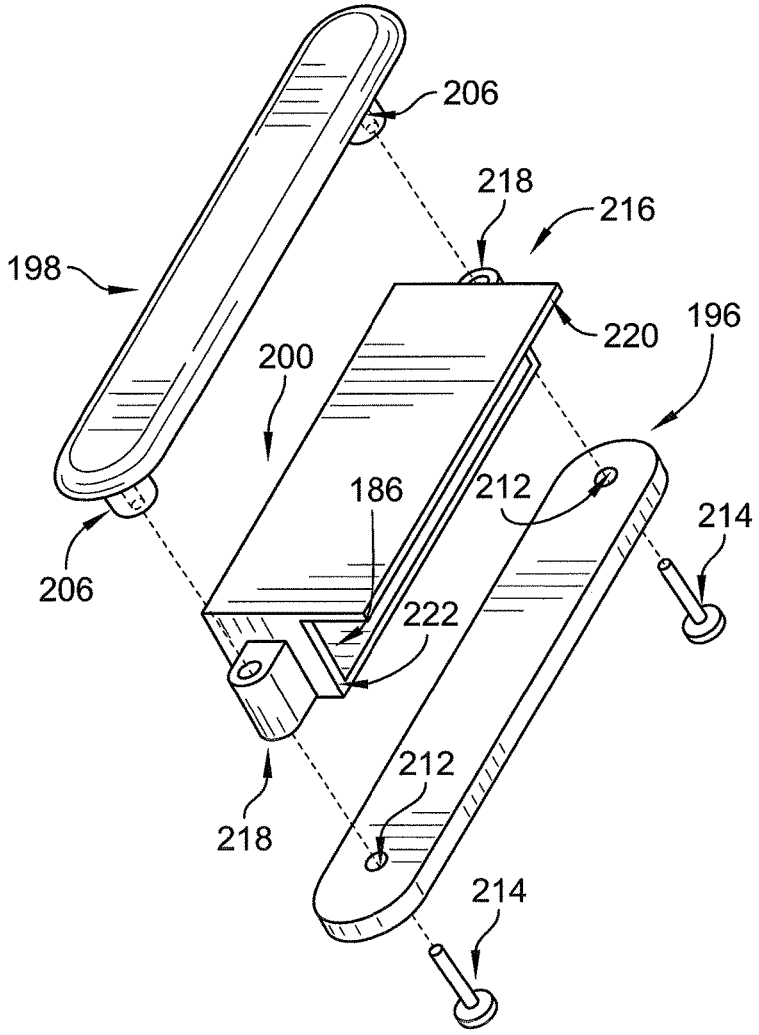
FIG. 12 is an exploded perspective view of one of the couplers of the shoulder straps of FIGS. 10 and 11 showing that the coupler includes a base and inner and outer connectors for attachment to the torso covering.

As shown in FIG. 12, the couplers 180 each includes an inner plate 196, an outer plate 198, and a connector 200 arranged between the inner and outer plates 196, 198. Each connector 200 is illustratively attached to the respective strap body 178 and is arranged with the spaces 54, 102, 136 of the respective inner pane 44, 130. The inner plate 196 is illustratively arranged in the depressions 202 formed in the outer surface 68, 112 of the right and left sections 32, 34 of the chest panel 14 and the depressions 204 formed in the back panel 16. The outer plate 198 illustratively includes mount fingers 206 that comprise fastener nuts (having internal threads) that extend through holes 208 in the respective depressions 202 for connection with the connector 200 and the inner plate 196 through fasteners holes 212. The inner plates 196 are illustratively arranged on the inner sides of the chest and back panels 14, 16 and extend through each of the respective inner panes 44, 92, 132 and the strap bodies 178 to connect with the outer plate 198 and connector 200 to clamp the strap bodies 178 and secure the straps 22 to the panel 14, 16. Fasteners 214 are inserted through the outer plates 198, back panel 16, and connectors 200, into connection with the mount fingers 206 as fastener nuts to attach the shoulder straps 22 to each of the chest and back panels 14, 16. The sandwiched attachment of the straps 22 to each of the chest and back panels 14, 16 distributes force broadly across the connections to reduce stress concentration.

The connector 200 illustratively includes a body 216 including supports 218 disposed on opposite sides each having a fastener hole 212 therethrough for receiving fasteners 214 as shown in FIG. 12. An extension plate 220 illustratively extends from a top side 222 of the body 216 between the supports 218 on an end near the connection with the outer plate 198 for attachment with the respective strap body 178. The body 216 illustratively extends between the inner and outer plates 196, 198 and defines another portion of the cavity 186 therethrough for passage of the cabling 188. The coupler 180 protects the cabling 188 against undesirable bending, crushing, and the like under movement of the straps 22.

Figure 13:
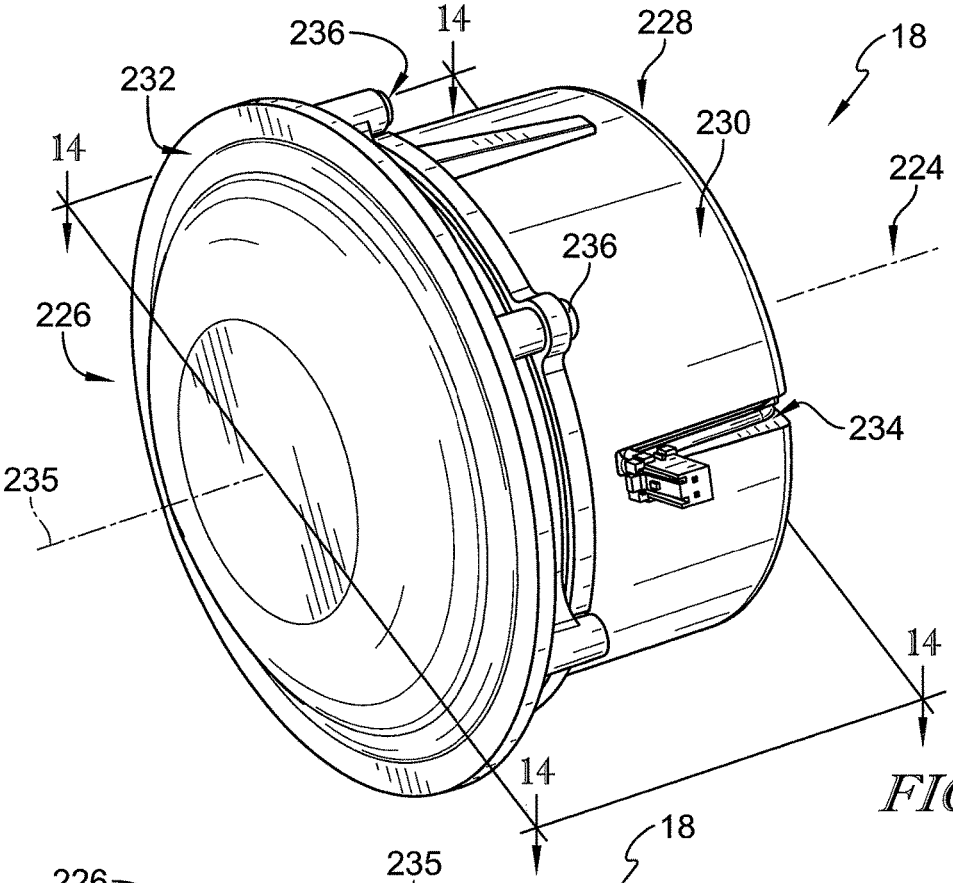
FIG. 13 is a perspective view of the percussive device of the percussion therapy apparatus of FIGS. 1-7 showing that the percussive device includes a housing having a basin and a cap, the cap having a contact face for engagement with the patient's torso.

Referring now to the illustrative embodiment of FIG. 13, the percussive device 18 includes an engagement end 224 for providing percussive force to the patient's torso and an outer end 226 opposite the engagement end 224. The percussive device 18 illustratively includes a housing 228 having a basin 230 and a cap 232 coupled to the basin 230. The housing 228 is illustratively cylindrical extending along an axis 235 between the engagement and outer ends 224, 226.

As shown in FIG. 13, the basin 230 is illustratively arranged near the engagement end 224 and includes a slot 234 for receiving an electrical connector 310 extending for connection with respective cabling 45, 47, 140. The cap 232 is illustratively arranged near the outer end 226 and is attached to the basin 230 with fasteners 236 to enclose the housing 228. In the illustrative embodiment, a seal 231 is illustratively disposed between the connection of the basin 230 and the cap 232, embodied as an o-ring, to fluidly seal the housing 228 against incursion. The housing 228 is illustratively embodied to be formed of plastic, for example but without limitation, polycarbonate. The fasteners 236 for joining the basin 230 and the cap 232 are illustratively plastic screws, for example but without limitation, Delta® fasteners as marketed by EJOT Gmbh & Co. Kg. In some embodiments, the housing 228 and fasteners 236 may each me formed of any suitable materials.

Figure 14A:
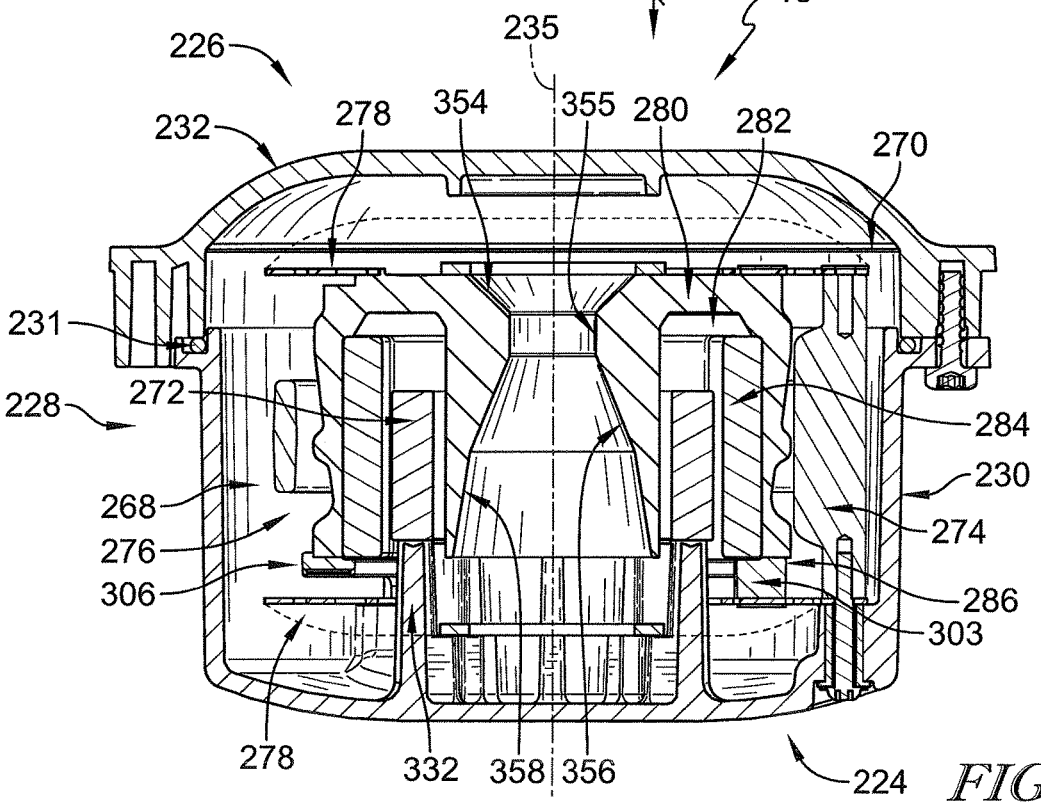
FIG. 14A is an elevation view of the percussive device of FIG. 13 in cross-section taken along the cross-sectional plane 14-14 to show that the percussive device includes a percussion assembly arranged within cavity of the housing for producing percussive force and an actuator arranged to selectively actuate the percussion assembly, and showing that the percussion assembly includes a percussion frame for supporting percussion force, a percussor for controlled movement between end positions to impose percussive force, and springs positioned on opposite sides of the percussor for assisting controlled movement of the percussor.

As shown in FIG. 14A, the percussive device 18 illustratively includes a percussion assembly 268 and an actuator 272 arranged for selective actuation of the percussion assembly 268 to provide percussive force. The percussion assembly 268 along with the actuator 272 is illustratively embodied as a voice coil, or voice coil linear motor, arranged within a cavity 270 of the housing 228. The percussion assembly 268 illustratively includes a percussion frame 274, a percussor 276 arranged for controlled movement to produce percussive force, and resilient members 278 for assisting movement of the percussor 276. The actuator 272 illustratively comprises an electromagnet selectively operable to drive movement of the percussor 276. The percussion assembly 268 selectively generates percussive force for application to the patient's torso through the housing 228.

Figure 14B:
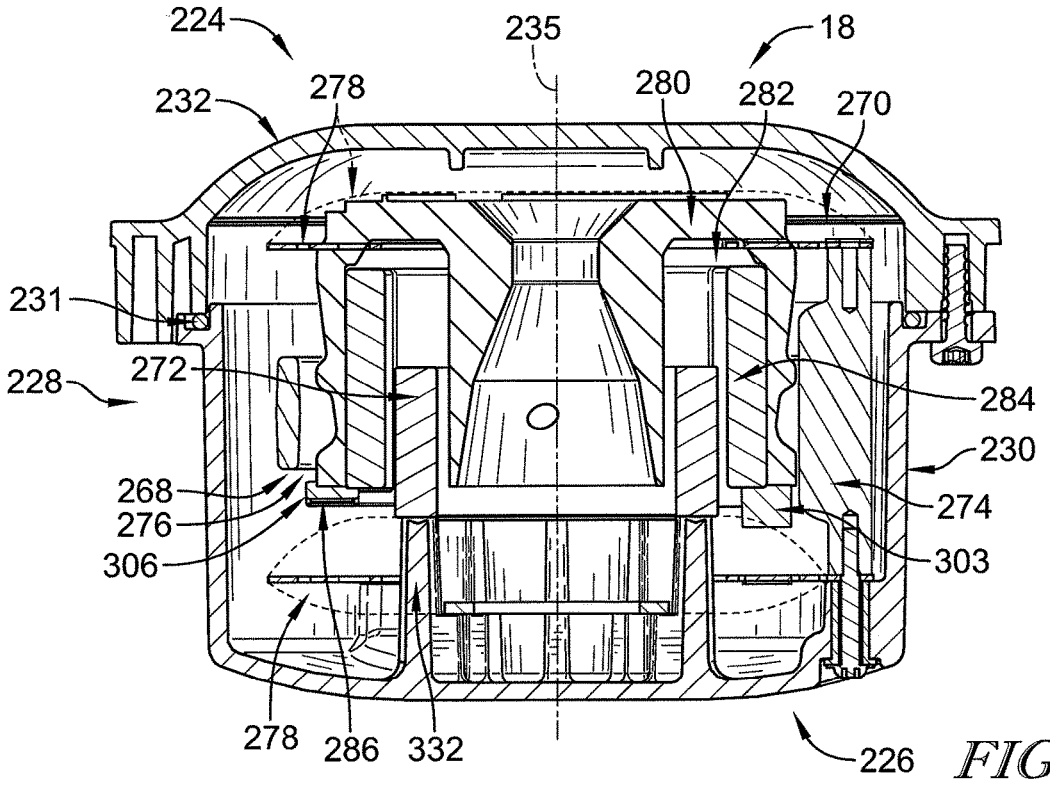
FIG. 14B is an elevation view of the percussive device of FIG. 13 in cross-section taken along the cross-sectional plane 14-14 showing that the percussor assembly is located at an end position (elevated) and that the (upper) resilient member (as shown in broken line) flexes to assist movement of the percussor assembly.
Figure 14C:
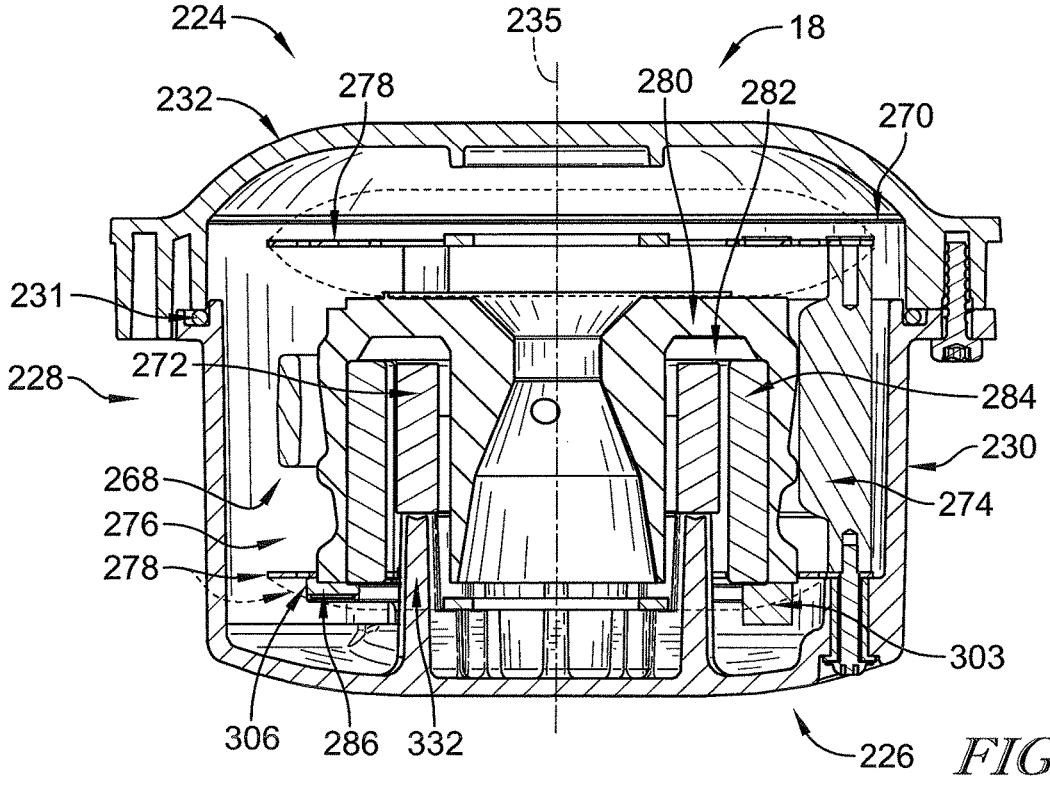
FIG. 14C is an elevation view of the percussive device of FIG. 13 in cross-section taken along the cross-sectional plane 14-14 showing that the percussor assembly is located at an end position (lowered) and that the (lower) resilient member (as shown in broken line) flexes to assist movement of the percussor assembly.

In the illustrative embodiment as shown in FIG. 14A, the percussor 276 illustratively includes a percussor body 280 defining an interior space 282, a magnet 284 arranged within the interior space 282, and a percussor cap 286 attached to the percussor body 280 to secure the magnet 284 within the interior space 282. The actuator 272 drives movement of the percussor 276 along the axis 235. The percussor 276 illustratively moves under force of the actuator 272 along the axis 235 between end positions as shown in FIGS. 14B and 14C. The movement of the percussor 276 imposes percussive force that is transmitted through the percussion frame 274 to the housing 228 for application to the patient's torso. An illustrative example of an acceptable percussive force includes a force within the range of about 4 N to about 25 N. In some embodiments, the force may range from about 3 N to about 30 N.

Figure 15A:
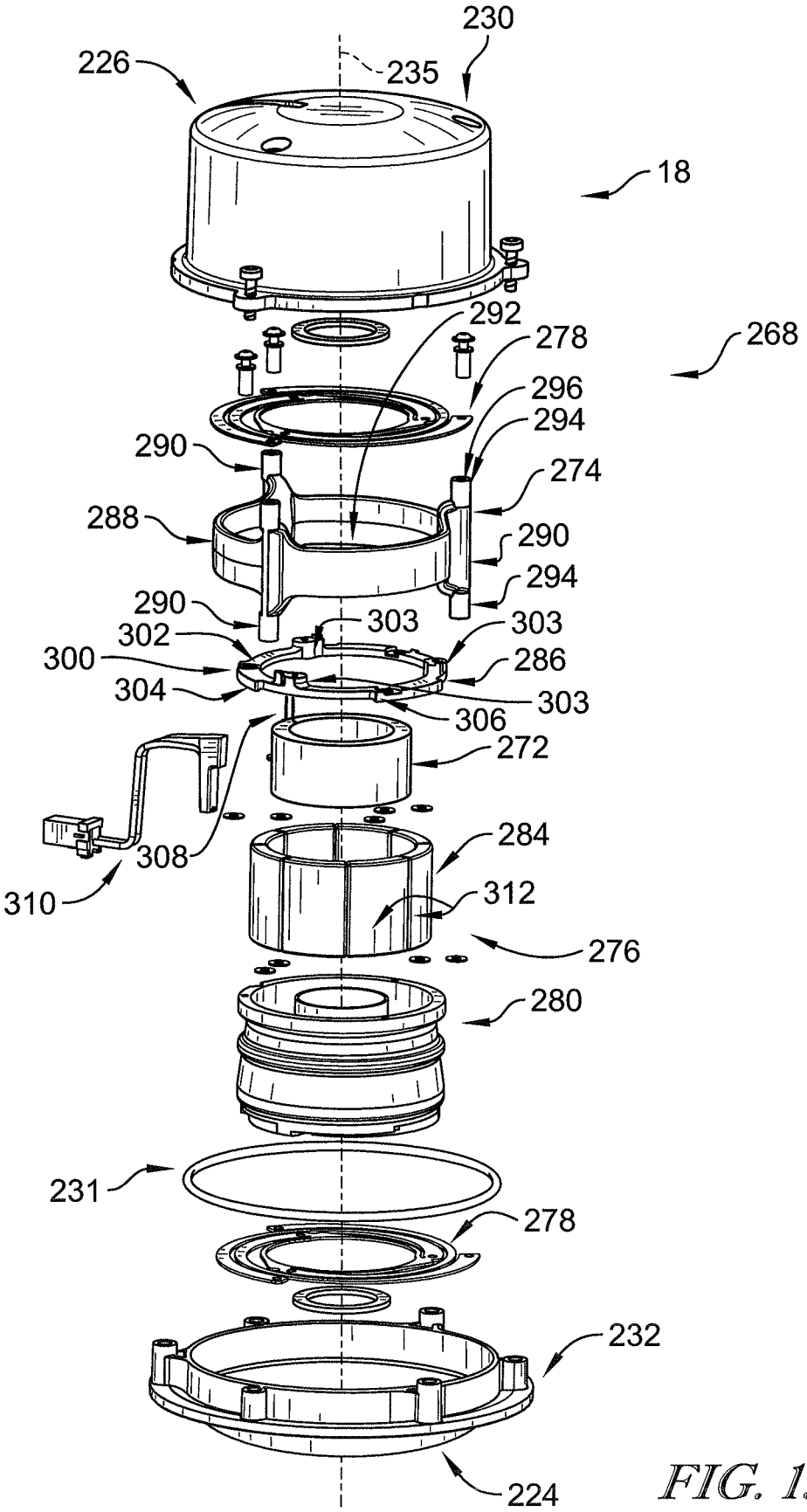
FIG. 15A is an exploded perspective view of the percussive device of FIGS. 13 and 14 showing that the percussor includes a percussor body that has an interior space, a magnet for positioning within the interior space, and a percussor cap for attachment with one end of the percussor body to secure the magnet within the interior space.

As shown in the exploded view of the illustrative embodiment of FIG. 15A, the percussive device 18 is generally cylindrical about the axis 235. The percussion frame 274 illustratively includes a base strut 288 extending about the axis 235 and anchors 290 connected to the base strut 288. The base strut 288 is illustratively embodied as an annular ring defining an inner void 292 therein for receiving the percussor 276. The anchors 290 are illustratively embodied as legs extending parallel with the axis 235 between opposite ends 294, 296 thereof. Each of the ends 294, 296 include fastener holes 298 defined therein for receiving fasteners for attachment of the resilient members 278. The anchors 290 are illustratively embodied as a set of three arranged with equal circumferential spacing around the axis 235, but in some embodiments, the anchors 290 may include any suitable number and/or arrangement to support the percussion assembly 268. The percussion frame 274 is illustratively formed by die-cast aluminum, but in some embodiments, may be formed of any suitable materials and/or process.

Figure 15B:
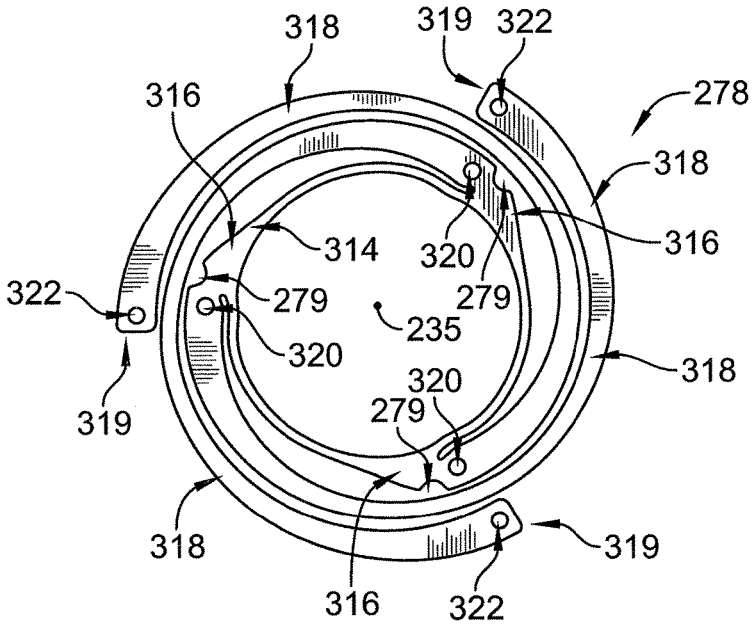
FIG. 15B is an overhead plan view of one of the resilient members of the percussion assembly of the percussive device of FIGS. 13-15A showing that the spring is a plate spring including an inner ring and fingers extending from the inner ring and curving about the inner ring in a counter-clockwise direction to outer ends to allow flexible extension along a central axis.
Figure 15C:
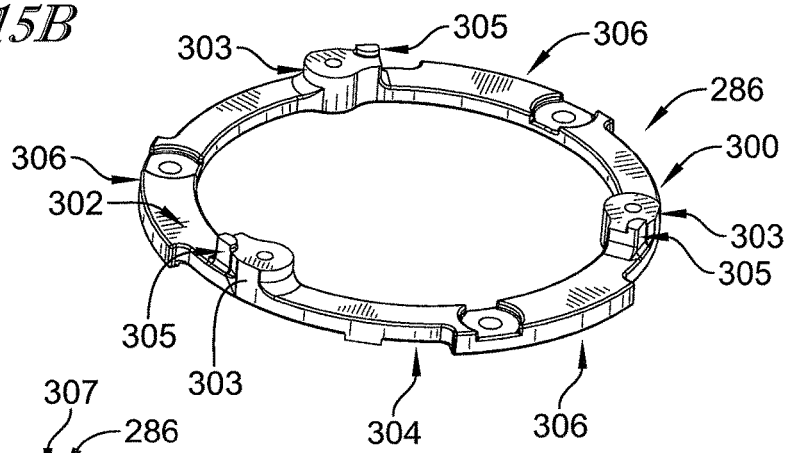
FIG. 15C is a top perspective view of the percussion cap of the percussion assembly of the percussive device of FIGS. 13-15A showing that the percussion cap includes feet for engagement with the percussor body and alignment stubs for engagement with the resilient members.

As best shown in illustrative embodiment of FIG. 15C, the percussor cap 286 is illustratively embodied to have a ring shaped body 300 having and feet 303 extending axially from a side 302 the body 300 towards the outer end 226 for connection with one of the resilient members 278. Each foot 303 illustratively includes an alignment stub 305 extending axially therefrom for engagement with alignment notches 279 of one of the resilient members 278 (discussed below).

Figure 15D:
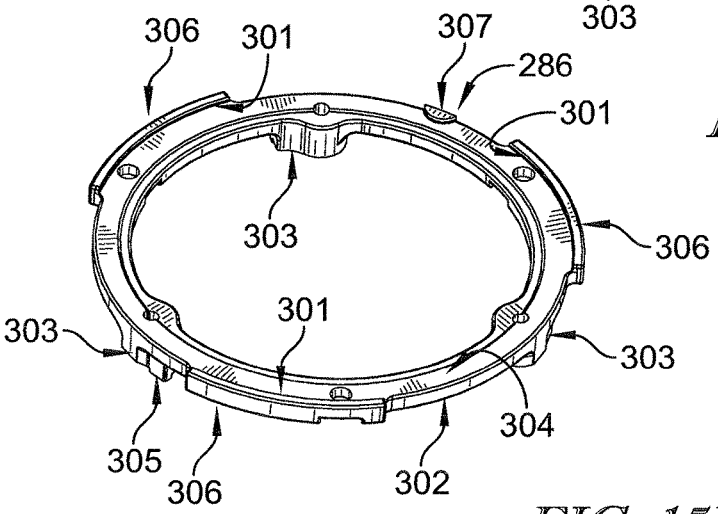
FIG. 15D is a bottom perspective view of the percussion cap of FIG. 15C showing that the percussion cap includes flanges extending therefrom for engagement with the percussor body.

As shown in FIG. 15D, the body 300 of the percussor cap 286 illustratively includes another side 304 opposite the side 302 for engagement with the percussor body 280 and an assembly stub 307 extending from the side 304 in an opposite direction from the alignment stubs 305 for engagement within an alignment groove 343 of the percussor body 280 as discussed below. The percussor cap 286 illustratively includes flanges 306 extending radially outward from the body 300 for a length and parallel to the axis for another length to form a corner 301. The flanges 306 illustratively wrap around the outside of the percussor body 280 (as best shown in FIGS. 14A-14C). The percussor cap 286 is illustratively formed by die-cast aluminum but in some embodiments may be formed of any suitable materials and/or process.

As shown in FIG. 15A, the actuator 272 is illustratively embodied as an electromagnetic coil winding including leads 308 arranged for connection with the electrical connector 310. The actuator 272 illustratively creates magnetic field to move the percussor 276 by passing electric current through the coil. In some embodiments, the actuator 272 may include any suitable actuation device for moving the percussor 276 to create percussive force.

As shown in FIG. 15A, the magnet 284 is illustratively embodied to have a ring shape. The magnet 284 illustratively includes arc segments 312 arranged successively about the axis 235 and being radially magnetized (with respect to axis 235). The arc segments 312 are illustratively arranged to form the ring shape and are mounted within the interior space 282 of the percussor body 280. A non-limiting example of an appropriate magnet include N84 high temperature magnets. The percussor cap 286 illustratively abuts the magnet 284 along an axial end of each arc segment 312 to secure the magnet 284 within the interior space 282 of the percussor body 280 (as best shown in FIGS. 14A-14C).

In the illustrative embodiment as shown in FIG. 15B, the resilient members 278 comprise plate springs forming a spiral shape. The resilient members 278 illustratively include a ring 314 formed about the axis 235 and having tabs 316 extending therefrom. The resilient members 278 illustratively include fingers 318 connected to the tabs 316 of the ring 314 and extending therefrom with curvature in the counter-clockwise direction (in the orientation shown in FIG. 15B) to ends 319 thereof. The resilient members 278 illustratively include alignment notches 279 defined between the tabs 316 and inner attachment points 320 (discussed below). In the illustrative embodiment, the fingers 318 have equal curvature to each other and define a close spacing with the next interior component (ring 314 and/or another finger 318) along its curved extension.

In the illustrative embodiment as shown in FIG. 15B, the fingers 318 illustratively include inner attachment points 320 disposed near the connection with the tabs 316 of the ring 314 and outer attachment points 322 disposed near the ends 318. The inner attachment points 320 are illustratively arranged for connection with the percussor cap 286, namely with the feet 303. The outer attachment points 322 are illustratively arranged for connection with the percussion frame 274, namely with the ends 294, 296 of the anchors 290.

As shown in FIG. 15B, the fingers 318 are illustratively flexible along their curvature between the inner and outer attachment points 320, 322 to extend axially to allow the ring 314 to move along with the percussor 276 and to assist movement back towards the opposite end position as shown in FIGS. 14B and 14C. The reciprocation of the percussor 276 creates the percussive force with assistance from the resilient members 276. In the illustrative embodiment, the inner and outer attachment points 320, 322 are embodied as fastener holes for receiving fasteners therethrough for attachment to their respective connections, but in some embodiments, the attachment points 320, 322 may include any suitable manner of attachment to their respective connections. In the illustrative embodiment, the resilient members 278 are formed of 14310 steel by chemical etching, but in some embodiments, may be formed of any suitable material and/or any suitable process (for example, but without limitation, laser cutting and/or electroforming).

Figure 15E:
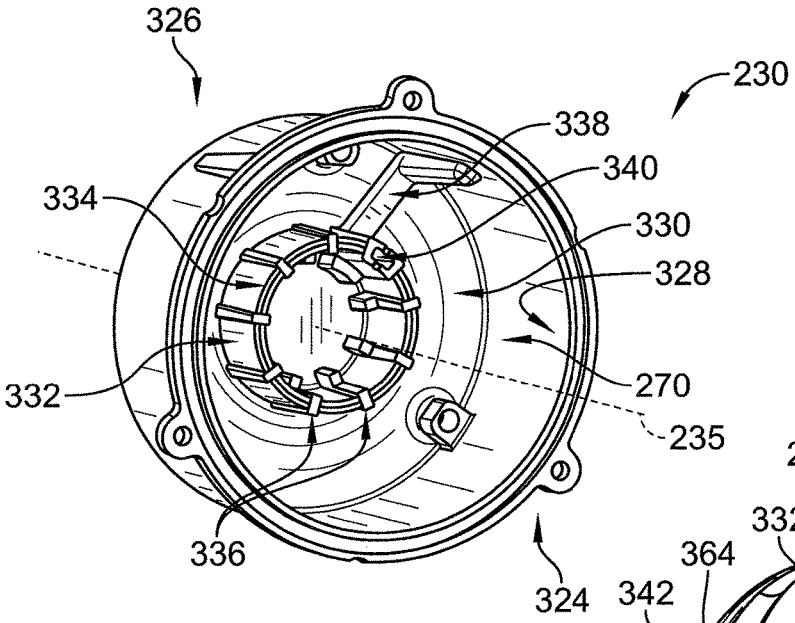
FIG. 15E is a perspective view of the basin of the housing of the percussive device of FIGS. 13-15 showing that the basin includes an outer circumferential wall encircling the central axis, an end wall enclosing one end of the circumferential wall and defining a cavity within the basin, and a mount wall extending from the end wall within the cavity to support the actuator of the percussive device.

As shown in FIG. 15E, the basin 230 of the housing 228 is illustratively embodied to have a cylindrical shape extending between an open end 324 for connection with the cap 232 and a closed end 326 opposite the open end 324. The basin 230 illustratively includes a circumferential wall 328 that extends about the axis 235 to define a portion of the cavity 270 of the housing 228 and an end wall 330 arranged at the closed end 326 to close the diameter of the circumferential wall 328 to enclose the cavity 270 within the basin 230. The basin 230 illustratively includes a mount wall 332 extending from the end wall 330 to a support end 334 to engage the actuator 272 (as best seen in FIGS. 14A-14C). In the illustrative embodiment, the actuator 272 is secured to the mount wall 332 with adhesive, but in some embodiments may be secured in any suitable manner.

In the illustrative embodiment as shown in FIG. 15E, the mount wall 332 is illustratively embodied to extend circumferentially about the axis 235. The mount wall 332 illustratively includes ribs 336 arranged circumferentially along the mount wall 332 in spaced apart relation to each other. The ribs 336 are illustratively embodied as enlarged sections for reinforcing the mount wall 332 to support the actuator 272.

A bus duct 338 is illustratively formed in the basin 230 as shown in FIG. 15E. The bus duct 338 illustratively defines a space 340 therein to receive the connector 310 for connection with the cabling 45, 47, 140 to provide electrical communication with the actuator 272. As shown in FIG. 15E, the bus duct 338 illustratively extends axially along a portion of the circumferential wall 328, radially along the end wall 330, and axially along the mount wall 332 to provide the support end 334 to provide connection from outside the basin 230 to the actuator 272.

Figure 15F:
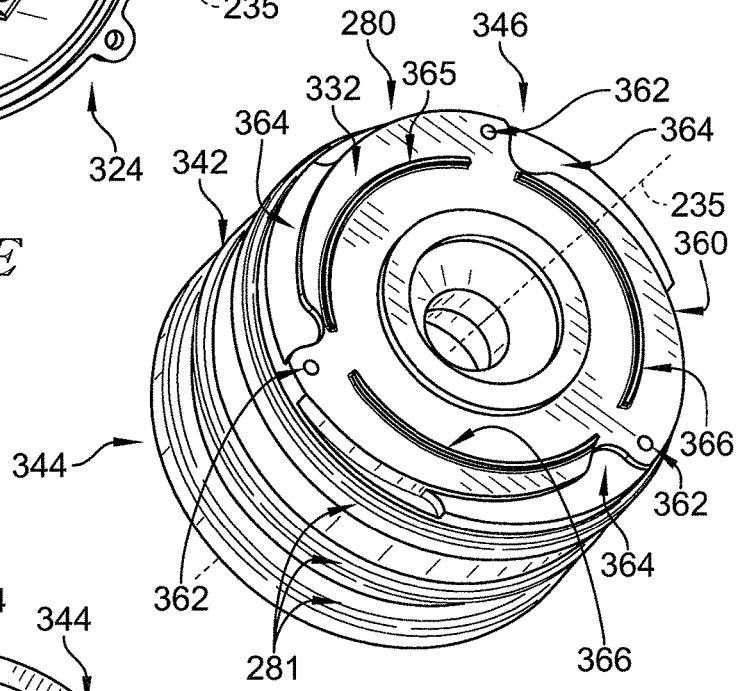
FIG. 15F is a perspective view of the percussor body of FIG. 15E from an opposite end showing that the percussor body includes a circumferential wall that extends around the central axis to define the interior, an end wall partially enclosing one end of the interior, and a central hub extending axially from the end wall within the interior space
Figure 15G:
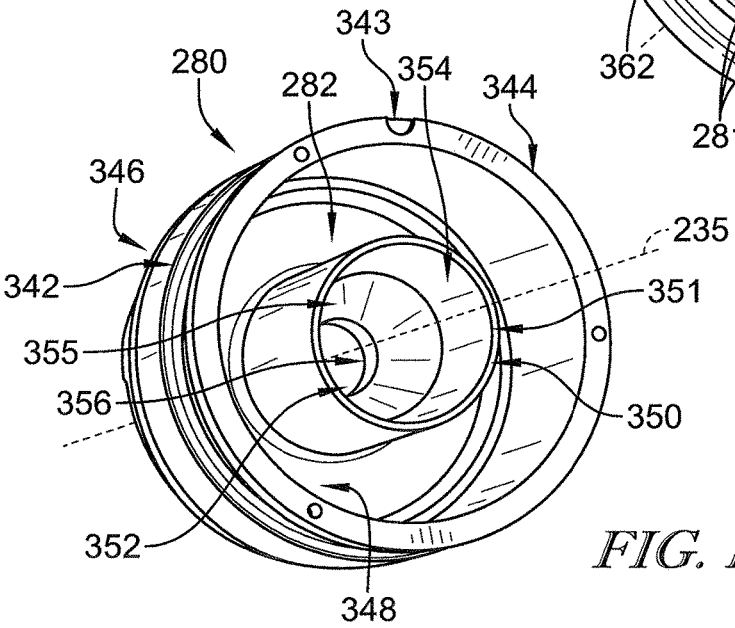
FIG. 15G is a perspective view of the percussor body of the percussive device of FIGS. 13-15A showing that an outer side of the end wall is configured to connect with one of the springs and includes ridge walls extending from the therefrom to encircle the inner ring.

As shown in the illustrative embodiment of FIGS. 15F and 15G, the percussor body 280 is embodied to have a generally cylindrical shape formed about the axis 235. The percussor body 280 illustratively includes a circumferential wall 342 that extends about the axis 235 to define the interior space 282. The percussor body illustratively includes an open end 344 (as best shown in FIG. 15G) and a closed end 346 that is at least partially closed by an end wall 348. As shown in FIG. 15G, an alignment groove 343 is defined in the circumferential wall 342 at the open at 344 complimentary to the assembly stub 307 of the percussor cap 286 for receiving the same for assembly alignment. The percussor body 280 is illustrative formed by high-speed turning operation and includes radial end stop surfaces 281 formed thereon. The percussor body 280 is illustratively formed with a balance of desirable weight and magnetic properties for creating percussive force for percussion therapy.

As shown in FIG. 15F, the end wall 348 of the percussor body 280 illustratively includes an outer face 360. The outer face 360 illustratively includes attachment points 362 embodied as fastener holes for receiving fasteners therethrough for attachment of the inner attachment points 320 of one of the resilient members 278. The outer face 360 illustratively includes depressions 364 formed therein and ridge walls 366 extending axially from the outer face 360 and circumferentially about the axis 235 with circumferentially spaced apart arrangement for engagement with an inner diameter of the ring 314 of the resilient member 278.

As best shown in FIG. 15G, the percussor body 280 illustratively includes a hub 350 formed of a hub wall 351 that extends axially from the end wall 348 and circumferentially about the axis 235 within the interior space 282. The hub 350 and the end wall 348 collectively define a hub passage 352 that extends axially therethrough. Referring to FIGS. 14A-14C, the magnet 284 is positioned with the interior space 282 radially outside of the hub 248.

As shown in FIG. 14A, the hub passage 352 is illustratively defined to include a sections 354, 355, 356, 358 defined by the interior of the hub wall 351. The sections 354, 355, 358 are illustratively have tapered diameters. The section 358 illustratively tapers inwardly from a larger diameter near an outer side of the end wall 348 to connect with the section 356 that illustratively has a constant diameter. The section 356 illustratively connects with the section 355 opposite the section 358. The section 355 illustratively tapers outwardly from the diameter of the section 356 and connects with the section 354. The section 354 illustratively tapers outwardly from the section 355 with a different angle of taper from the section 355 to an end of the hub 350 opposite the end wall 348.

Returning briefly to FIGS. 1-7, the percussive device 18 are illustratively arranged with their respective panels 14, 16 to form a isosceles trapezoidal shape on each of the patient's chest and back. In the illustrative embodiment, the number of percussive devices 18 and their positioning is strategically selected. In general, the position of the percussive devices 18 relative to the sternum and the spine should preferably not change significantly with patients ranging from the 5th percentile to the 95th percentile of bodily dimensions, and as such a single size of covering 12 can be used by a large portion of the patient demographic. In some embodiments, the location of the percussive devices 18 may be locally adjustable relative to the respective panel 14, 16.

Figure 16A:
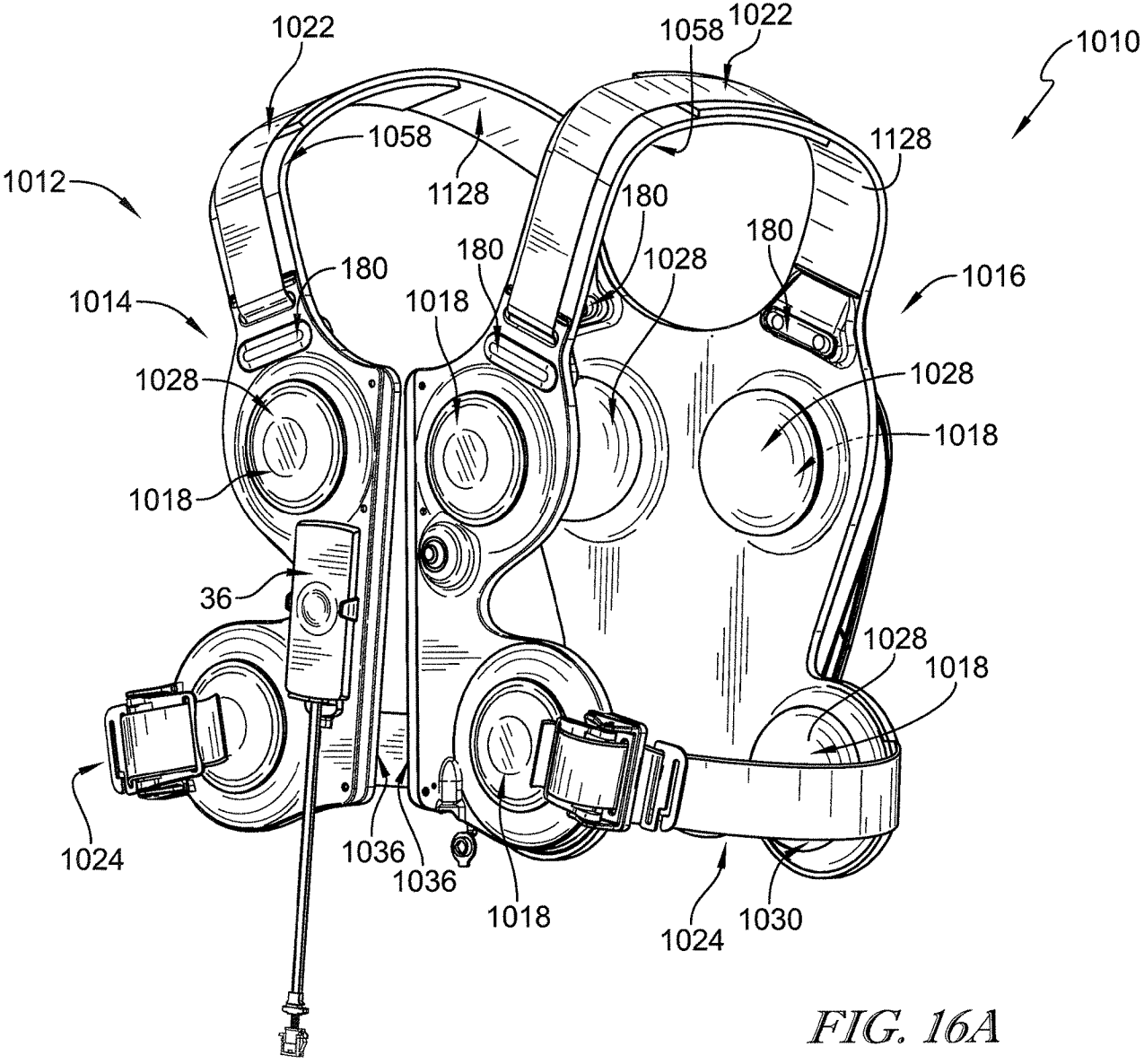
FIG. 16A is a front perspective view of another percussion therapy apparatus for percussion therapy showing that the apparatus includes a covering for a patient's torso having chest panel with left and right sections (according to the patient's perspective, respectively, right and left sides), and a back panel, a number of percussive devices for providing percussive force attached to each of the chest and back panels, and an attachment system including shoulder straps and side straps for securing the covering to a patient's torso.

Referring now to FIG. 16A, another illustrative embodiment of a percussion therapy apparatus 1010 is shown. The percussion therapy apparatus 1010 illustratively includes a covering 1012 having a chest panel 1014 and a back panel 1016, and percussive devices 1018 that are attachable to the covering 1012 to engage with the patient's torso to provide thoracic percussion therapy. The percussion therapy apparatus 1010 illustratively includes an attachment assembly 1020 comprising shoulder straps 1022 and side strap assembly 1024 for securing the covering 1012 to the patient's torso. The percussion therapy apparatus 1010 is similar to the percussion therapy apparatus 10 and is embodied include any of the features of the percussion therapy apparatus 10 except where conflicting with the specific description and illustration of the percussion therapy apparatus 1010.

In the illustrative embodiment of FIG. 16A, the percussion therapy apparatus 1010 is formed as a sleeveless garment, or vest, to be worn by the patient for receiving percussion therapy. The chest panel 1014 and back panel 1016 illustratively include curvature to conform generally to the form of a patient's torso. Properly fitting the percussion therapy apparatus 1010 can provide more efficient application of percussive therapy and reduce the negative effects to the patient.

Figure 16B:
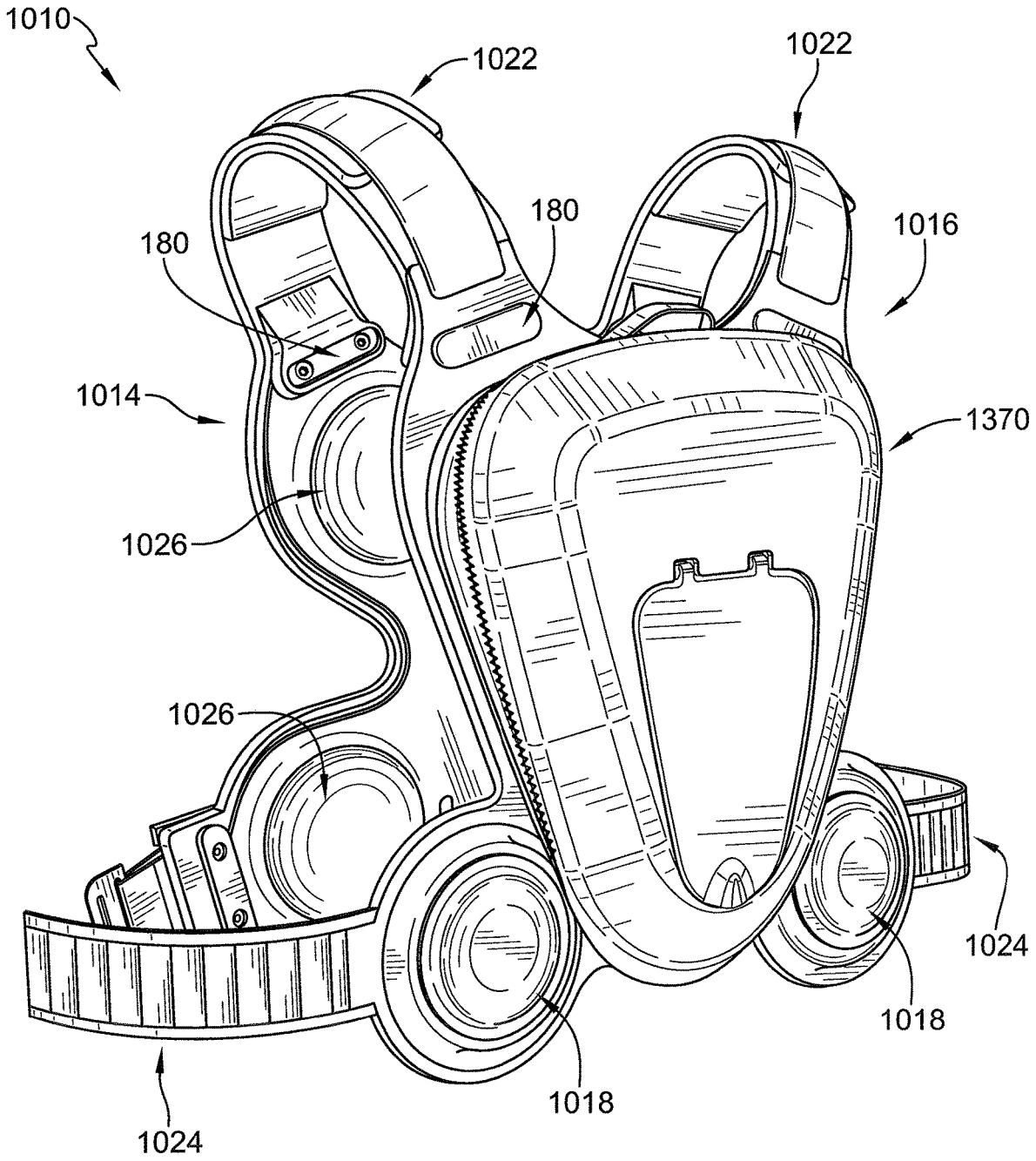
FIG. 16B is a rear perspective view of the percussion therapy apparatus of FIG. 16A showing that the back panel includes a power source received in a power source compartment that is positioned generally centrally in the back panel.

As shown in FIGS. 16A and 16B, the percussion therapy apparatus 1010 illustratively includes contact padding 1026, 1028 arranged inside of the chest and back panels 1014, 1016 as an interface between the respective panel 1014, 1016 and the patient's torso. The contact padding 1026, 1028 is illustratively arranged between the percussive devices 1018 and the patient's torso to provide additional cushion in application of the percussive force of the percussive devices 1018.

Figure 18:
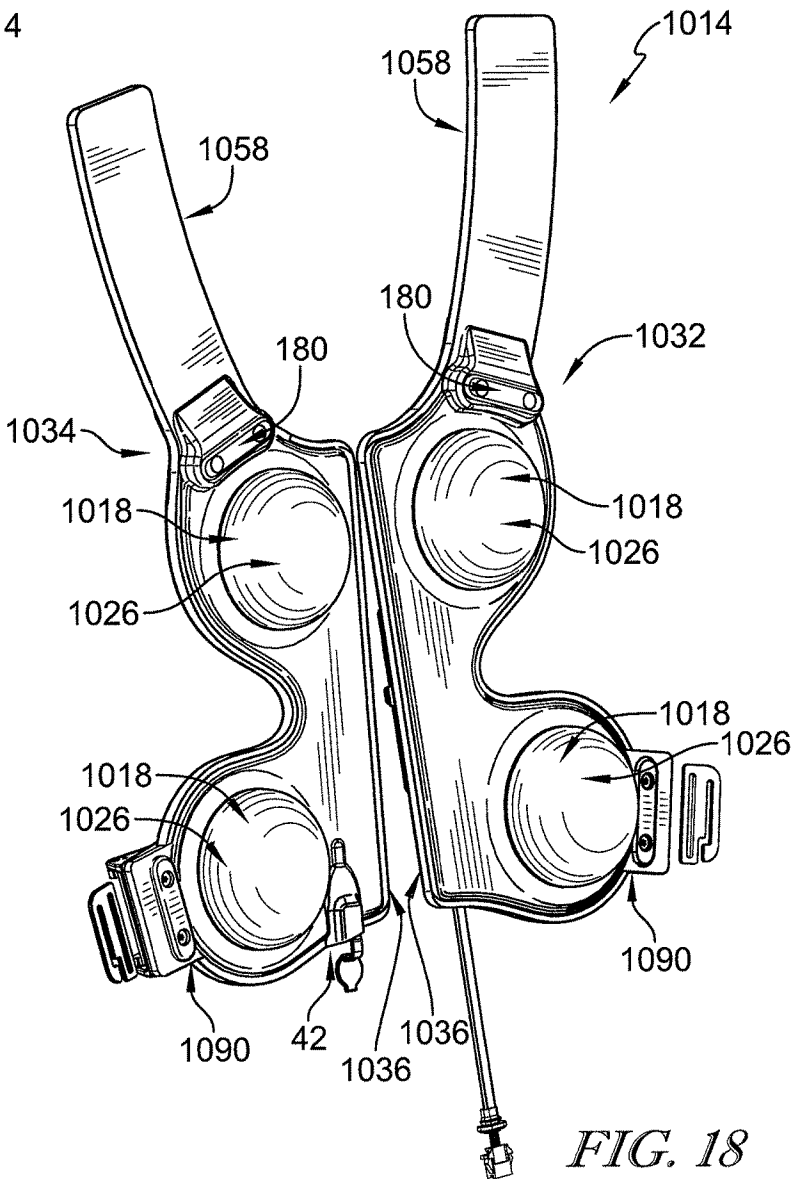
FIG. 18 is a rear perspective view of the chest panel of FIG. 17 showing that each percussive device includes a pad attached to an engagement end of the percussive device on the interior side of the chest panel for contact with a patient's torso to provide percussive force.
Figure 17:
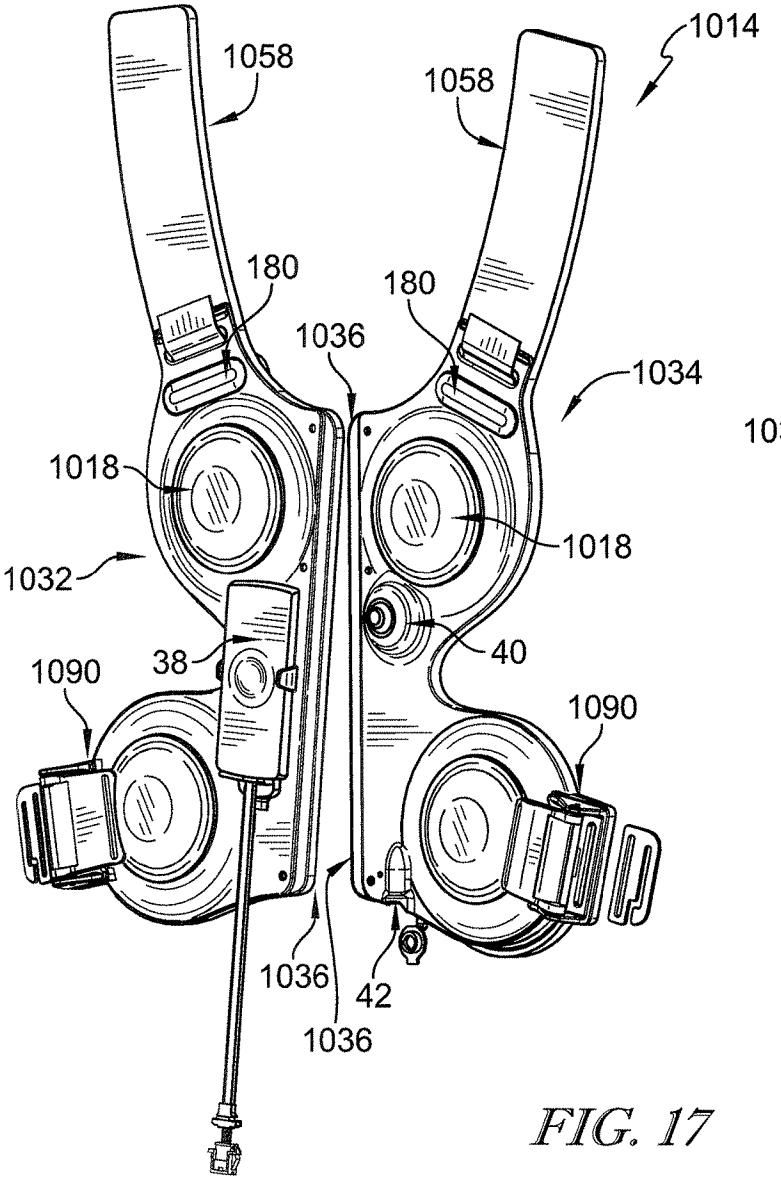
FIG. 17 is a front perspective view of the chest panel of the percussion therapy apparatus of FIGS. 16A and 16B showing that a percussive devices are mounted to the chest panel and showing that a user interface is coupled to the right section and a break button and a power port are attached to the left section.

As shown in FIGS. 17 and 18, the chest panel 1014 illustratively includes a right section 1032 and a left section 1034 each respectively arranged on the right and left side of the patient's chest when the apparatus 1010 is worn. The right and left sections 1032, 1034 illustratively form an hour glass-shape, each defining one half thereof and each generally having an outline that is a mirror image of the other.

As shown in FIG. 18, the chest panel 1014 illustratively includes shoulder portions 1058 and side tabs 1090 for connection with the side straps assemblies 1024 of the attachment assembly 1020 to secure the apparatus 1010 to a patient's torso. The right and left sections 1032, 1034 each illustratively include a straight edge 1036 on a medial side thereof for releasably coupling to one another as explained herein.

The right section 1032 illustratively includes the user interface 38 mounted thereto as shown in FIG. 17. The user interface 38 illustratively provides a communication interface for the user to operate the percussive devices 1018 as described in more below. The left section 1034 illustratively includes the break button 40 for pausing operation of the percussive devices 1018 and the power port 42 for connection with a power cord to receive electric power.

Figure 19:
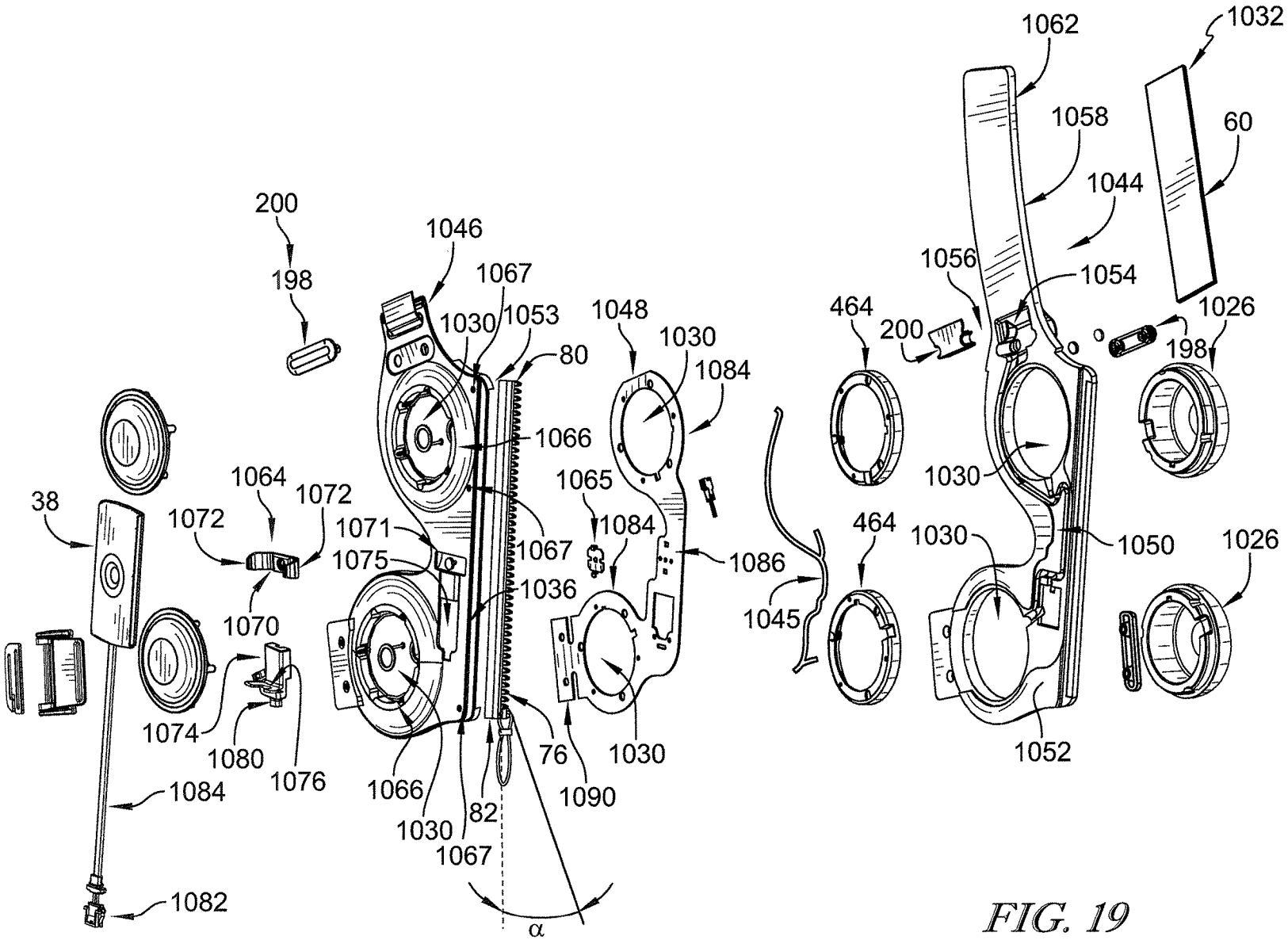
FIG. 19 is an exploded perspective view of the right section of the chest panel of FIGS. 17 and 18 showing that the right section includes inner and outer panes and a frame pane arranged between the inner and outer panes.

Referring to FIG. 19, the right section 1032 of the chest panel 1014 illustratively includes an inner pane 1044, an outer pane 1046, and a frame pane 1048 arranged between the inner and outer panes 1044, 1046. Each of the panes 1044, 1046, 1048 illustratively include openings 1030 defined therein to receive the percussive devices 1018. The inner pane 1044 illustratively includes grooves 1050 defined in a front side 1052 thereof. The grooves 1050 illustratively extend vertically with curvature to accept cabling 1045 therein for positioning between the inner pane 1044 and the frame pane 1048. Retainer rings 464 are illustratively arranged within the openings 1030 of the inner pane 1044 for attachment of the contact padding 1026 as discussed below.

As shown in FIG. 19, the grooves 1050 illustratively connect with a space 1054 of the inner pane 1044 located near the top end 1056 thereof. The inner pane 1044 illustratively includes the shoulder portion 1058 extending from the top end 1056 thereof for connection with the back panel 1016. The shoulder portion 1058 illustratively includes an attachment device 60 embodied as one portion of hook and unbreakable loop fasteners attached to a rear side 1062 thereof for connection with the back panel 1016.

The outer pane 1046 illustratively includes an interface mount 1064, percussion mounts 1066 (comprising raised sections for ergonomics), and snaps 1067 each attached to an outer surface 1068 thereof as shown in FIG. 19. The snaps 1067 illustratively receive complimentary snap portions 1069 of accessories for attachment to the outer pane 1046, for example, an outer liner 1472 discussed herein. The interface mount 1064 illustratively includes a mount body 1070 including wings 1072 arranged on opposite lateral sides of the mount body 1070 with curvature to flexibly wrap (snap fit) around the user interface 38 for coupling to the chest panel 1014.

As shown in FIG. 19, the interface mount 1064 illustratively includes a mount plate 1065 for attaching to the mount body 1070 through a hole 1071 in the outer pane 1046 and for attaching to the inner pane 1048 to secure the interface mount 1064 to the chest panel 1014. The interface mount 1064 illustratively includes a mount base 1074 coupled to the chest panel 1014 and having a step 1076 for supporting the user interface 38 in attachment to the right section 1032. The mount base 1074 illustratively attaches to the frame pane 1048 through a hole 1075 in each of the outer pane 1046 and includes a connection jack 1080 for receiving a connection end 1082 of cabling 1085 of the user interface 38 providing communication and power to and from the user interface 38. The mount base 1074 is illustratively connected to the power and control circuitry 1412 through the cabling 1045 to operate the percussion therapy apparatus as discussed below.

As shown in FIG. 19, the outer pane 1046 illustratively includes the straight edge 1036 formed on a medial side thereof. The straight edge 1036 includes a zipper portion 76 of a zipper assembly 76, 78 attached thereto for releasable coupling between the right and left sections 1032, 1034. In the illustrative embodiment, the zipper portion 76 illustratively includes a top end 80 and a bottom end 82 and is attached to the straight edge 36 along its entire length between its ends 80, 82. The zipper portion 76 is illustratively attached to the outer pane 1046 and is angled between its top and bottom ends 80, 82 such that its bottom end 82 is positioned farther from the sagittal plane (of the patient when wearing the percussion therapy apparatus) than its top end 80. In the illustrative embodiment, the zipper portion 76 is arranged at an angle $\alpha$ relative to the sagittal plane (indicated in broken line) within the range of about 1 degree to about 5 degrees, for example, about 1.8 degrees, or about 3 degrees.

As shown in FIG. 19, the frame pane 1048 illustratively provides a substructure for the right section 1032. The frame pane 1048 is illustratively embodied as a sheet of material including rings 1084 that define the openings 30 and a stem 1086 extending between the rings 1084. The frame pane 1048 illustratively includes a side tab 1090 extending from the (lower) ring 1084 for connection with the side strap assembly 1024.

Figure 20:
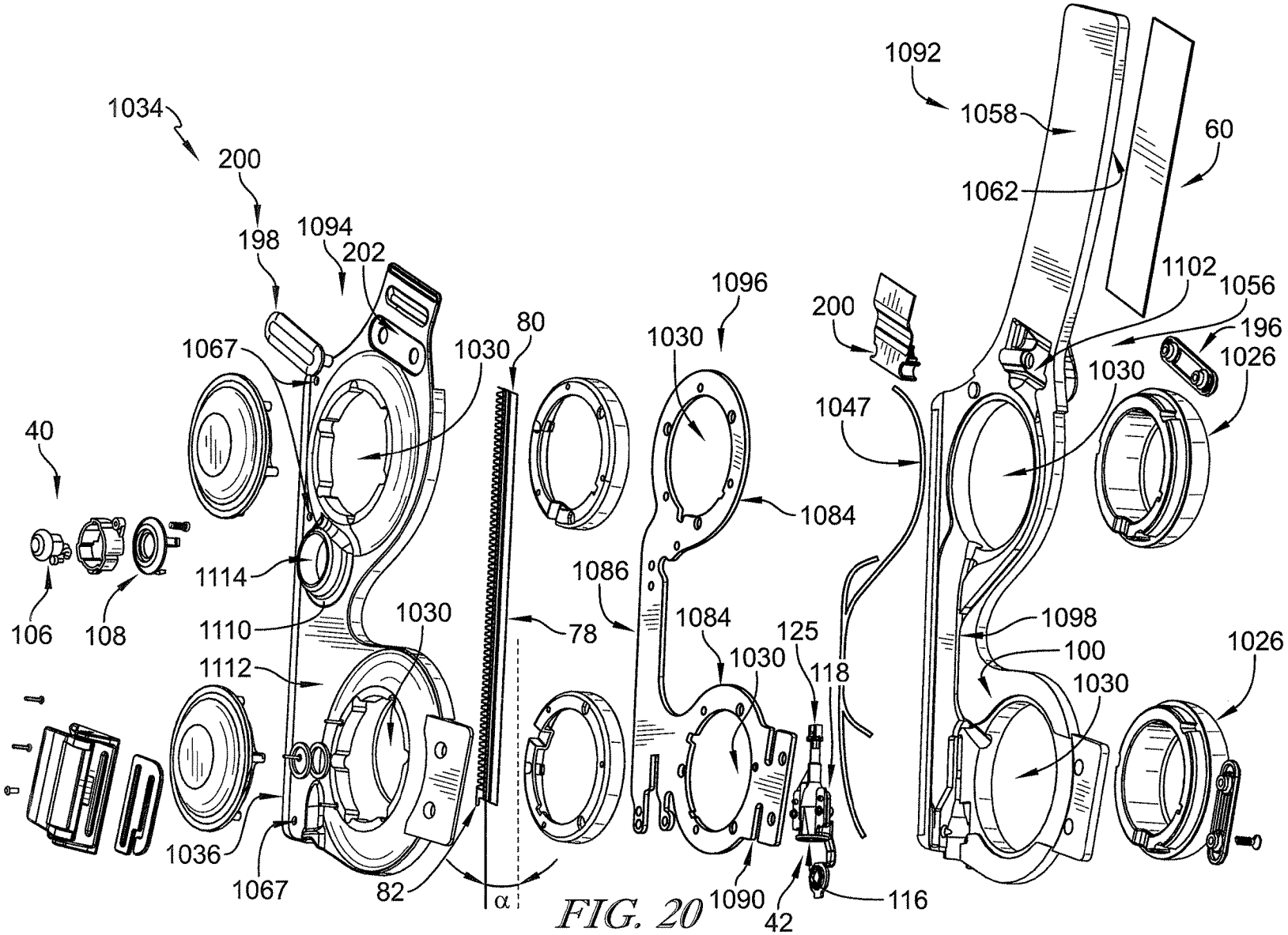
FIG. 20 is an exploded perspective view of the left section of the chest panel of FIGS. 17 and 18 showing that the left section includes inner and outer panes and a frame pane arranged between the inner and outer panes.

Referring to FIG. 20, the left section 1034 of the chest panel 1014 illustratively includes an inner pane 1092, an outer pane 1094, and a frame pane 1096 arranged between the inner and outer panes 1092, 1094. Each of the panes 1092, 1094, 1096 illustratively include openings 1030 defined therein to receive the percussive devices 1018. The inner pane 1092 illustratively includes grooves 1098 defined in a front side 100 thereof. The grooves 1098 illustratively extends vertically with curvature to accept cabling 1047 therein for positioning between the inner pane 1092 and the frame pane 1096.

As shown in FIG. 20, the grooves 1098 illustratively connect with a space 1102 of the inner pane 1092 located near the top end 1056 thereof. The inner pane 1092 illustratively includes a shoulder portion 1058 extending from the top end 1056 of the inner pane 1092 for connection with the back panel 1016. The shoulder portion 1058 of the inner pane 1092 illustratively includes an attachment device 60 embodied as one portion of hook and unbreakable loop fasteners attached to a rear side 1062 thereof for connection with the back panel 1016.

As mentioned above, the outer pane 1094 illustratively includes the break button 40 for pausing operation of the percussive devices 18 and the power port 42 for connection with a power cord as shown in FIG. 20. The break button 40 illustratively includes a button assembly 1104 having an actuator button 106 and housing 108 for receiving the actuator button 106. A raised section 1110 is disposed on the front side 1112 of the outer pane 1094 and defines a hole 1114 therethrough for receiving the button assembly 1104. The cabling 1047 illustratively connects with the actuator button 1106 to provide communication with the percussive devices 1018. A user can depress the actuator button 1106 to operate the break button 40 to pause operation of the percussive devices 1018. In the illustrative embodiment, the actuator button 1106 is embodied as a linear actuation button, but in some embodiments may be any suitable style of actuator button to operate the break button 40 for pausing.

In the illustratively embodiment, the power port 42 illustratively includes a power terminal 116 housed within a port housing 118 as shown in FIG. 20. The port housing 118 illustratively connects with the frame pane 1096 and is positioned with complimentary depressions 1097 of the inner and outer panes 1092, 1094. The power terminal 116 is illustratively received within an interior of the port housing 118 and is embodied as a 5-pin connector accessible through an opening 120 in a lower face of the port housing 118. The power terminal 116 illustratively includes wiring 122 that extends from a top side of the port housing 118 to a connector 125 for connection with the cabling 1047. In some embodiments, the power terminal 116 may include an suitable type and/or arrangement of connector for receiving power for charging and/or operating the apparatus 10.

As shown in FIG. 20, the outer pane 1094 illustratively includes snaps 1067 on the outer surface 1112 thereof. The snaps 1067 illustratively receive complimentary snap portions 1069 of accessories for attachment to the outer pane 1046, for example, an outer liner 1472 discussed herein. The outer pane 1094 illustratively includes the straight edge 1036 formed on a medial side thereof. The straight edge 1036 includes a zipper portion 78 of a zipper assembly 76, 78 attached thereto for releasable coupling between the right and left sections 1032, 1034. In the illustrative embodiment, the zipper portion 78 illustratively includes a top end 80 and a bottom end 82 and is attached to the straight edge 1036 of the outer pane 1094 along its entire length between its ends 80, 82. The zipper portion 78 is illustratively attached to the outer pane 1094 and angled between its top and bottom ends 80, 82 such that its bottom end 82 is positioned farther from the sagittal plane (of the patient when wearing the percussion therapy apparatus) than its top end 80, in the opposite direction of the zipper portion 76 of the right section 1032. In the illustrative embodiment, the zipper portion 78 is arranged at an angle $\alpha$ relative to the sagittal plane, in the opposite direction of the zipper portion 76 of the right section 1032, within the range of about 1 degree to about 5 degrees, for example, 1.8 degrees, or 3 degrees. Angling the zipper assembly 76, 78 as described provides a conforming fit to the patient upon coupling with the right section 1032, reducing slack and improving engagement with the patient's torso.

The frame pane 1096 illustratively provides a substructure for the left section 1034 as shown in FIG. 20. The frame pane 1096 is illustratively embodied as a sheet of material including rings 1084 that define the openings 1030 and a stem 1086 extending between the rings 1084. The frame pane 1096 illustratively includes a side tab 1090 extending from the (lower) ring 1084 for connection with the side strap assembly 1024.

In the illustrative embodiment, the inner panes 1044, 1092 and outer panes 1046, 1094 of each of the chest panel 1014 and back panel 1016, respectively, are formed of a relatively soft but firm material such as compression foam, and the frame panes 1048, 1096 are formed of a semi-rigid polymer and are shaped to flex more easily in certain directions to provide support to the panels 1014, 1016 while permitting snug contact of the percussive devices 1018 with the patient's torso and generally allowing movement of the patient while wearing the percussive therapy apparatus 1010. In some embodiment, any number of suitable materials may be used for each of the panes 1044, 1046, 1048, 1092, 1094, 1096.

Figure 21B:
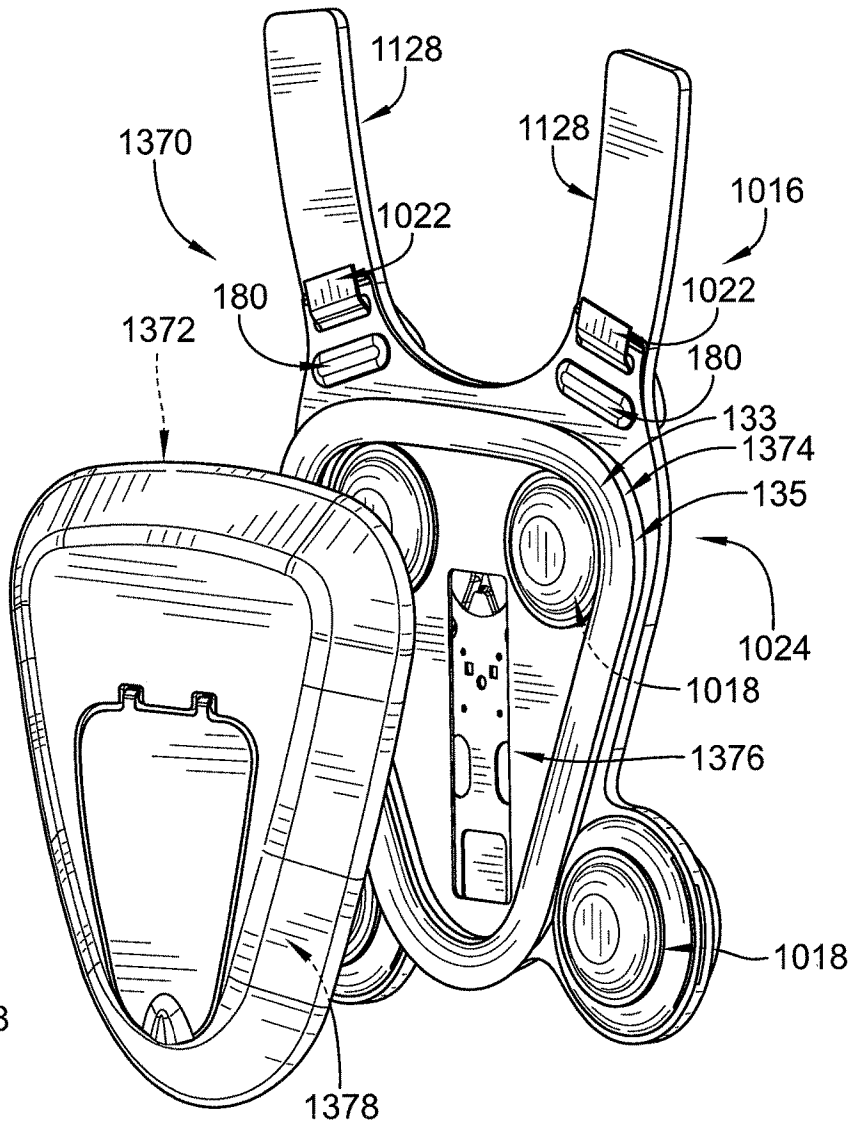
FIG. 21B is a perspective rear view of the back panel of FIG. 21A with an outer cover of the receiver assembly removed to show that the control pack is mounted to the back panel and showing that the receiver assembly includes a rim mounted to a flange of the back panel to provide a ledge to allow a skirt of the outer cover to be cinched about the ledge to couple the outer cover to the back panel.
Figure 21A:
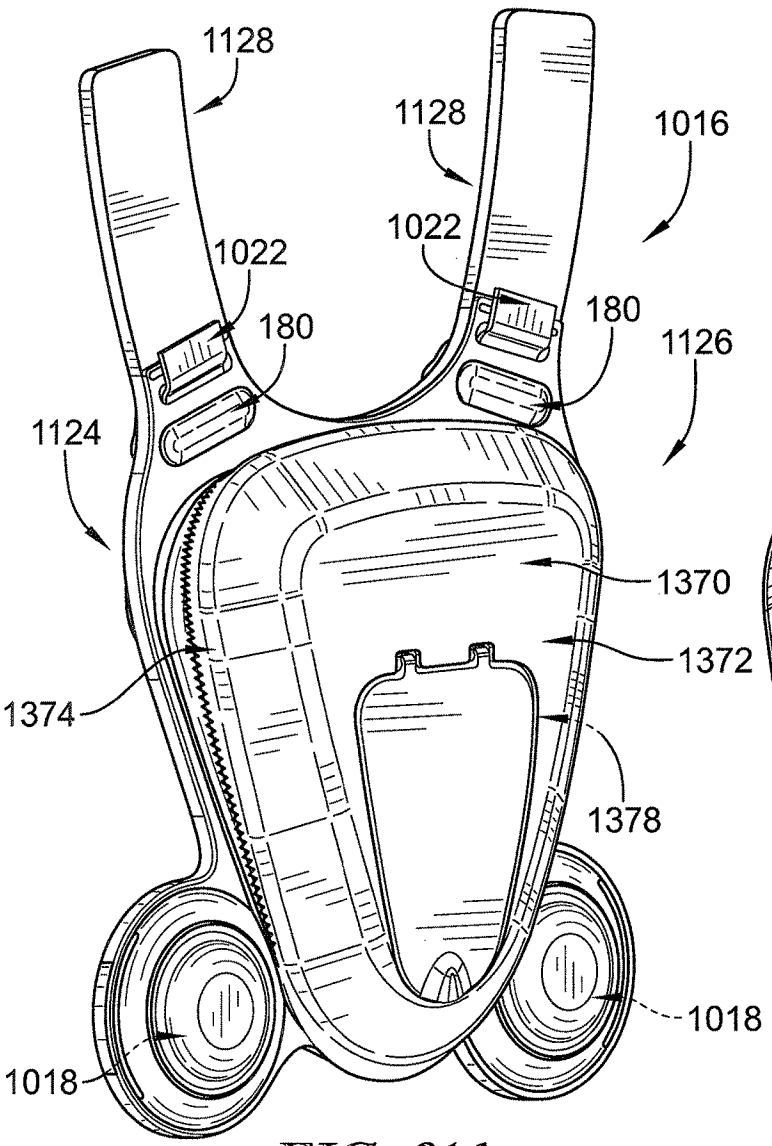
FIG. 21A is a perspective rear view of the back panel of the percussion therapy apparatus of FIG. 16 showing that the back panel includes a receiver assembly for housing a control pack for power and communication of the percussion therapy apparatus.

In the illustrative embodiment of FIGS. 21A and 21B, the back panel 1016 includes a single section having an interior side 1124 for engagement with the patient's back and an exterior side 1126 opposite the interior side 1124. The back panel 1016 illustratively includes a pack housing 1370 comprising an outer cover 1372 and a receiver 1374 of the back panel 1016 collectively defining a control cavity 1376 therein for housing a control pack 1378. The control pack 1378 illustratively provides power and control to the percussion therapy apparatus 1010 as discussed in more detail below.

Figure 22:
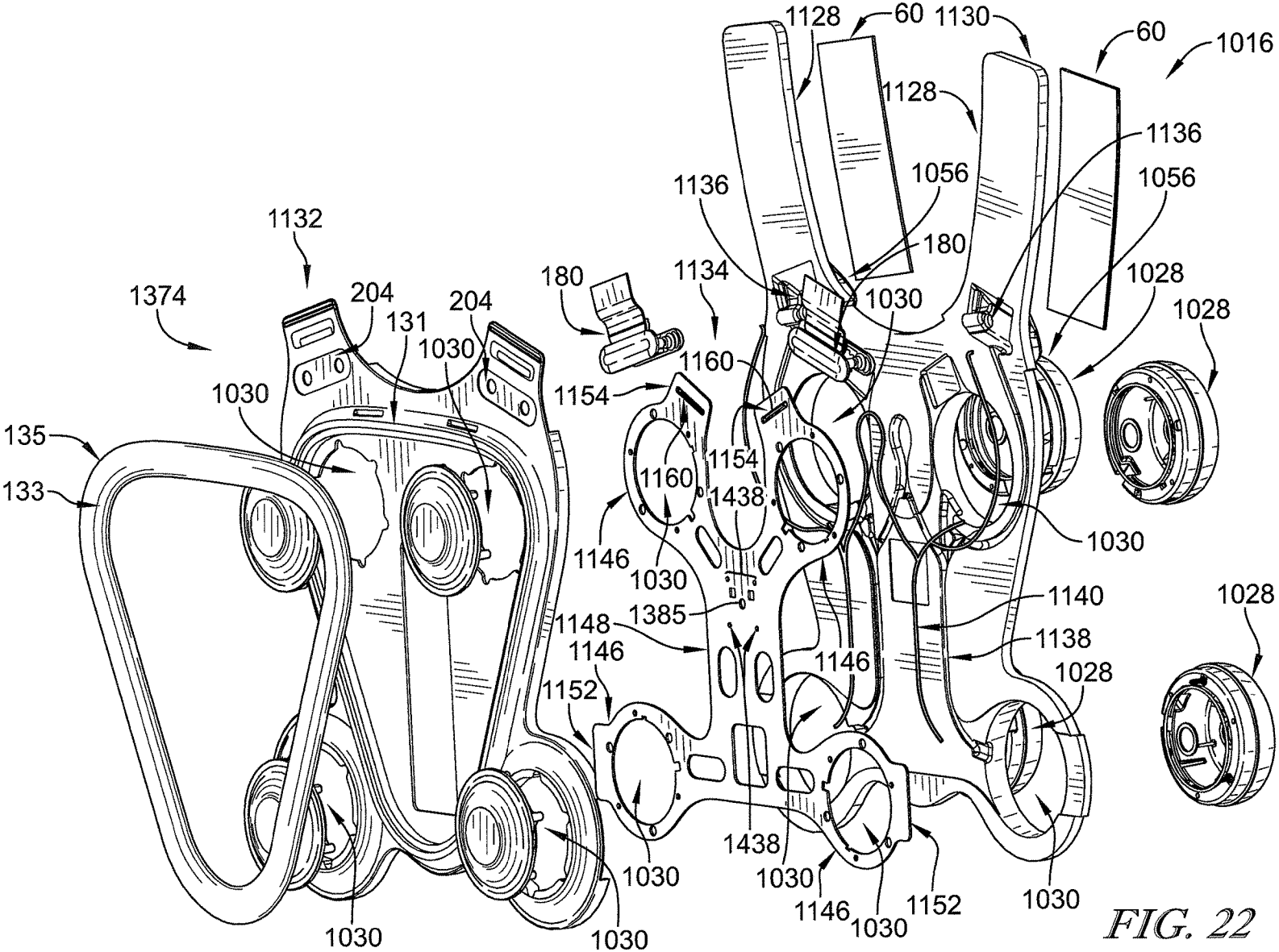
FIG. 22 is an exploded perspective view of the back panel of the percussion therapy apparatus of FIG. 16 showing that the back panel includes an inner pane, an outer pane, and a frame pane arranged between the inner and outer panes.

As shown in the illustrative embodiment of FIG. 22, the back panel includes an inner pane 1130, an outer pane 1132, and a frame pane 1134 arranged between the inner and outer panes 1130, 1132. Each of the panes 1130, 1132, 1134 illustratively include openings 1030 defined therein to receive the percussive devices 1018. The inner pane 1130 illustratively includes spaces 1136 for receiving couplers 180 of the shoulder straps 1022, and grooves 1138 extending between the spaces 1136 and the openings 1030 thereof for receiving cabling 1140 between the inner pane 1130 and the frame pane 1134.

As shown in FIG. 22, the frame pane 1134 provides a sub-structure for the back panel 1016. The frame pane 1134 is illustratively connected with each of the handle 142, the side strap assemblies 24, and the control pack 1378. The frame pane 1134 is illustratively embodied as a sheet of material including rings 1146 that define the openings 30 and a stem 1148 extending between the rings 1146. The frame pane 1134 illustratively includes a side tab 1152 extending from each (lower) ring 1146 for connection with the respective side strap assembly 1024 and a handle tab 1154 attached to each (upper) ring 1146 for connection with the handle 142.

The handle tabs 1154 each illustratively includes a slot 1160 extending therethrough to receive the handle 142. The plates 158 of the handle 142 are each passed through a respective slot 1160 and pivoted on the strap body 156 to prevent removal from the slots 1160. The strap body 156 is thus coupled to the frame pane 1134 through the slots 1160 of the handle tabs 1154 which can only pass through the slots 1160 in certain (flat) orientation. Upon supporting the apparatus 1010 using the handle 142, the loading is generally directed to the frame pane 1134.

As shown in FIG. 22, the side tabs 1152 extend from their respective rings 1146 in opposite directions for connection with the respective side strap assemblies 1024. The side strap assemblies 1024 are illustratively embodied to be similar to the side strap assemblies 24 discussed above and include all the features of side strap assemblies 24 unless contradicting the specific disclosure of side strap assemblies 1024. The end 164 of each respective main strap 161 of the side strap assembly 1024 is illustratively attached to the respective side tab 1152. The main straps 161 extend from the frame pane 1134 between the inner and outer panes 1130, 1132 to couple with the chest panel 1014 through the D-rings 155 and cam buckles 151 as described above.

As shown in FIG. 22, the inner pane 1130 of the back panel 1016 illustratively includes shoulder portions 1128 extending from a top end 1056 thereof. The shoulder portions 1128 each illustratively include an attachment device 60 (embodied as another portion of hook and unbreakable loop fasteners complimentary to that of the shoulder portions 1058 of the chest panel 1014) attached to a rear side 62 thereof for connection with the chest panel 1014. In the illustrative embodiment, on the exterior side 1126, the back panel 1016 includes depressions 204 for connection of the shoulder straps 22 and a receiver 1129 disposed for receiving a control pack for control and power of the percussive devices 18.

As shown in FIG. 16, each shoulder portion 1128 overlaps with the respective shoulder portion 1058 to releasably fasten their attachment devices 60 together, illustratively as hook and unbreakable loop joining. In some embodiments, the attachment devices 60 may include any suitable fastening system.

In the illustrative embodiment as shown in FIG. 16, the shoulder straps 1022 are attached with each of the chest and back panels 1014, 1016 with the shoulder portions 1058, 1128 arranged underneath for padding. As mentioned above regarding FIGS. 10-12, the shoulder straps 22 extend between opposite ends 182, 184 thereof and define a cavity 186 therethrough for receiving cabling 188 for communication between the chest and back panels 14, 16. Each shoulder strap 1022 illustratively includes a strap body 178 and couplers 180 disposed at each opposite end 182, 184 for attachment to the chest and back panels 1014, 1016. Each strap body 178 illustratively includes an upper sheet 190 and a lower sheet 192 attached together along seams 194 near their outer edges to create a portion of the cavity 186. The shoulder straps 1022 are illustratively formed of fabric and the couplers 180 are illustratively formed of plastic, but in some embodiments each may comprise any suitable materials. As mentioned above regarding FIG. 11, the cabling 188 illustratively extends through the cavity 186 in a serpentine arrangement to relief stress on the cabling 188 upon movement of the shoulder straps 1022.

Returning to FIG. 22, the outer pane 1132 illustratively includes the receiver 1374. The receiver 1374 is illustratively similar to the receiver 129 and includes the ridge 131 extending outward and the rim 133 attached to the ridge 131 to provide the ledge 135 that faces radially outward to engage the outer cover 1372. The outer cover 1372 can illustratively extend over and cinch around the ledge 135 to releasably affix to the back panel 1016.

Figure 23:
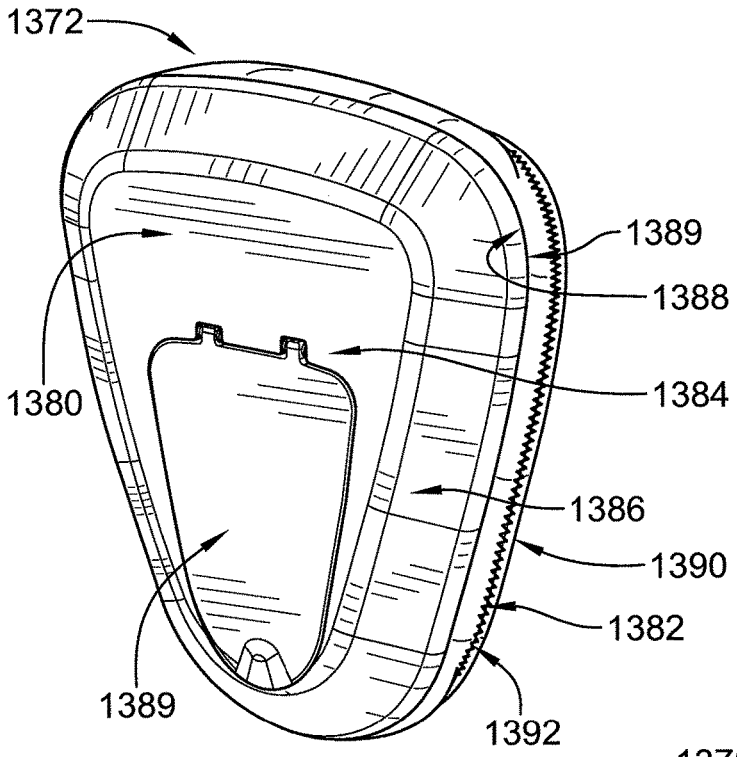
FIG. 23 is a perspective view of the outer cover of the percussion therapy apparatus of FIG. 16 showing that the outer cover includes the skirt for connection with the back panel.

In the illustrative embodiment as shown in FIG. 23, the outer cover 1372 of the pack housing 1370 is shown in isolation from the receiver 1374. The outer cover 1372 illustratively forms a generally triangular-shaped outline and includes a body 1380 and a skirt 1382 attached to the body 1380 to secure the outer cover 1372 to the receiver 1374. The body 1380 is illustratively formed as a shallow foam dish having a central section 1384 extending generally flat (at least with little or limited curvature) in a plane and a transition section 1386 attached to and circumferentially surrounding the central section 1384 and curving away from the plane of the central section 1384 in a direction towards the receiver 1374 to form an outer edge 1388 of the body 1380. The central section 1384 illustratively includes an access door 1389 pivotably attached thereto for providing access to a power source 1402 discussed below.

As shown in FIG. 23, the skirt 1382 is illustratively attached to the outer edge 1388 of the body 1380. In the illustrative embodiment, the skirt 1382 is illustratively attached to the outer edge 1388 about its entire length around the outer cover 1372 to form an annular shape having an axial edge 1389 attached to the outer edge 1388. The skirt 1382 is illustratively formed of a resilient fabric, for example, elastane, but in some embodiments may include any suitable material. The other axial edge 1390 of the skirt 1382 illustratively includes a stretch band 1392 attached thereto to elastically cinch the axial edge 1390 to a reduced radial size for attachment over the ledge 135 of the rim 133 of the receiver 1374. In the illustrative embodiment, the stretch band 1392 extends along the entire axial edge 1390 of the skirt 1382, but in some embodiments, may extend along any suitable portion of the skirt to attach the outer cover 1372 to the receiver 1374. In some embodiments, the skirt 1382 may cover the body 1380 including the central section 1384 while extending from the outer edge 1388 to its axial edge 1390. The generally sturdy but flexible construction of the outer cover 1372 and its elastic connection to the receiver 1374 provides the pack housing 1370 without overly restricting movement of the patient wearing the covering 1012. In some embodiments, the skirt 1382 may be formed with resilient rigidity to form a snapfit with the receiver 1374.

Figure 24:
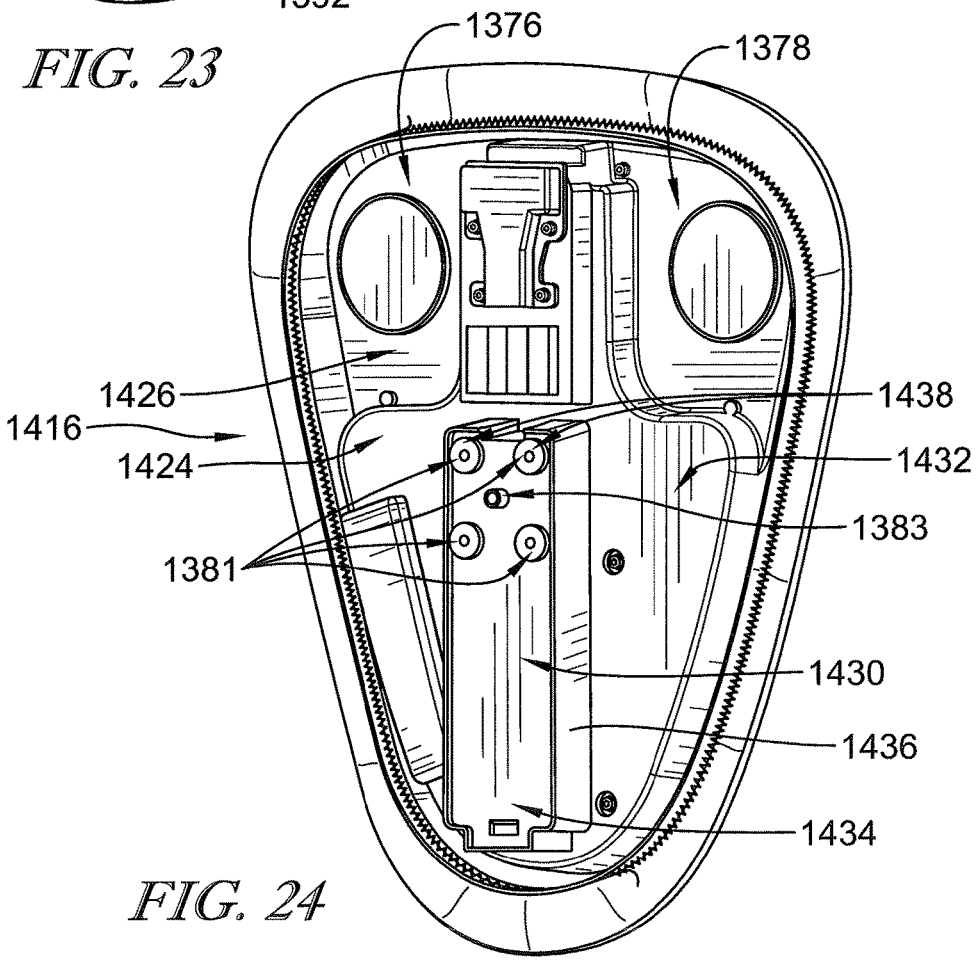
FIG. 24 is a perspective view of the outer cover of FIG. 23 from an opposite direction showing that the control pack is surrounded by the outer cover and includes a pack casing.

As shown in FIG. 24, the outer cover 1372 illustratively defines a portion of the control cavity 1376 therein. The control pack 1378 is received at least partly within the portion of the control cavity 1376 defined by the outer cover 1372 with attachment points 1381, 1383 exposed for connection with the frame pane 1134 of the back panel 1016.

Figure 25:
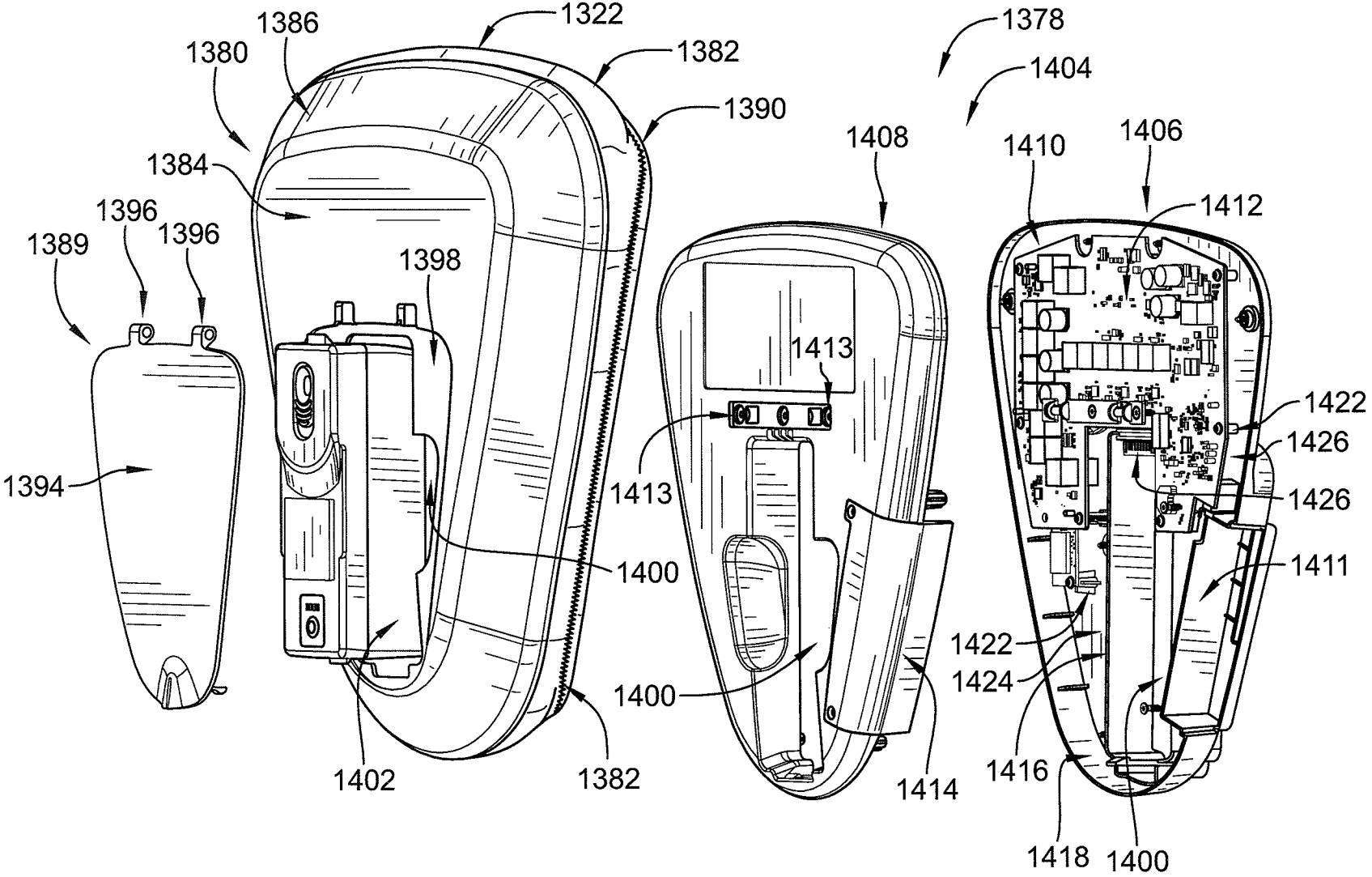
FIG. 25 is an exploded perspective view of the outer cover and control pack of FIGS. 23 and 24 showing that the pack casing includes inner and outer portions that together define an interior cavity for housing the control system of the percussion therapy apparatus.

As shown in FIG. 25, the access door 1389 illustratively includes a triangular battery panel 1394 having two pivot arms 1396 extending from a top edge thereof for pivotably connection with the control pack 1378. The outer cover 1372 illustratively includes a space 1398 shaped complimentary to the access door 1389 to provide a continuous outer surface when the access door 1389 is closed. A portion of a battery cavity 1400 extends through the outer cover 1372 and the space 1398 to permit a power source, illustratively a battery 1402, to be inserted into the control pack 1378.

As shown in FIG. 25 the control pack 1378 illustratively forms a power and control processing unit for operation of the percussion therapy apparatus 1010. The control pack 1378 illustratively includes a control casing 1404 having inner and outer sections 1406, 1408 attached to each other and collectively defining an interior space 1410 and a communications receptacle 1411. The control pack 1378 illustratively includes power and control circuitry 1412 arranged within the interior space 1410 for operation of the percussive devices 1018.

As shown in FIG. 25, the outer section 1408 of the control casing 1404 illustratively includes tabs 1413 for pivotable connection of the battery panel 1394 and a communications panel 1414 pivotably attached thereto for providing access to the communications receptacle 1411. The communications receptacle 1411 is adapted to house communications circuitry embodied as Bluetooth® circuitry arranged in communication with the circuitry 1412 to provide communication with other devices. The communications circuitry is illustratively adapted to provide communication between the power and control circuitry 1412 and other devices such as personal mobile devices (e.g., mobile phones, PDAs, tablet computers, etc.) and care facility devices (such as dedicated terminals, caretaker-assigned mobile devices, workflow systems, etc.). In some embodiments, the communications circuitry may include any number and/or type of wireless communications circuitry, for example, Zigbee®, Wi-Fi®, WiMAX, 3G and/or 4G technology, radio frequency (RF), infrared (IR), sonar, including different versions thereof (e.g., classic Bluetooth® and Bluetooth 4.0/low energy). and/or wired communications circuitry, for example, parallel ports for any of standard 37 pin connections used by Hill-Rom Services, Inc., serial ports, coaxials, universal serial bus (USB), SPI, I2C, UART, fiber optics, ethernet, other general pin input/output (GPIO), other analogue and/or digital ports, etc. In some embodiments, the communications circuitry may comprise a portion of the power and control circuitry 1412. The communications panel 1414 provides access to the communications circuitry and the power and control circuitry 1412 without requiring disassembly of the control pack 1378 to permit maintenance such as configuration, debugging, diagnosing, monitoring, customizing, and/or updating of control operations. The outer section 1408 illustratively includes a portion of the battery cavity 1400 defined there through for receiving the power source 1402.

As shown in FIG. 25, the inner section 1406 of the control casing 1404 illustratively includes a base wall 1416 and a side wall 1418 extending from the outer edge of the base wall 1416 and generally perpendicular to the base wall 1416 to define a portion of the interior space 1410. The base wall 1416 illustratively includes circuitry mounts 1422 extending from the base wall 1416 into the interior space 1410 for attachment of the power and control circuitry 1412 within the interior space 1410.

The base wall 1416 illustratively includes tiered sections 1424, 1426, the tiered section 1426 being arranged closer to the outer section 1408 of the control casing 1404 than the tiered section 1426 as shown in FIGS. 24 and 25. The tiered section 1424 illustratively defines a portion of the battery cavity 1400 therethrough and includes a power connector 1428 for electrically connecting the battery with the power and control circuitry 1412 when the power source 1402 is received within the battery cavity 1400.

Returning to FIG. 24, the tiered section 1424 illustratively includes a section wall 1432 and a battery receptacle 1430 that defines the portion of the battery cavity 1400 provided by the base wall 1416. The battery receptacle 1430 illustratively includes a rear wall 1434 and side walls 1436 extending between the rear wall 1434 and the section wall 1432. In the illustrative embodiment shown in FIG. 24, the attachment points 1381, 1383 are illustratively attached to the rear wall 1434 of the base wall 1416 to connect with the frame pane 1134 of the back panel 1016.

In the illustrative embodiment, the attachment points 1381 and the frame pane 1134 each include fasteners holes 1438 for receiving fasteners to connect the control pack 1378 with the frame pane 1134. Each fastener hole 1438 of the frame pane 1134 is illustratively aligned with a corresponding fastener hole 1438 the attachment points 1381. The corresponding fasteners holes 1438 are illustratively arranged in a square pattern, but in some embodiments may be arranged in any suitable pattern. The attachment point 1383 is illustratively embodied as a cylinder extending axially from the base wall 1416 thorough an attachment hole 1385 defined through the frame pane 1134 (as best shown in FIG. 22) to be complimentary with the attachment point 1383.

As best shown in FIGS. 21A, 22, and 24, the attachment points 1381, 1383 and the fastener holes 1438 are illustratively centrally positioned with respect to the back panel 1016. The attachment points 1381, 1383 and the fastener holes 1438 illustratively form the only fixed connection of between the control pack 1378 and the back panel 1016. The control pack 1378 is illustratively rigid in comparison to the more forgiving compression foam of the chest and back panels 1014, 1016, the localized and centralized attachment between the control pack 1378 and the back panel 1016 provides ease of movement to the patient wearing the covering 1012 by permitting chest and back panels 1014, 1016 to flex while the control pack 1378 remains rigid to protect the circuitry within. The control pack 1378 can incur limited movement within the control cavity 1376 of the pack housing 1370 resultant from flexing of the panels 1014, 1016.

In the illustrative embodiment as shown in FIG. 25, the control pack 1378 is illustratively formed of a rigid plastic, generally with a triangular shape having rounded corners, generally complimentary to the shape of the pack housing 1370. In some embodiments, the control pack 1378 may include any suitable materials and have any suitable shape for forming a power and control processing unit.

Figure 26:
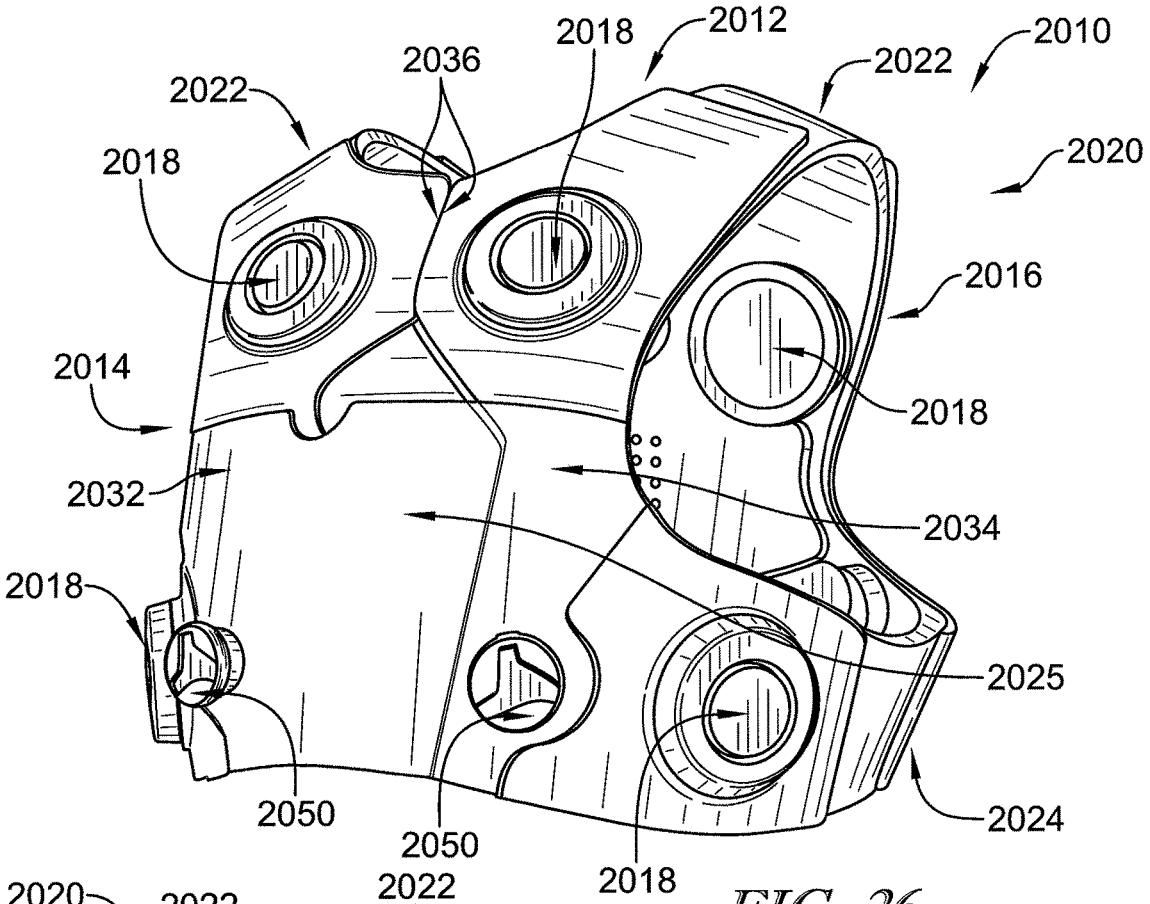
FIG. 26 is a perspective view of another percussion therapy apparatus showing that the percussion therapy apparatus includes chest and back panels each having percussive devices mounted thereto and showing that the front panel includes a control flap for covering a user interface.

As shown in FIG. 26, another illustrative percussion therapy apparatus 2010 illustratively includes a covering 2012 for securing to a patient's torso having percussive devices 2018 coupled to the covering 2012 to provide high frequency percussive force to the patient to assist in expectoration. The percussion therapy apparatus 2010 illustratively includes a chest panel 2014 and a back panel 2016 each defining openings 2030 therethrough for receiving the percussive devices 2018 for attachment. The percussion therapy apparatus 2010 illustratively includes an attachment assembly 2020 including should straps 2022 and side strap assemblies 2024 to secure the covering 2012 to the patient's torso.

Figure 27:
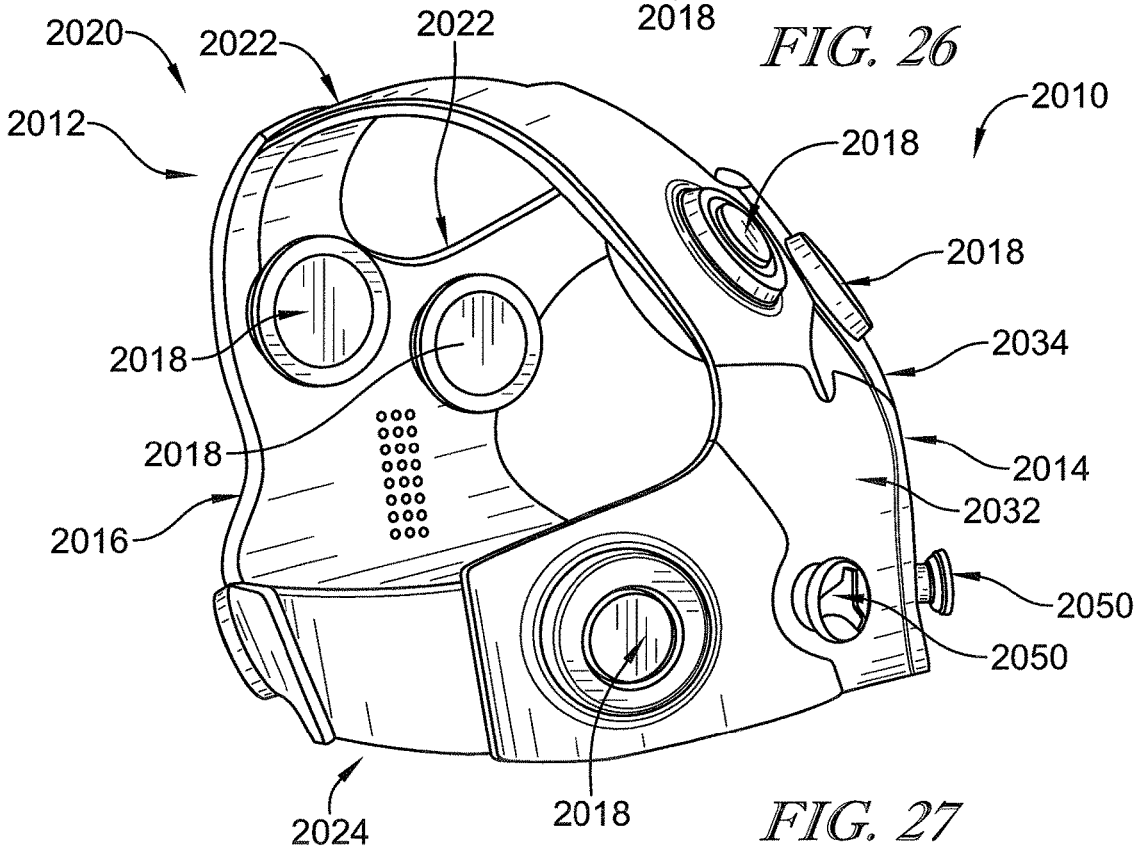
FIG. 27 is another perspective view of the percussion therapy apparatus of FIG. 26 showing that the percussion therapy apparatus includes an attachment system for securing the apparatus to a patient torso.

As shown in FIG. 26, the chest panel 2014 illustratively includes a right section 2032 and a left section 2034 (according to patient's right and left) each joined at a medial edge 2036 thereof. As shown in FIG. 27, the right and left sections 2032, 2034 each illustratively include an adjustment knob 2050 of the respective side strap assembly 2024 for adjusting the effective length of the side strap assemblies 2024. The right and left sections 2032, 2034 each illustratively receive two percussive devices 2018 therethrough for engagement with the patient's torso to provide percussive force. As shown in FIG. 26, the covering 2012 illustratively forms a generally continuous surface across the chest panel 2014.

Figure 28:
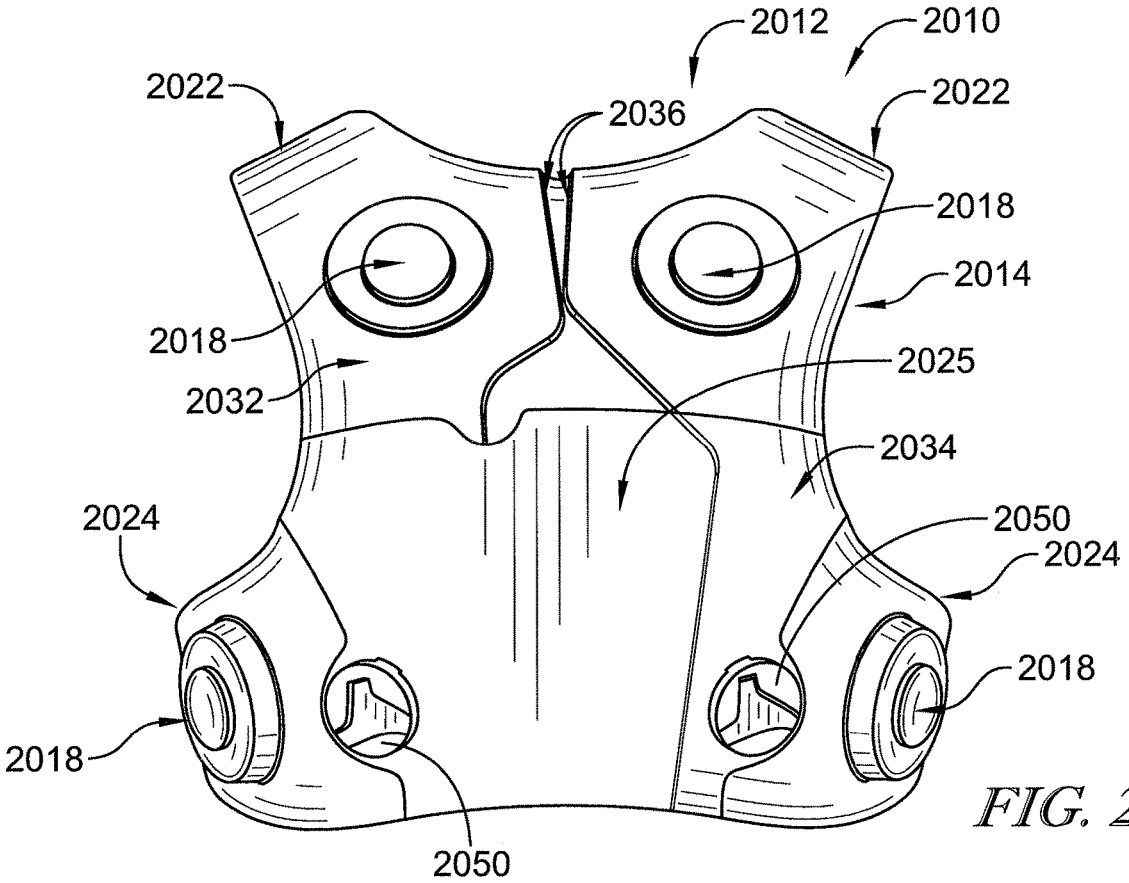
FIG. 28 is a front elevation view of the percussion therapy apparatus of FIGS. 26 and 27 showing that the control flap extends across a center of the front panel.
Figure 29:
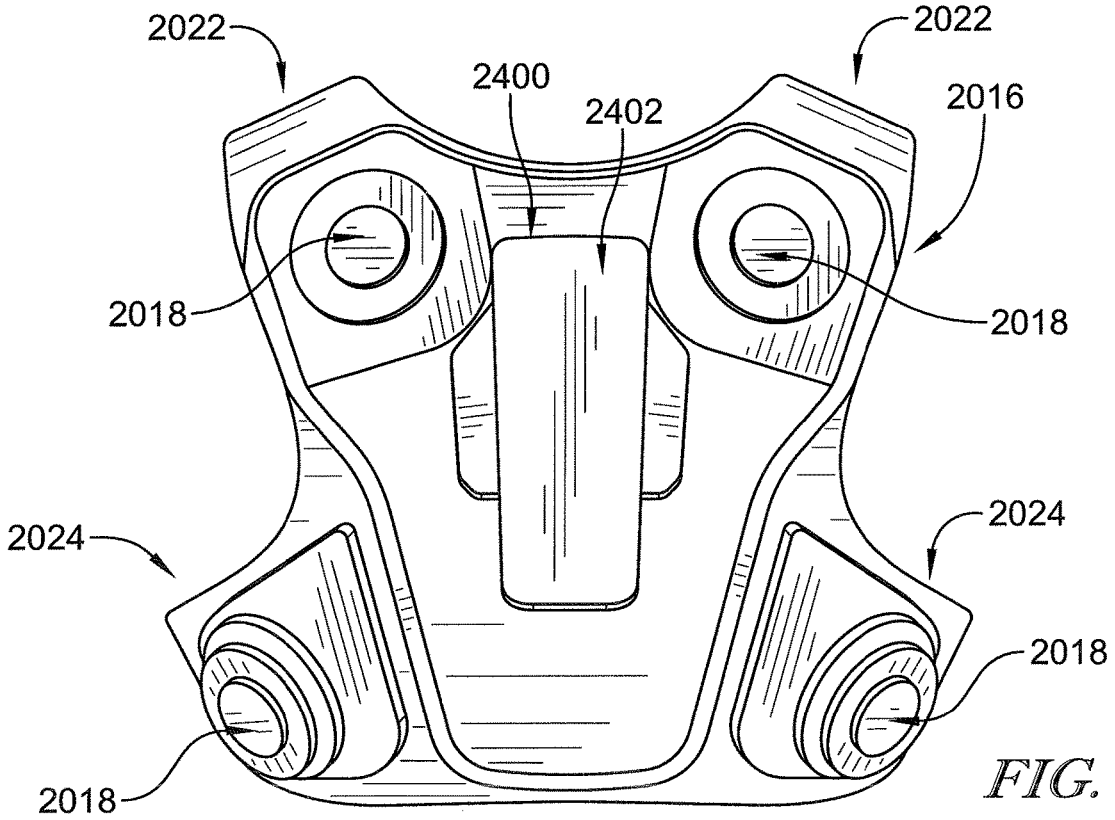
FIG. 29 is a rear elevation view of the percussion therapy apparatus of FIGS. 26-28 showing that the apparatus includes a battery pack coupled within the back panel to provide power to the percussive devices.

As shown in FIG. 28, the chest panel 2014 illustratively includes an access panel 2025 attached to the right section 2032 and selectively attachable to the left section 2034 to enclose a user interface 38 as discussed in detail below. As shown in FIG. 29, the back panel 2016 illustratively includes a power source 2042, illustratively embodied as a battery, received within a battery cavity 2400. The power source 2042 is illustratively connected to the power and control circuitry 1412 located within the covering 2012 to provide power and control to the percussive devices 2018.

Figure 30:
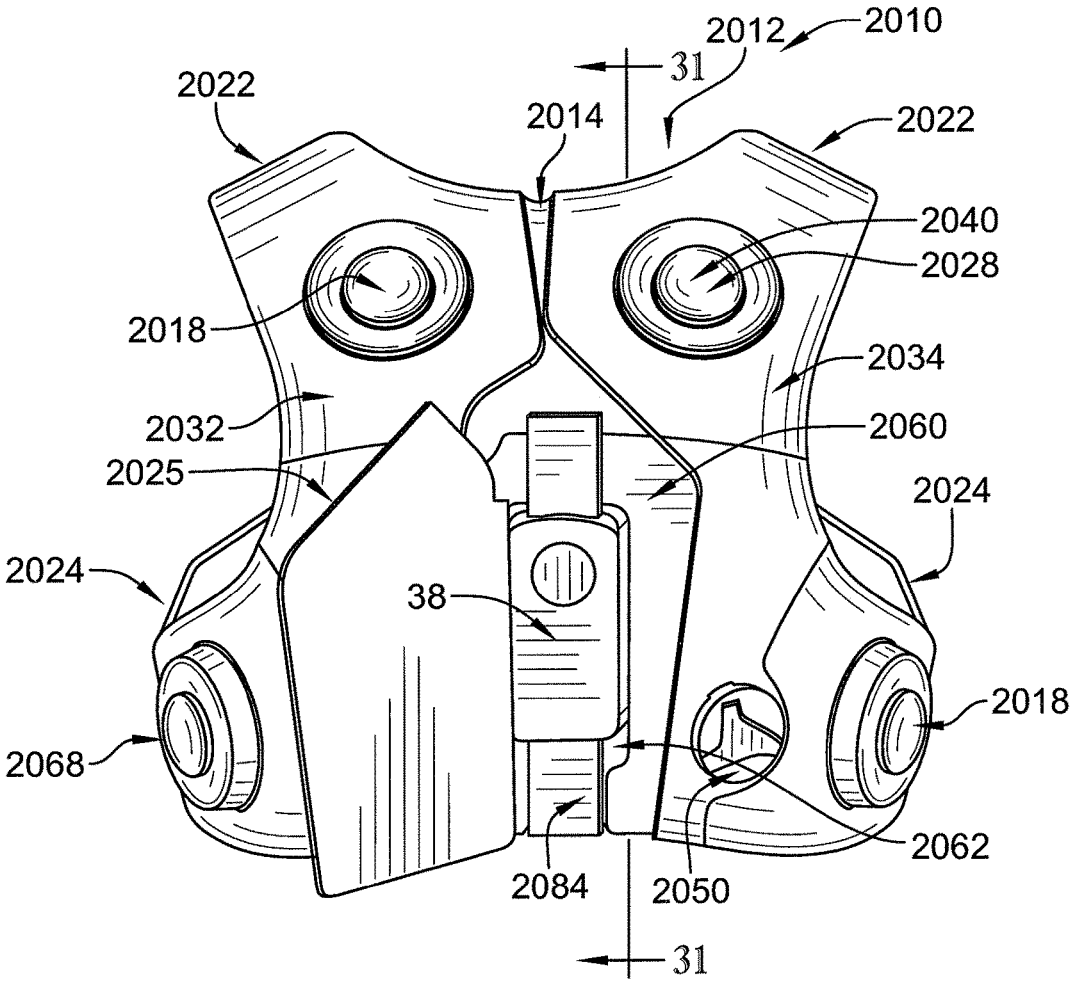
FIG. 30 is a front elevation view of the percussion therapy apparatus similar to FIG. 28 showing that the control flap has been peeled open to show the user interface coupled to the chest panel.

As shown in FIG. 30, the chest panel 2014 is shown with the access panel 2025 opened. The chest panel 2014 illustratively includes a break button 2040 positioned on the upper percussive device 2018 of the left section 2034. A user can depress the break button 2040 to pause operation of the percussive devices 2018, for example, but without limitation, to cough and/or expectorate. The break button 2040 is similar to the break button 40, but is ergonomically positioned on the percussive device 2018 for ease of access, reduction in spatial requirements and structural components.

As shown in FIG. 30, the chest panel 2014 illustratively includes a depression 2060 formed therein collectively by portions of the right and left sections 2032, 2034 at the medial interface. The depression 2060 illustratively includes an interface receptacle 2062 for receiving the user interface 38 for storage. The interface receptacle 2062 is illustratively formed complimentary to the user interface 38 and its cabling 2084 to permit a user to store the user interface 38 within the interface receptacle 2062.

Figure 31:
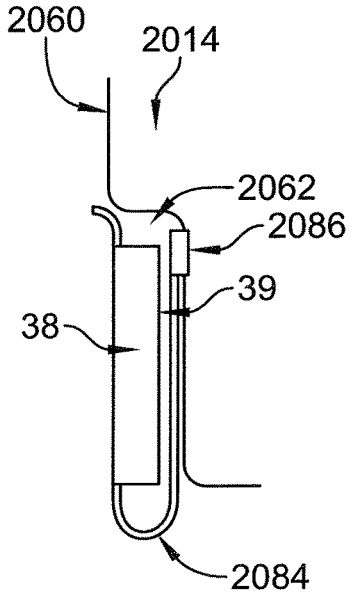
FIG. 31 is a side elevation view of a portion of the percussion therapy apparatus of FIG. 30 in cross-section taken along the line 31-31 showing that chest panel includes a depression for receiving the user interface such that a display face of the user interface faces the chest panel and showing that the chest panel includes a connector for connection of cabling between the chest panel and the user interface.
Figure 32:
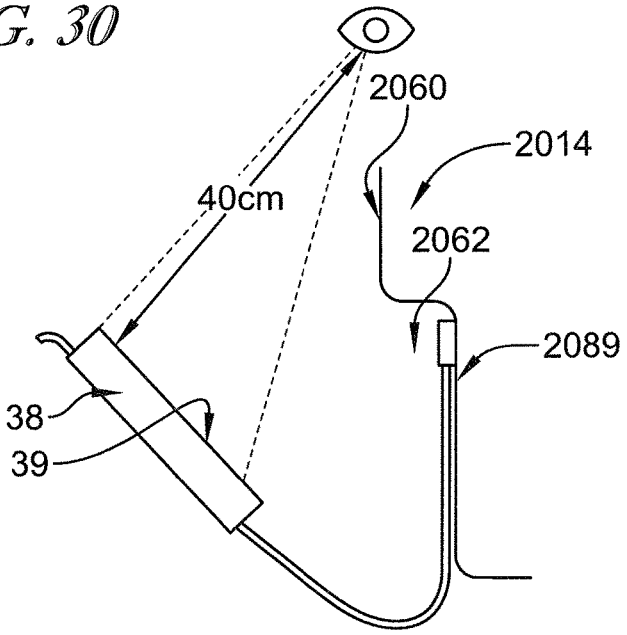
FIG. 32 is a side elevation view similar to FIG. 31 showing that the user interface has been removed from the depression for use and the cabling is arranged to permit the user interface to be oriented for viewing the display face by the patient wearing the percussion therapy apparatus.

As shown in FIGS. 31 and 32, the user interface 38 is positionable within the interface receptacle 2062 and illustratively includes the cabling 2084 extending from a bottom end thereof and extending to a connector 2086 positioned within the interface receptacle 2062. The connector 2086 is illustratively in communication with the power and control circuitry 2412 to provide power and communication therebetween.

As shown in FIG. 32, a display 39 of the user interface 38 is illustratively arranged to face the chest panel 2014. The cabling 2084 is illustratively arranged to permit the user interface 38 to be removed from the interface receptacle 2062 and operated by a user. In the illustrative embodiment, the user interface 38 is adapted to be operated by a patient wearing the covering 2012 and/or by another user. The cabling 2084 and display 39 are illustratively configured to allow a patient wearing the covering 2012 to bring the display 39 within viewing range (distance and angle) relative to the patient, for example, about 40 cm from the patient's eye and within an angle of about 0 to about 90 degrees from the horizontal relative to the patient's eye.

Figure 33:
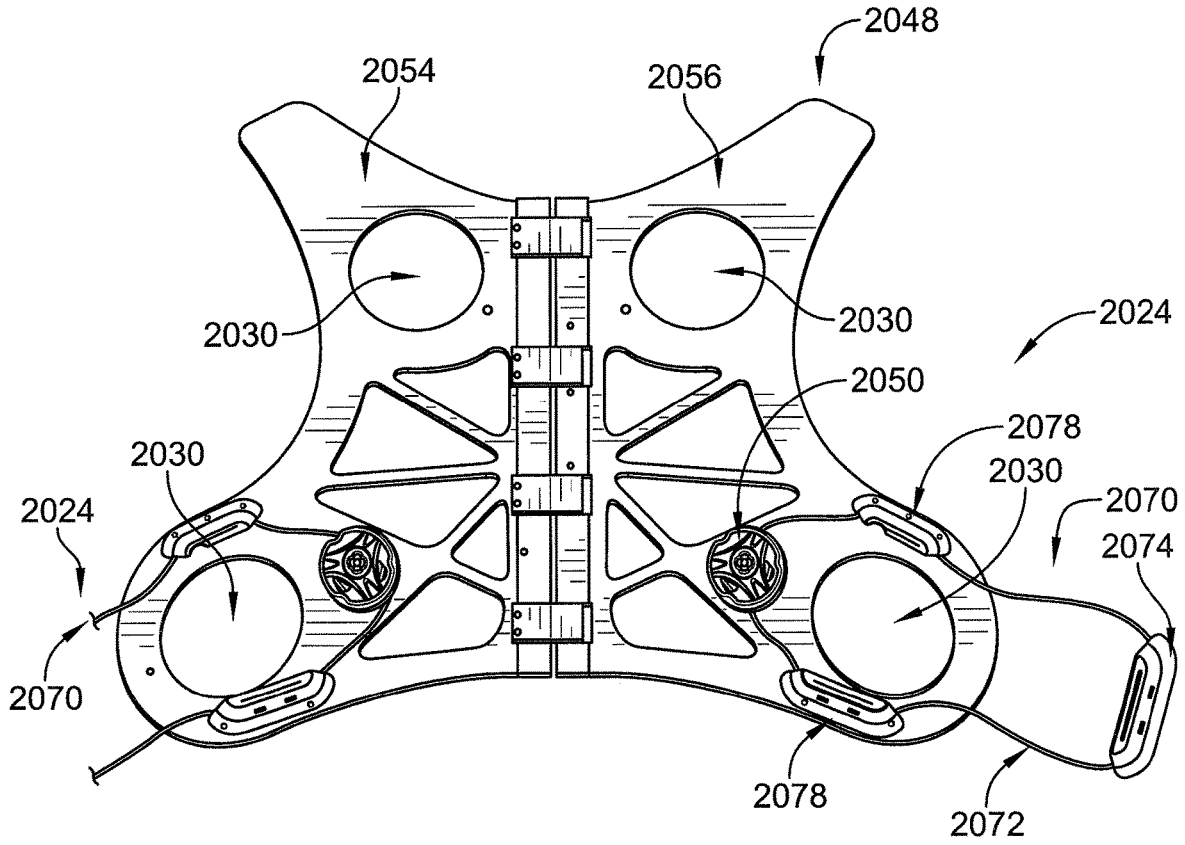
FIG. 33 is a front elevation view of a frame pane of the chest panel of the percussion therapy apparatus of FIGS. 26-30 showing that the frame pane includes a left section and a right section releasably coupled at a medial intersection therebetween and showing that the attachment assembly includes line assemblies disposed at lateral side thereof.

Referring now to FIG. 33, the chest and back panels 2014, 2016 illustratively include similar construction to those of panels 14, 16, 1014, 1016 including inner and outer panes, and a frame pane 2048 disposed between the respective inner and outer panes. As shown in FIG. 33, the frame pane 2048 of the chest panel 2014 illustratively includes right and left portions 2054, 2056 each defining openings 2030 for receiving the percussive devices 2018 therethrough. A retractable leash assembly 2070 of the side strap assemblies 2024 illustratively extends from each of the left and right portions 2054, 2056 for connection with the back panel 2016.

Figure 34:
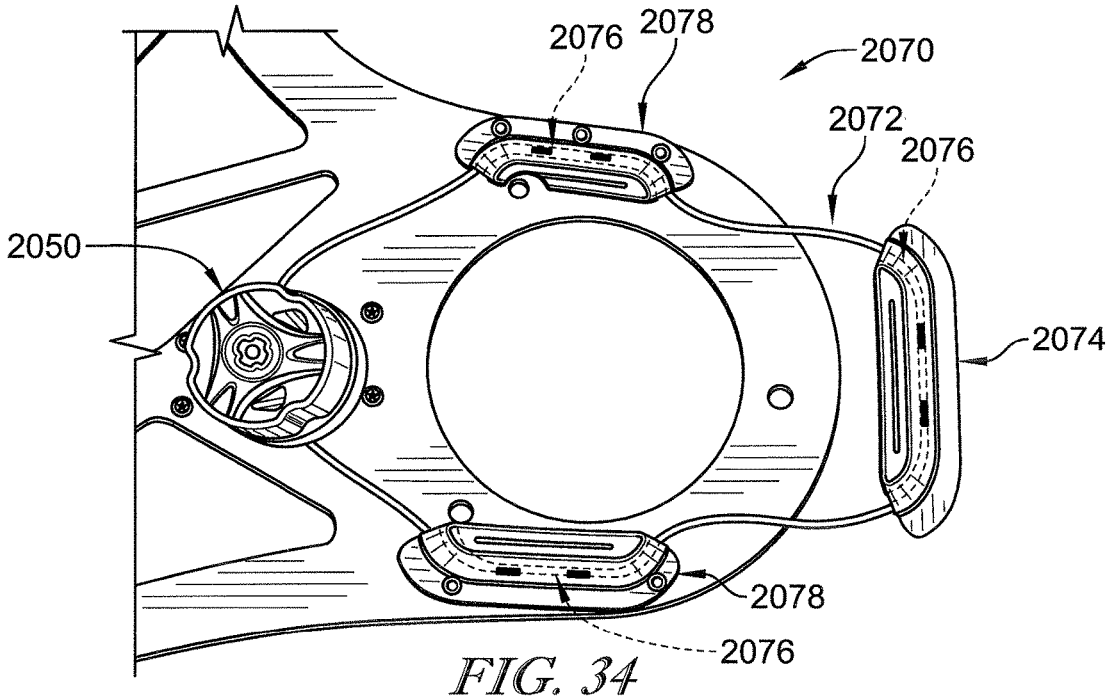
FIG. 34 is a closer front elevation view of a portion of the frame pane of FIG. 33 showing that each leash assembly includes a leash line coupled to a retraction reel on the chest panel for adjusting the length of the leash line and a leash end for attachment to the back panel and through which the leash line is slidingly threaded to allowing sliding length adjustment of the leash line.

As shown in FIG. 34, each retractable leash assembly 2070 illustratively includes the adjustable knob 2050 having a ratcheting device therein, a leash 2072 connected to the knob 2050 and arranged for slack adjustment thereby, and a mooring 2074 attached to the back panel 2016 and having a track 2076 defined therethrough for receiving the leash 2072 slidingly threaded through the mooring 2074 to couple the leash 2072 with the back panel 2016.

The knobs 2050 having their ratcheting devices are illustratively attached to their respective right and left portions 2054, 2056 (the knobs 2050 illustratively protrude through other panes of the chest panel 2014 as needed for access by users) as shown in FIG. 34. The leash 2072 illustratively connects to the knob 2050 at a first end, loops through the mooring 2074, and connects to the knob 2050 also at its opposite end to form a continuous loop. The leash assembly 2070 illustratively includes additional moorings 2078 attached to the chest panel 2014 and receiving the leash 2072 through respective track 2076 therein for guiding the leash 2072 between the chest and back panels 2016. In the illustrative embodiment, the ratcheting device of the knob 2050 is released by pulling outward on the knob 2050. Operation of the knob 2050 to retract or extend the length of the leash 2072 reduces or extends the allowable separation between the knob 2050 and the mooring 2074 enabling adjustment of the fit of the covering 2012 to the patient.

Figure 35:
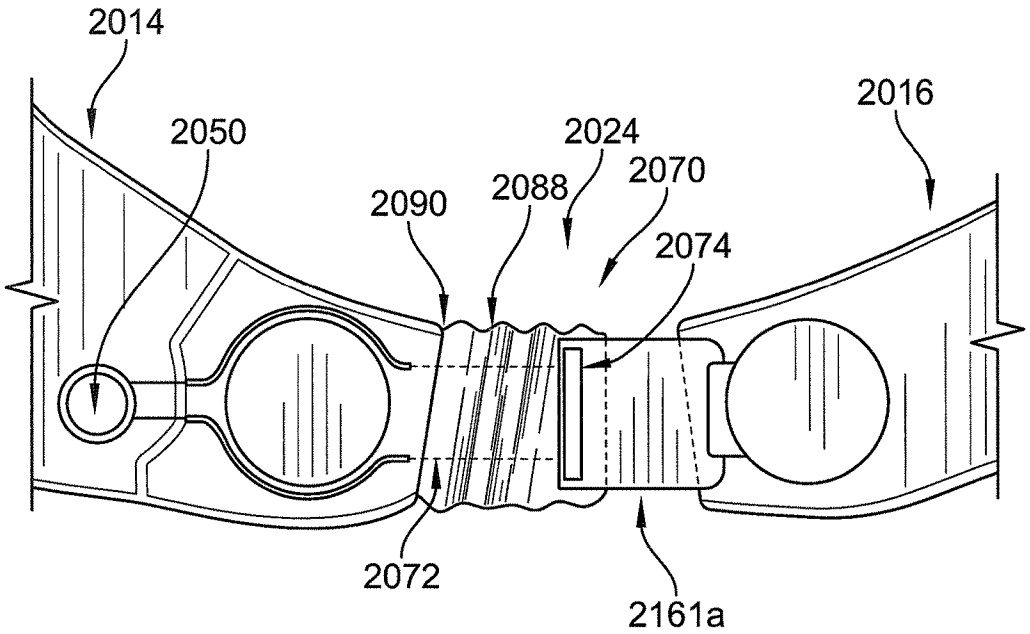
FIG. 35 is a side elevation view of a portion of the attachment assembly of the percussion therapy apparatus of FIGS. 26-30 showing that the leash line extends through a leash covering and the leash end is coupled to back panel by a side strap to allow adjustable securing of the percussion therapy device to the patient's torso by operating the retraction reel to adjust the length of the leash line.
Figure 36:
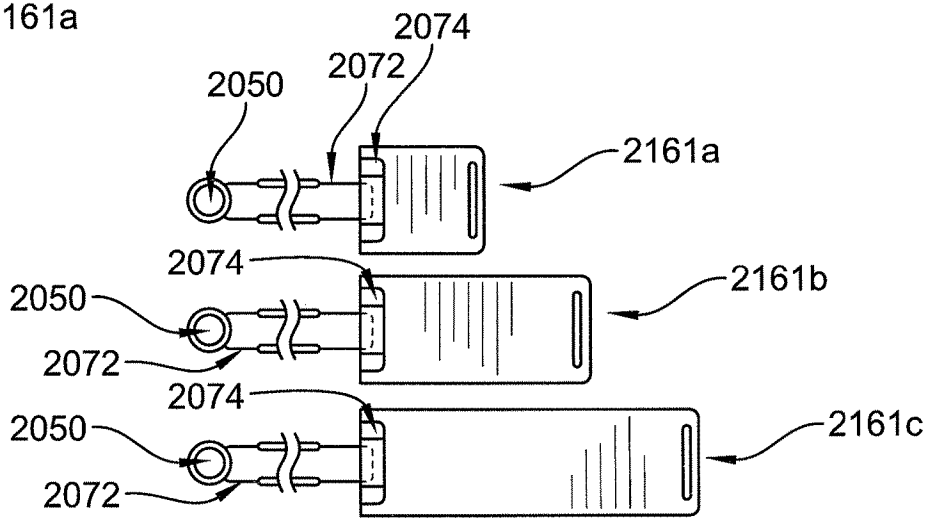
FIG. 36 is a side elevation view of a number of side straps having successively longer length for selective use in the attachment assembly to provide gross length adjustment of the attachment assembly at lateral sides of the percussion therapy apparatus.

As shown in FIGS. 35 and 36, the mooring 2074 is illustratively attached to the back panel 2016 with a main strap 2161*a*. The main straps 2161 illustratively extends between and connect at opposite ends with the mooring 2074 and the back panel 2016 to couple the chest and back panels 2014, 2016 together. The main straps 2161*a* are illustratively interchangeable with main straps 2161*b*, 2161*c* which have successively longer length as shown in FIG. 35B to accommodate differently sized patients. The moorings 2074 can be selectively attached to any of the main straps 2161*a*, 2161*b*, 2161*c* to accommodate interchange.

As shown in FIG. 35, the leash 2072 illustratively extends through a sock 2088 to shield the patient from contact with the leash 2072. The sock 2088 is illustratively connected to an end 2090 of the chest panel 2014 at one end and at an opposite end to the main strap 2161*a* near the mooring 2074. The sock 2088 illustratively defines an interior passage through which the leash 2072 is threaded.

Figure 37:
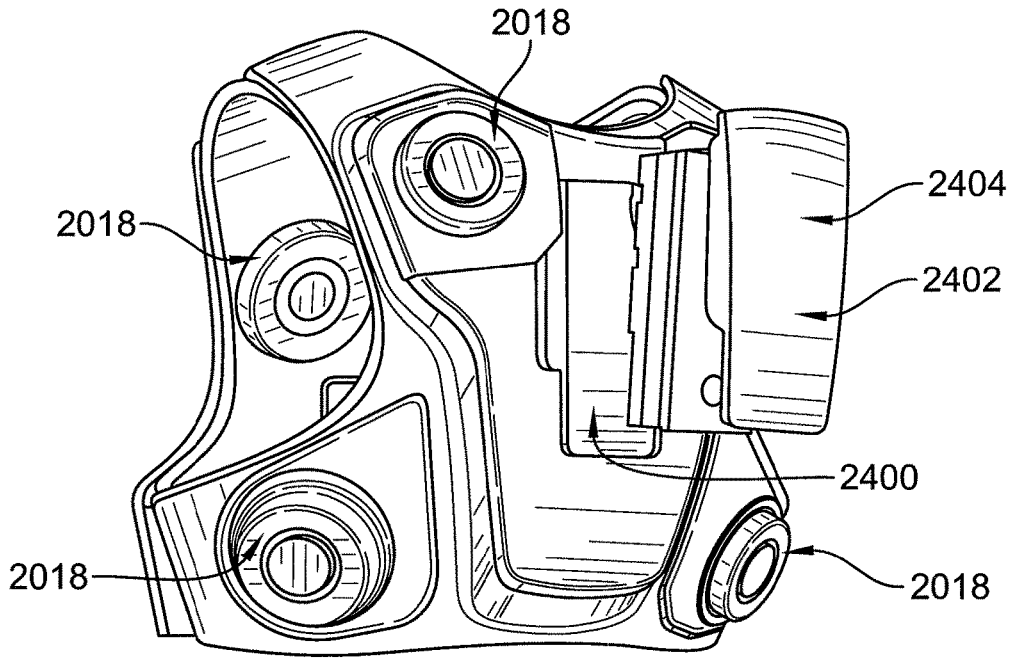
FIG. 37 is a rear perspective view of the percussion therapy apparatus of FIGS. 26-30 from the showing that a battery cover and the battery have been removed to show that the battery is received within a battery compartment defined within the back panel.

As mentioned above, FIG. 37 shows the battery cavity 2400 is illustratively defined in the back panel 2016. The battery cavity 2400 is illustrative arranged generally centrally within the back panel 2016 between the percussive devices 2018 mounted to the back panel 2016 and is formed complimentary to the power source 2402. The power source 2402 illustratively includes an outer face 2404 which remains exposed when the power source 2402 is received within the battery cavity 2400 (as shown in FIG. 29).

Figure 38:
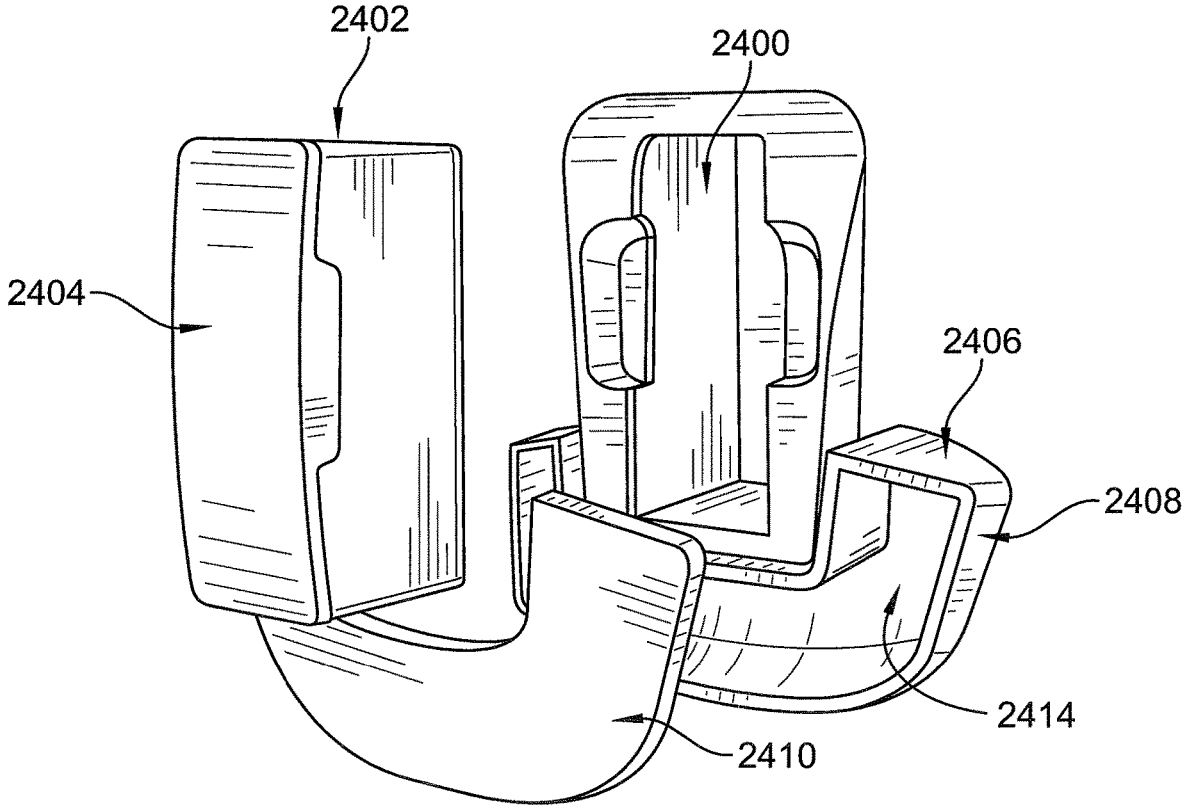
FIG. 38 is another perspective view of the battery compartment of FIG. 36 in relative isolation showing that the battery compartment includes a control compartment formed in the back panel with a U-shape for housing a controller of the percussion therapy apparatus.

As shown in FIG. 38, a storage housing 2406 is illustratively included in the back panel 2016. The storage housing 2406 illustratively comprises a receptacle 2408 and a cover 2410 that together forms a cavity 2414 for housing control and power circuitry for operation of the percussive therapy apparatus 2010. The storage housing 2406 is illustratively u-shaped and is arrange in close proximity to the battery cavity 2400 to provide ease of connection between the power source 2402 and the control and power circuitry.

Figure 39:
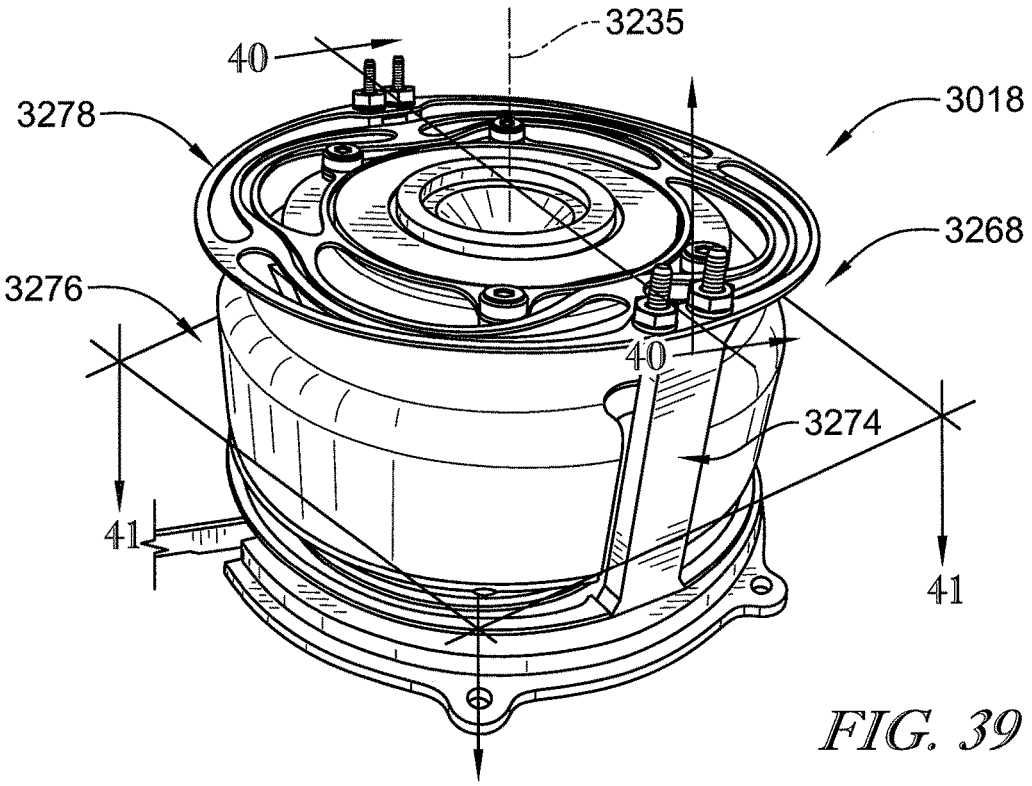
FIG. 39 is a perspective view of a percussive device adapted for use in the percussion therapy apparatuses of FIGS. 1-7, 16A and 16B, and 26-30 with a housing removed to show that the percussive device includes a percussion frame and a percussion assembly for providing percussive force.

In FIG. 39, another illustrative embodiment of a percussive device 3018 for use with the percussion therapy apparatuses 10, 1010, 2010 is shown with a portion of its housing 3228 removed. The percussive device 3018 illustratively includes a percussion assembly 3268 and an actuator 3272 (best shown in FIG. 39) arranged for selective actuation of the percussion assembly 3268. The percussion assembly 3268 along with the actuator 3272 is illustratively embodied as a voice coil, or voice coil linear motor.

Figure 40:
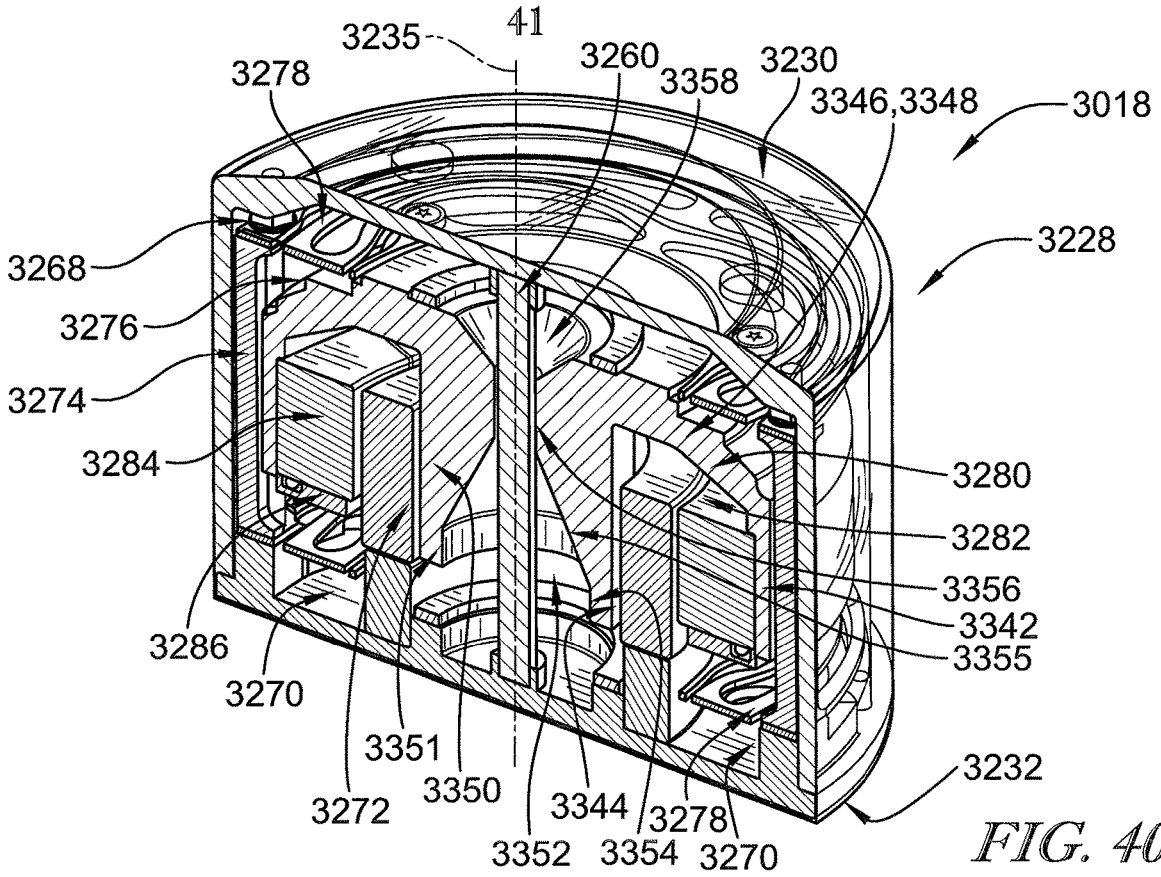
FIG. 40 is a perspective view of the percussive device of FIG. 39 in cross-section taken along the line 40-40 and showing the housing as transparent to illustrate that it defines an cavity for receiving the percussion assembly.

As best shown in FIG. 40, the percussion assembly 3268 illustratively includes a percussion frame 3274, a percussor 3276 arranged for controlled movement to produce percussive force, and resilient members 3278 for assisting movement of the percussor 3276. The actuator 3272 illustratively comprises an electromagnet selectively operable to drive movement of the percussor 3276. The percussion assembly 3268 selectively generates percussive force for application to the patient's torso through the housing 3228 (shown partially transparent in FIG. 40).

Figures 46A, 46B, 46C:
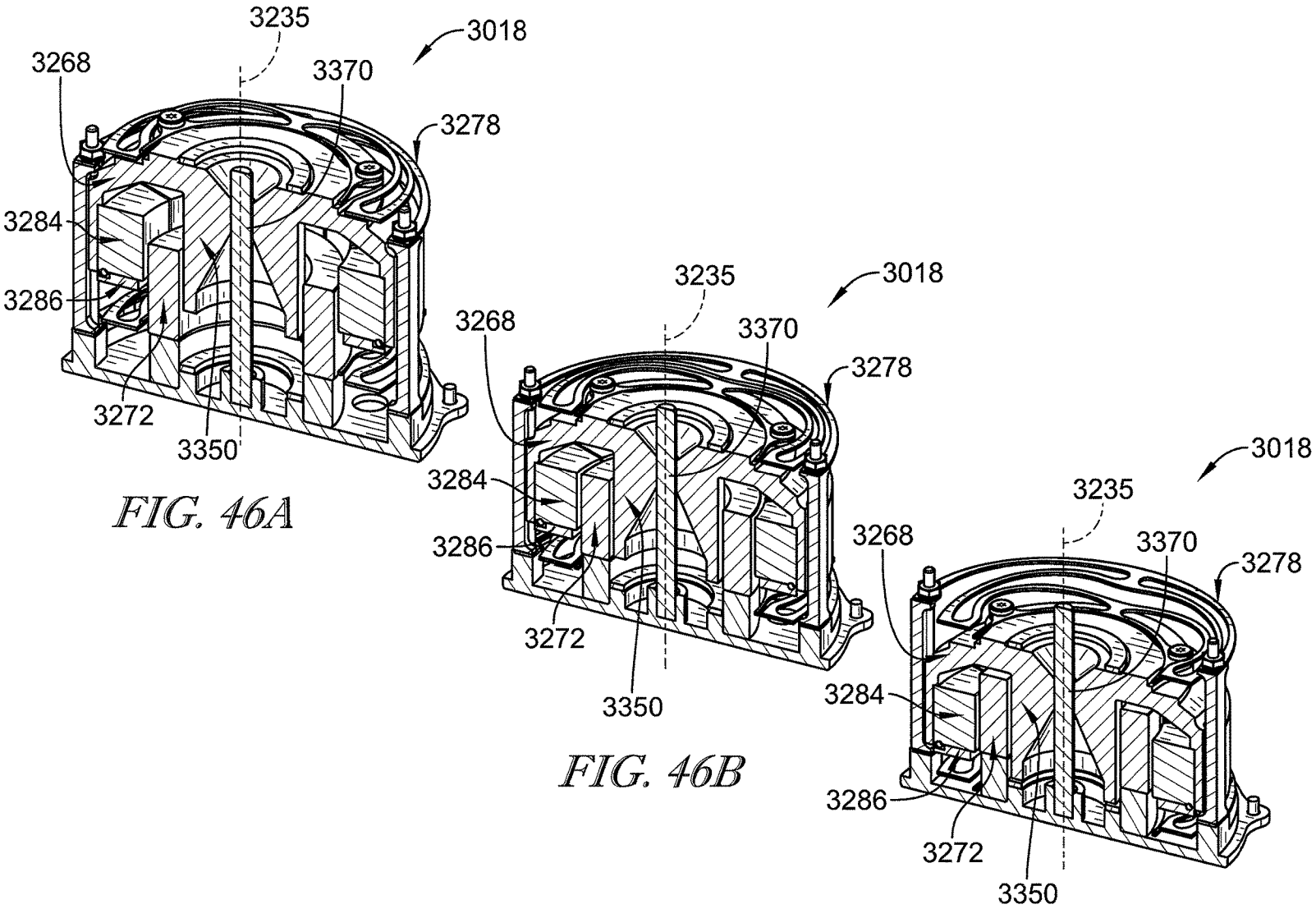
FIGS. 46A-46C are perspective views of the percussive device of FIGS. 39-42 in cross-section taken along the line 40-40 with the housing removed to show a variety of respective positions of the percussor in motion including a top end position, a central position, and a bottom end position.

In the illustrative embodiment as shown in FIG. 40, the percussor 3276 illustratively includes a percussor body 3280 defining an interior space 3282, a magnet 3284 arranged within the interior space 3282, and a percussor cap 3286 attached to the percussor body 3280 to secure the magnet 3284 within the interior space 3282. The actuator 3272 drives movement of the percussor 3276 along the axis 3235. The percussor 3276 moves along axis 3235 between end positions as shown in FIGS. 46A-46C. The movement of the percussor 3276 imposes percussive force that is transmitted through the percussion frame 3274 to the housing 3228 for application to the patient's torso.

Figure 43:
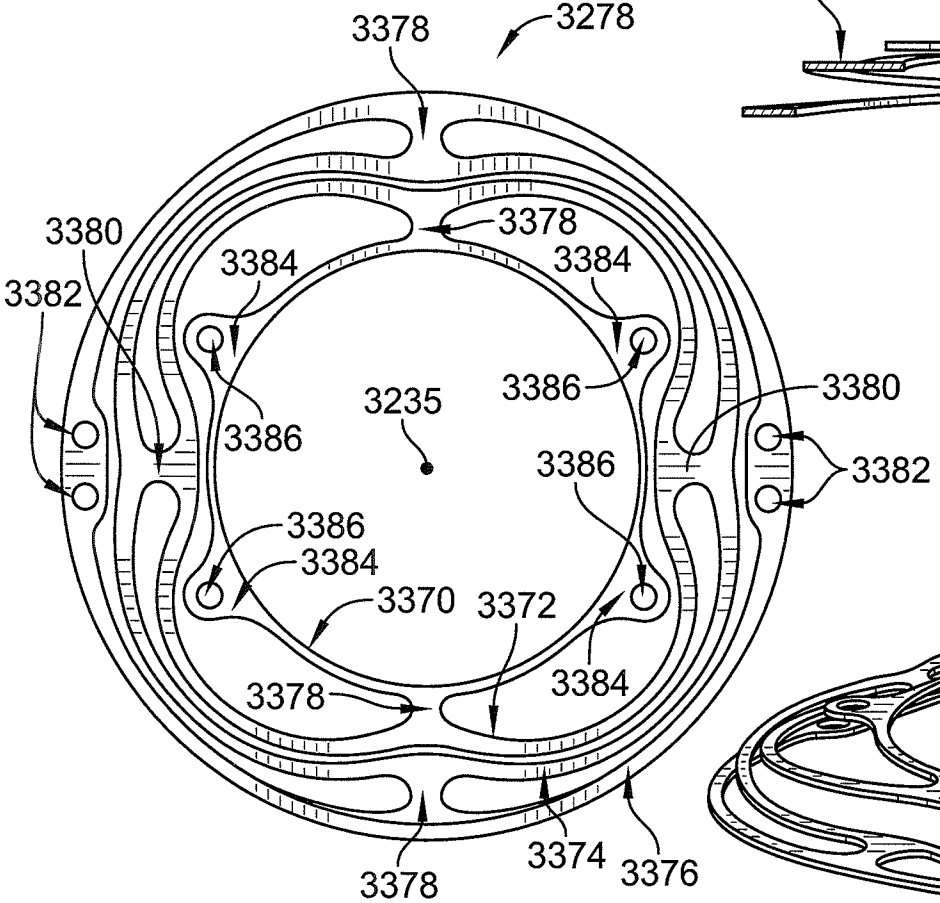
FIG. 43 is an overhead plan view one of the resilient members of the percussive device of FIGS. 39-42 showing that the resilient member includes a number of concentric hoops having increase diameters and showing that adjacent hoops are attached to each other at connection points that are angularly offset from the connection points of the next set of adjacent hoops in the radial direction.

As shown in the illustrative embodiment of FIG. 40, the percussor body 3280 is embodied to have a generally cylindrical shape formed about the axis 3235 including a basin 3230 and cap 3232 attached to the basin 3230 and collectively defining an cavity 3270 therein. The percussor body 3280 illustratively includes a circumferential wall 3342 that extends about the axis 3235 to define the interior space 3282 form an open end 3344 and a closed end 3346 that is at least partially closed by an end wall 3348 (as best shown in FIG. 43).

As best shown in FIG. 40, the percussor body 3280 illustratively includes a hub 3350 formed of a hub wall 3351 the extends from the end wall 3348 circumferentially about the axis 3235 within the interior space 3282. The hub 3350 and the end wall 3348 collectively define a hub passage 3352 that extends axially therethrough. The magnet 3284 is positioned with the interior space 3282 radially outside of the hub 3350.

The hub passage 3352 is illustratively defined to include a sections 3354, 3355, 3356, 3358 defined by the interior of the hub wall 3351 as shown in FIG. 40. The sections 3354, 3358 illustratively have tapered diameters. The section 3358 illustratively tapers inwardly from a larger diameter near an outer side of the end wall 3348 to connect with the section 3356 that illustratively has a constant diameter. The section 3356 illustratively connects with the section 3355 opposite the section 3358. The section 3355 illustratively tapers outwardly from the diameter of the section 3356 and connects with the section 3354 that illustratively has a constant diameter.

As shown in FIG. 40, the percussive device 3018 illustratively includes a central shaft 3360 that extends between and connects to each of the basin 3230 and cap 3232 of the housing 3228. The central shaft 3360 illustratively extends through the hub passage 3248 engaging with the section 3356 of the hub passage 3248 as a bearing to guide the movement of the percussor 3276.

Figure 41:
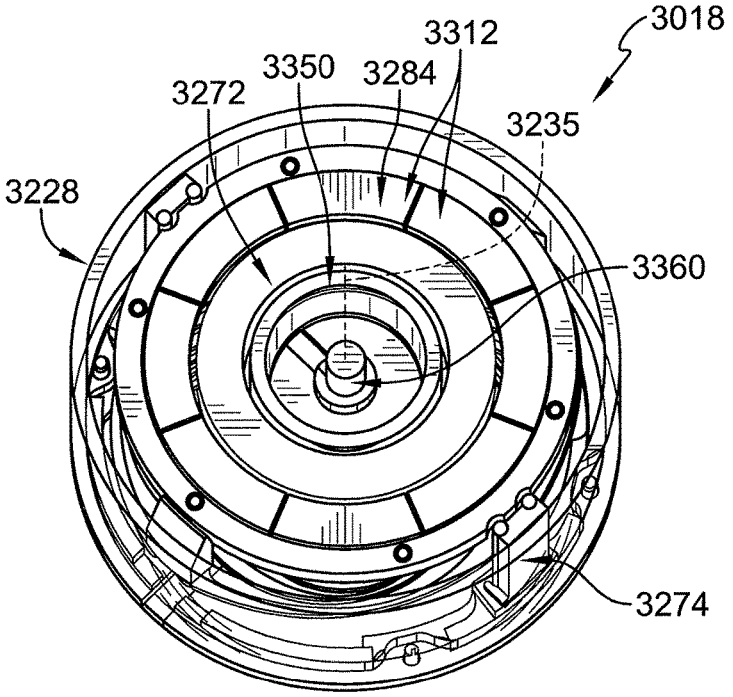
FIG. 41 is a perspective view of the percussive device of FIGS. 39 and 41 in cross-section taken along the plane 41-41 with the housing as transparent to show that the percussor includes a magnet including arc segments arranged about a central axis.
Figure 42:
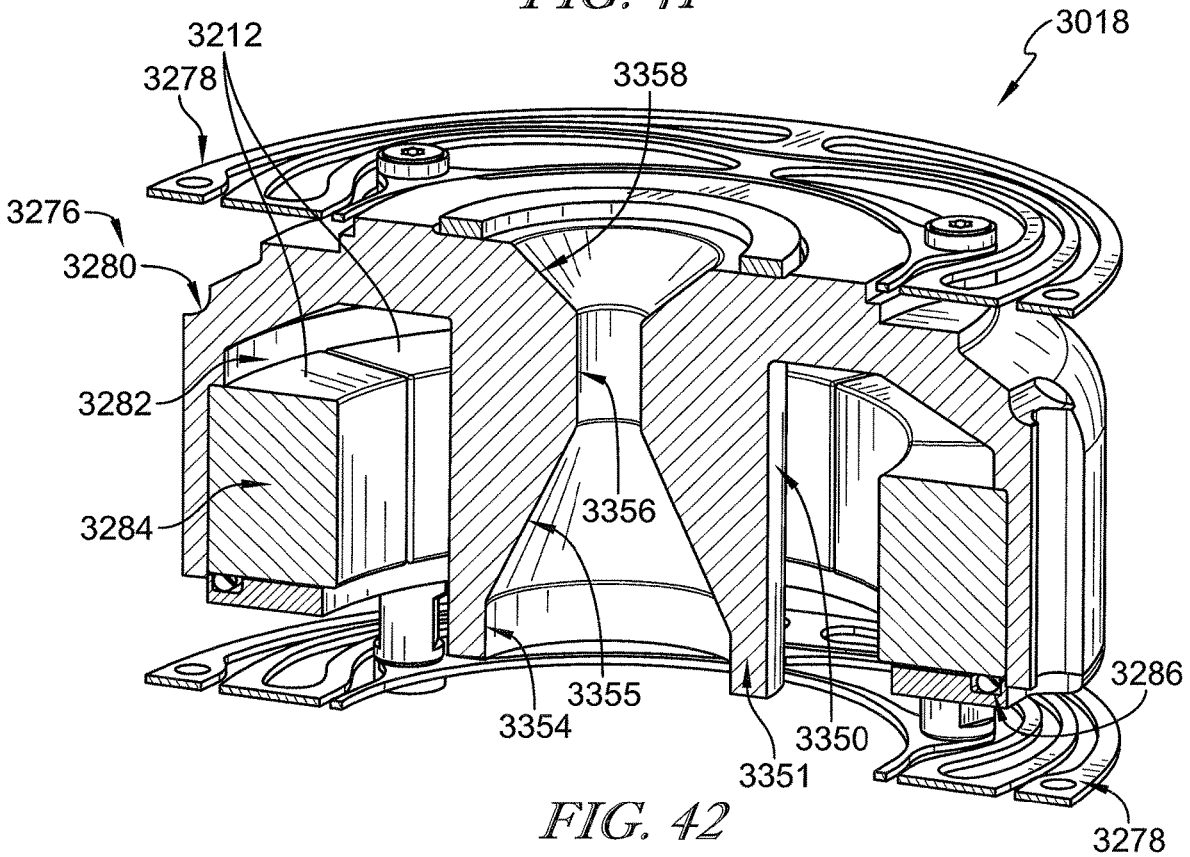
FIG. 42 is a perspective view of the percussive device of FIGS. 39-41 in cross-section taken along the line 40-40 with the housing removed to show that the percussor includes a percussor body including a hub having a hub passage defined therethrough.

As shown in FIGS. 41 and 42, the magnet 3284 is illustratively embodied to have a ring shape. The magnet 3284 illustratively includes arc segments 3312 arranged successively about the axis 3235 and being radially magnetized with respect to axis 3235. The arc segments 3312 are illustratively arranged to form the ring shape and are mounted within the interior space 3282 of the percussor body 3280. A non-limiting example of an appropriate magnet includes N84 high temperature magnets. The percussor cap 3286 illustratively abuts the magnet 3284 along an axial end of each arc segment 3312 to secure the magnet 3284 within the interior space 3282 of the percussor body 3280 (as best shown in FIG. 42).

Figure 44:
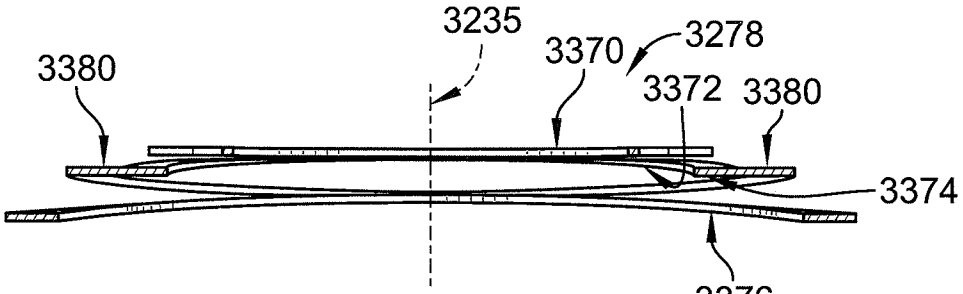
FIG. 44 is an elevation view of the resilient member of FIG. 43 showing that the resilient member is arranged in an elongated state such as when the percussor moves between end positions showing that the hoops are flexible to permit movement in the axial direction.
Figure 45:
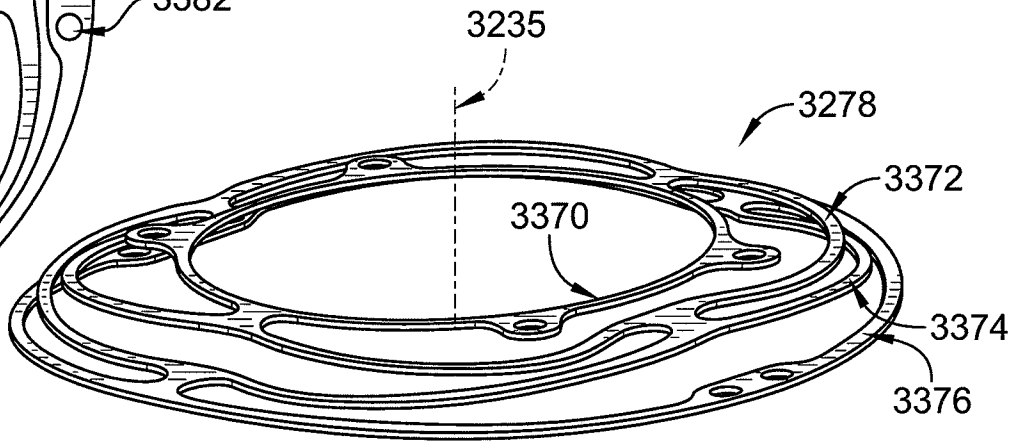
FIG. 45 is an perspective view of the resilient member of FIGS. 43 and 44 in the elongated state showing that the resilient member includes inner attachment points and outer attachment points that are displaced from each other when the resilient member is in the elongated state.

As shown in FIGS. 43-45, the resilient members 3278 are illustratively embodied as plate springs. The resilient members 3278 illustratively include coplanar hoops 3370, 3372, 3374, 3376. The hoops 3370, 3372, 3374, 3376 are illustratively arranged concentrically about the axis 3235 and with successively larger size from the innermost hoop 3370 to the outermost hoop 3376. Each of the hoops 3370, 3372, 3374, 3376 are closely spaced apart from immediately adjacent hoops 3370, 3372, 3374, 3376 but are connected thereto at connections points 3378, 3380.

As shown in FIG. 43, the (innermost) hoop 3370 is illustratively connected to the adjacent hoop 3372 at connection points 3378 which are positioned at 12 o'clock and 6 o'clock in the orientation of FIG. 43. Hoop 3372 is illustratively connected to adjacent hoop 3374 at connection points 3380 which are positioned at 3 o'clock and 9 o'clock in the orientation of FIG. 43. Hoop 3374 is illustratively connected to the adjacent (outermost) hoop 3376 at connection points 3378 which are positioned at 12 o'clock and 6 o'clock in the orientation of FIG. 43. The connection points 3378 are illustratively arranged angularly offset from the connection points 3380. In the illustrative embodiment, the connection points 3378, 3380 between the same to hoops 3370, 3372, 3374, 3376 are arranged opposite each other. The disclosed arrangement of hoops 3370, 3372, 3374, 3376 and their connection points 3378 3380 permits the hoops 3370, 3372, 3374, 3376 to be resiliently displaced from each other along the axis 3235 as shown in FIGS. 44 and 45.

The outermost hoop 3376 illustratively includes attachment holes 3382 formed therethrough on opposite sides for receiving fasteners for connection to the percussion frame 3274 (as best shown in FIG. 39). The innermost hoop 3370 illustratively includes attachment tabs 3384 extending radially therefrom and including attachment holes 3386 for receiving fasteners for connection to the percussor body 3280 (as best shown in FIGS. 39 and 41). The resilient members 3278 assist movement of the percussor 3276 along the axis 3235.

As shown in FIGS. 46A-46C, the percussive devices 3018 illustratively generate percussive force through the percussion assembly 3268 by movement of the percussor 3276 (including the percussor body 3280, magnet 3284, and percussor cap 3286) along the axis 3235. In FIG. 46A, the percussor 3276 is illustratively shown as located in an elevated position (in the displayed orientation of FIG. 46A) relative to the actuator 3272, shaft 3360, and housing 3228. In FIG. 46B, the percussor 3276 is illustratively shown as located in a generally middle position (in the displayed orientation of FIG. 46B) relative to the actuator 3272, the shaft 3360, and the housing 3228.

In FIG. 46C, the percussor 3276 is illustratively shown as located in a lowered position (in the displayed orientation of FIG. 46C) relative to the actuator 3272, the shaft 3360, and the housing 3228. Reciprocation of the percussor 3276 between the elevated position and the lowered position as end positions produces the percussive force. In the illustrative embodiment, the percussive devices 3018 are configured to operate to provide high frequency percussive force.

Figure 47:
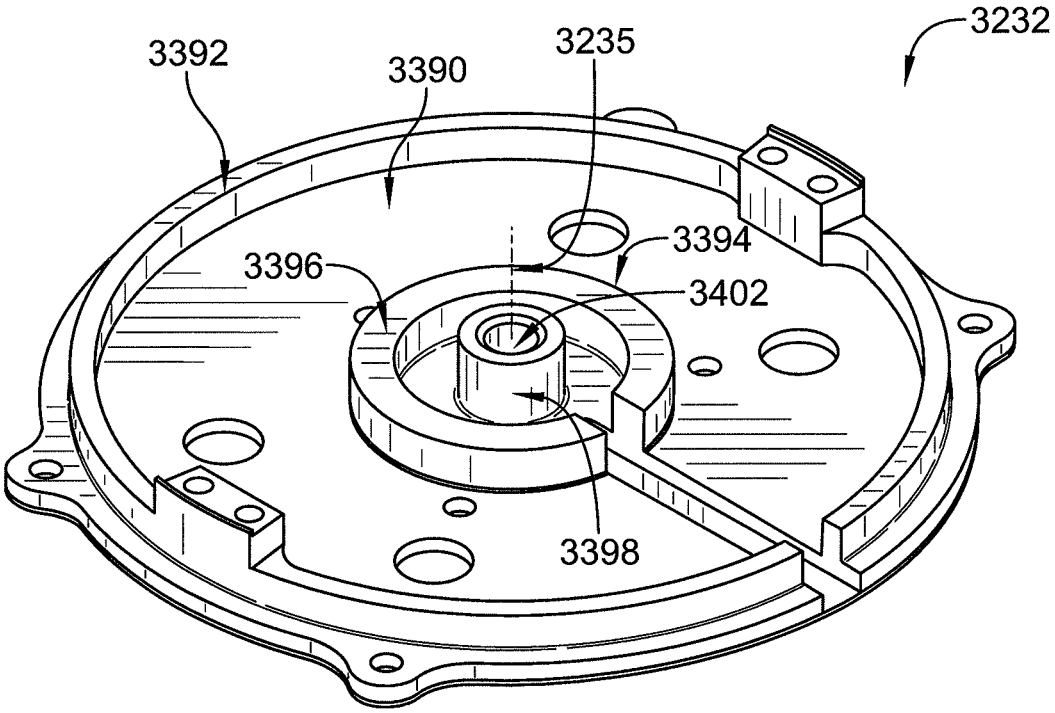
FIG. 47 is perspective view of a cap of the housing of the percussive device of FIGS. 39-42 showing that the cap includes a rim for connection with a basin of the housing.

As shown in FIG. 47, the cap 3232 of the housing 3228 illustratively includes an end wall 3390 embodied as a plate and a circumferential wall 3392 extending from the end wall 3390 about the axis 3235. A mount wall 3394 extends from the end wall 3390 about the axis 3235 radially inward of the circumferential wall 3392 to a support end 3396 for supporting the actuator 3272.

As shown in FIG. 47, a stub 3398 illustratively extends axially from the end wall 3390 radially inward of the mount wall 3394. The stub 3398 illustratively includes a recess 3402 defined therein for receiving the shaft 3360. The cap 3232 is illustratively secured to the basin 3230 to define a cavity 3270 of the housing 3228.

Figure 48:
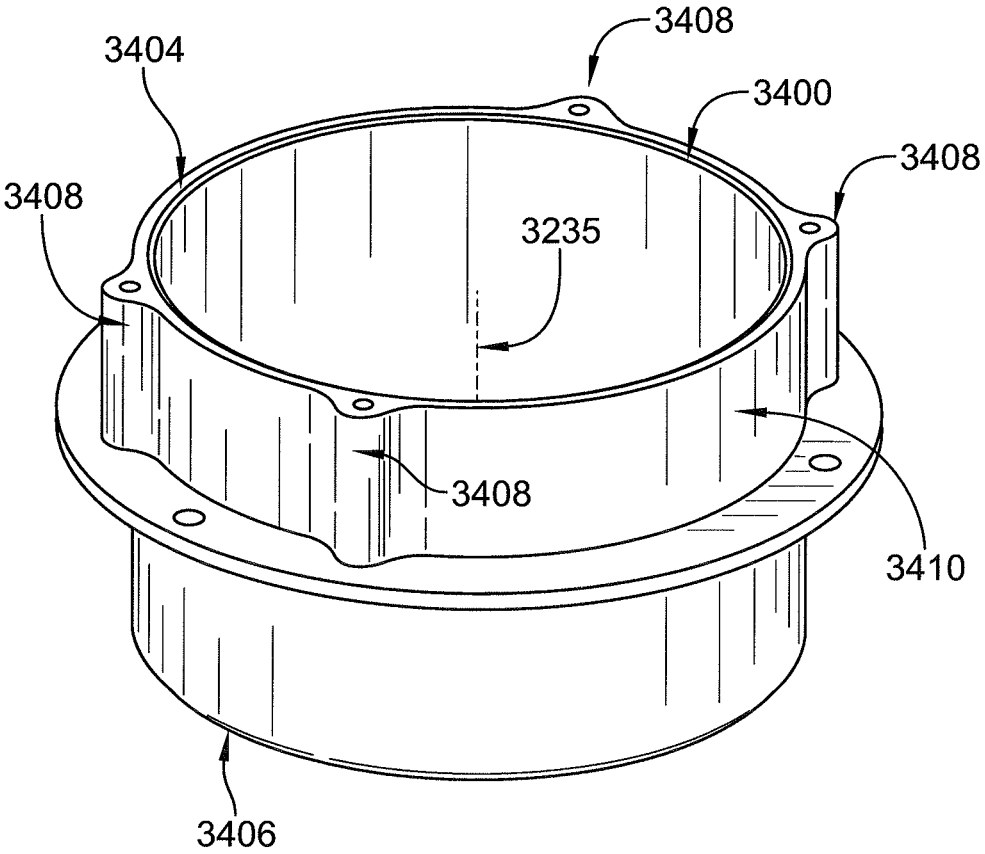
FIG. 48 is a perspective view of the basin of the housing of the percussive device of FIGS. 39-42 showing that the basin is generally cylindrical about a central axis.

As shown in FIG. 48, the basin 3230 illustratively includes a circumferential wall 3404 that extends about the axis 3235 and an end wall 3406 enclosing the circumferential wall 3404. The circumferential wall 3404 illustratively defines a rim 3400 opposite the end wall 3406 and extending about the axis 3235. The circumferential wall 3404 illustratively includes mounts 3408 extending radially from an exterior side 3410 thereof. The mounts 3408 illustratively extend axially along the exterior side 3410 between the rim 3400 and a flange 3412. The flange 3412 illustratively extends radially from the exterior side 3410 of the circumferential wall 3404. The rim 3400 engages with the cap 3232 to secure the housing 3228 and define the cavity 3270.

Figure 49:
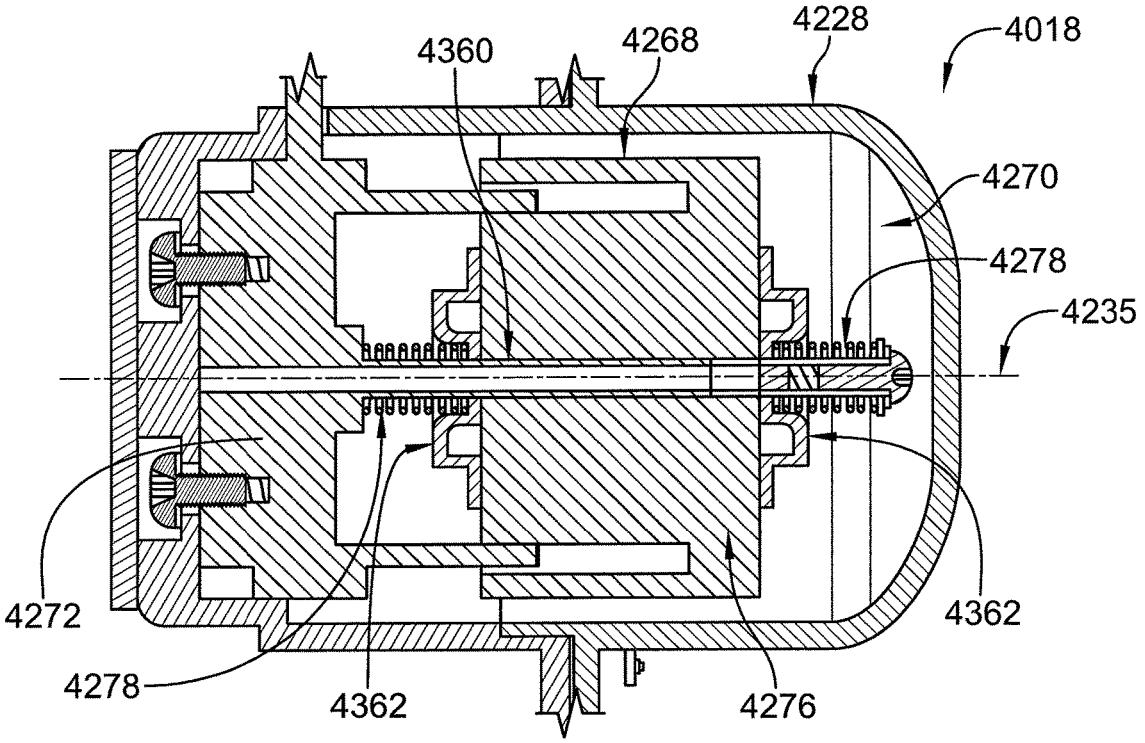
FIG. 49 is an elevation view of another percussive device adapted for use in the percussion therapy apparatuses of FIGS. 1-7, 16A and 16B, and 26-28 in cross-section showing that the resilient members are embodied as coiled springs mounted in spring mounts.

In FIG. 49, another illustrative embodiment of a percussive device 4018 for use in the percussion therapy apparatuses 10, 1010, 2010 is shown. The percussive device 4018 illustratively includes a housing 4228 defining a cavity 4270 therein and a percussion assembly 4268 arranged within the cavity 4270 to generate percussive force. The percussion assembly 4268 illustratively includes a percussor 4276 arranged for linear motion along the axis 4235 and an actuator 4272 for driving motion of the percussor 4276. The percussor 4276 illustratively comprises a magnet and the actuator 4272 comprises an coil-wound electromagnetic in electrical communication with a power source.

As shown in FIG. 49, the central shaft 4360 is illustratively orientated along the axis 4235 and extends through the actuator 4272 for guiding movement thereof. The shaft 4360 illustratively cantilevers from the actuator 4272. The percussor 4276 illustratively includes hardstops 4362 disposed on opposite axially ends and resilient member 4278 engaged with the hardstops 4362. As shown in FIG. 49, the resilient members 4278 are illustratively embodied as linear springs each arranged in contact at one end with a respective hardstops 4362 and fixed relative to the housing 4228 at the other end. In the illustrative embodiment as shown in FIG. 49, the resilient member 4278 arranged near the actuator 4272 is illustratively fixed at its other end to the actuator 4272 and the other resilient member 4278 is illustratively fixed at its other end to the cantilevered end of the shaft 4360.

Figure 50:
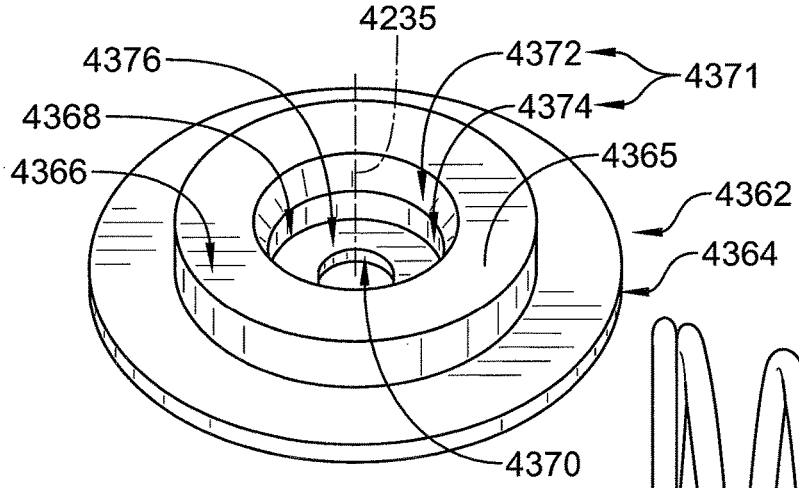
FIG. 50 is a perspective of one of the spring mounts of the percussive device of FIG. 49.

As shown in FIG. 50, the end stops 4362 are illustratively circular shaped about the axis 4235. The end stops 4362 each illustratively include a base 4364 and a cylindrical tier 4366 that extends from the base 4364 to an end surface 4365 for engagement with other components at extreme ends of movement of the percussor 4276. The tier 4366 illustratively includes a cavity 4368 defined therethrough along the axis 4235 for receiving the respective resilient member 4278 and the base 4364 includes a hole 4370 defined therethrough along the axis 4235 for receiving the shaft 4360 and connecting with the cavity 4368.

As shown in FIG. 50, the tier 4366 illustratively includes an interior surface 4371 that defines the cavity 4368 having a slanted section 4372 extending from the end surface 4365 along the axis 4235 and a straight section 4374 extending from the slanted section 4372 along the axis 4235 to an interior portion 4376 of the base 4364. The interior portion 4376 of the base 4364 illustratively extends radially between the straight section 4374 and the hole 4370 for engaging an end of the respective resilient member 4278. The straight section 4374 illustratively engages sides of the respective resilient member 4278 to maintain its position along the axis 4235.

Figure 51:
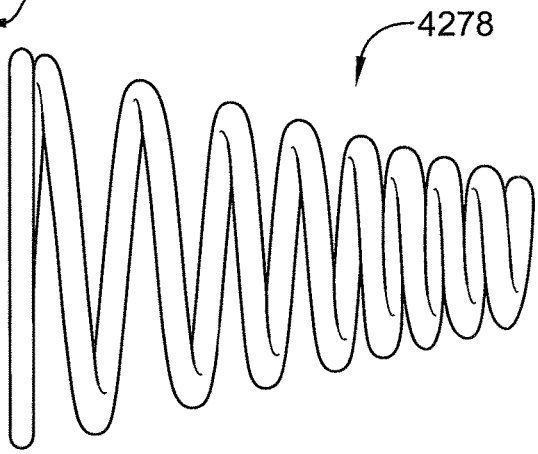
FIG. 51 is an elevation view of one of the coiled springs of the percussive device of FIG. 49 showing that the coiled spring is a conical coiled spring.

Referring to FIG. 49, the end stops 4362 are illustratively coupled to opposite ends of the percussor 4276 (magnet). The end stops 4362 illustratively receive the resilient members 4278 within their respective cavities 4368 to protect the resilient members 4278 during a bottom-out situation in which the end stops 4362 contact the housing 4228 or other components during actuation. In the illustrative embodiment of FIG. 49, but in some embodiments, the resilient members 4278 as linear springs may comprise conical springs as shown in FIG. 51.

Figure 53:
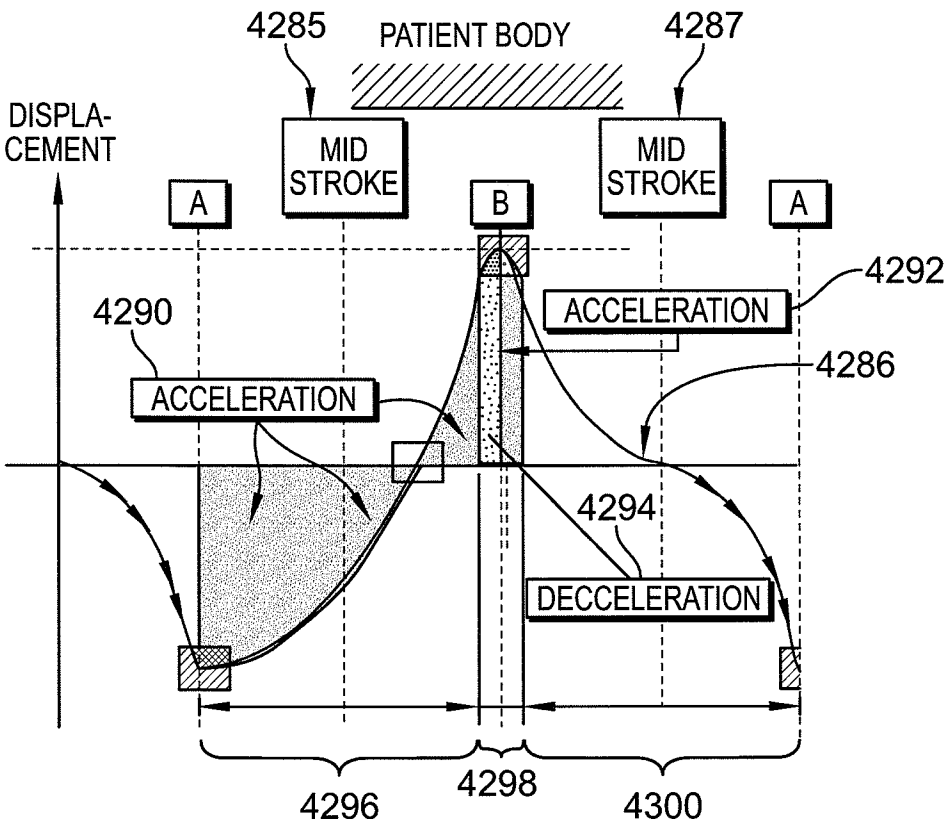
FIG. 53 is a graphical depiction of the position of the percussor of the percussive devices of FIGS. 13, 38, and 49 over time operating in a non-sinusoidal control arrangement and illustrating periods of acceleration and deceleration.
Figure 52:
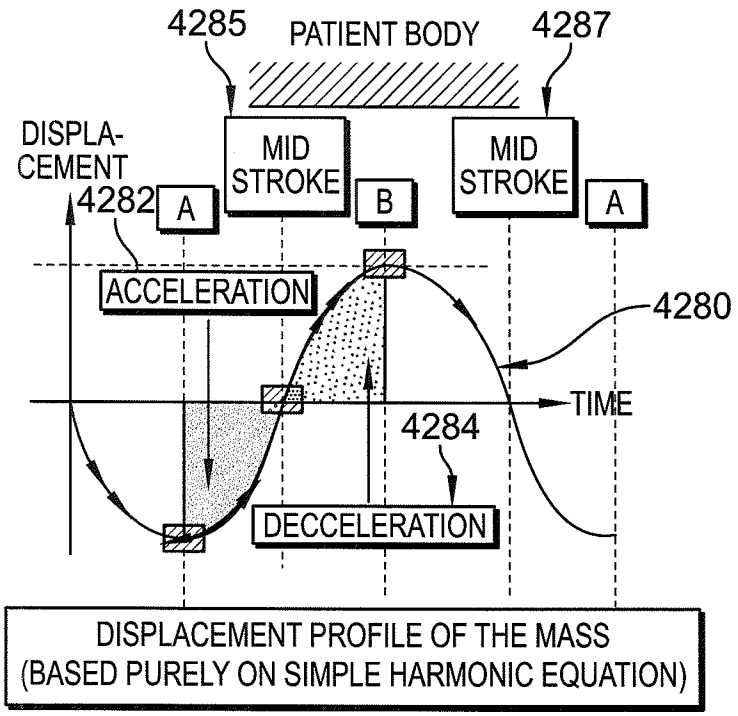
FIG. 52 is a graphical depiction of the position of the percussor of the percussive devices of FIGS. 13, 38, and 49 over time operating in a standard sinusoidal control arrangement and illustrating periods of acceleration and deceleration.

As shown in FIGS. 52 and 53, graphical depictions of the movement of the percussor 4276 is shown as represented by position along the axis 4235 as a function of time. As shown in FIG. 52, a generally sinusoidal wave form 4280 is created by the movement of the percussor 4276. The movement of the percussor 4276 between end positions A, B includes an acceleration region 4282 and a deceleration period 4284 as shown in FIG. 52. As shown in FIG. 52, the acceleration region 4282 includes all area between the end point A and a midpoint 4285 and the deceleration region 4284 includes all area between the midpoint 4285 and the end point B. Thus, the percussor 4276 accelerates from end point A to the midpoint 4285 and decelerates from the midpoint 4285 to the end point B.

As shown in FIG. 53, a non-sinusoidal waveform 4286 is created by movement of the percussor 4276 between the end positions A, B. The non-sinusoidal waveform 4286 illustratively includes acceleration regions 4290, 4292 and a deceleration region 4294, and illustratively defines zones 4296, 4298, 4300. As seen in FIG. 53, the deceleration region 4294 illustratively extends along a shorter time interval than the deceleration region 4284 of the sinusoidal waveform 4280. As compared to FIG. 52, the acceleration region 4290 includes the area between the end point A and the midpoint 4285, but also includes some of the area between the midpoint 4285 and the end point B. The acceleration region 4290 illustratively defines a ramping zone 4296 embodied between the end points A, B.

As shown in FIG. 53, the deceleration region 4294 illustratively includes the area between the ramping zone 4296 and the end point B. The acceleration region 4292 illustratively includes a portion of the area from the end point B to a midpoint 4287. The deceleration region 4294 and the acceleration region 4292 collectively define an impact zone 4298. The area between the impact zone 4298 and the proceeding end point A illustratively defines a power saving zone 4300.

As shown in FIG. 53, the ramping zone 4296 illustratively includes extended acceleration to maximize the force generated at end point B. The impact zone 4298 includes constant current to the actuator 4272 such that the movement of the percussor 4276 is through momentum alone, although in some embodiment some force from the actuator 4272 may be applied. The power saving zone 4300 is illustratively embodied as a zone of reduced power consumption represented by the area under the waveform 4286. In the illustratively embodiment, the waveform 4286 is described based on operation of the percussive device 4018, but is equally applicable to the percussive devices 18, 1018, 2018, 3018 to maximize percussive force.

Figure 54:
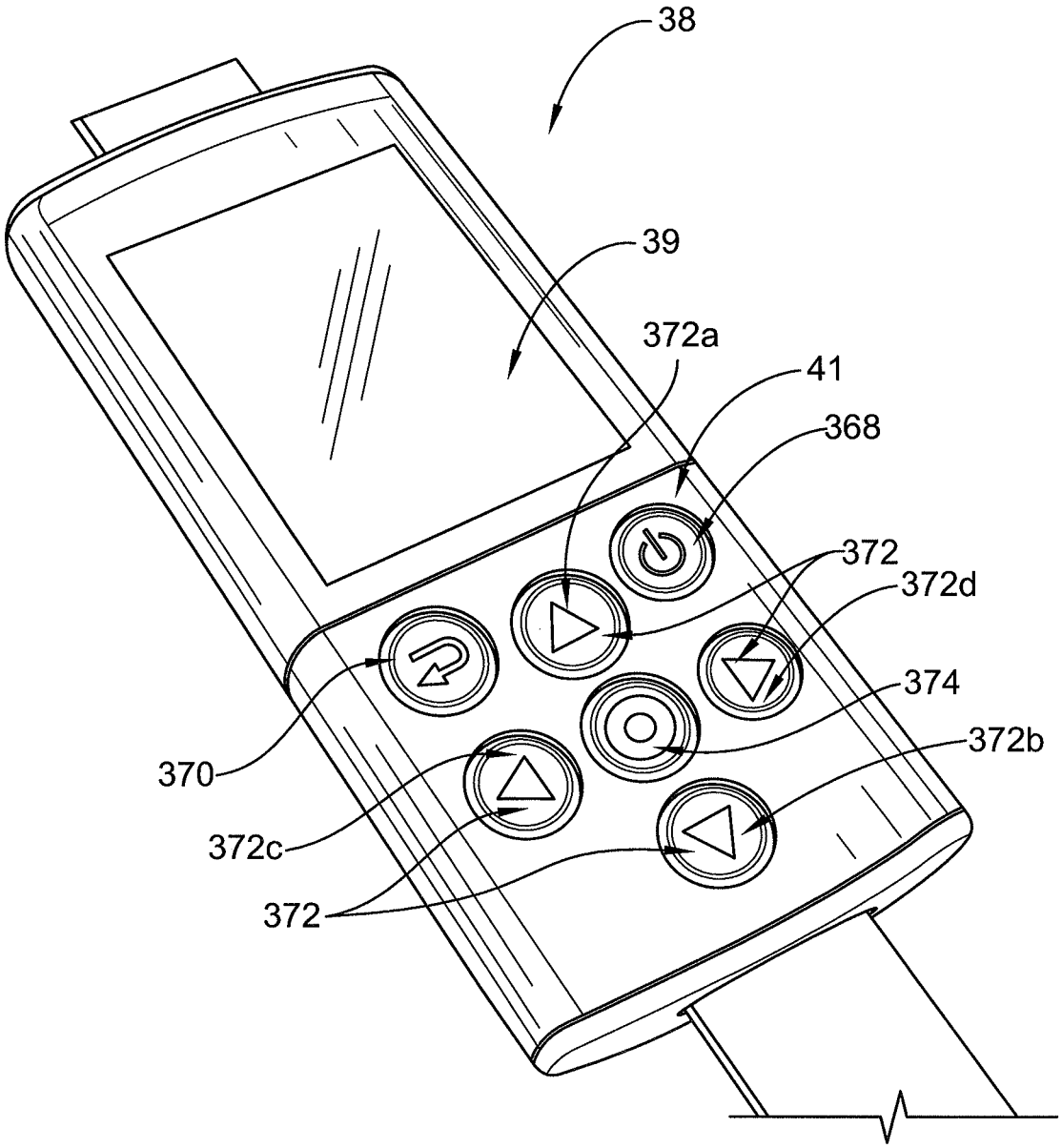
FIG. 54 is a perspective view of the user interface of the percussion therapy apparatus of FIGS. 1, 16A and 16B, and 26 showing that the user interface includes a display and navigational buttons for interacting with the display.

In the illustrative embodiment as shown in FIG. 54, the user interface 38 illustratively includes the display 39 and a number of buttons 41 for navigating the control operations shown on the display 39. The buttons 41 illustratively include a power button 368, a return button 370, directional buttons (up 372*a*, down 372*b*, left 372*c*, right 372*d*) 372, and a select button 374. The display 39 illustratively shows screens 5001-5170 and the buttons 41 can be depressed to interact with the screens 5001-5170 to operate the percussion therapy apparatuses 10, 1010, 2010 as discussed below.

Figure 55:
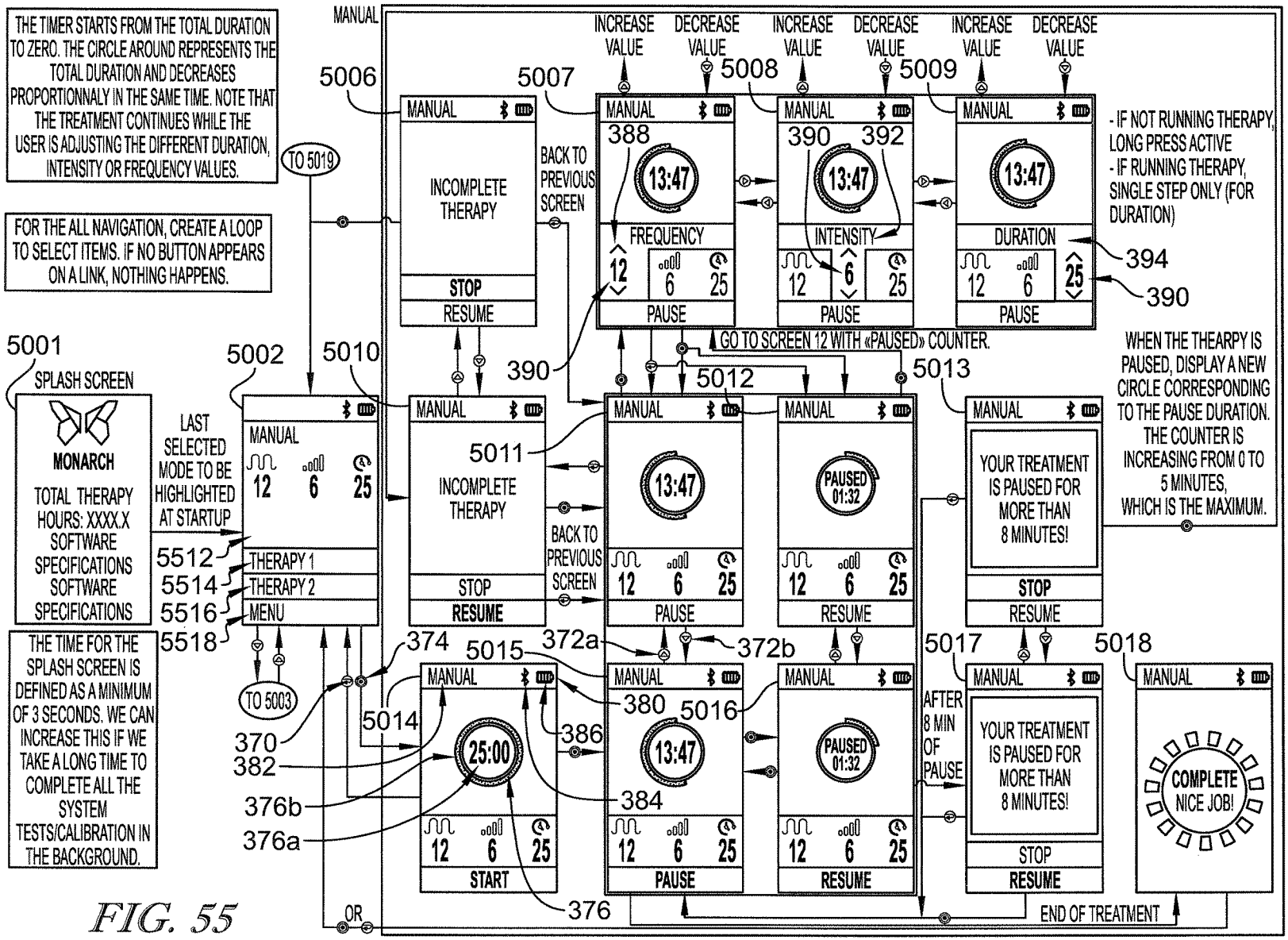
FIGS. 55-63 is a user interface map showing a series of screen shots from the display of the user interface of FIG. 54 and depicting operational sequences of the user interface to illustrate the control and operation of the user interface.
Figure 56:
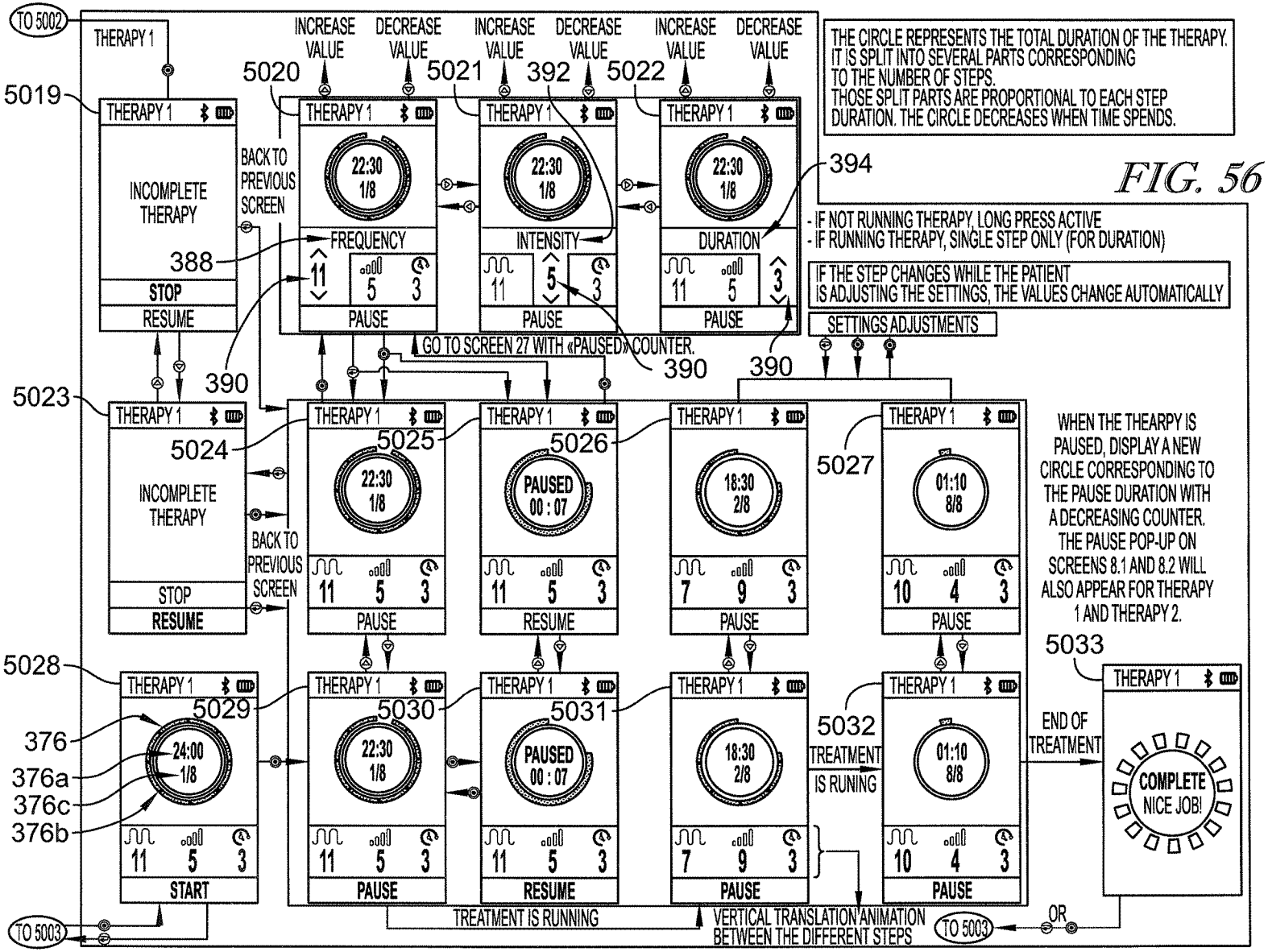
Figure 60A:
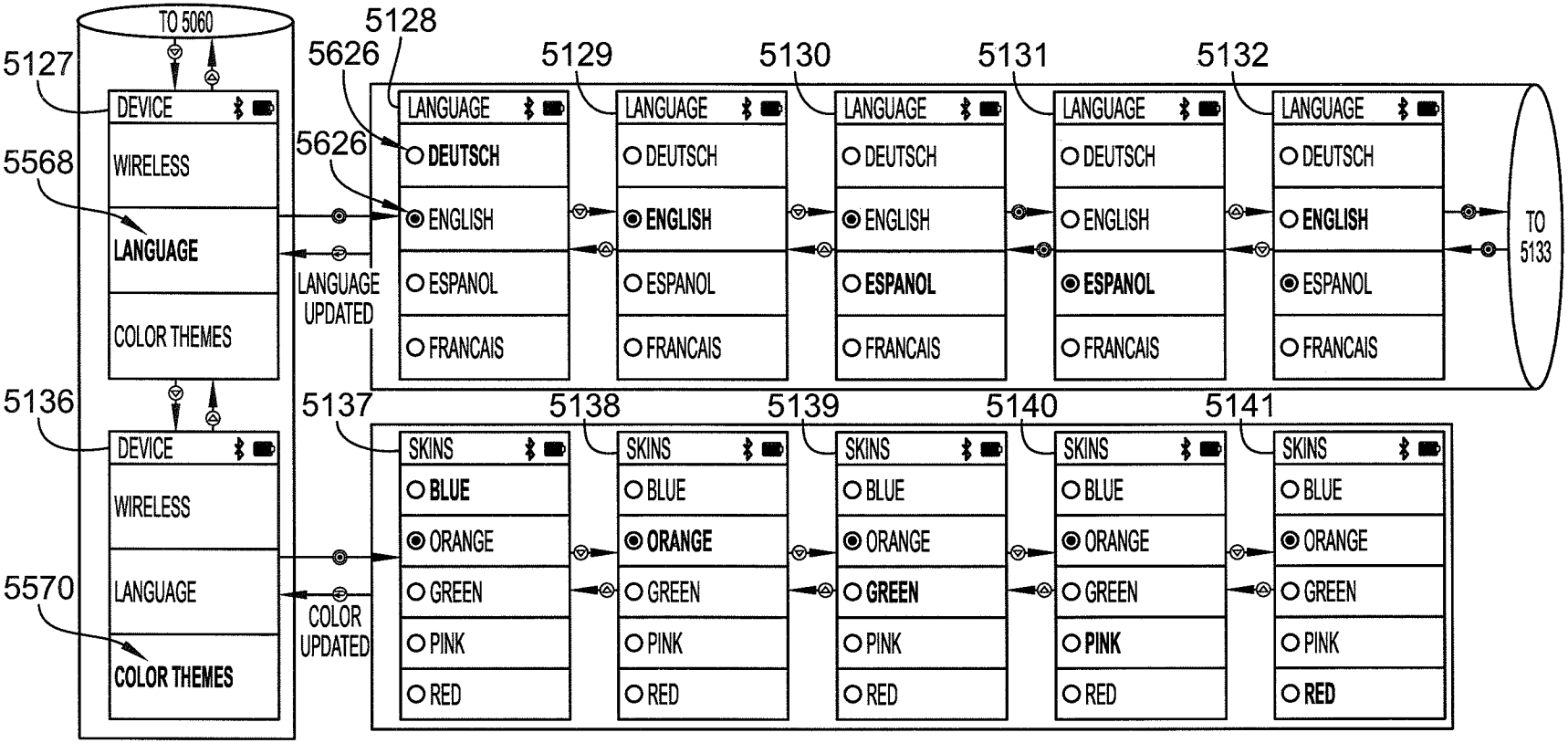
Figure 60B:
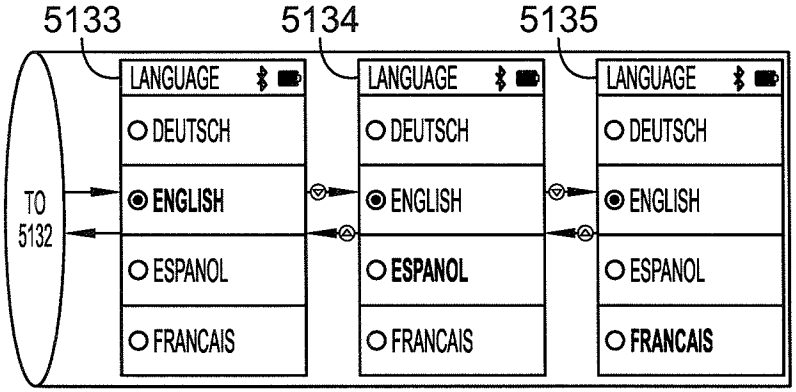
Figure 60C:
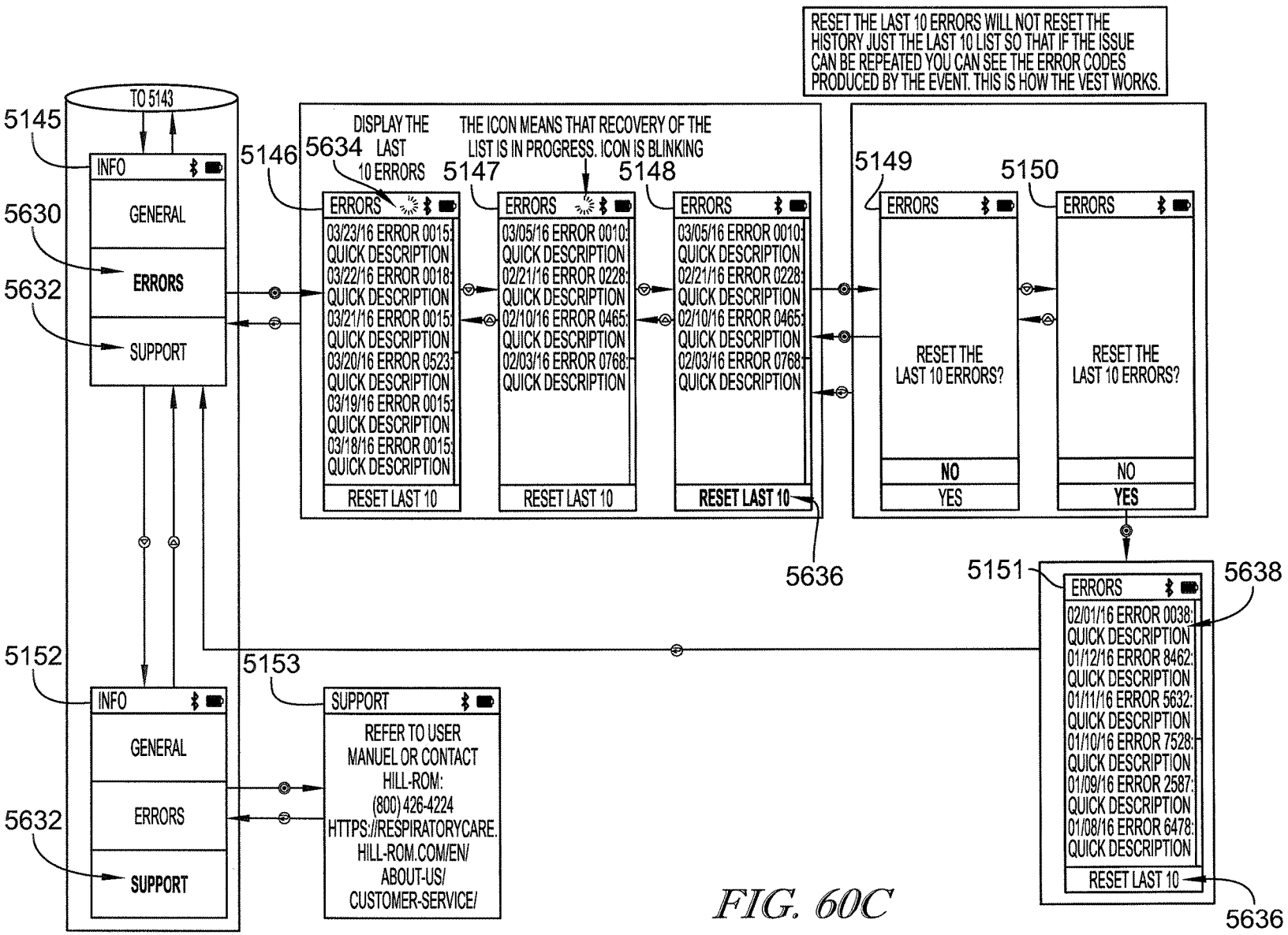
Figure 61A:
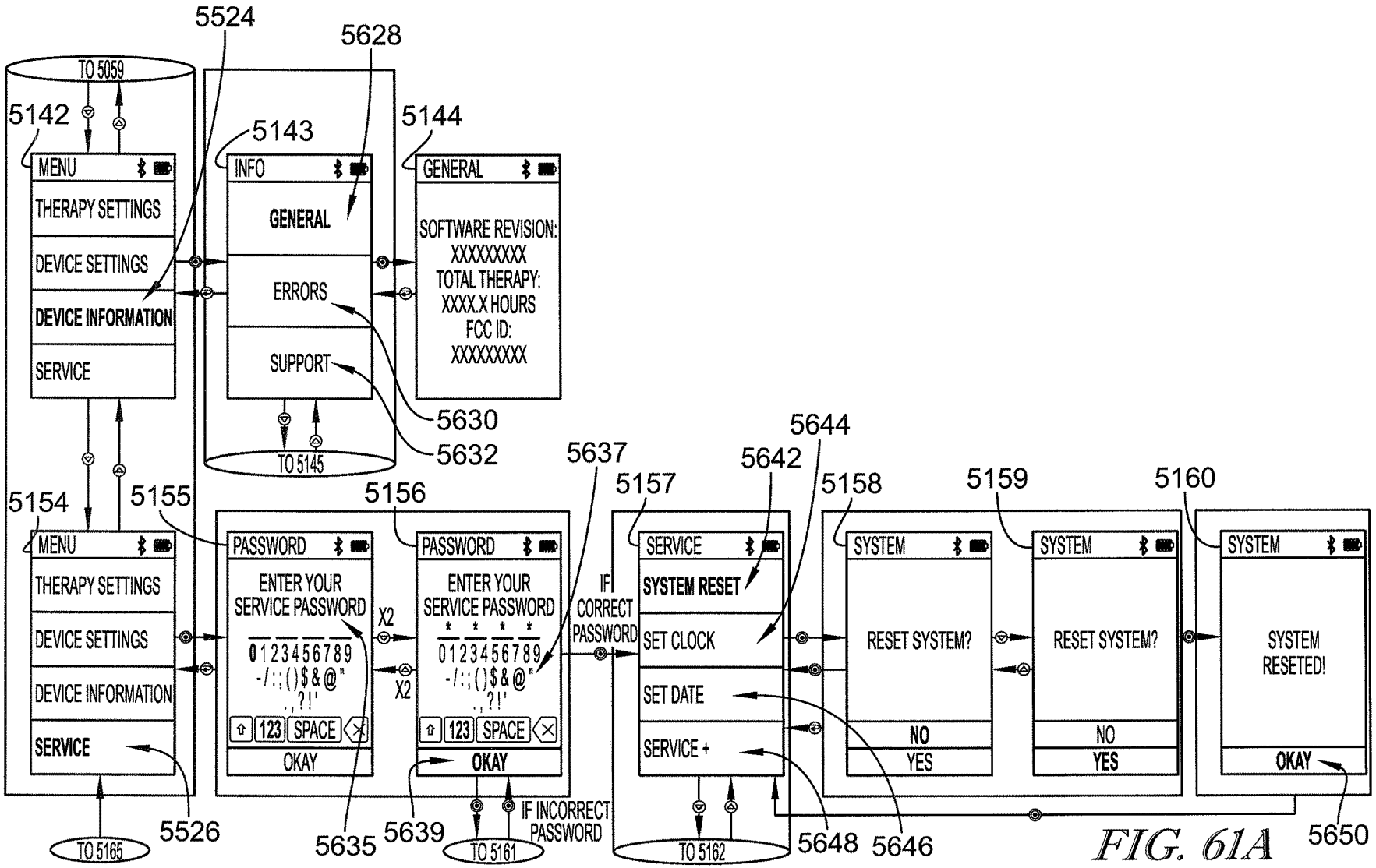
Figure 61B:
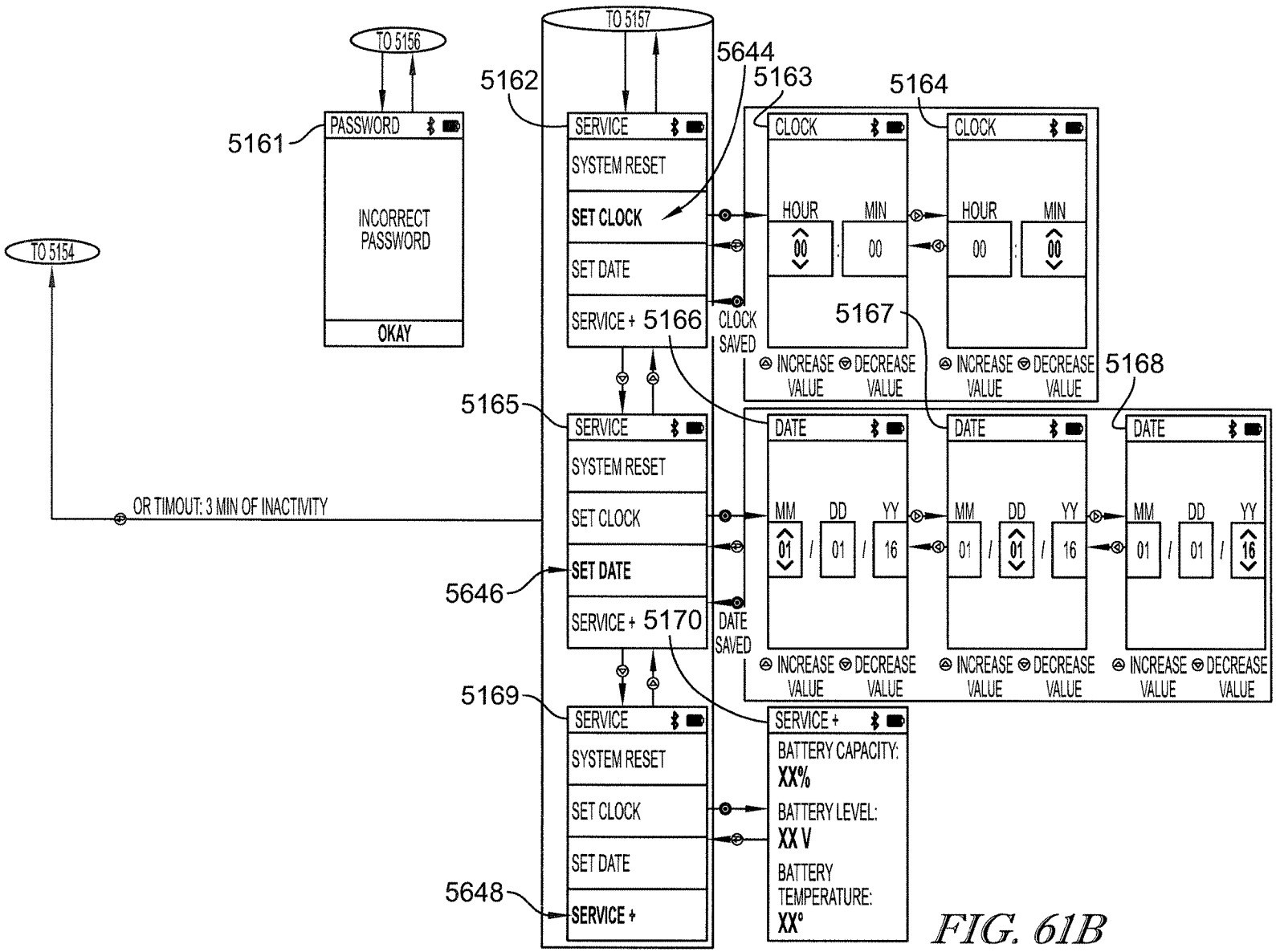
Figure 62:
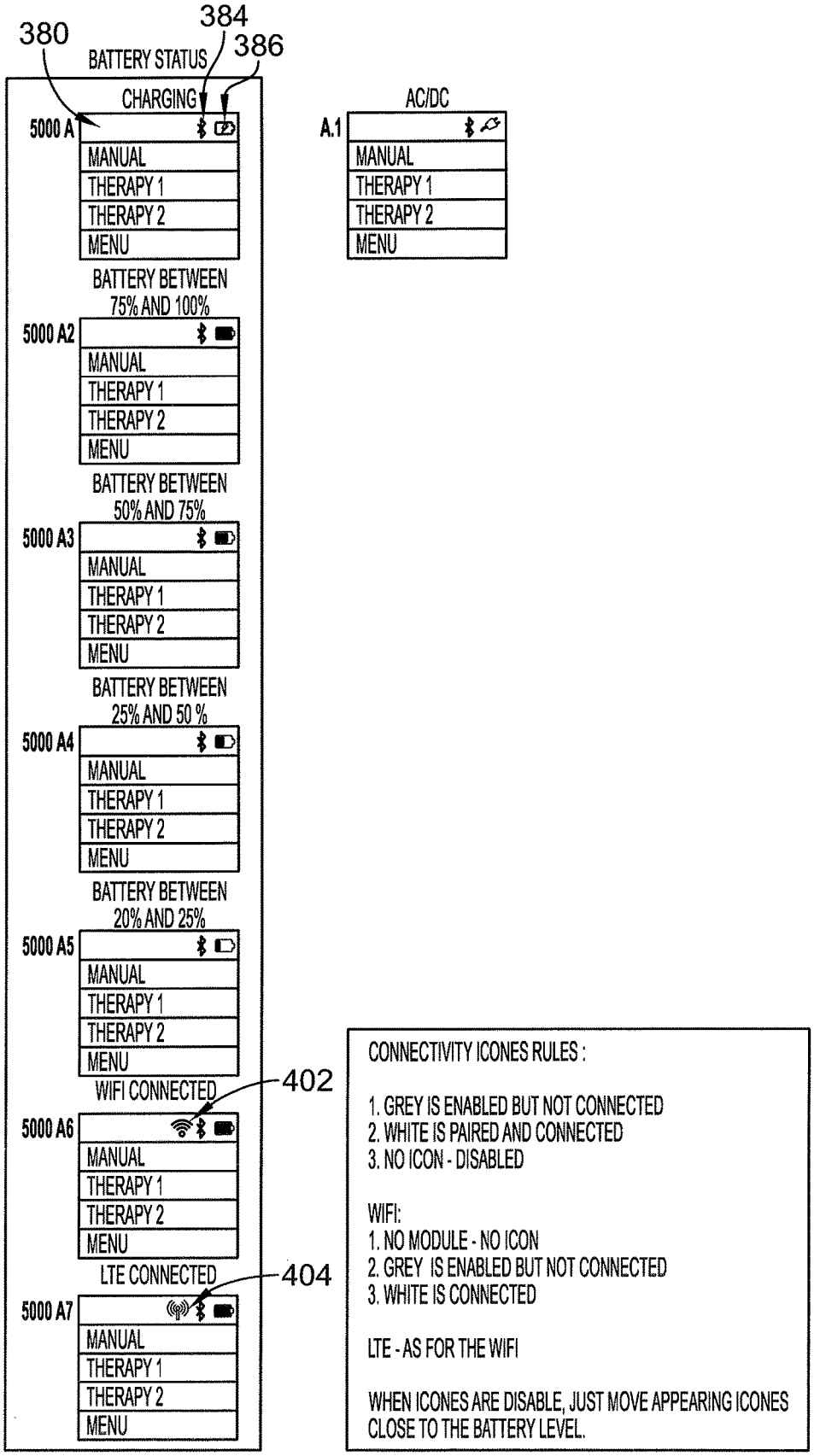
Figure 63:
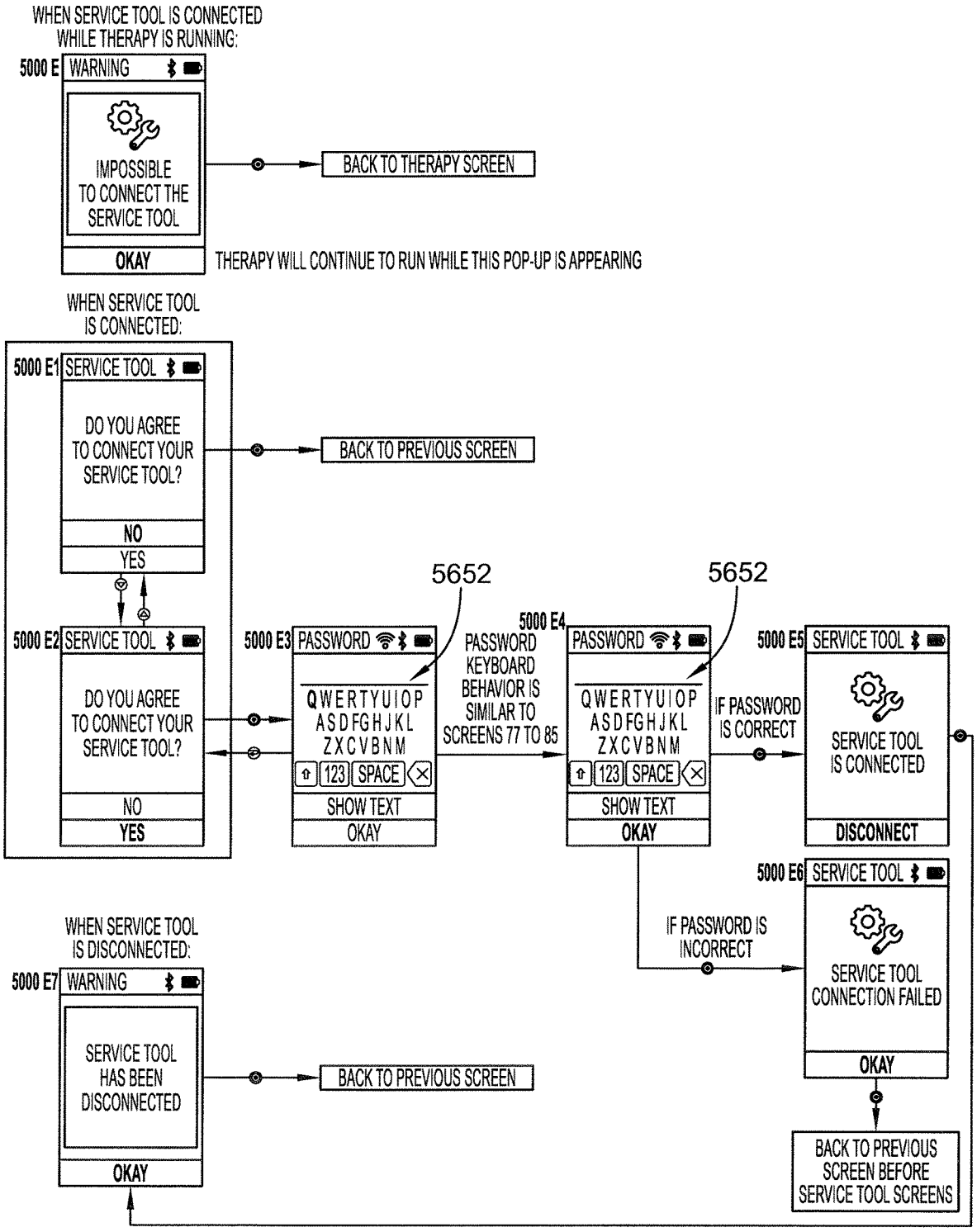

In the illustrative embodiment as shown in FIGS. 55-63, flow diagrams depict the operational sequences of the user interface 38. In FIGS. 55 and 56, a manual operational sequence and preset therapy sequences are shown. In FIGS. 57A and 57B, an adjustment sequence of the therapy sequences is shown. In FIGS. 58A-60C, a device adjustment sequence is shown. In FIGS. 61A and 61B, a service sequence is shown. In FIG. 62, a battery status representation is shown. In FIG. 63, a service tool sequence is shown. The user interface 38 is illustratively embodied to be in communication with the power and control circuitry 1412 to perform the disclosed operations. In the illustratively embodiment, hardware and/or software for generating screens 5000-5170 (discussed below) on the display 39 of the user interface 38 is provided by the power and control circuitry 1412, but in some embodiments, operations user interface 38 may utilize any suitable arrangement of shared and/or dedicated software and/or hardware.

Referring to FIG. 55, a screen 5001 illustratively shows a splash screen indicating the "Monarch" product name and basic information such as total therapy hours and software specifications for a brief moment on startup, for example, 3 seconds before proceeding to screen 5002. Screen 5002 illustratively includes a number of options, shown as bars 5512, 5514, 5516, 5518. In FIG. 55, bar 5512 is currently active (indicating that depressing the select button 374 selects the active option 5512), as indicated by the expanded height of the bar 5512 compared to the other bars 5514, 5516, 5518. The bar 5512 is illustratively embodied as the Manual Sequence that permits direct (or "manual") manipulation of the percussion therapy apparatus operation. Within the expanded height of the bar 5512 current information is illustratively shown (frequency "12", intensity "6", and cycle duration "25"). A user can select a Manual mode on screen 5002 by pressing the select button 374, and in response, the sequence illustratively advances to screen 5014.

As shown in FIG. 55, the Manual mode is embodied as an operation of the percussive devices 18, 1018, 2018, 3018, 4018 illustratively including a default 25 minute cycle duration illustrated by the stopwatch 376 on screen 5014. The stopwatch 376 illustratively includes a digital time display 376*a* and countdown bar 376*b*. Also illustratively shown on a top status bar 380 of screen 5014 is the screen title 382, a connectivity indicator 384, and a current battery life indicator 386.

On screen 5014, a user can illustratively depress the select button 374 to begin the Manual mode percussion therapy, which responsive begins operation of the percussive devices 18, 1018, 2018, 3018, 4018 and advances to screen 5015 as shown in FIG. 55. On screen 5014, if the return button 370 is instead depressed, the display 39 illustratively returns to screen 5012. Screen 5015 illustratively depicts the Manual mode having been operated for about 11 minutes and 13 seconds as indicated by both the time display and countdown bar. On screen 5015, operation of the select button 374 illustratively pauses the Manual mode and advances to screen 5016 which starts a timer for the amount of time paused (illustratively shown as 1 minute 32 seconds). In the illustrative embodiment, after 8 minutes of uninterrupted pausing of the Manual mode, the display 39 automatically advances to screen 5017 to prompt a selection of either resume or stop (to end the Manual Sequence).

As shown in FIG. 55, from either of screens 5015, 5016, a user can depress the up button 372*a* to respectively advance to screens 5011, 5012 to adjust the Manual mode. Depressing the down button 372*b* returns to the respective screen 5011, 5012. On screens 5015, 5016, depressing the select button 374 advances to screen 5007 to adjust the Manual mode. On screen 5007, a frequency parameter 388 is active (indicating that depressing the select button 374 selects the frequency parameter 388) as shown by the tab 390 which extends into the frequency parameter 388 and the up and down arrows shown above and below the current frequency parameter setting illustratively shown as 12 Hz. In some embodiments, being active may be indicated by any visual distinction, for example but without limitation, color, font, form, etc. On screen 5007, depressing up or down buttons 372*a*, 372*b* illustratively increases or decreases the value of the frequency parameter 388. On screen 5007, depressing the right button 372*d* illustratively selects an intensity parameter 392 and advances to screen 5008.

As shown in FIG. 55, screen 5008 illustratively indicates that the intensity parameter 392 is active as illustrated by the tab 390 now being focused (extending) thereon. Selection of the intensity parameter 392 illustratively permits adjustment of the current intensity parameter value, shown as level 6, by using the up or down buttons 372*a*, 372*b*. Using the left or right buttons 372*c*, 372*d* illustratively toggles between screens 5007, 5009 respectively.

As shown in FIG. 55, screen 5009 illustratively indicates that a duration parameter 394 is active as the tab 390 has now been focused thereon. Selection of the duration parameter 394 illustratively permits adjustment of the current duration parameter setting, illustratively shown as 25 minutes, by using the up or down buttons 372*a*, 372*b*. Using the left button 372*c* illustratively returns to screen 5007.

The specific operation and navigation of the user interface 38 throughout FIGS. 55-63 is illustratively conducted generally as described above. As shown in FIG. 55, a user can illustratively stop the present therapy mode which returns to screen 5002, for example, on screen 5006. On screen 5002, a user can illustratively operate the up and down buttons 372*a*, 372*b* to navigate between the bars 5512, 5514, 5516, 5518 (as shown in screens 5003, 5004, 5005 on FIG. 57A). Referring briefly to FIG. 57A, a user can illustratively navigate to bar 5514 as indicated by the expanded height of the bar 5514 on screen 5003 as compared to the other bars 5512, 5516, 5518. By selecting bar 5514 (e.g., illustratively depressing the selection button while the bar 5514 is active), a user can illustratively manipulate the Therapy mode 1 which advances to screen 5028 on FIG. 56.

As shown in FIG. 56, user selection of bar 5514 illustratively advances to screen 5028 to permit manipulation of the predetermined initial parameters for the Therapy mode 1. As shown in FIG. 56, a user can illustratively operate the user interface to start/stop, pause/resume, and adjust the current frequency, intensity, and duration parameters 388, 392, 394 in similar manner to that discussed above regarding the Manual mode. In the illustrative embodiment, the Therapy mode 1 and the Therapy mode 2 each illustratively include up to eight distinct therapy intervals which can each have distinct values for any of the frequency, intensity, and/or duration parameters 388, 392, 394. As shown on screens 5028, 5029, an indictor 376*c* illustratively displays the current therapy interval as the first of eight (1/8). Unlike the Manual mode, each therapy interval of the Therapy modes 1 and 2 can be individually manipulated for any of the frequency, intensity, and/or duration parameters 388, 392, 394 as discussed below.

As shown in FIG. 56, on screen 5028 the stopwatch 376 illustratively displays the total time duration for all therapy intervals of the Therapy mode 1 and displays the current therapy interval (shown as 376*c*) and digital time display 376*a* within the countdown bar 376*b*. A user can begin the Therapy mode 1 and advance to screen 5029. Notably, the duration parameter 394 displayed on screens 5020-5022 and 5028-5032 illustratively shows the remaining duration of the therapy intervals (illustratively 3 minutes). Adjustment of the duration parameter 394 on screen 5022 illustratively sets the current duration parameter 394 for each therapy interval of the Therapy mode 1.

Figure 57A:
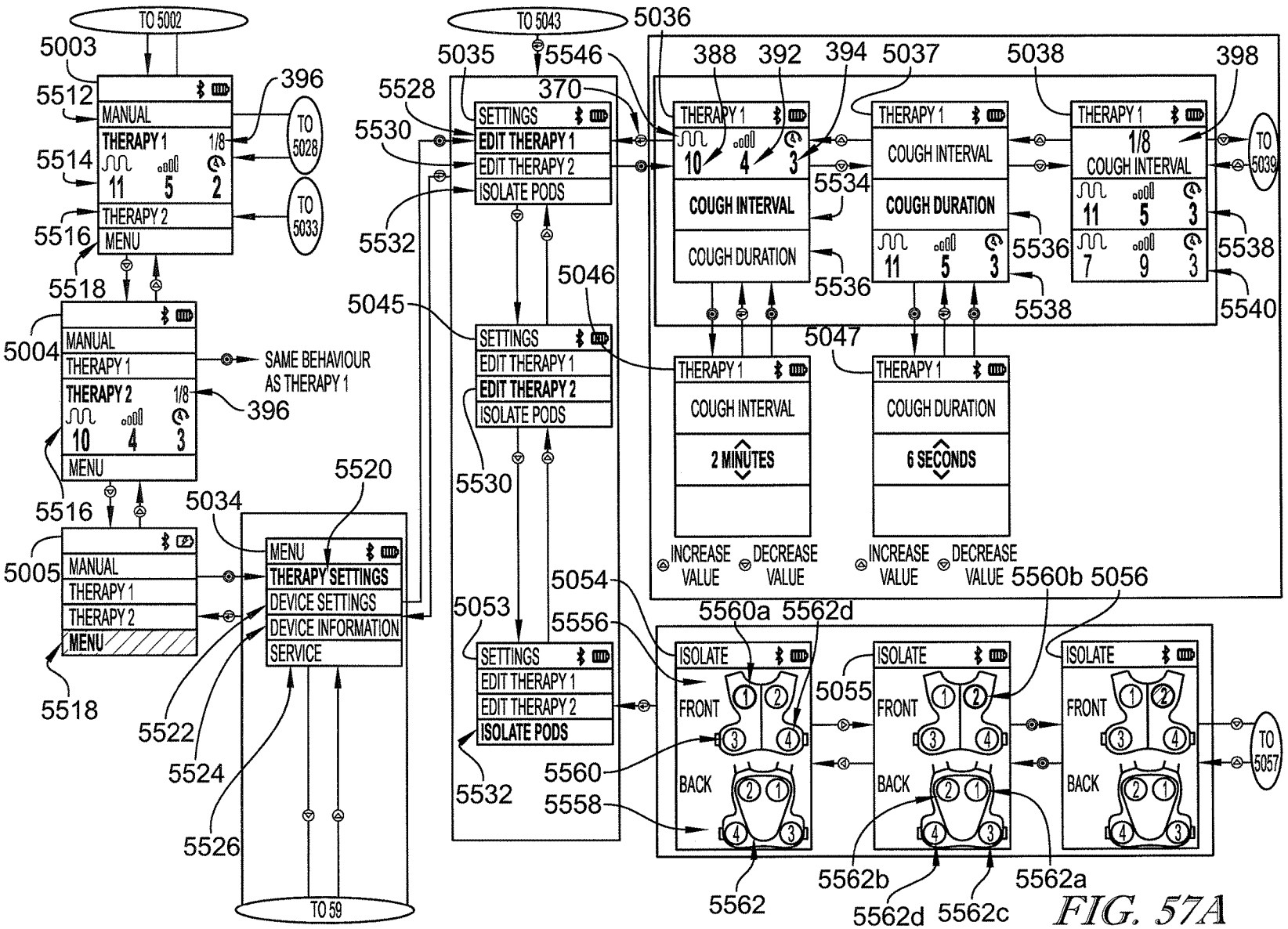

As shown in FIG. 57A, user selection of the bar 5516 for the Therapy mode 2 illustratively performs the same behavior as Therapy mode 1 but according to its own predetermined initial settings. However, unlike the Manual mode, a user can illustratively select the bar 5518 to manipulate the predetermined initial parameters of each of the Therapy mode 1 and Therapy mode 2 to provide predetermined customized therapy regimes.

As shown in FIG. 57A, a user can illustratively select the bar 5518 (Menu) to manipulate various therapy settings, device (percussion therapy apparatus 10, 1010, 2010) settings, to view device (percussion therapy apparatus 10, 1010, 2010) information, and/or to conduct service. Selection of the Menu (bar 5518) illustratively advances to screen 5034 ("menu screen" 5034), which presents the options 5520, 5522, 5524, 5526 respectively embodied as Therapy settings, Device Settings, Device Information, and Service.

As shown in FIG. 57A, selection of Therapy Settings 5520 illustratively advances to screen 5035 which presents options 5528, 5530, 5532 respectively embodied as Edit Therapy 1, Edit Therapy 2, Isolate PODs (percussive devices 18, 1018, 2018, 3018, 4018). A user can illustratively toggle between the options 5528, 5530, 5532 as shown in screens 5035, 5045, 5053 using the up and down buttons 372*a*, 372*b*. Selection of Edit Therapy 1 5035 illustratively advances to screen 5036.

As shown in FIG. 57A, screen 5036 illustratively displays as options for user selection a cough interval option 5534 (active), a cough duration option 5536 (inactive), and an eighth therapy interval option 5546 (inactive). The cough interval option 5534 is illustratively active as indicated by the bold script while the cough duration option 5536 and eighth therapy interval option 5546 are illustratively inactive as indicated in non-bold script. The cough interval option 5534 is illustratively embodied as a predetermined period of time between cough pauses in the operation of the percussive devices 18, 1018, 2018, 3018, 4018 (illustratively shown as 2 minutes on screen 5046) during the Therapy modes 1 and 2.

As shown in FIG. 57A, the cough interval option 5534 is illustratively embodied as a predetermined duration of the cough pause in the operation of the percussive devices 18, 1018, 2018, 3018, 4018 (illustratively shown as 6 seconds on screen 5047) during the Therapy modes 1 and 2. The cough pauses are illustratively embodied as a controlled cessation of the movement of the percussor of the percussive devices by deactivation of the actuators to assist the patient in expectoration. The cough pauses are independent of any manual pause provided by activate of the break button 40. On screens 5046, 5047, a user can alter the value of the cough interval option 5534 and the cough duration option 5536 respectively by operation of the up and down buttons 372*a*, 372*b*.

As shown in FIG. 57A, on screen 5037, depressing the down button 372*b* illustratively makes active a first therapy interval option 5538 and advances to screen 5038. By making active the first therapy interval option 5538 (as illustrated by bold script on screen 5038) a currently active therapy interval bar 398 is displayed on screen 5038 to identify the therapy interval (illustratively the first therapy interval option 5538 on screen 5038). On screen 5037, depressing the down button 372*b* makes active a second therapy interval option 5540 and advances to screen 5039 on FIG. 57B.

Figure 57B:
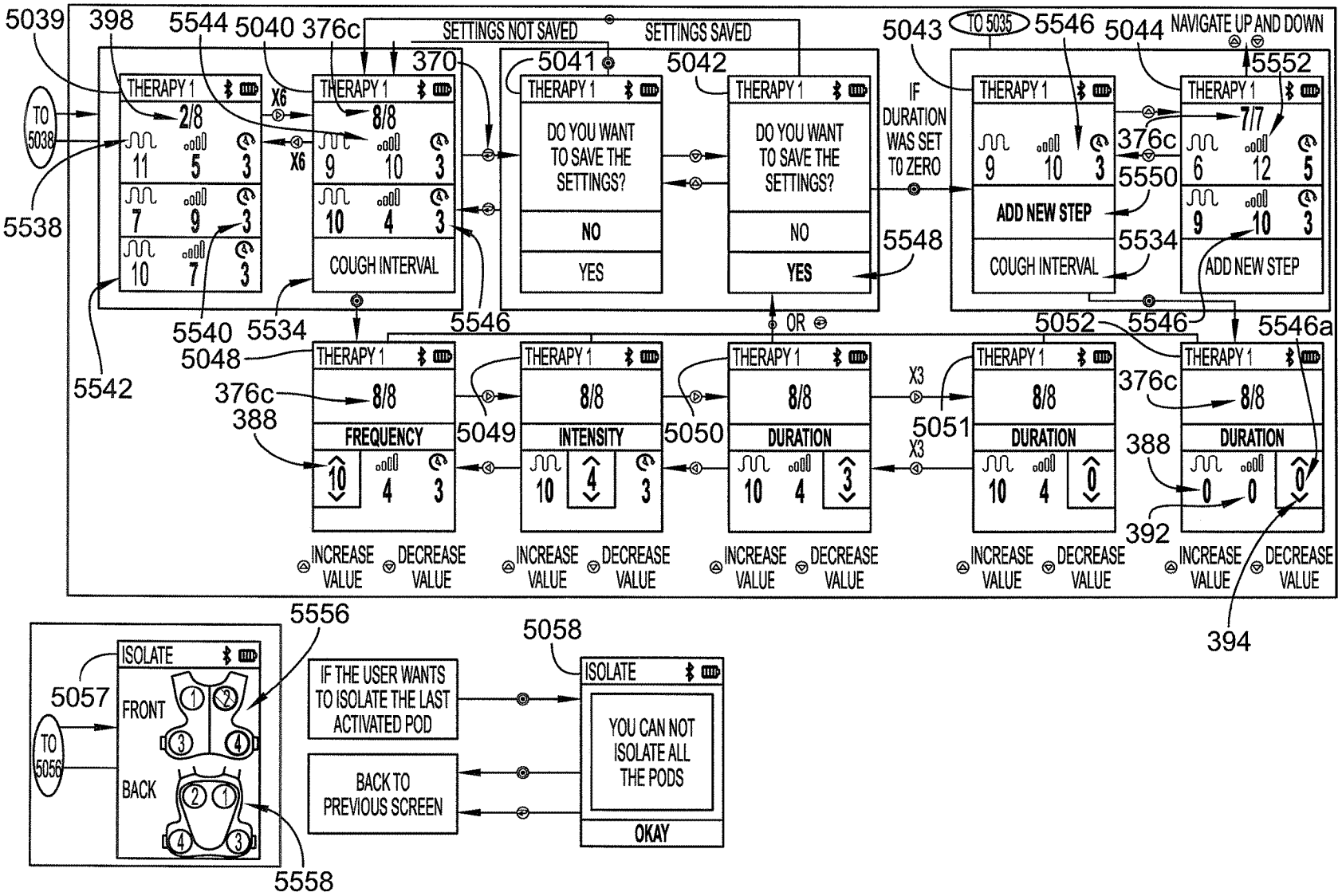

As shown in FIG. 57B, on screen 5039, the second therapy interval option 5540 is illustratively active (as shown in bold script) and the currently active therapy interval bar 398 indicates the same by displaying "2/8". A third therapy interval option 5542 is illustratively shown on screen 5039 as inactive (as shown in non-bold script) and can be made active by depressing the down button 372*b*. Screens showing the third therapy interval as active and showing the therapy interval options four through seven have been omitted, but each is illustratively embodied to be made active through appropriate toggling of the up and down buttons 372*a*, 372*b* (for example, successively depressing the down button 372*b* beginning on screen 5039 until reaching screen 5040) and would each be presented in bold script and would each indicate their respective therapy interval at the current therapy interval indicator 376*c* when active (i.e., 3/8, 4/8, 5/8, 6/8, 7/8). Navigation and operation of therapy interval options four through seven illustratively occurs in a similar manner to the other therapy interval options 5538, 5540.

In the illustrative embodiment of FIG. 57B, on screen 5040 an eighth therapy interval option 5546 is active (as shown in bold script) and a seven therapy interval option 5544 is inactive (as shown in non-bold script). The cough interval option 5534 is illustrative shown (inactive) beneath the either therapy interval option 5546 to illustrate that the list of options of (under) Edit Therapy 1 5528 are arranged in a continuous loop upon successive toggling either upward or downward such that additional pressing of the down button 372*b* (once) would return the display 39 to screen 5036.

As shown in FIGS. 57A and 57B, if no changes have been made to any parameter accessed through any of the screens 5036-5040 (and including screens for illustrative therapy interval options four through seven, not shown), on any of the those screens 5036-5040 (and including screens for illustrative therapy interval options four through six, not shown) depressing the return button 370 returns to screen 5035 (see return button 370 on arrow extending from screen 5036 to 5035 in FIG. 57A). However, if any such parameter has been changed, depressing the return button 370 on any of such screens advances to screen 5041 to require user confirmation to save the settings before storing the new parameters for execution as Therapy mode 1. On screen 5041, a user can depress the down button 372*b* to make active a "yes" option 5548 and advances to screen 5042. Selection of either the "yes" option 5548 or (the "no" option), respectively saves or does not save the settings as new parameters for execution of Therapy mode 1, and advances to screen 5040, momentarily displaying a message indicating whether the settings were saved or not.

In the illustrative embodiment, as shown in FIG. 57B, on screen 5042, when the "yes" option 5548 is selected, and the duration parameter 394 of any therapy interval option is set to zero, screen 5043 is displayed including a new therapy interval option 5550 as discussed below and the therapy interval option that is set to zero and all therapy interval option following are removed from the list on screens 5036-5040. For example but without limitation, saving the sixth therapy interval option with the value of the duration parameter 394 set to zero illustratively removes the sixth, seventh, and eighth therapy interval options from the list on screens 5036-5040 leaving only the first through fifth therapy interval options displayed. Screen 5043, thus, includes the list contents of screens 5036-5040 without those removed therapy interval options and with the new therapy interval option 5550. Screen 5043 can be toggled down (or up) to activation other list content and to advance to screen 5044 which illustratively shows a seventh interval option 5554 (active) and a sixth interval option 5552 (inactive).

As shown in FIG. 57B, by selecting the new interval option 5550 a new interval can be added and the sequence advances to screen 5052. Screen 5052 is illustratively embodied to add an additional (new) eighth therapy interval 5546*a* with values presently set to zero for all parameters 388, 392, 394. The values for parameters 388, 392, 394 of the (new) eighth therapy interval 5546*a* can illustratively be set and adjusted by similar operation to that shown and described for screens 5048-5051.

As shown in FIG. 57B, on screen 5040, selecting the eighth interval option 5546 advances to screen 5048 to permit manipulation of the parameters 388, 392, 394. On screen 5048, the value of the frequency parameter 388 of the eighth interval option 5546 is selected (as shown by indicator 376*c*) and can be increased or decreased by toggling the up or down buttons 372*a*, 372*b* accordingly. On screen 5048, depressing the right button 372*d* makes active the intensity parameter 392 of the eighth interval option 5546 and advances to screen 5049 to permit increase or decrease of the value thereof. On screen 5049, depressing the right button 372*d* makes active the duration parameter 394 of the eighth interval option 5546 and advances to screen 5050 to permit increase or decrease (adjustment) of the value thereof. Adjustment of the value of the duration parameter 394 of the eighth interval option 5546 is illustratively shown by comparison of screen 5050 and screen 5051, respectively from a value of 3 minutes to 0 minutes (after each use of the down button 372*b*, the value drops by 1 minute). The adjustment of the frequency and intensity parameters 388, 392 can illustratively be performed similarly to that for the duration parameter 388 and thus is exemplified by the comparison of screens 5050, 5051.

On any of the screens 5038, 5039, 5040 (and including screens for illustrative therapy interval options four through six, not shown), selecting an active one of any of the therapy interval options (e.g., 5538, 5540, and illustrative therapy interval options not shown) operates in a similar manner to screens 5048-5052 to permit adjustment of the values of the parameters 388, 392, 394.

Returning to FIG. 57A, on screen 5035, the Edit Therapy 2 option 5530 can be made active by navigating downward to advance to screen 5045. On screen 5045 the Edit Therapy 2 option 5530 can be selected to permit adjustment of any of the cough interval option 5534, the cough duration option 5536, and the values of the parameters 388, 392, 394 of any of the therapy interval options, for the Therapy mode 2. Thus, the Therapy modes 1 and 2 provide independently customizable predetermined settings for operation of the percussive devices 18, 1018, 2018, 3018, 4018. The customizable predetermined settings create customized therapy regimes which can be arranged in advance and be made readily available without requiring specific programming with each therapy session. This can reduce the need for the patient to perform programming tasks and can provide direct caregiver involvement in preparing the apparatus for use without requiring the caregiver to be present during therapy sessions.

As shown in FIG. 57A, on screen 5045, the Isolate PODs option 5532 be made active by navigating downward to advance to screen 5053. On screen 5053, selecting the Isolate PODs option 5532 illustratively advances to screen 5054 which displays a front diagram 5556 and back diagram 5558 each including POD markers 5560, 5562 representing the respective percussive devices 18, 1018, 2018, 3018, 4018 of chest and back panels in their relative positions. On screen 5054, a first POD markers 5560*a* is active as shown in bold (front upper left POD marker corresponding to patients upper right chest), while second through fourth POD markers 5560*b*-5560*d* of the front diagram 5556 and first through forth POD markers 5562*a*-5562*d* of the back diagram 5558 are inactive as shown in non-bold. A user can make active the other (inactive) POD markers 5560*b*-*d*,

5062*a-d* by appropriate directional navigation, such as, for example but without limitation, depressing the right button 372*d* to make active the second POD marker 5560*b* and to advance to screen 5055.

As shown in FIG. 57A, on screen 5055 the second POD marker 5560*b* of the front diagram 5556 is active. On screen 5055 toggling the directional buttons 372 makes active the other POD markers 5560, 5562. Illustratively selecting the second POD marker 5560*b* isolates the corresponding percussive device (illustratively, the percussive device proximate to the patient's upper left chest) and advances to screen 5056. Having isolated POD marker 5560*b* (indicated by cross-hatching), a user can make active another POD marker 5560, 5562 by appropriate navigation and may isolate other POD markers 5560, 5562 as desired (as shown in FIG. 57B on screen 5057), although an attempt to isolate all POD markers 5560, 5562 is restricted and advances to screen 5058 with a message indicating the restriction (as shown in FIG. 57B). Isolation of POD markers 5560, 5562 and their corresponding percussive devices prevents the same from operation to create percussive force during therapy sessions. This flexibility permits targeted percussive force to be applied to some areas of the patient's body while conserving sensitive areas against percussive force, for example but without limitation, areas close to a patient's medical port for passage of fluids.

Figure 58A:
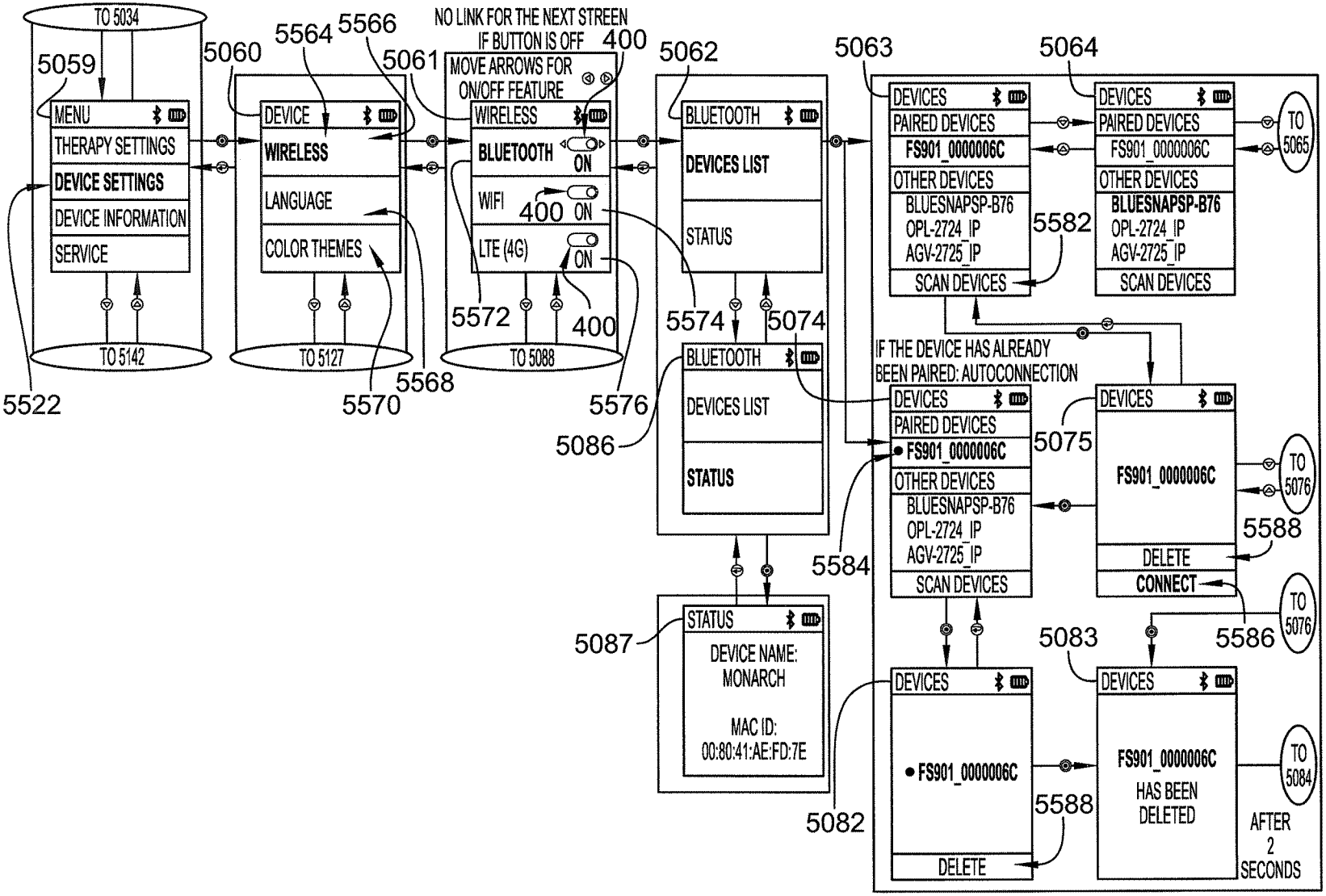

Returning briefly to the menu screen 5034 as shown in FIG. 57A, a user can make active the device settings bar 5522 by depressing the down button 372*b*, advancing to screen 5059 as shown on FIG. 58A. Selecting the device setting bar 5522 illustratively advances to screen 5060 to display a device list 5564 including a wireless option 5564, a language option 5568, and a color themes option 5570 as shown in FIG. 58A. Selecting the wireless option 5564 illustratively advances to screen 5061 and presents a Bluetooth option 5572, Wi-Fi_33 option 5574, and LTE option 5576 each including a toggle switch 400 for each of Bluetooth, Wi-Fi_33, and LTE (4G) communications for selectively turning each communications protocol on or off. The user interface 38 is illustratively operable to permit operation and/or control of the percussion therapy apparatus 10, 1010, 2010 through a remote device, for example but without limitation, a smartphone, laptop, and/or tablet computer, and in such instance, the screens 5000-5170 are illustratively embodied to be presented on the remote device and including icons representing the buttons 41 for touch screen devices and compatible button operation for non-touch screen devices.

As shown on FIG. 58A, selecting the Bluetooth option 5572 advances to screen 5062 and displays a devices list option 5578 and a status option 5580. Selection of the device list option 5578 illustratively advances to either screen 5063 or screen 5074 and presents a list of paired and other (unpaired) devices in range of the apparatus 10, 1010, 2010 and a scan devices option 5582. If upon selection of the Bluetooth option 5580, there exists a paired device (illustratively "FS901_0000006C") which is already connected to the apparatus 10, 1010, 2010 advancement is to the screen 5074 which indicates the existing Bluetooth connection by the indicator dot 5584 as shown in FIG. 58A. On screen 5074, selecting of the delete option 5588 terminates the paired state of that device which illustratively advances to screen 5083 for 2 seconds before advancing to screen 5084 which now does not show the device "FS901_0000006C". If instead, no existing connection exists, the advancement is to screen 5063 to accept requests for pairing.

As shown in FIG. 58A, on screen 5063 each of the devices from the list of paired and unpaired devices can be made active and can be selected by appropriate navigation, for example, toggling downward illustratively makes active the unpaired device "BLUESNAPSP-B76," and advances to screen 5064. On screen 5063, selection of a paired device, as illustrated by paired device "FS901_0000006C" advances to screen 5075 and permits selection of a connect option 5586 to initiate connection with the paired device and a delete option 5588 to initiate deletion of the paired device. On screen 5063, toggling to the delete option 5588 advances to screen 5076 and permits selection of the delete option 5588 to terminate the paired state of that device which illustratively advances to screen 5083 for 2 seconds before advancing to screen 5084 which now does not show the device "FS901_0000006C". On screen 5063, selection of the connect option 5586 illustratively connects the apparatus 10, 1010, 2010 with the paired device through Bluetooth connection and advances to screen 5074.

Figure 58B:
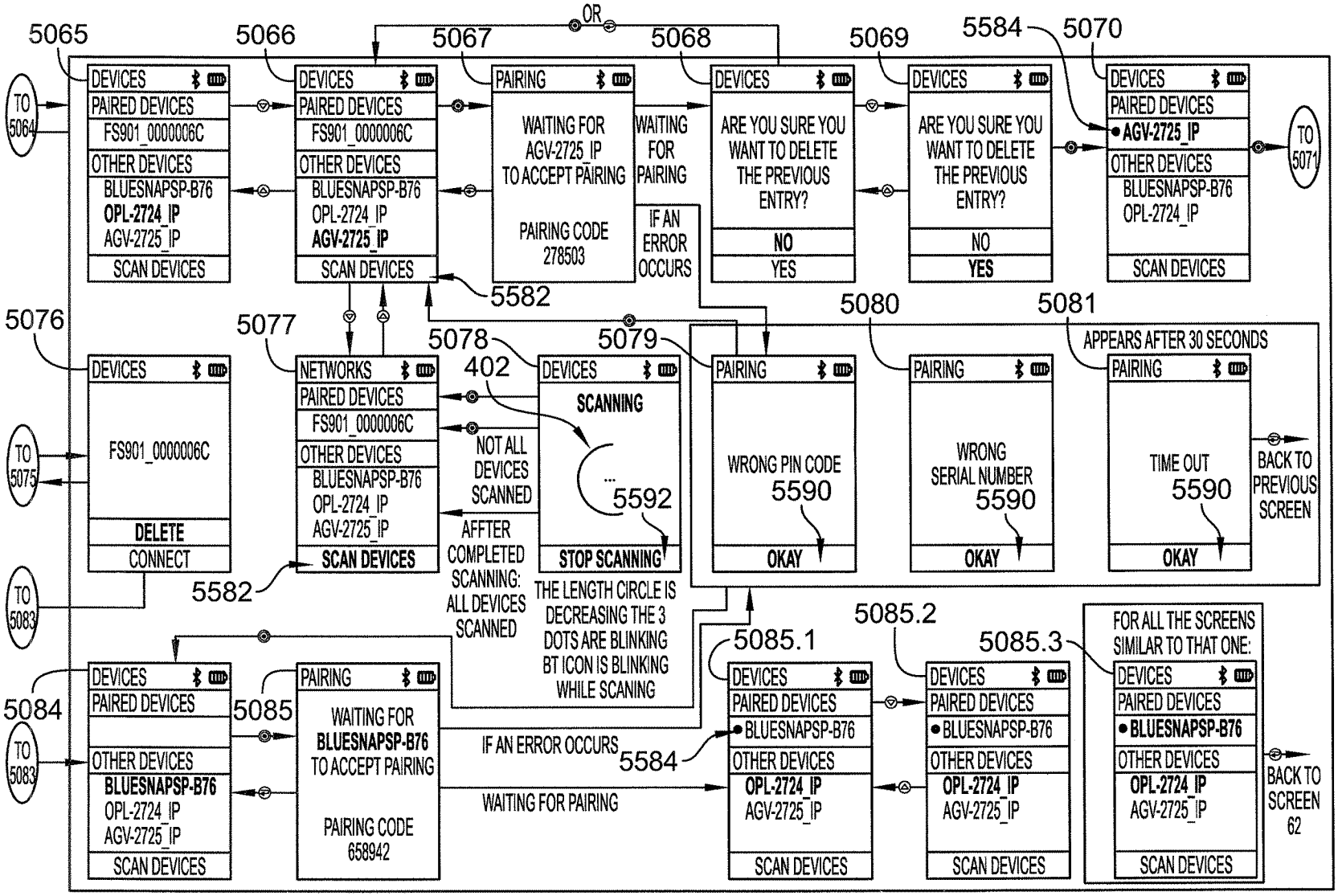
Figure 58C:
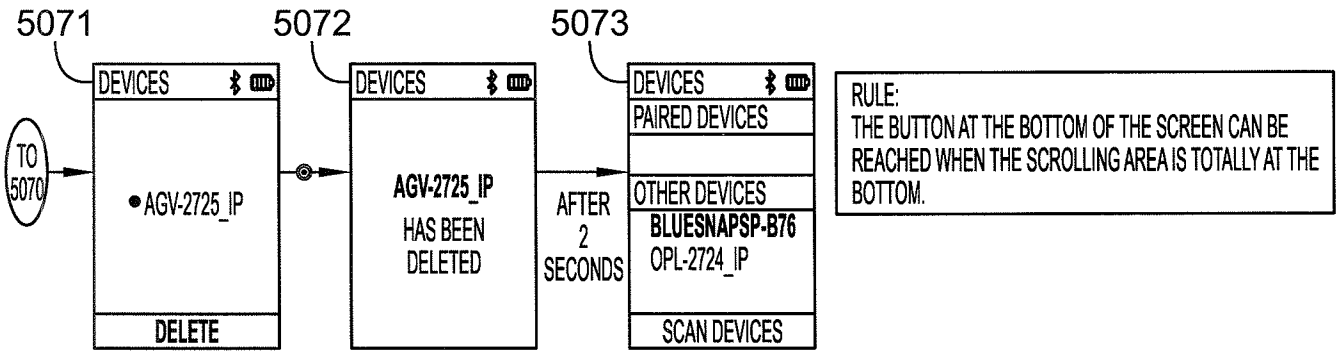

As shown in FIG. 58B, on screen 5083, making active and selecting another (unpaired device), illustratively "BLUESNAPSP-B76" performs a pairing operation for that device and advances to screen 5085. On screen 5085, a pairing code is provided for entry onto the device ("BLUESNAPSP-B76"). If the pairing code is improperly entered (or pairing fails for another reason), the screen advances to the appropriate one of screens 5079, 5080, 5081 for incorrect pairing code, incorrect serial number, and time out respectively, and on to screen 5084 with selection of the okay option 5590. If the paring code is correctly entered (and pairing otherwise succeeds), the display 39 illustratively advances to screen 5085.1 and indicates that the device "BLUESNAPSP-B76" is now paired as indicated by the indicator dot 5584. On screen 5085.1, a user can make active other devices by toggling, for example, to advance to screen 5085.2.

As shown on FIG. 58B, on screen 5066 a user can make active the scan devices option 5582 and advance to screen 5077. Selection of the scan devices option 5582 performs a Bluetooth scanning operation and advances to screen 5078. Screen 5078 illustratively shows a time bar (circle) 402 which decreases to show progress of the scanning operation, and displays information as to whether all or less than all devices were scanned before advancing to screen 5077. Screen 5078 illustratively includes a stop option 5592 for terminating the scan operation.

As shown in FIG. 58B, on screen 5066 a user can select one of the other (unpaired) devices, illustratively device "AGV-2725JP"), to advance to screen 5067 and display a pairing code for entry into the other device. Correct entry of the pairing code into the other device advances to the appropriate one of screens 5079, 5080, 5081. Because a device ("FS901_0000006C") is already paired, confirmation of the correct pairing code advances to screen 5068 to confirm that the previously paired device ("FS901_0000006C") should be replaced with the selected device ("AGV-2725_IP"). Confirmation advances to screen 5070 which illustratively shows the device "AGV-2725_IP" as the paired device as indicated by the indicator dot 5584. On screen 5070, selection of the paired device "AGV-2725JP" advances to screen 5071 on FIG. 58C to permit section of the delete option 5588 to perform deletion of the paired device. Selection of the delete option 5588 executes the deletion operation and advances to screen 5072 for 2 second before advancing to screen 5073.

Returning briefly to screen 5061 as shown in FIG. 58A, toggling downward illustratively makes active the Wi-Fi option 5574 and advance to screen 5088. Selection of the Wi-Fi_33 option 5574 illustratively advances to screen 5089 and permits selection of an available networks option 5594, a settings option 5596, and a status option 5598. Section of the available network option 5594 illustratively prevents a list of networks 5600 for selection to connect thereto. In the illustrative embodiment, the "NETWORK 1" is illustratively connected and toggling to other networks (e.g., "NETWORK 1 . . . 6"; as shown in screens 5091-5093) illustratively permits selection of the same to perform a connection operation. On selection of another network, if required, a password can be entered as suggested in screens 5096, 5097-5106 in FIGS. 59A-59C. Toggling to the bottom of the list 5600 illustratively permits selection of a search option 5602 for finding Wi-Fi_33 networks within range of the apparatus 10, 1010, 2010 as shown on screen 5094 in FIG. 59B. On screen 5094, selection of the search option 5602 illustratively executes the search operation and advances to screen 5095 to indicate progress of the search operation and to present a stop option 5604 for terminating the search operation, the selection of which illustratively returns to screen 5090.

Figure 59A:
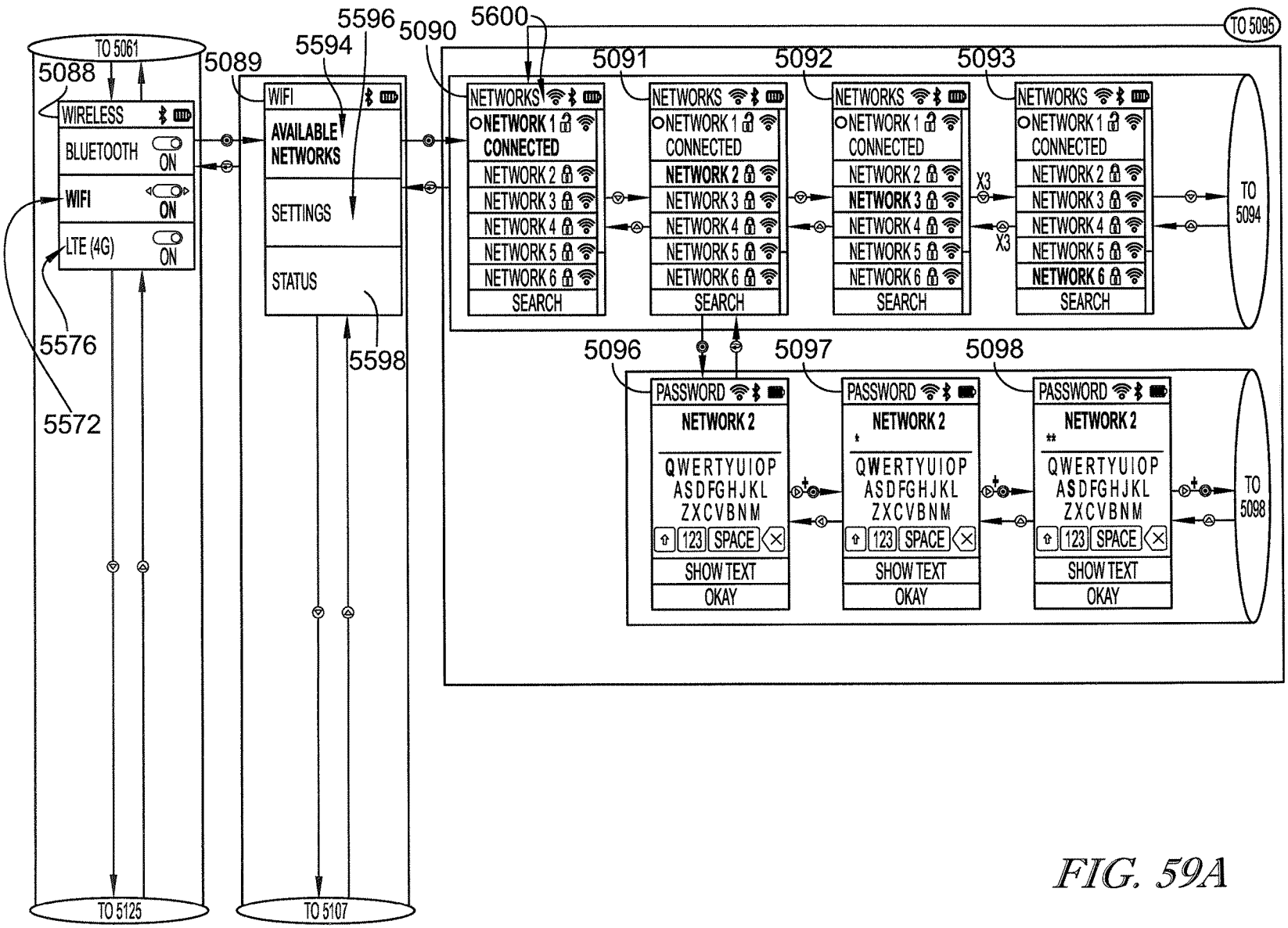
Figure 59B:
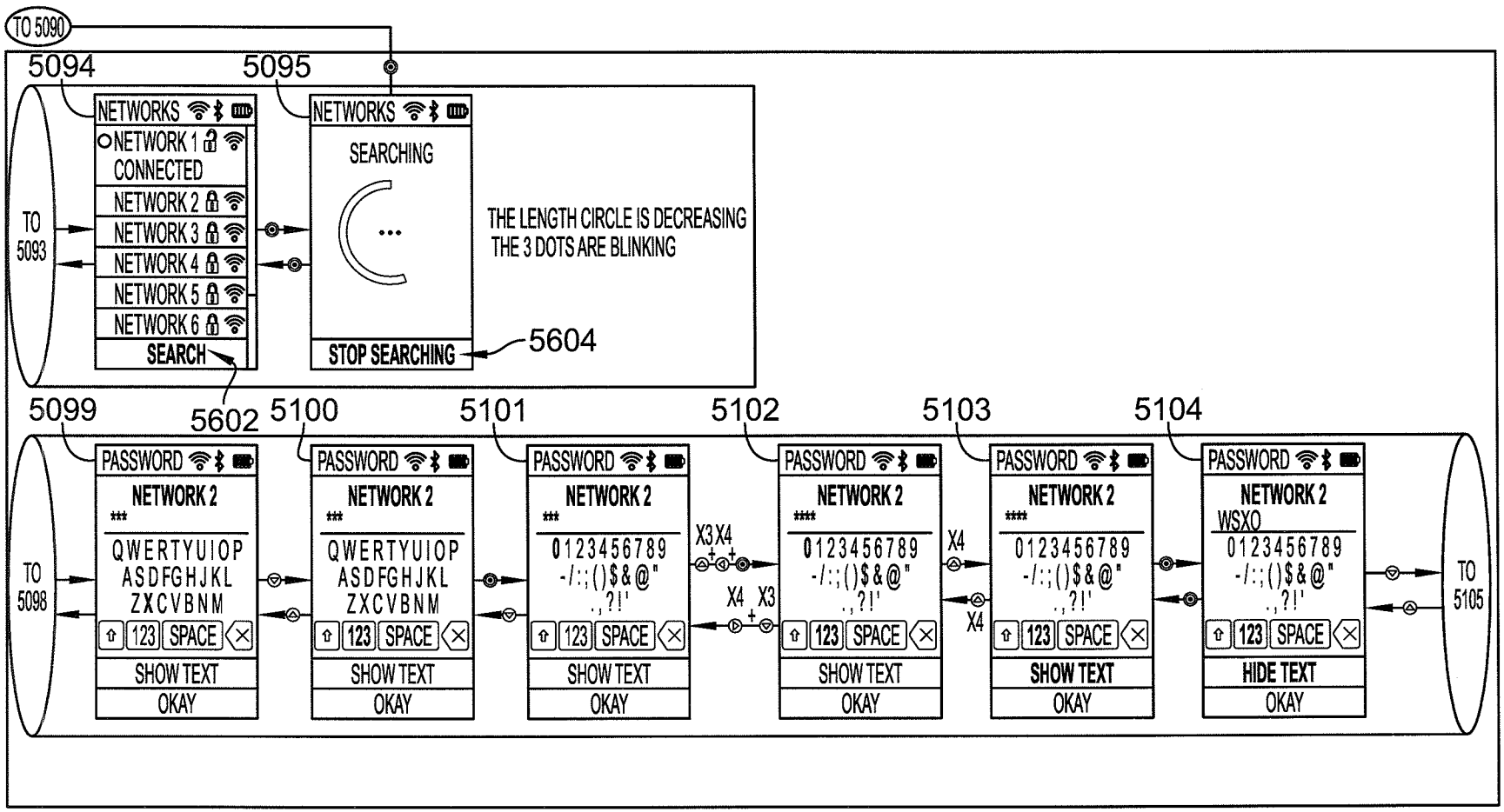
Figure 59C:
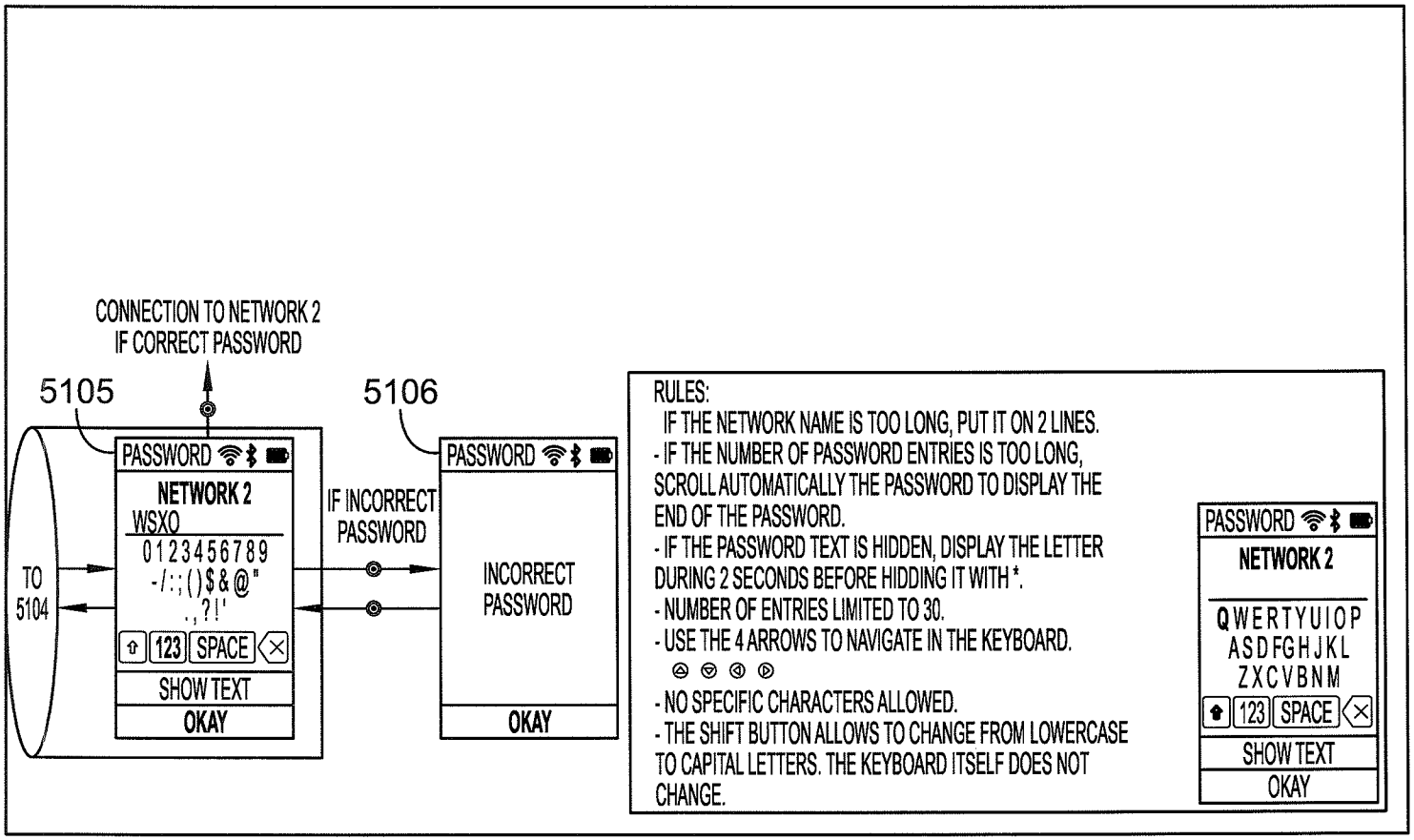
Figure 59D:
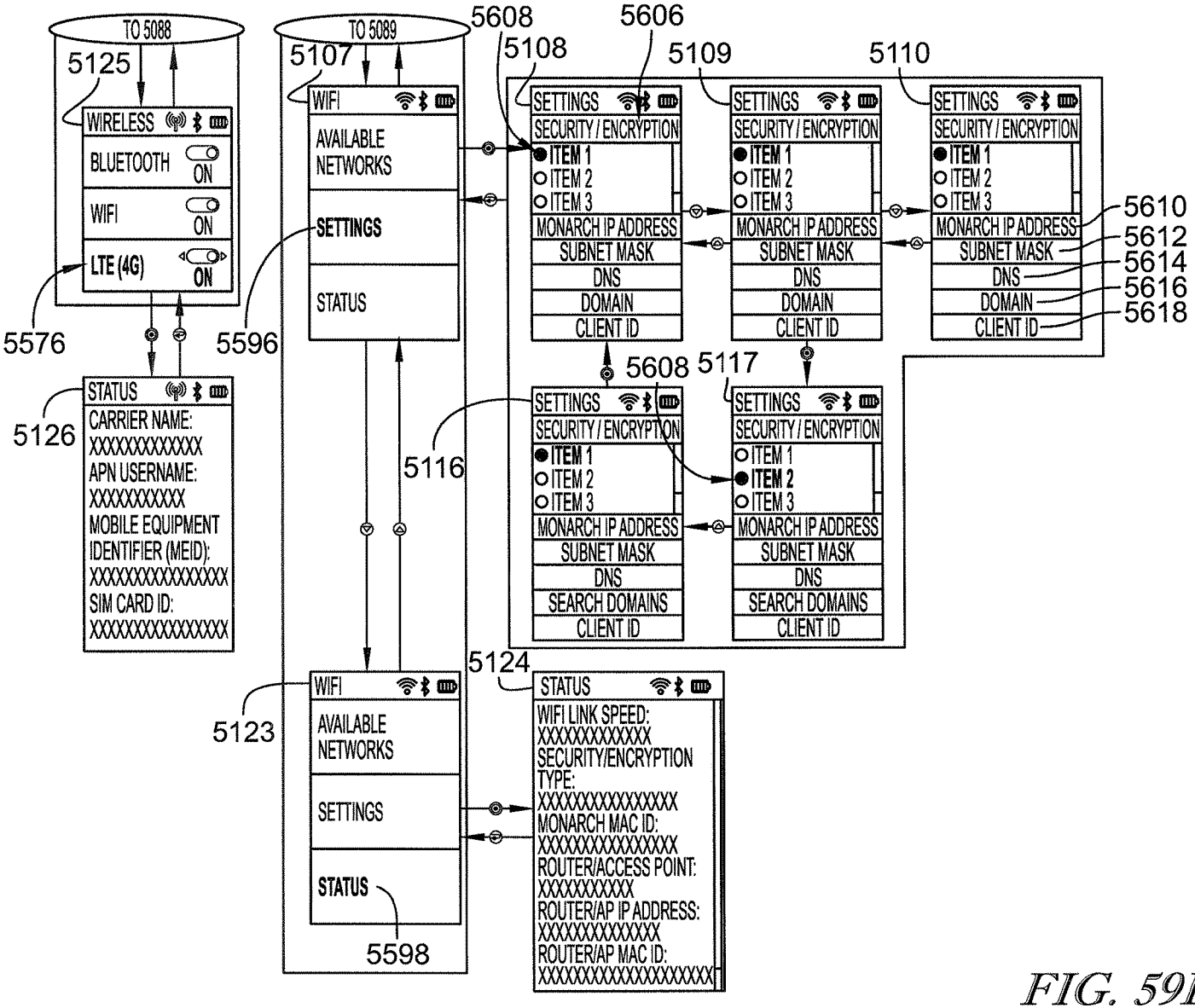

As shown in FIG. 59A, on screen 5089, toggling downward illustratively make active the settings option 5596 and advances to screen 5107 (as shown in FIG. 59D). Selection of the settings option 5596 illustratively presents security list 5606 including Items 1, 2, 3 On screen 5108, Item 1 is currently set as indicated by the corresponding indicator dot 5608 being filled in while the indicator dots 5608 for Items 2 and 3 remain unfilled (inactive). On screen 5108, toggling downward makes active Item 2 as indicated in bold script and advances to screen 5108. On screen 5108, selection of Item 2 advances to screen 5117 and makes the corresponding indicator dot 5608 filled in while making the indicator dots 5608 of Items 1 and 3 unfilled. On screen 5117, toggling upward makes active Item 1 and subsequent selection advances to screen 5108 as shown in FIG. 59D.

As shown in FIG. 59D, on screen 5109, toggling downward makes active Item 3 and advances to screen 5110. A number of security options 5610-5618 are available for each Item 1, 2, 3. On screen 5110, toggling downward makes active an IP address option 5610 as indicated in bold script and advances to screen 5111. On screen 5111, Item 1 remains selected as indicated by the indicator dot 5608 being filled in and selection of the active IP address option 5610 advances to screen 5118 to permit entry and/or alteration of the IP address value corresponding to Item 1.

As shown in FIG. 59D, on screen 5118, the currently entered IP address value for Item 1 is illustratively shown as 192.168.1.2. A user can illustratively alter the current IP address value for Item 1 into the text field 5620 by navigating text entry options 5622. Acceptance of the IP address value for Item 1 as entered is illustratively achieved by selection of the Okay option 5624 which stores the IP address of Item 1 and advances to screen 5111.

Figure 59E:
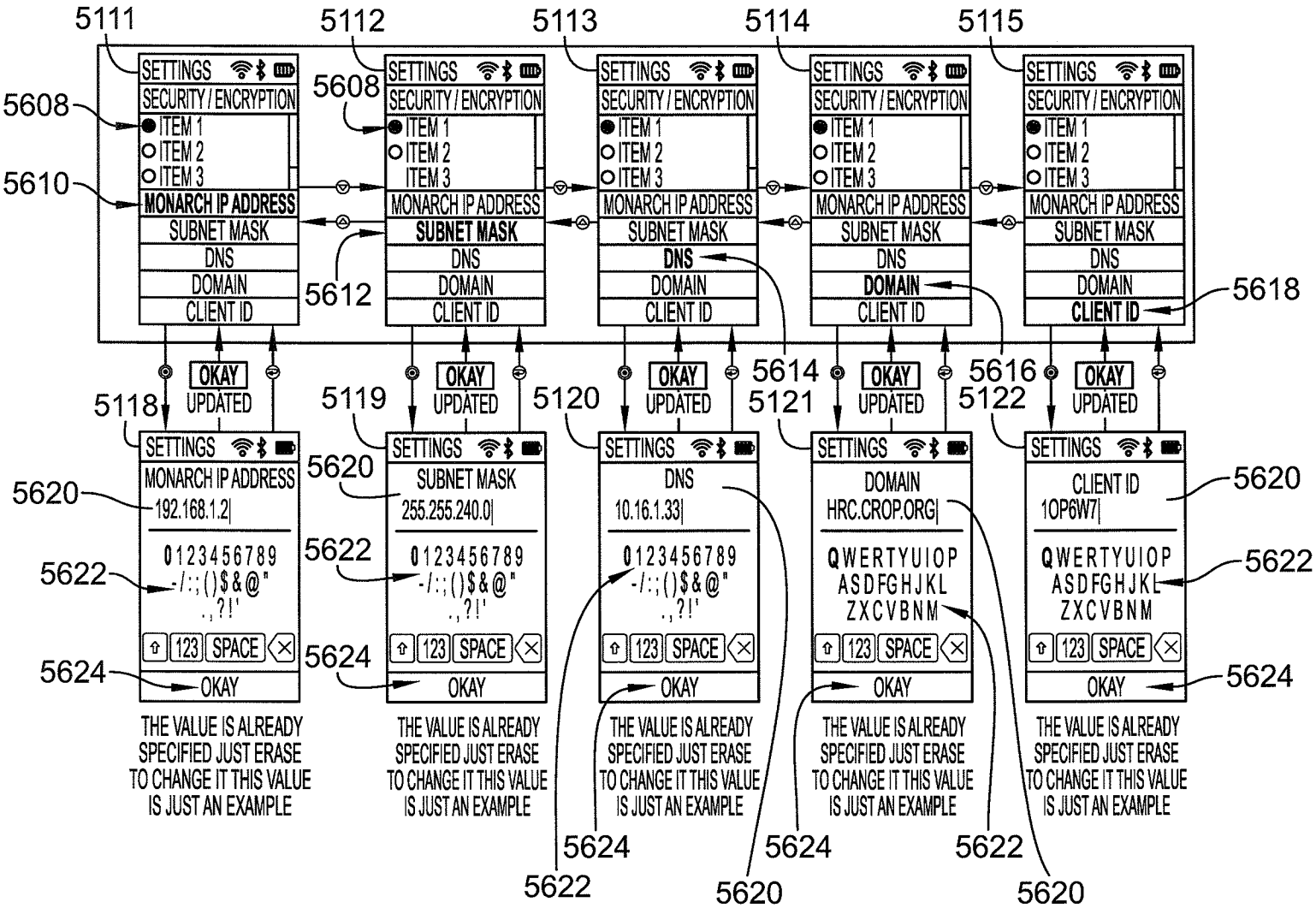

On screen 5111, toggling down makes active the subnet mask option 5612 and advances to screen 5112 as shown on FIG. 59E. On screen 5112, Item 1 remains selected as indicated by the indicator dot 5608 being filled in and selection of the subnet mask option 5612 advances to screen 5119 to permit entry and/or alteration of the subnet mask value for Item 1, illustratively shown as "255.255.240.0" within the text field 5620. The subnet mask value is illustratively entered and/or altered in similar manner to the IP address value using the text entry options 5622.

On screen 5112, toggling down makes active the DNS option 5614 and advances to screen 5113 as shown on FIG. 59E. On screen 5113, Item 1 remains selected as indicated by the indicator dot 5608 being filled in and selection of the DNS option 5614 advances to screen 5120 to permit entry and/or alteration of the DNS value for Item 1, illustratively shown as "10.13.1.33" within the text field 5620. The DNS value is illustratively entered and/or altered in similar manner to the IP address and subnet mask values using the text entry options 5622.

On screen 5113, toggling down makes active the Domain option 5616 and advances to screen 5114 as shown on FIG. 59E. On screen 5114, Item 1 remains selected as indicated by the indicator dot 5608 being filled in and selection of the Domain option 5616 advances to screen 5121 to permit entry and/or alteration of the Domain value for Item 1, illustratively shown as "HRC.CROP.ORG" within the text field 5620. The Domain value is illustratively entered and/or altered in similar manner to the IP address, subnet mask, and DNS values using the text entry options 5622.

On screen 5114, toggling down makes active the Client ID option 5618 and advances to screen 5114 as shown on FIG. 59E. On screen 5114, Item 1 remains selected as indicated by the indicator dot 5608 being filled in and selection of the Client ID option 5618 advances to screen 5121 to permit entry and/or alteration of the Client ID value for Item 1, illustratively shown as "1OP6W7" within the text field 5620. The Client ID value is illustratively entered and/or altered in similar manner to the IP address, subnet mask, DNS, and Domain values using the text entry options 5622.

As shown in FIG. 59D, on screen 5107, toggling downward makes active status option 5598 and advances to screen 5123. On screen 5123, selection of the status option 5598 illustratively presents Wi-Fi_33 status information and advances to screen 5124. On screen 5124, Wi-Fi_33 status information illustratively includes an indication of the applicable Wi-Fi_33 link speed, security/encryption type, the media access card (MAC) ID for the percussion therapy apparatus (Monarch), router/access point (AP), router/AP IP Address, router/AP MAC ID, but in some embodiments, may include any number and/or type of wireless communications information.

As shown in FIG. 59A, on screen 5088, toggling down illustratively makes active the LTE (4G) option and advances to screen 5125. As shown in FIG. 59D, on screen 5125 the LTE (4G) option 5576 is active and the respective switch 400 is on. Selection of the LTE (4G) option 5576 advances to screen 5126 and presents various wireless information, for example but without limitation, a carrier name, an APN username, a mobile equipment identifier (MEID), and/or a sim card ID as shown in FIG. 59D. In some embodiments, screen 5126 may include any number and/or type of wireless communications information.

Returning briefly to FIG. 58A, on screen 5060, toggling downward makes active the language option and advances to screen 5127 (as shown on FIG. 60A). On screen 5127, selection of language option 5568 permits selection of the language for use on the display and advances to screen 5128 as shown in FIG. 60A. On screen 5128, the language is currently set to English as indicated by indicator dot 5626 being filled in while the indicator dots 5626 corresponding to other languages (Duetsch, Espanol, Francias) are unfilled. On screen 5128, the Duetsch language is active and other languages can be made active by appropriate toggling (as suggested on screens 5128-5135). On screen 5130, the Spanish language is active and selection thereof illustratively changes the display language to Espanol and advances to screen 5131. On screen 5131, the Spanish ("Espanol") language is active and selected and toggling upward makes active the English language and advances to screen 5132. On screen 5132, selection of the English language changes the display language to English and advances to screen 5133 as shown in FIG. 60B. On screen 5133, further downward toggling makes active the Spanish and French languages and advances to screens 5134 and 5135, in turn.

As shown in FIG. 60A, on screen 5127, toggling downward makes active the color themes option 5570 and advances to screen 5136. Selection of the color themes option 5570 permits selection of the general color pattern "skins" on the display 39 and advances to screen 5137. On screens 5137-5141, appropriate toggling and selection of the colors options (e.g, blue, orange, green, pink, red) sets the display 39 accordingly.

Returning to FIG. 58A, on screen 5059, toggling downward illustratively makes active the device information option 5524 and advances to screen 5142 as shown in FIG. 61A. Selection of the device information option 5524 illustratively presents a general option 5628, an errors option 5630, and a support option 5632. Selection of the general option 5628 illustratively present general device information and advances to screen 5144. General device information illustratively includes software revision no, total therapy hours, and FCC ID, but in some embodiments may include any number and/or type of general information about the apparatus 10, 1010, 2010. On screen 5142, toggling downward makes active the errors option 5630 and advances to screen 5145 as shown in FIG. 60C.

In FIG. 60C, on screen 5145 selection of the error option 5630 illustratively presents a list of errors 5634 and advances to screen 5146. On screens 5146-5148, the list of error 5634 is illustratively shown including the last 10 errors. A reset button 5636 is selectable to clear the list of errors 5634, the selection of which advances to screen 5149 for confirmation to clear the list of errors 5634. Confirmation to clear the list of error 5634 illustratively clears the list of errors 5634 and advances to screen 5151. On screen 5151, a new list of errors 5638 (preceding the list of errors 5634) is presented.

As shown in FIG. 60C, on screen 5145, toggling downward makes active the support option 5632 and advances to screen 5152. In the illustrative embodiment, selection of the support option 5632 present support information including contact phone number and web address. In some embodiments, the support option 5632 may include support instructions, support functions (e.g., diagnosis operations), and/or support request operations.

Returning now to FIG. 61A, on screen 5142, toggling downward illustratively makes active the service option 5526. Selection of the service option 5526 prompts the user for a password for access and advances to screen 5155. A user can enter a password into the text field 5635 (illustratively shown on screen 5156) using the text entry options 5637 and can submit the entered password by selecting the Okay button 5639. If the submitted password is incorrect, a message is display as shown on screen 5161 in FIG. 61B. If the submitted password is correct, the service options 5640 are presented on screen 5157.

As shown in FIG. 61A, on screen 5157, the service options 5640 illustratively include a system reset option 5642, a set clock option 5644, a set date option 5646, and a service+option 5648. Selecting the system reset option 5642 advances to screen 5158 and presents a confirmation message. On screen 5158, the user is prompted to confirm that system reset is desired by toggling appropriately to either yes or no as shown on screens 5158, 5159. Confirmation of system reset performs a system reset to default settings and advances to screen 5160. Screen 5160 illustratively presented a completion message and selection of the Okay button 5650 illustratively returns to screen 5157. On screen 5157, appropriately toggling downward makes active either of the set clock option 5644 and the set date option 5646 and advances corresponding through screens 5162 and 5163.

As shown in FIG. 61B, on screens 5162 and 5163, appropriate toggling and selection of either of the set clock option 5644 or the set date option 5646 permits adjustment of the current time and date respectively as shown on screens 5163-5168. On screen 5165, toggling downward illustratively makes active the service+option 5648 and advances to screen 5169. Selecting the service+option 5648 illustratively presents power source information (battery) including battery capacity, battery level, and battery temperature, but in some embodiments, may include any number and/or type of information.

As shown in FIG. 63, the top status bar 380 illustratively includes the battery life indicator 386 which communicates a battery status as shown on screens 5000A-5000A7. On screen 5000A, the battery life indicator 386 is shown as empty and includes an electrical symbol therein to indicate that charging is taking place. The screens 5000A2-5000A5 each indicate a corresponding amount of battery life, for example, about 75% to about 100% (screen 5000A2), about 50% to about 75% (screen 5000A3), about 25% to about 50% (screen 5000A4), and about 20% to about 25% (screen 5000A5), respectively.

As shown on screen 5000A6, the top status bar 380 illustratively includes a Wi-Fi_33 indicator 402 to indicate that a Wi-Fi_33 connection is enabled. As shown on screen 5000A6, the top status bar 380 illustratively includes an LTE indicator 404 to indicate that an LTE connection is enabled. In the illustrative embodiment, the presence of the indicators 384, 402, 404 indicate the specific connection type is enabled but not connected, however, upon connection the respective indicator illustratively changes color, illustratively from gray (enabled, not connected) to white (paired and/or connected). In some embodiments, disabled, enabled (not connected), and connected wireless connectivity may be indicated by any suitable visual distinction.

As shown in FIG. 63, a number of service screens 5000E-5000E7 provide interaction when a service tool is connected to the power and control circuitry 1412. If a therapy session is operating, and a service tool is subsequently attached to the power and control circuitry 1412, on screen 5000E a warning message is shown indicating that the service tool cannot presently operate. Upon attachment of the service tool when no therapy is operating, screen 5000E1 is presented to request confirmation of connecting the service tool. Upon confirming (selection of yes on screen 5000E2), a service password is requested on screen 5000E3. A user can enter a service password into the text field 5652 on screens 5000E3 and 5000E4 and submit for validation. Upon correct submission of the service password, the service tool is connected and an indication message is shown on screen 5000E5. An incorrect password prompts screen 5000E6 indicating no connection of the service tool. Upon disconnection of the service tool, a message indicating the disconnection is presented on screen 5000E7.

In the illustrative embodiment, subject matter that is active and/or selected is described as being indicated by one or more of allocating a tab, designated indicators, and/or bold script, but in some embodiments active and/or selected subject matter may be indicated by any visual distinction, for example but without limitation, color, font, form, etc.

In the illustrative embodiment as shown in FIG. 64, an attachment assembly 410 for securing the percussive devices 18, 1018, 2018, 3018, 4018 with the coverings 12, 1012, 2012 illustratively includes the panel 14, 16, 1014, 1016, 2014, 2016, a mounting bracket 412, the percussive device 18, 1018, 2018, 3018, 4018, and contact padding 26, 28, 1026, 1028. In the illustrative embodiment, the mounting bracket 412 is rigidly attached to the panel 14, 16, 1014, 1016, 2014, 2016 and the percussive device 18, 1018, 2018, 3018, 4018 is secured to the mounting bracket 412.

Figure 64A:
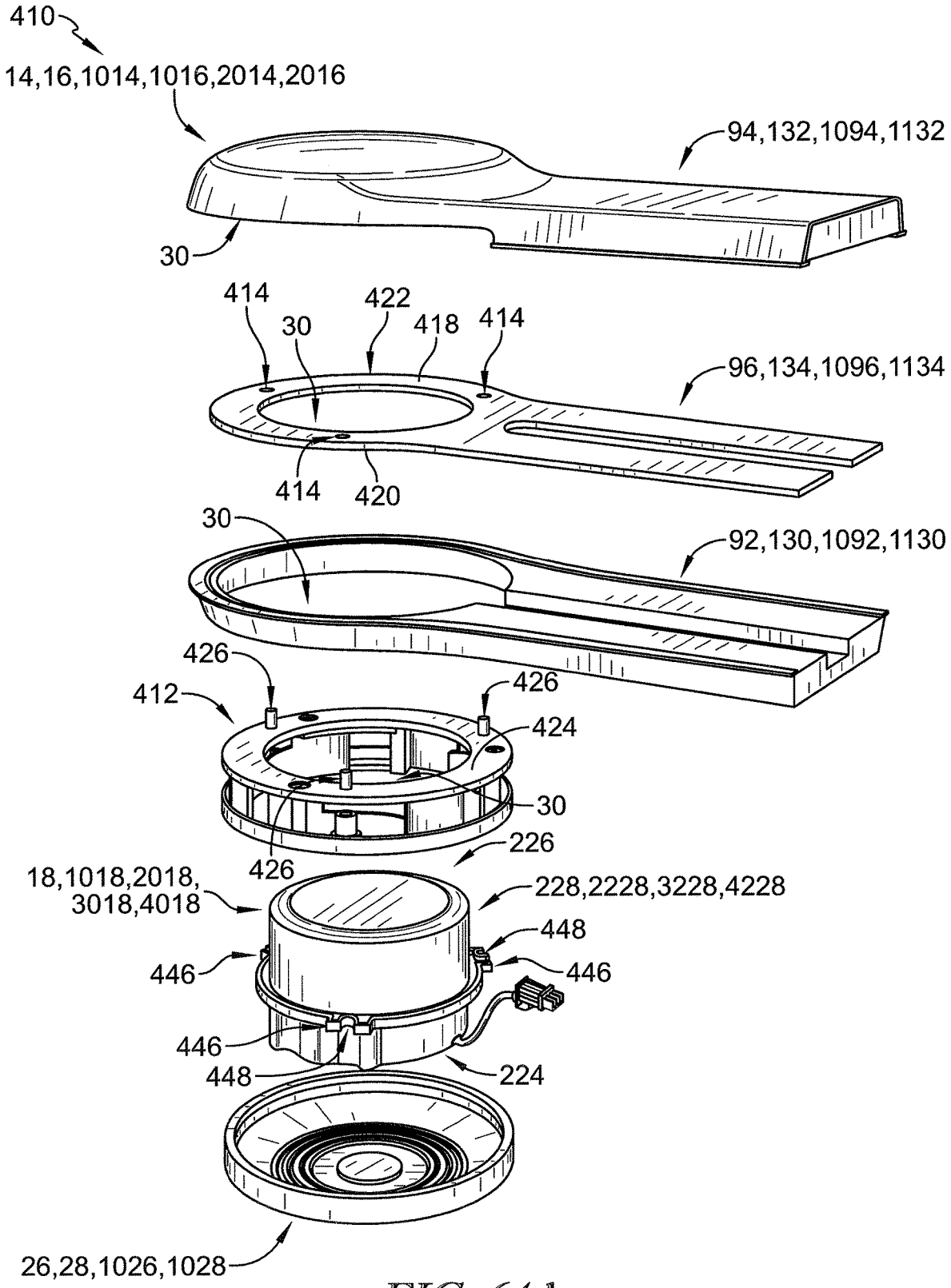
FIG. 64A is an exploded perspective view of the percussive device of FIGS. 1, 16A and 16B, and 26 showing an attachment system for securing the percussive devices to the covering and showing that the attachment system includes an attachment ring that is secured to the inner pane of the covering, and showing that the housing of the percussive device inserts into the attachment ring and twists to secure the housing with the attachment ring.

As shown in FIG. 64A, the panel 14, 16, 1014, 1016, 2014, 2016 illustratively includes the panes 92, 94, 96, 130, 132, 134, 1092, 1094, 1096, 1130, 1132, 1134 disclosed above. The frame pane 96, 134, 1096, 1134 illustratively includes a number of holes 414 for receiving stems 416 of the mounting bracket 412 for attachment therebetween. The holes 414 are illustratively formed on a ring 422 of the frame pane 96, 134, 1096, 1134 that defines the opening 30. The holes illustratively extend through the ring 422 between opposite surfaces 418, 420 thereof.

The mounting bracket 412 illustratively includes a mount surface 424 and the stems 426 extend from the mount surface 424 for insertion within the holes 414 of the frame pane 96, 134, 1096, 1134 as shown in FIG. 64A. The stems 426 are each illustratively arranged complimentary to one of the holes 414 for reception therein. The mount surface 424 illustratively engages the surface 420 of the ring 422 of the frame pane 96, 134, 1096, 1134 through the inner pane 92, 130, 1092, 1130 and the stems 426 are inserted through the holes 414. In the illustratively embodiment, the stems 426 receive fasteners from the opposite side of the frame pane 96, 134, 1096, 1134 to attach the mounting bracket 412 with the panel 14, 16, 1014, 1016, 2014, 2016. The percussive device 18, 1018, 2018, 3018, 4018 illustratively fastens to the mounting bracket 412.

The percussive device 18, 1018, 2018, 3018, 4018 illustratively includes the housing 228, 2228, 3228, 4228 and wings 446 extending radially from the housing 228, 2228, 3228, 4228 for engagement with the mounting bracket 412 as shown in FIG. 64A. In the illustratively embodiment, the wings 446 are illustratively arranged circumferentially about the housing 228, 2228, 3228, 4228 and each include a gap 448 defined therethrough for receiving a fastener.

Figure 64C:
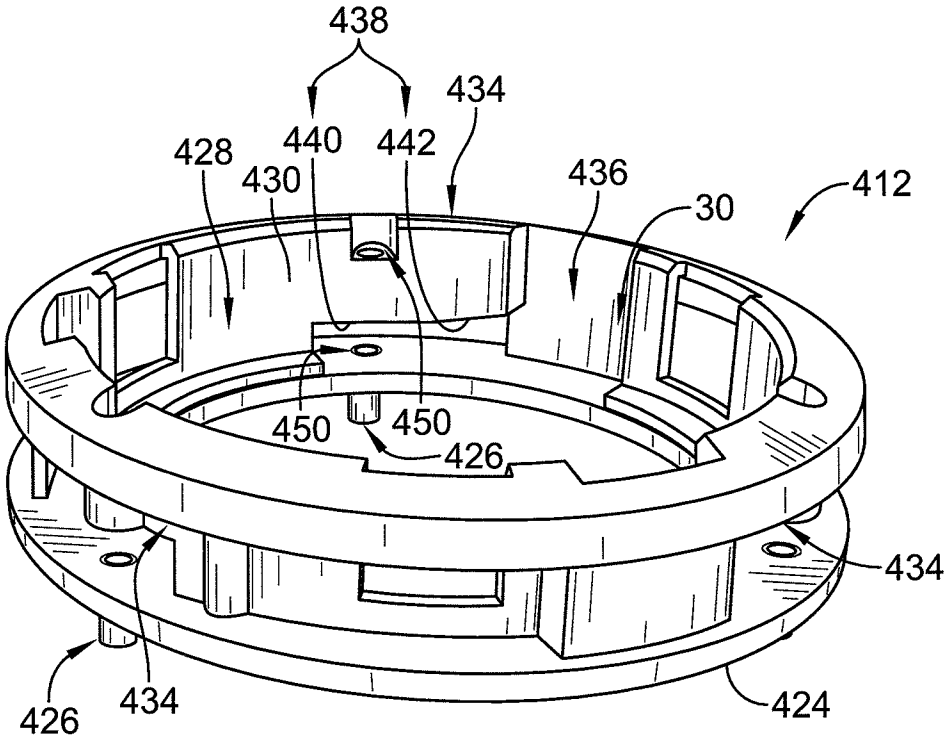
FIG. 64C is a bottom perspective view of the attachment ring of FIG. 64B showing that the attachment ring includes stop surfaces enabling a twist securing of the percussive device with the attachment ring.
Figure 64B:
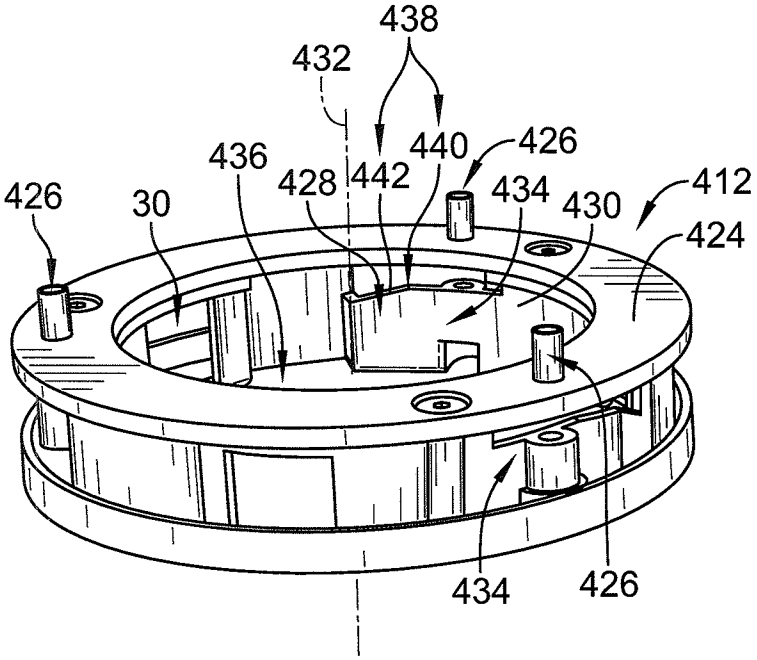
FIG. 64B is a perspective view of the attachment ring of FIG. 64A showing that the attachment ring includes stems for engagement with the frame pane.

As shown in FIGS. 64B and 64C, the mounting bracket 412 illustratively defines an opening 30 therethrough for receiving one of the percussive devices 18, 1018, 2018, 3018, 4018. The mounting bracket 412 illustratively includes wall 428 having an inner surface 430 that at least partially defines the opening 30. The wall 428 illustratively extends circumferentially about a central axis 432 to form fairings 434 having the inner surface 430 positioned at radial distance from the axis 432. The fairings 434 illustratively engage with the wings 446 of the percussive device 18, 1018, 2018, 3018, 4018 to secure the mounting bracket 412 with the percussive device 18, 1018, 2018, 3018, 4018.

The wall 428 illustratively defines receptacles 436 located between adjacent fairings 434. The receptacles 436 are illustratively formed as sections of the wall 428 that have increased radial distance from the axis 432 relative to the inner surface 430 as shown in FIGS. 64B and 64C. The receptacles 436 are illustratively arranged complimentary to the wings 446 of the percussive device 18, 1018, 2018, 3018, 4018 to receive the wings 446 therein.

As shown in FIGS. 64B and 64C, the fairings 434 each illustratively include a stopper surface 438 that faces axially towards the stems 426. The stopper surface 438 illustratively includes a rest section 440 positioned angularly offset from the adjacent receptacle 436 and a ramped section 442. The ramped section 442 illustratively has an incline along the axial direction and extends from the receptacle 436 to the rest section 440 with increasing proximity to the stems 426 to form a ramp between the adjacent receptacle 436 and the rest section 440.

Figure 64D:
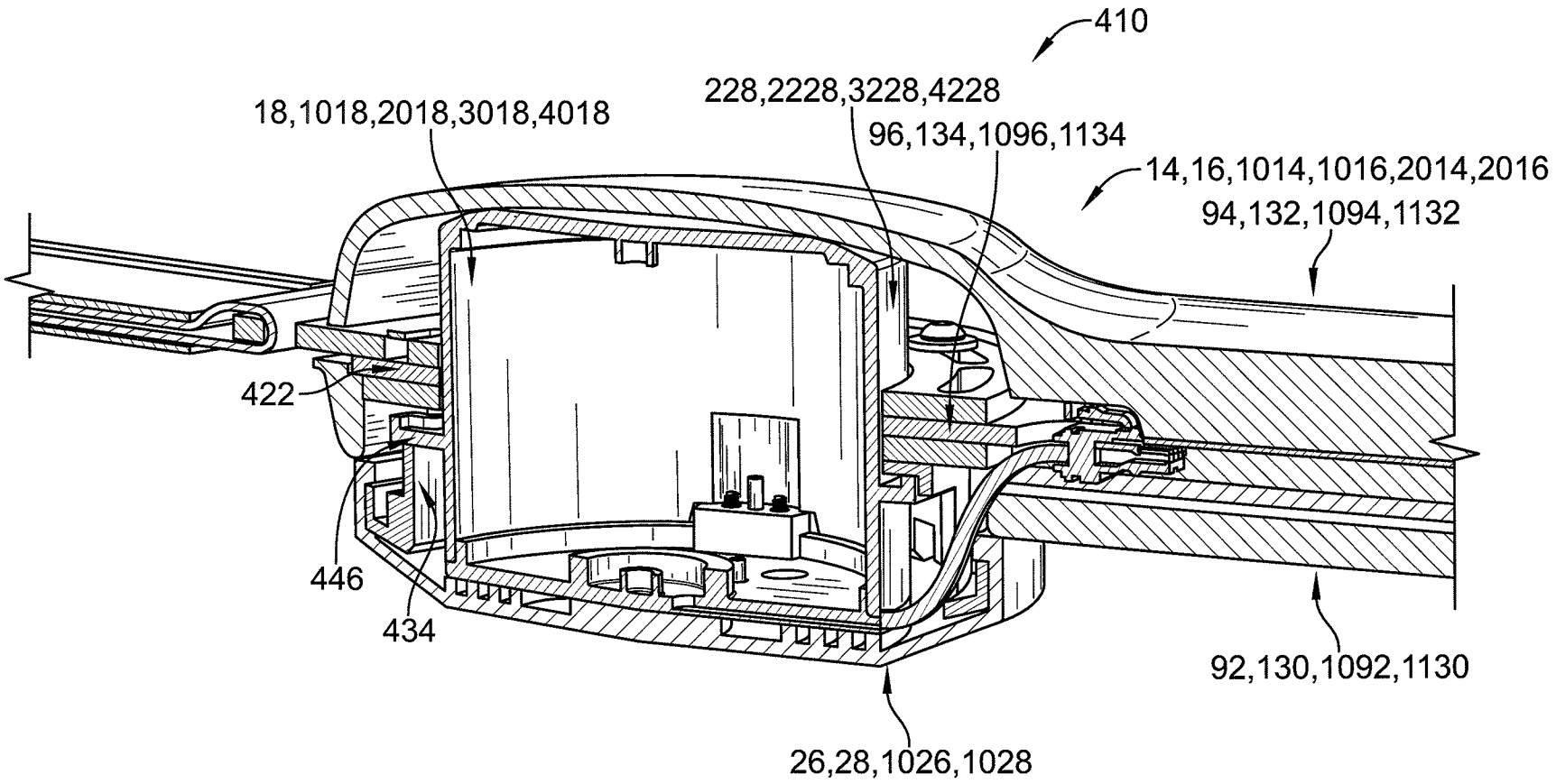
FIG. 64D is a perspective view of the attachment system of FIG. 64A in cross-section showing that the percussive device is engaged with the stop surfaces and received within an opening in the panel.

As shown in FIG. 64D, the percussive device 18, 1018, 2018, 3018, 4018 is inserted into the opening 30 of the mounting bracket 412 and rotated such that the wings 446 engage the stopper surface 438 to secure the percussive device 18, 1018, 2018, 3018, 4018 to the mounting bracket 412. The wings 434 are illustratively positioned within the receptacles 436 and a user can rotate the housing 228, 2228, 3228, 4228 to engage the wings 446 with the ramped sections 442 of the stopper surface 438. Under rotation, the wings 446 are wedged by the ramped sections 442 to the axial position of the rest section 440 and into a seated position in contact with the rest section 440. In the seated position, as shown in FIG. 64D, the gap 448 of each wing 446 is aligned with holes 450 of each of the wall 428 and the corresponding stem 426. Moreover, in the seated position, the gap 448 of each wing 446 is aligned with the corresponding holes 250 of the mounting bracket 412 to receive a fastener therethrough to prevent disengagement (untwisting) of the wings 446 and the fairings 434, and thereby securing the percussive device 18, 1018, 2018, 3018, 4018 with the mounting bracket 412. The contact padding 26, 28, 1026, 1028 illustratively attaches to the covering 12, 1012, 2012 over the percussive device 18, 1018, 2018, 3018, 4018 for interface with the patient's torso.

Figures 65A, 65B, 65C:
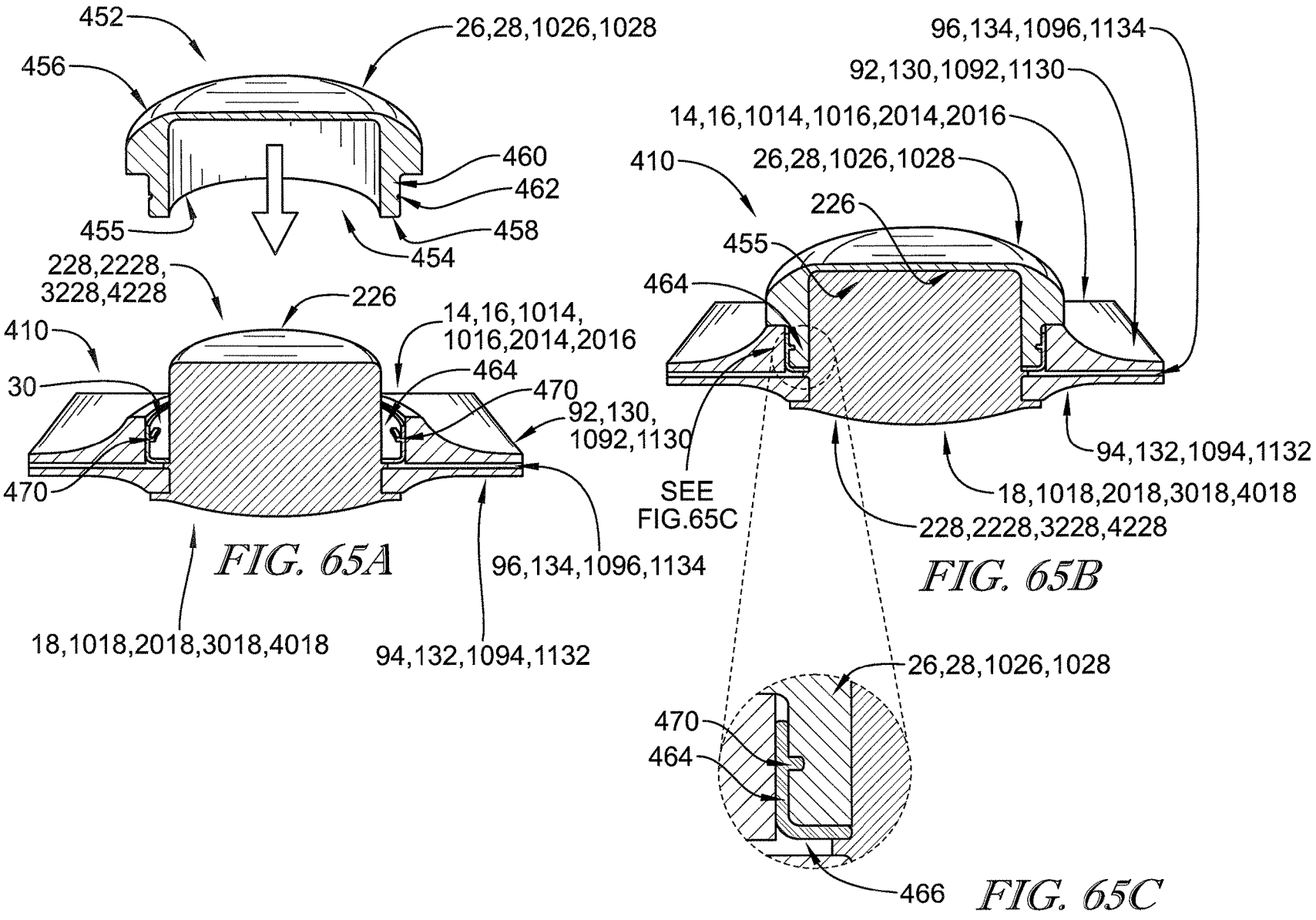
FIG. 65A is a perspective view of one of the percussive devices of the percussion therapy apparatuses of FIGS. 1, 16A and 16B, and 26 in cross-section to show that contact padding (exploded) is secured over an engagement end of the percussive device.
FIG. 65B is a perspective view of the one of the percussive devices of FIG. 64A showing that a retainer is engaged with the contact padding to secure the contact padding to the panel.
FIG. 65C is a closer view of a portion of the one of the percussive devices FIG. 64B showing that the retainer includes tabs engaged with a groove of the contact padding.

As shown in FIGS. 65A-65C, the contact padding 26, 28, 1026, 1028 illustratively includes a contact side 452 for engagement with the patient's torso and a connection side 454 for attachment about the percussive device 18, 1018, 2018, 3018, 4018 to the covering 12, 1012, 2012. The contact padding 26, 28, 1026, 1028 illustratively comprises a soft but firm, resilient material (for example but without limitation, foam) for easing the imposition of percussive force of the percussive devices 18, 1018, 2018, 3018, 4018 onto the patient's body. A set of contact paddings 26, 28, 1026, 1028 having different firmness and/or other properties can be used to permit customizable cushioning, for example but without limitation, to apply less firm contact padding to a sensitive area of the patient's body.

As shown in FIGS. 65A-65C, the contact padding 26, 28, 1026, 1028 illustratively defines a cavity 455 therein for receiving the engagement end 224 of the percussive device 18, 1018, 2018, 3018, 4018. The contact padding 26, 28, 1026, 1028 illustratively includes a head 456 arranged on the contact side 452 and a collar 458 extending from the head 456 on the connection side 454 for connection with the panel 14, 16, 1014, 1016, 2014, 2016. The collar 458 is illustratively embodied as a circular flange having an outer surface 460 and includes a groove 462 defined therein. The collar 458 illustratively engages the panel 14, 16, 1014, 1016, 2014, 2016 to secure itself about the percussive device 18, 1018, 2018, 3018, 4018.

A retainer 464 is disposed within the opening 30 of the inner pane 92, 130, 1092, 1130 of the panel 14, 16, 1014, 1016, 2014, 2016 as shown in FIG. 65A. The retainer 464 is illustratively embodied as a ring that is attached to the frame pane 96, 134, 1096, 1134 and that defines an opening 30 for receiving the percussive device 18, 1018, 2018, 3018, 4018 therethrough. The retainer 464 illustratively engages with the collar 458 of the contact padding 26, 28, 1026, 1028 to secure the contact padding 26, 28, 1026, 1028 with the covering 12, 1012, 2012.

As best shown in FIG. 65C, the retainer 464 illustratively includes a base wall 466 and a frame wall 468 extending perpendicularly from a radially outer end the base wall 466. The frame wall 468 illustratively includes a number of tabs 470 extending radially inward from the frame wall 468 and spaced apart axially from the base wall 466. The tabs 470 are illustratively inserted into the groove 462 of the collar 458 of the contact padding 26, 28, 1026, 1028 to secure the collar 458 to the panel 14, 16, 1014, 1016, 2014, 2016 with snap-fit connection.

Figure 66:
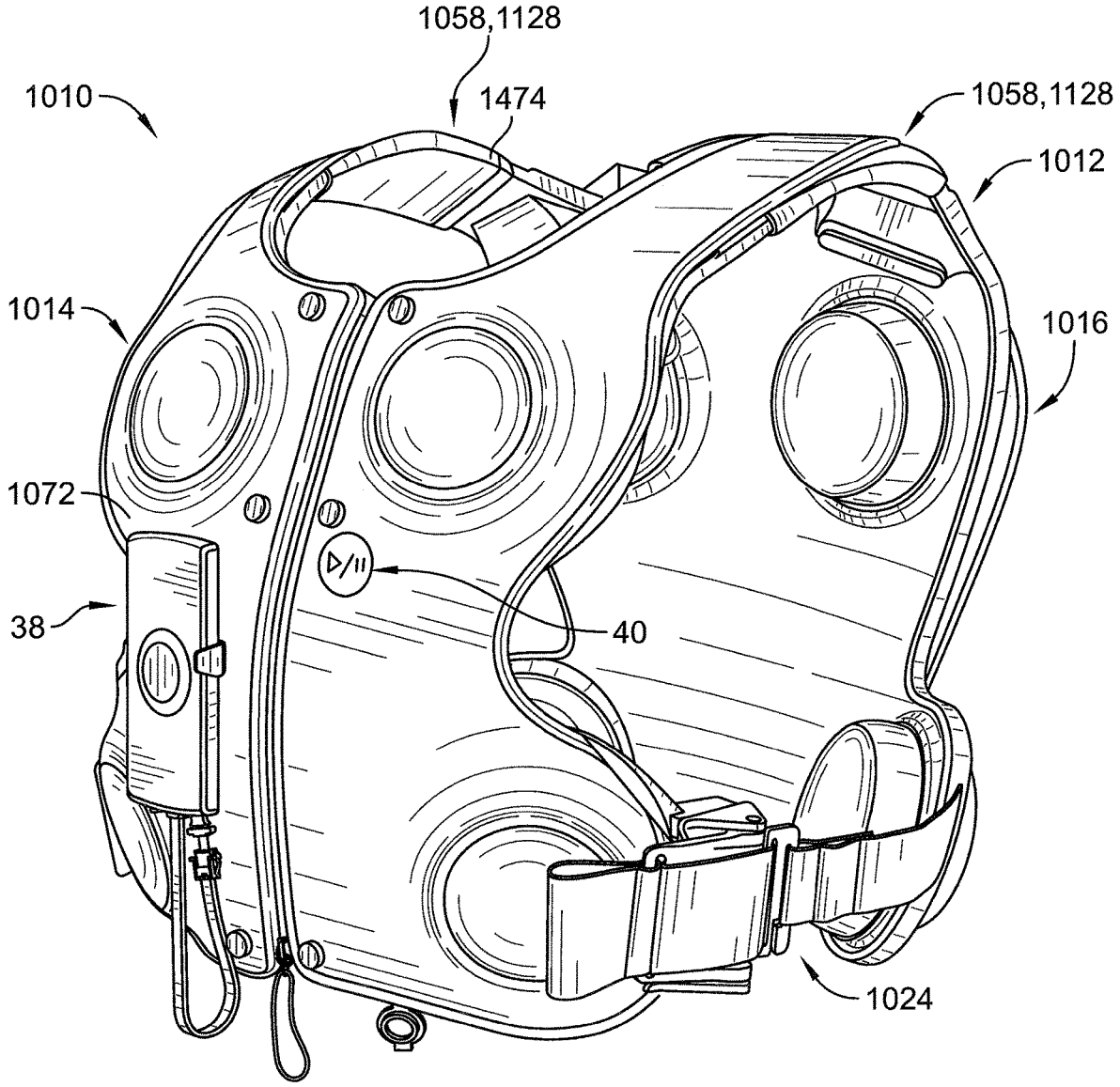
FIG. 66 is a front perspective view of the percussion therapy apparatus of FIG. 16A in high resolution and showing that an outer liner is attached to the front panel.

As shown in FIGS. 66-84, a percussion therapy apparatus 1010 is shown with high resolution graphics and illustratively including appropriate curvature. As shown in FIG. 66, the percussion therapy apparatus 1010 illustratively includes the outer liner 1472 attached to the covering 1012 to provide style, comfort, and protection. In the illustrative embodiment, the outer liner 1472 is attached to the chest panel 1014 to protect the chest panel 1014 from foreign substances and to provide style and comfort to the outside of the covering 1012. As shown in FIG. 66, the user interface 38 illustratively attaches to the covering 1012 outside of the outer liner 1472 while the break button 40 is operable from outside of the outer liner 1472.

Figure 67:
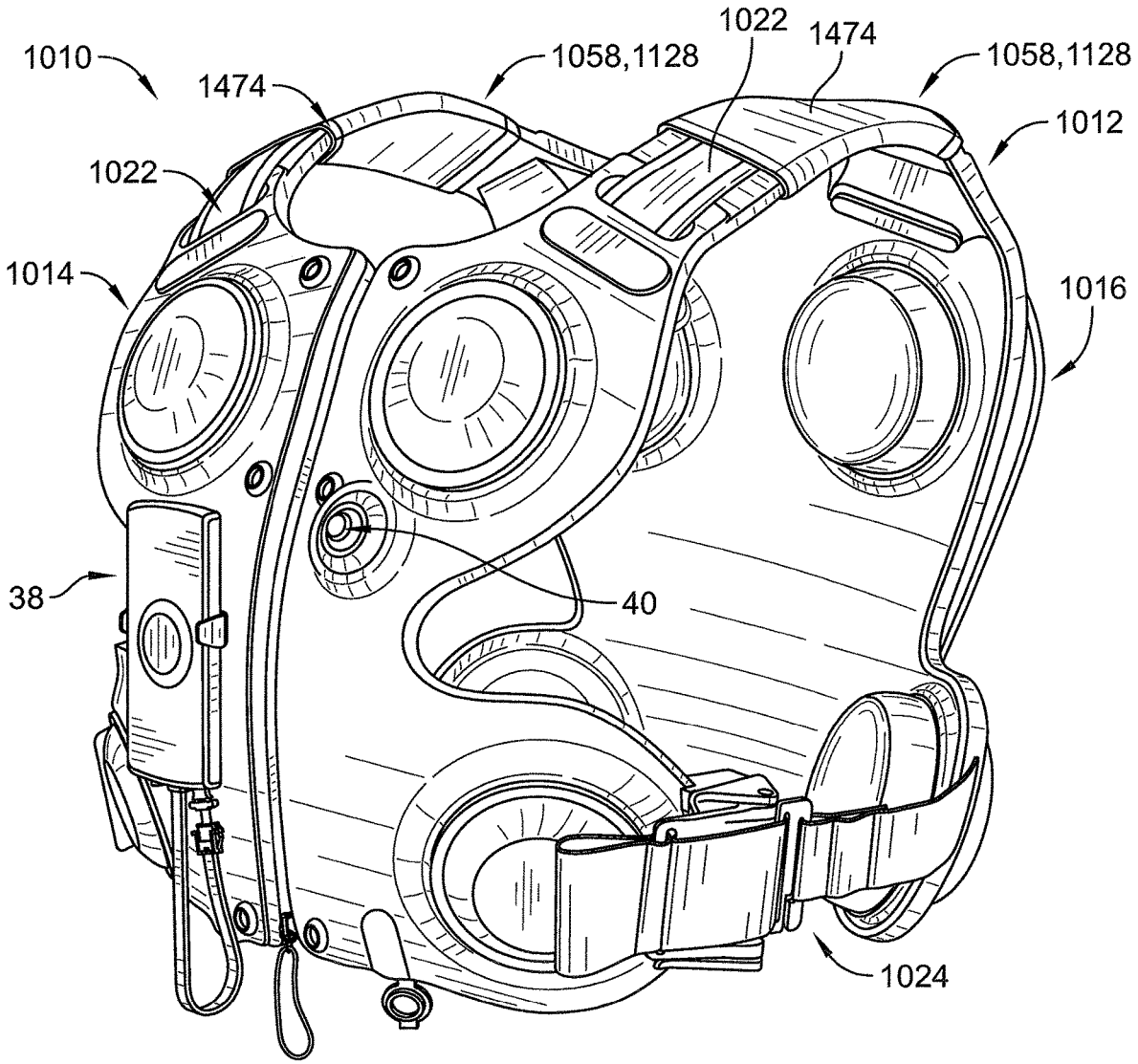
FIG. 67 is a front perspective view of the percussion therapy apparatus of FIG. 66 in high resolution and showing that the outer liner has been removed from the front panel.
Figure 68:
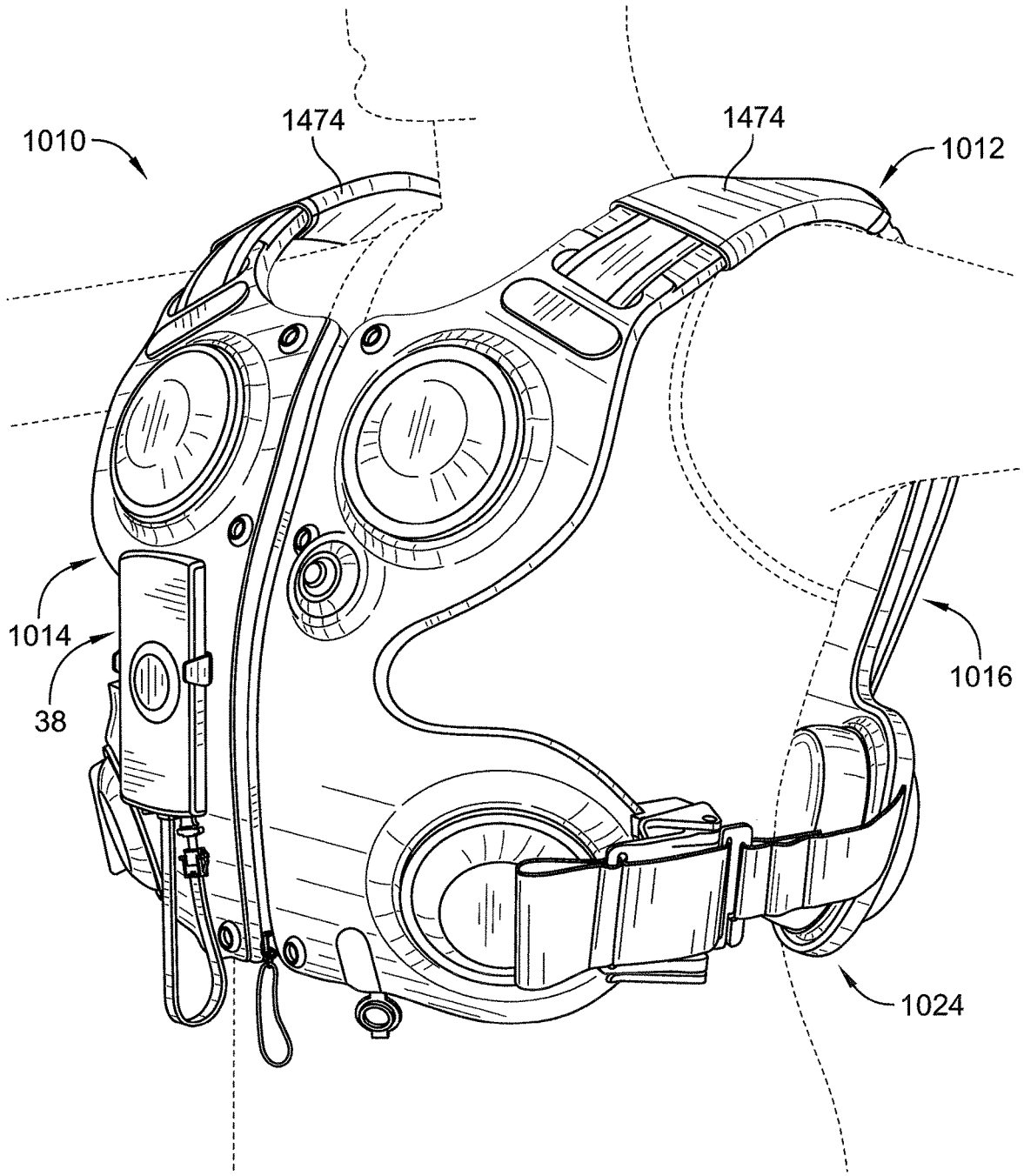
FIG. 68 is a front perspective view of the percussion therapy apparatus of FIG. 67 in high resolution showing the percussion therapy apparatus secured to a patient's torso.
Figure 69:
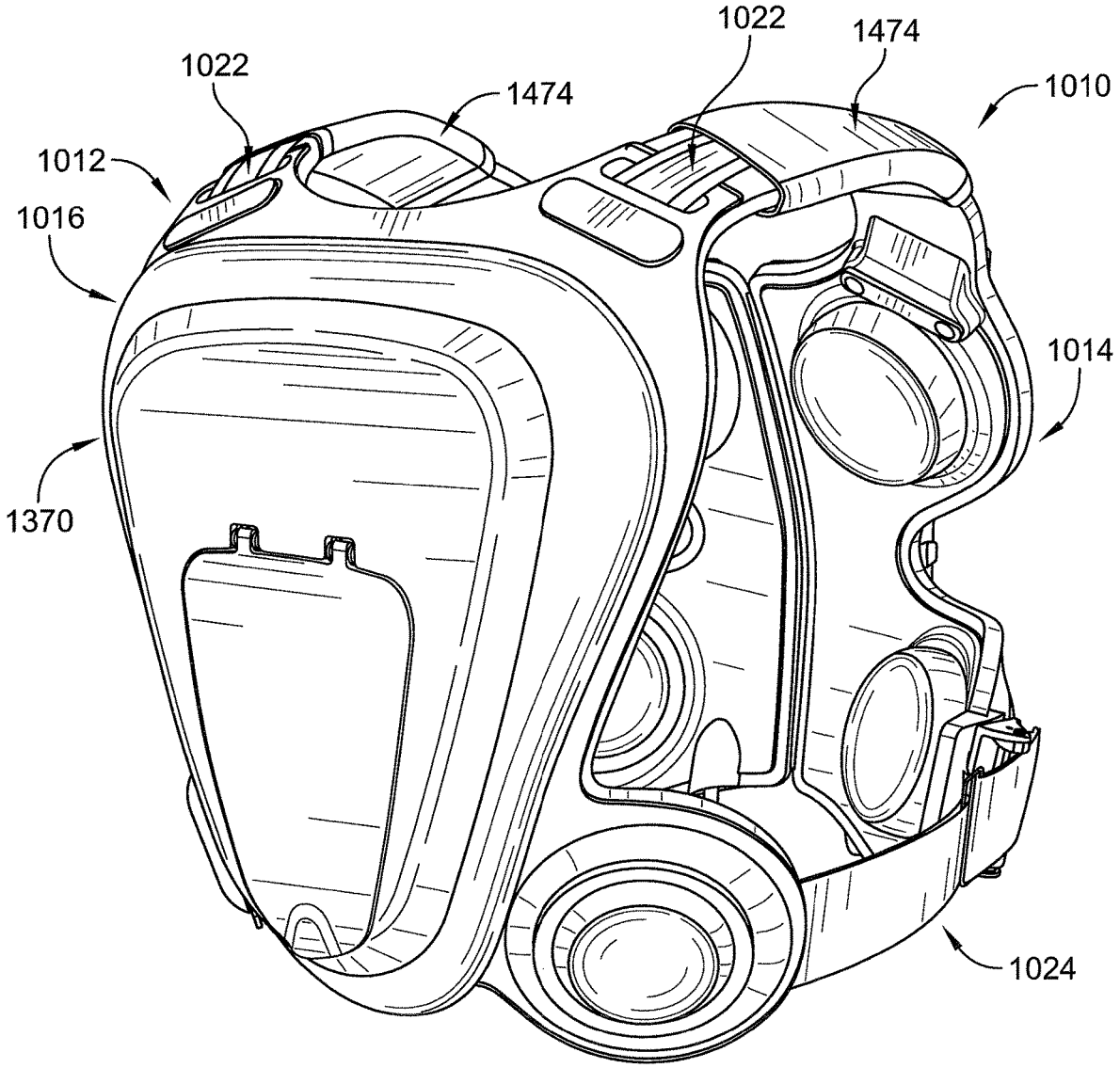
FIG. 69 is a rear perspective view of the percussion therapy apparatus of FIG. 66 in high resolution and showing that the outer cover is attached to the back panel.
Figure 70:
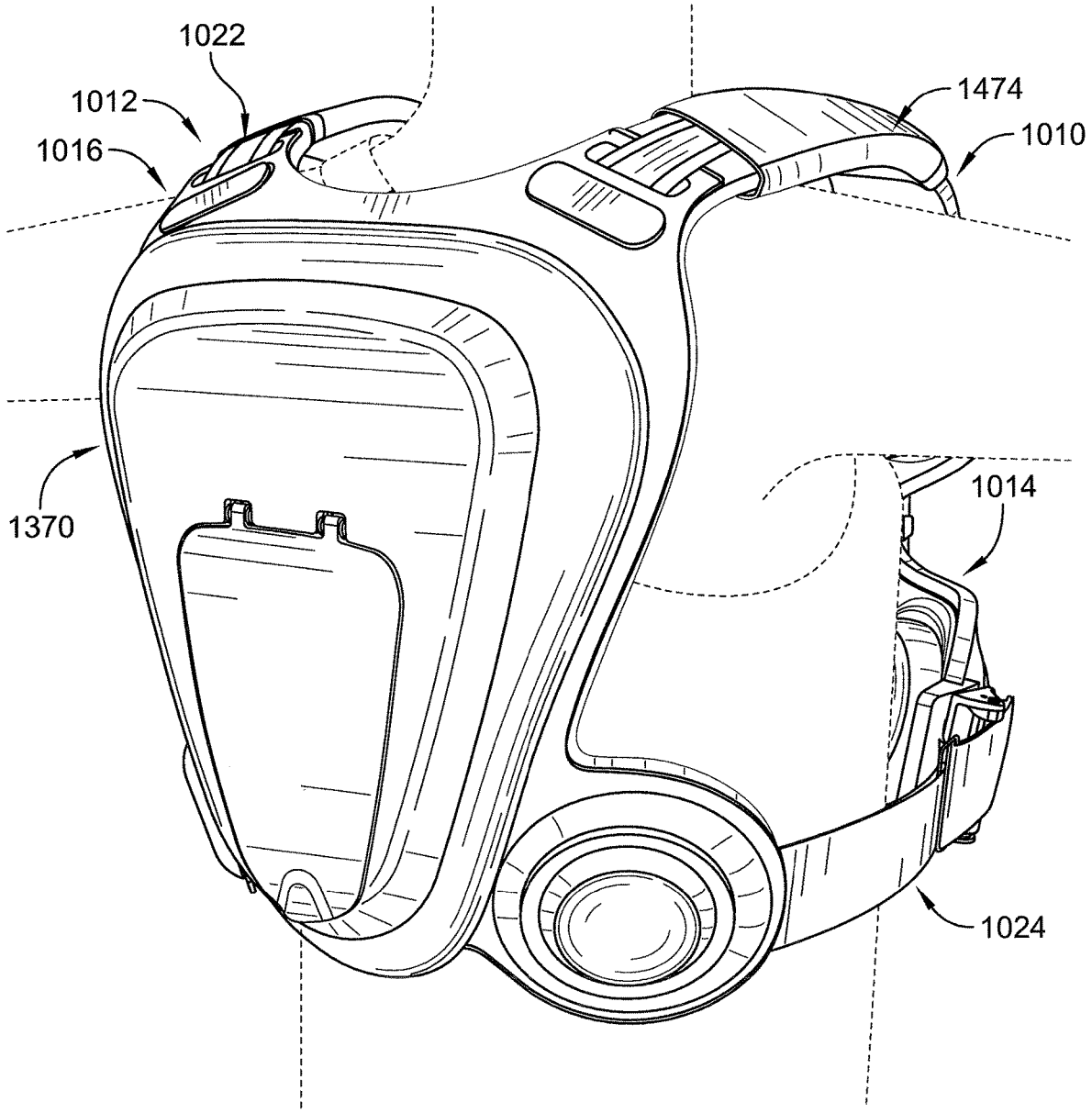
FIG. 70 is a rear perspective view of the percussion therapy apparatus of FIG. 69 in high resolution showing the percussion therapy apparatus secured to a patient's torso.

As shown in FIG. 67, the percussion therapy apparatus 1010 is shown with the outer liner 1472 removed to reveal that the percussion therapy apparatus 1010 illustratively includes shoulder socks 1474 that wrap around the shoulder straps 1022 and shoulder portions 1058, 1128. As shown in FIG. 68, the percussion therapy apparatus 1010 is shown with the outer liner 1472 removed as worn by a patient. As shown in FIG. 69, the percussion therapy apparatus 1010 is shown in rear perspective view to show the pack housing 1370. As shown in FIG. 70, the percussion therapy apparatus 1010 is shown in the rear perspective view as worn by a patient.

Figure 71:
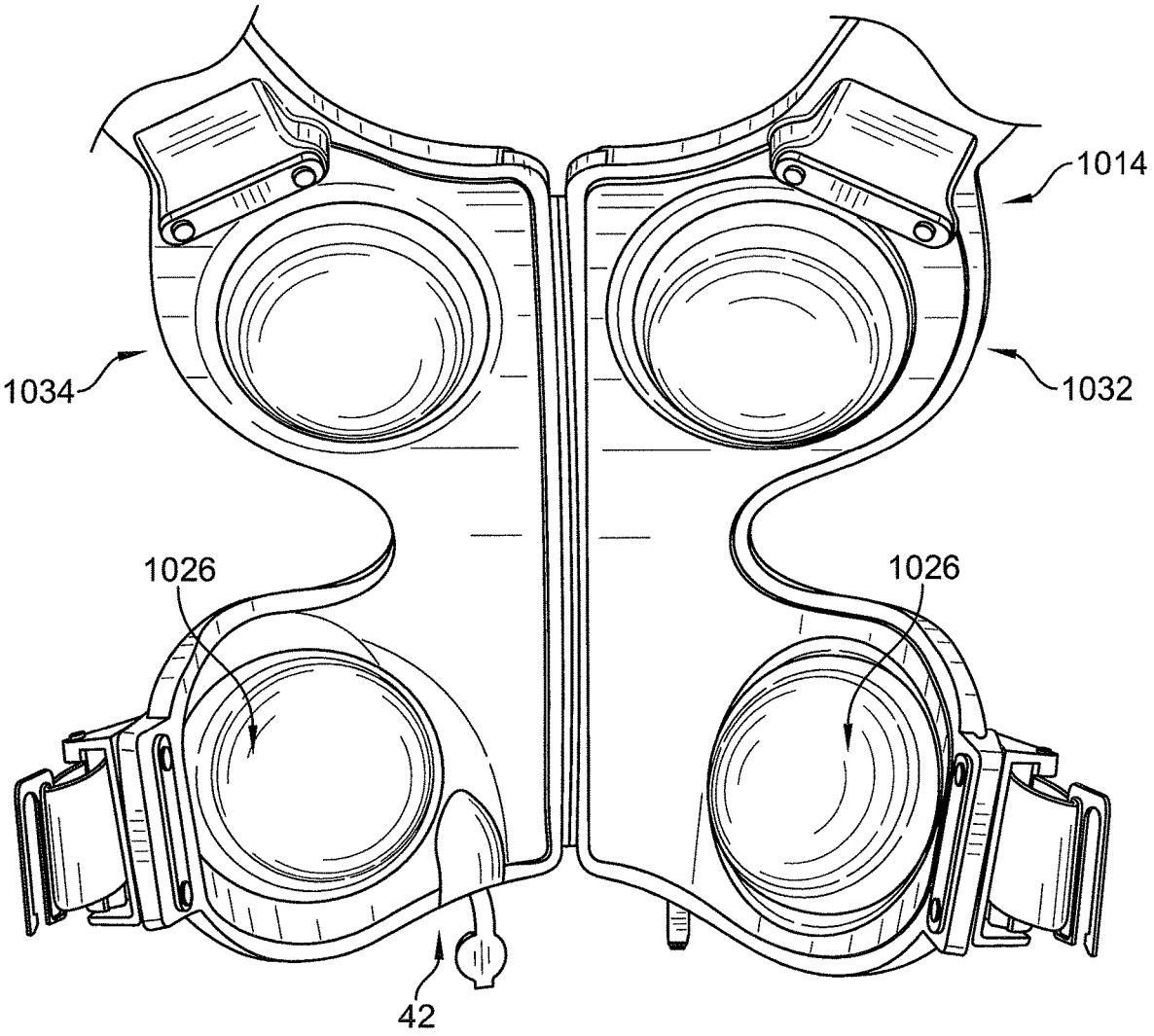
FIG. 71 is a rear view of the chest panel of the percussion therapy apparatus of FIG. 66 from an interior, in high resolution and showing the contact padding secured about the percussive devices.
Figure 72:
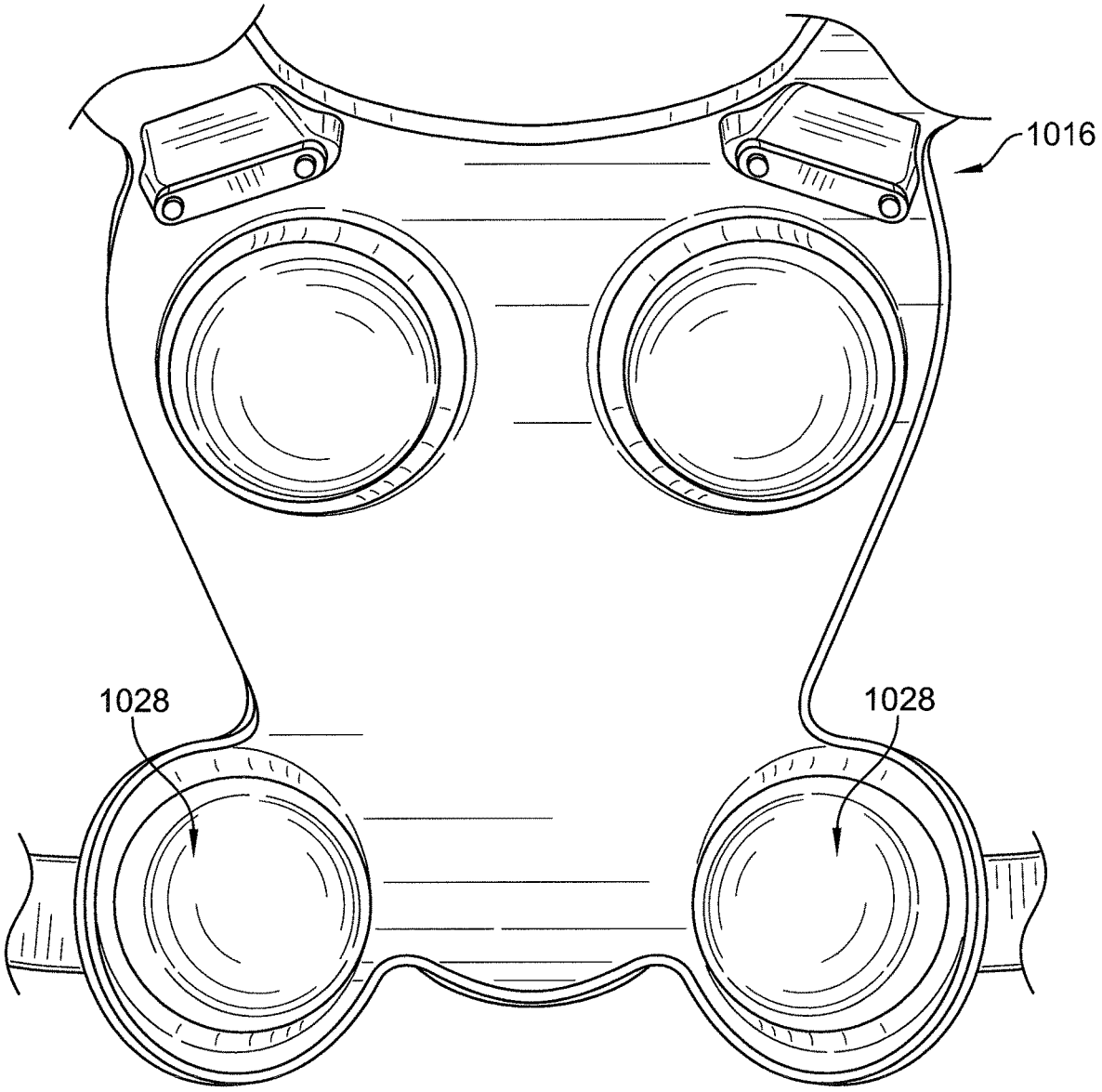
FIG. 72 is a rear view of the back panel of the percussion therapy apparatus of FIG. 66 from an interior, in high resolution and showing the contact padding secured about the percussive devices.

As shown in FIG. 71, the chest panel 1014 is shown from a rear (interior) view showing the contact padding 1026 covering the percussive devices 1018 on each of the right and left sections 1032, 1034. A power port 1040 is shown to illustratively protrude to the interior of the chest panel 1014. As shown in FIG. 72, the back panel 1016 is shown from a front (interior) view showing the contact padding 1026 covering the percussive devices 1018.

Figure 73:
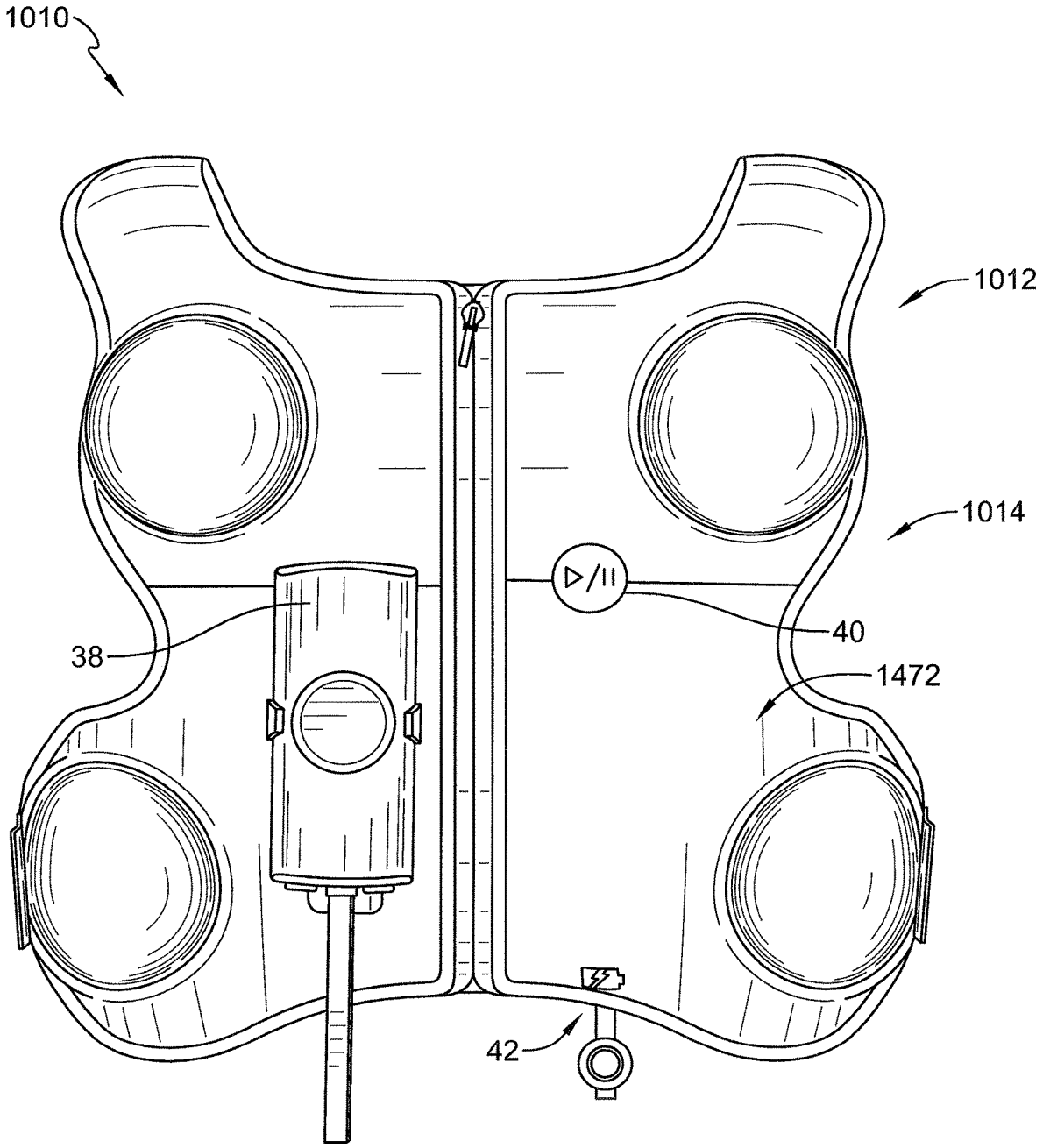
FIG. 73 is a front view of the percussion therapy device of FIG. 67.
Figure 74:
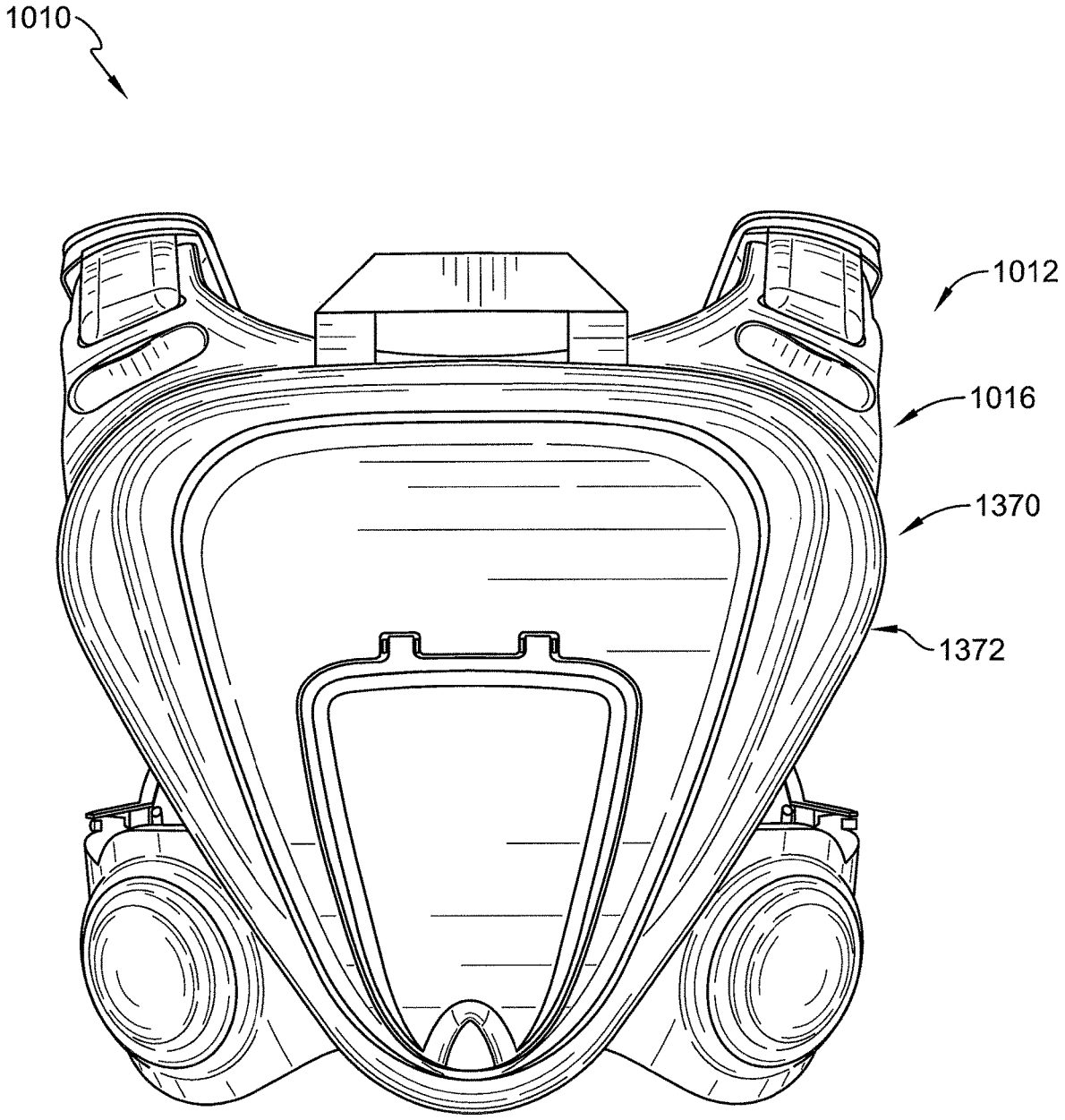
FIG. 74 is a rear view of the percussion therapy device of FIG. 73 showing that the outer cover has been removed.
Figure 75:
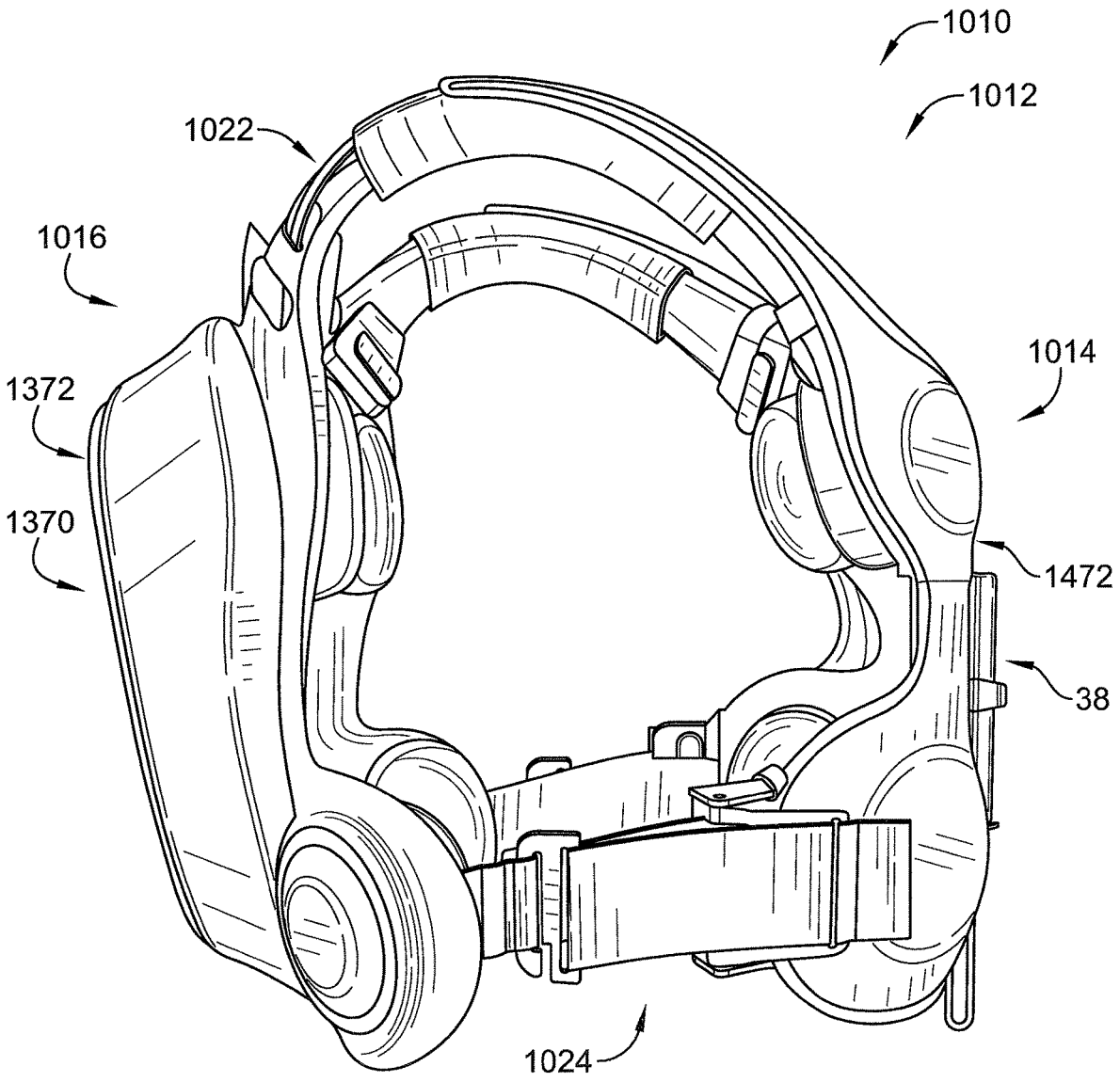
FIG. 75 is a left side view of the percussion therapy device of FIGS. 73 and 74.
Figure 76:
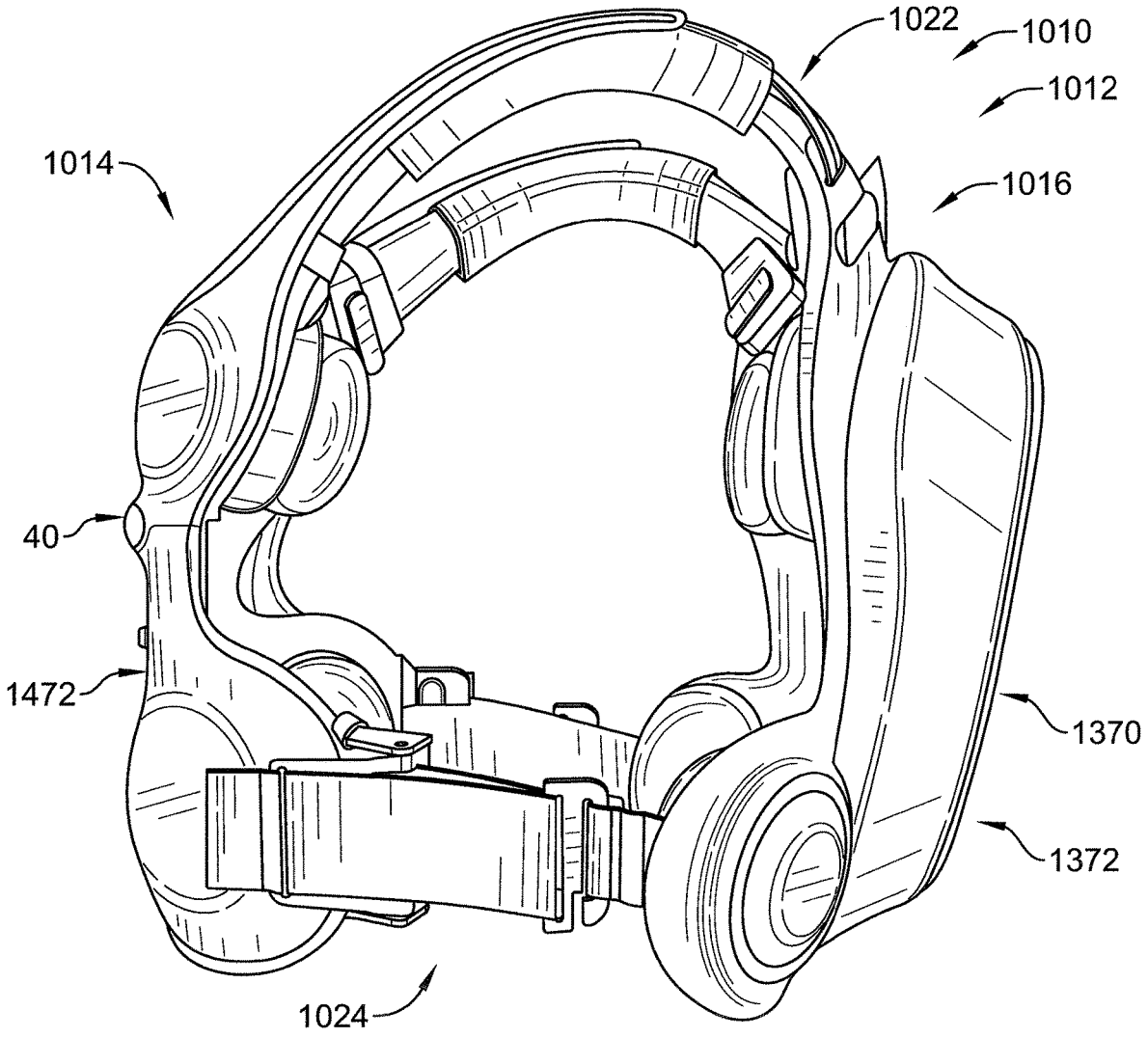
FIG. 76 is a right side view of the percussion therapy device of FIGS. 73-75.
Figure 77:
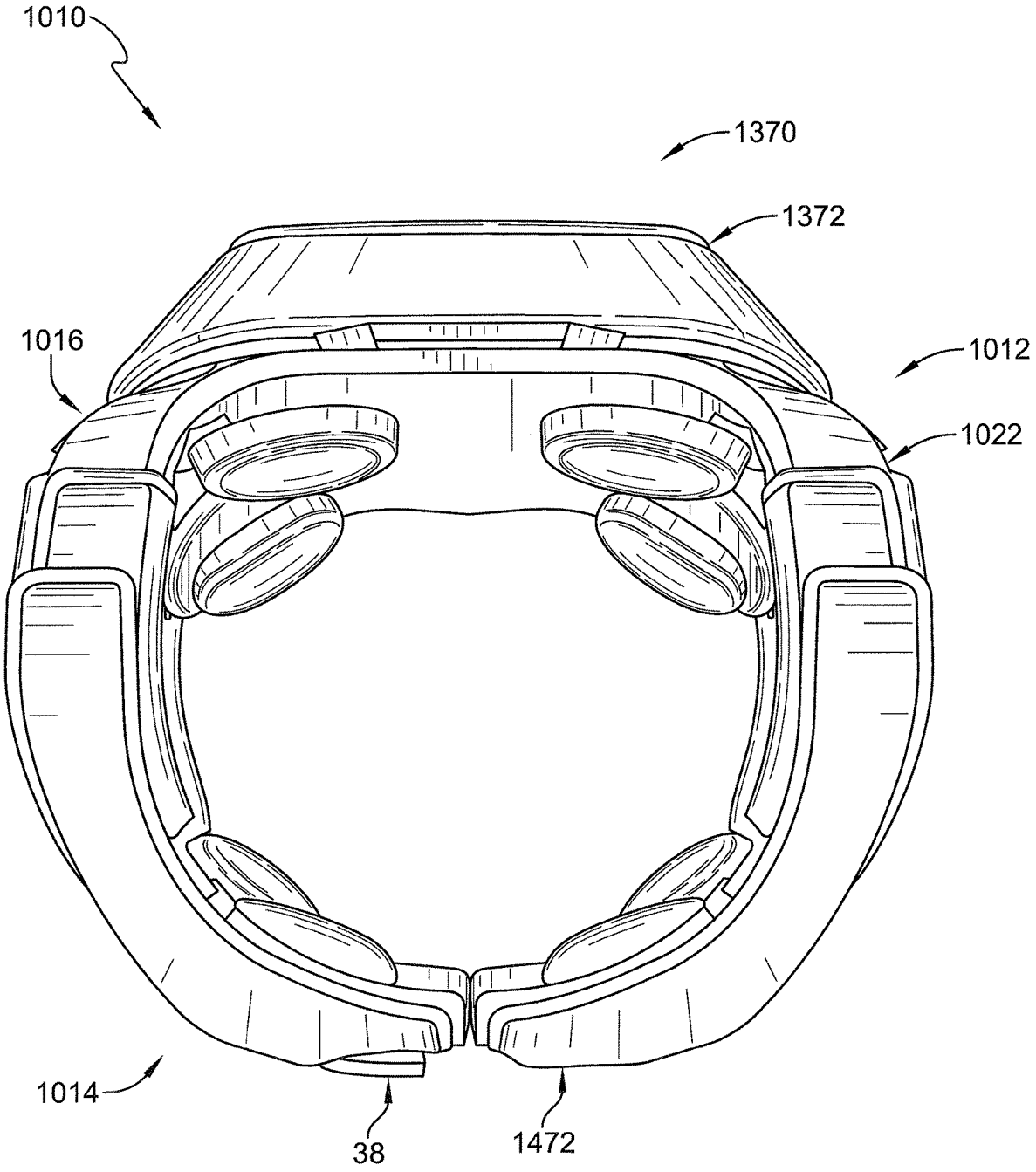
FIG. 77 is a top view of the percussion therapy device of FIGS. 73-76.
Figure 78:
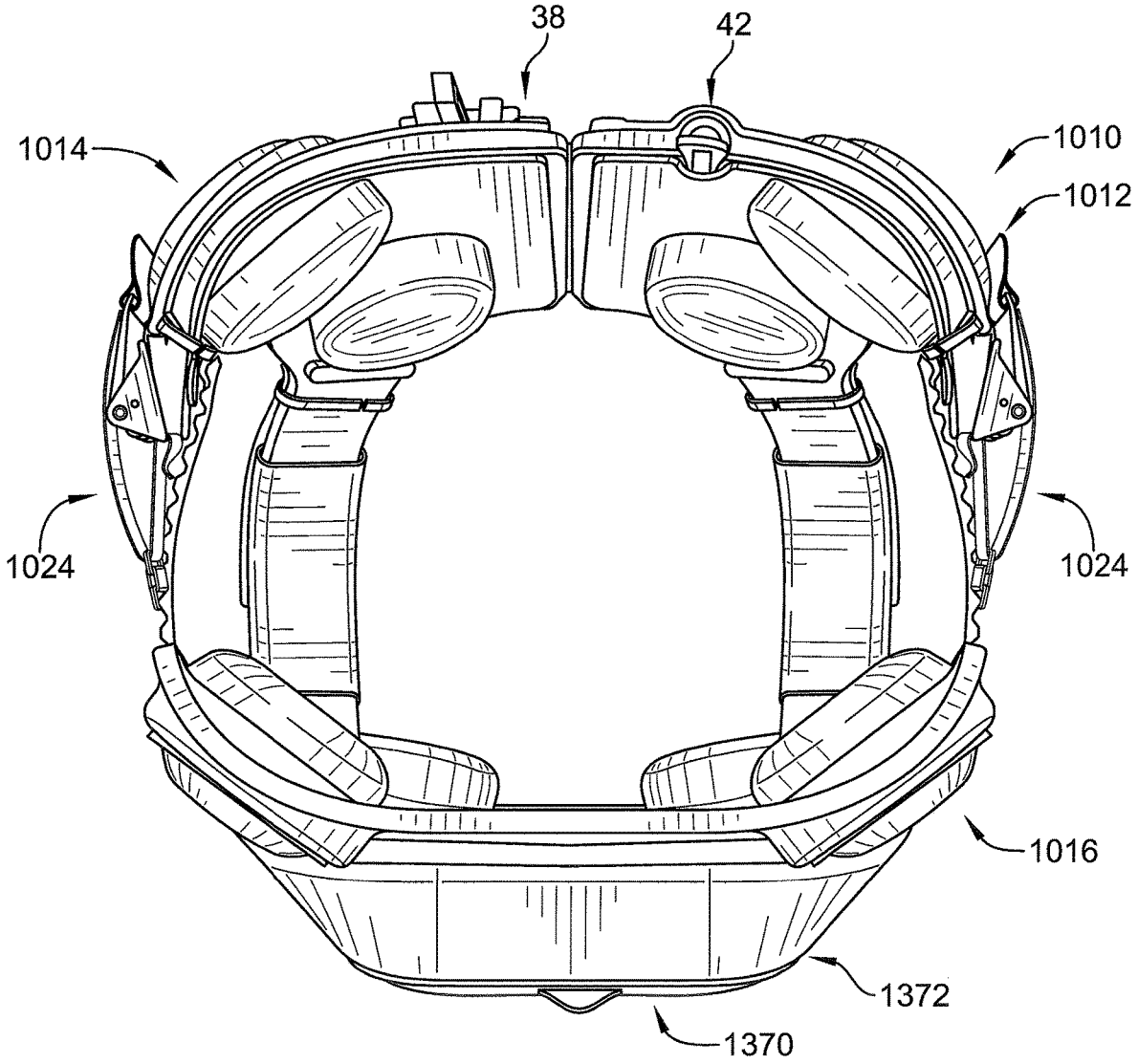
FIG. 78 is a bottom view of the percussion therapy device of FIGS. 73-77.

As shown in FIG. 73, the percussion therapy device 1010 is shown in a front view with the outer liner 1472 attached to the chest panel 1014 and the outer cover 1372 attached to the back panel 1016. In FIG. 74, the percussion therapy device 1010 is shown in a rear view with the outer liner 1472 attached to the chest panel 1014 and the outer cover 1372 attached to the back panel 1016. In FIG. 75, the percussion therapy device 1010 is shown in a left side view with the outer liner 1472 attached to the chest panel 1014 and the outer cover 1372 attached to the back panel 1016. In FIG. 76, the percussion therapy device 1010 is shown in a right side view with the outer liner 1472 attached to the chest panel 1014 and the outer cover 1372 attached to the back panel 1016. In FIG. 77, the percussion therapy device 1010 is shown in a top view with the outer liner 1472 attached to the chest panel 1014 and the outer cover 1372 attached to the back panel 1016. In FIG. 78, the percussion therapy device 1010 is shown in a bottom view with the outer liner 1472 attached to the chest panel 1014 and the outer cover 1372 attached to the back panel 1016.

Figure 79:
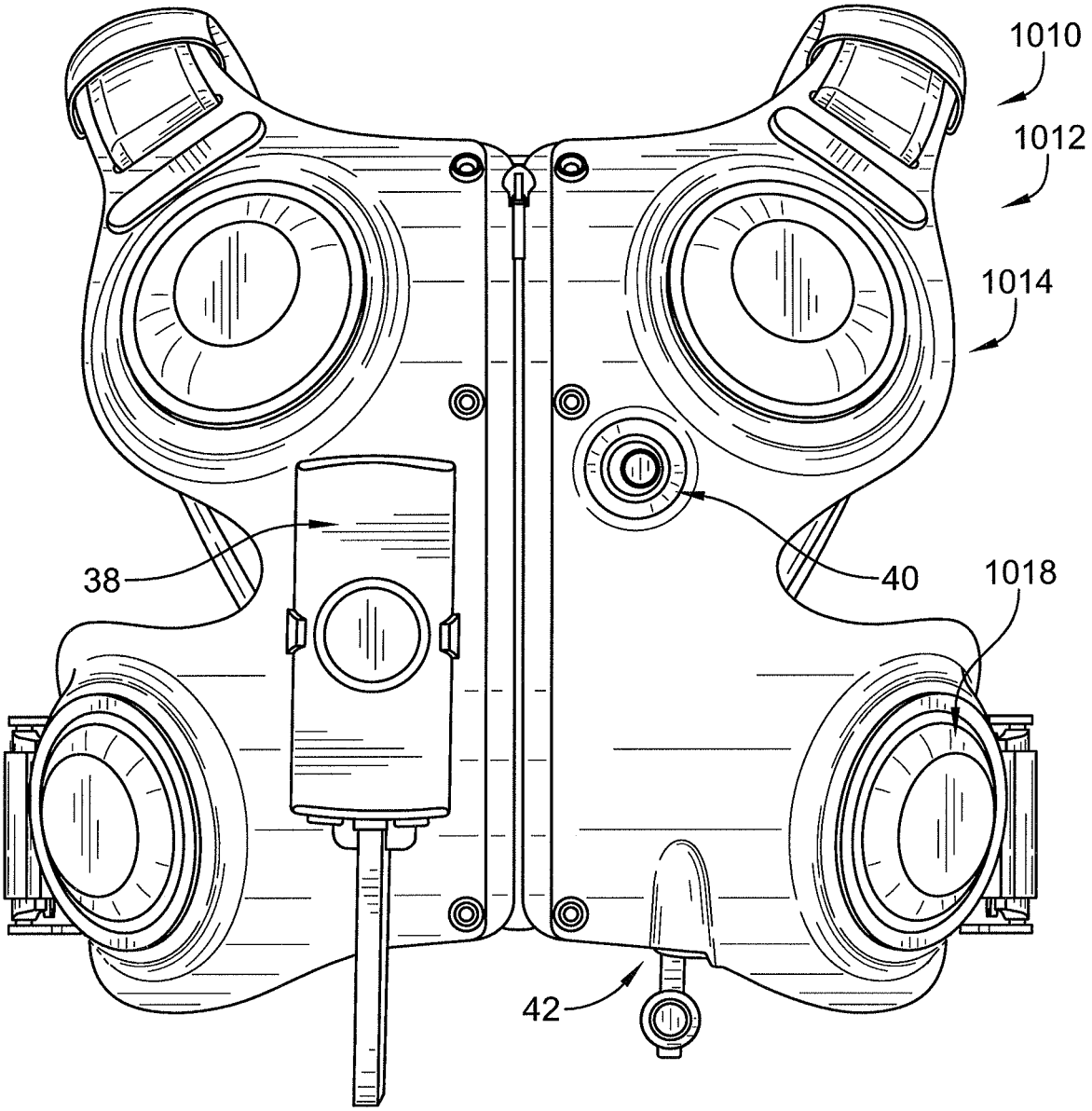
FIG. 79 is a front view of the percussion therapy device of FIGS. 73-78.
Figure 80:
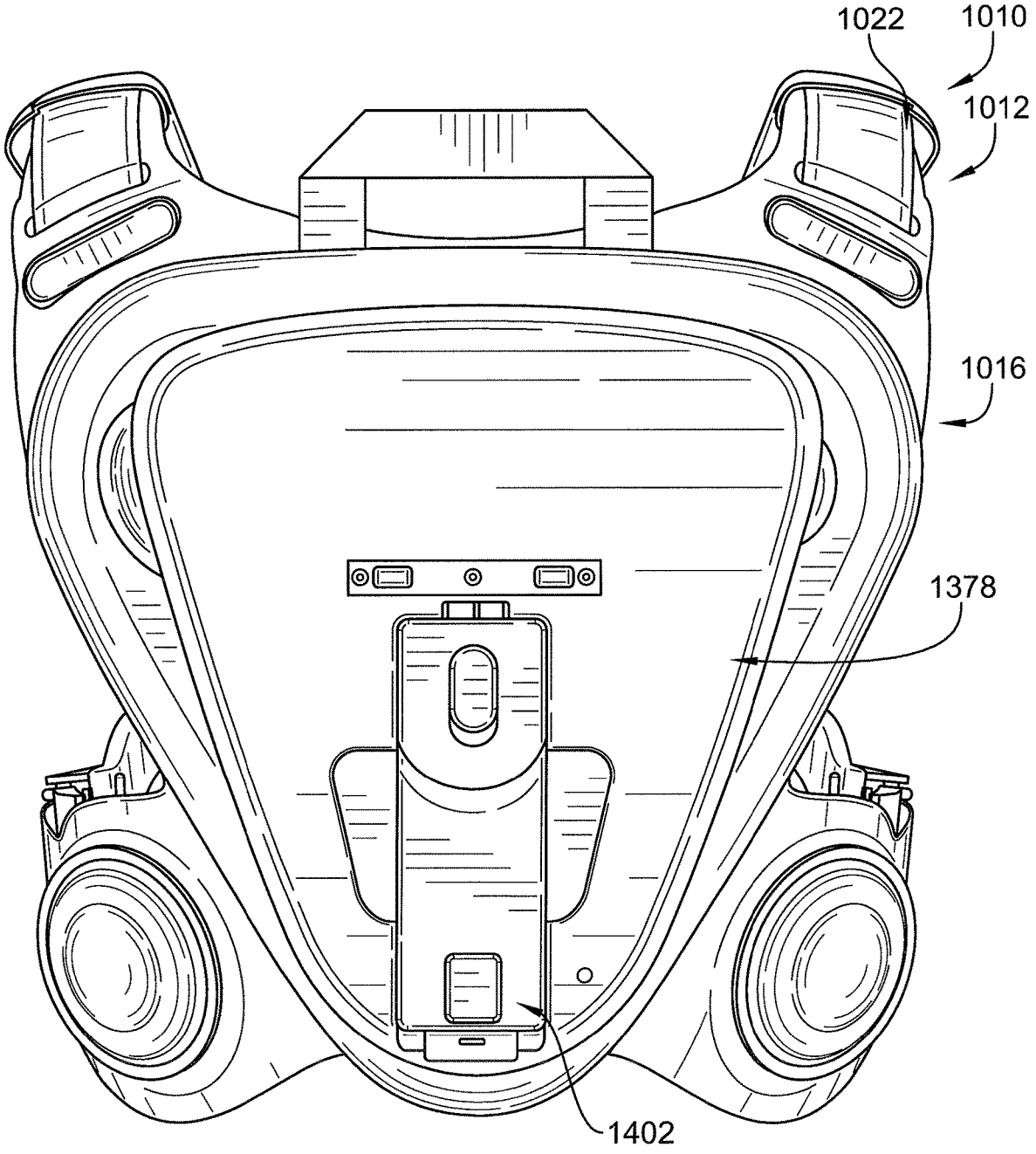
FIG. 80 is a rear view of the percussion therapy device of FIGS. 73-79.
Figure 81:
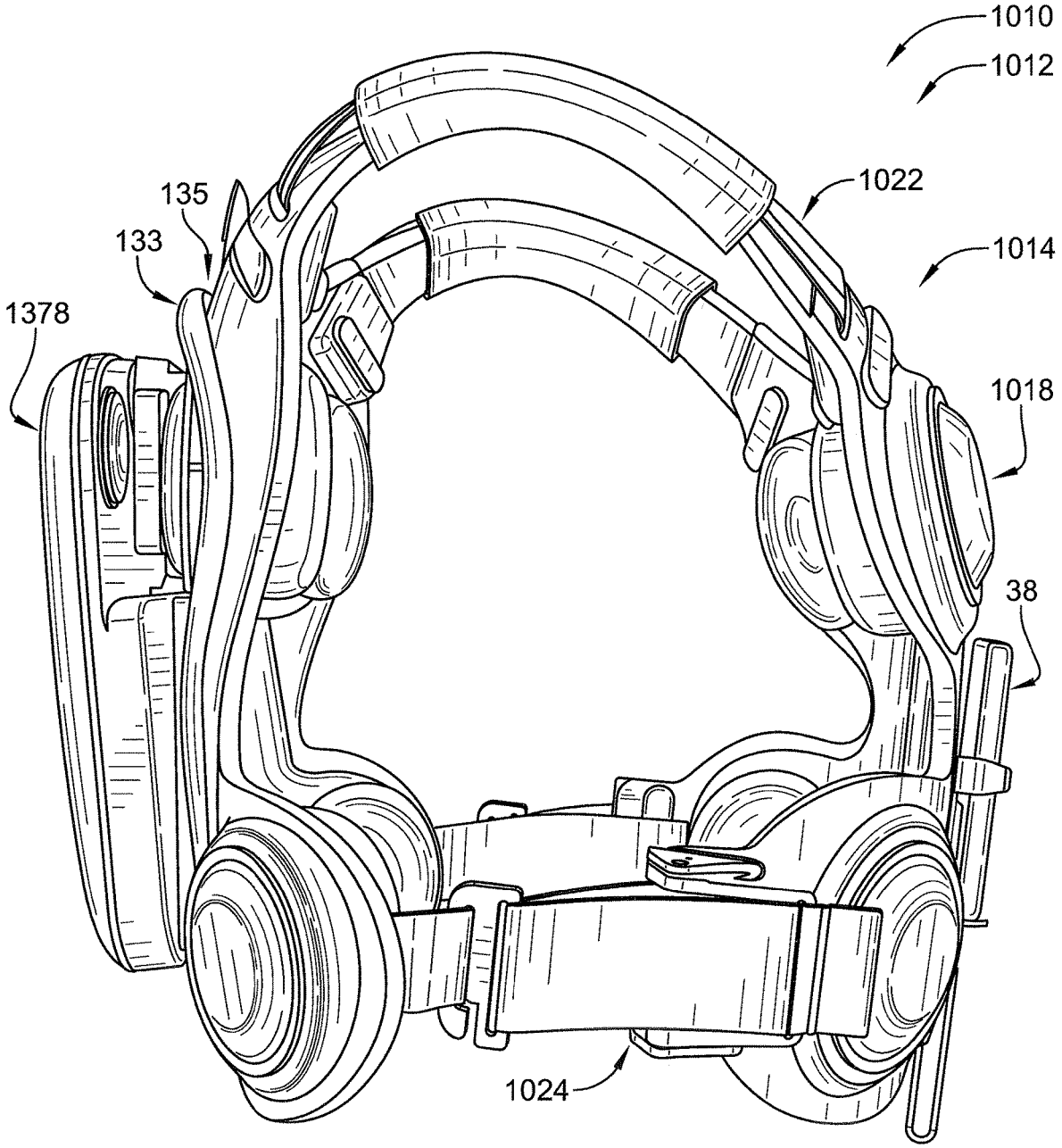
FIG. 81 is a left side view of the percussion therapy device of FIGS. 73-80.
Figure 82:
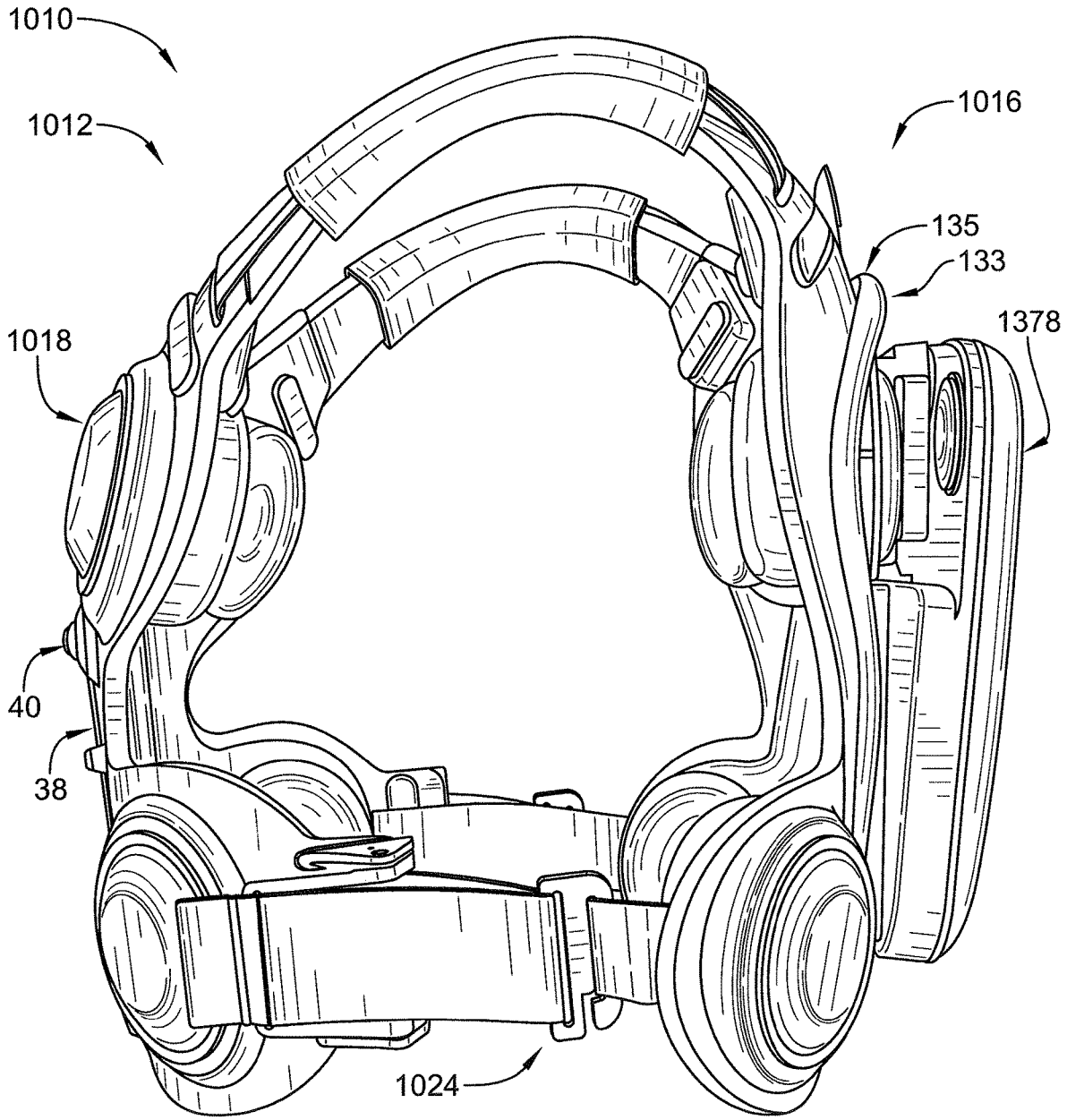
FIG. 82 is a right side view of the percussion therapy device of FIGS. 73-81.
Figure 83:
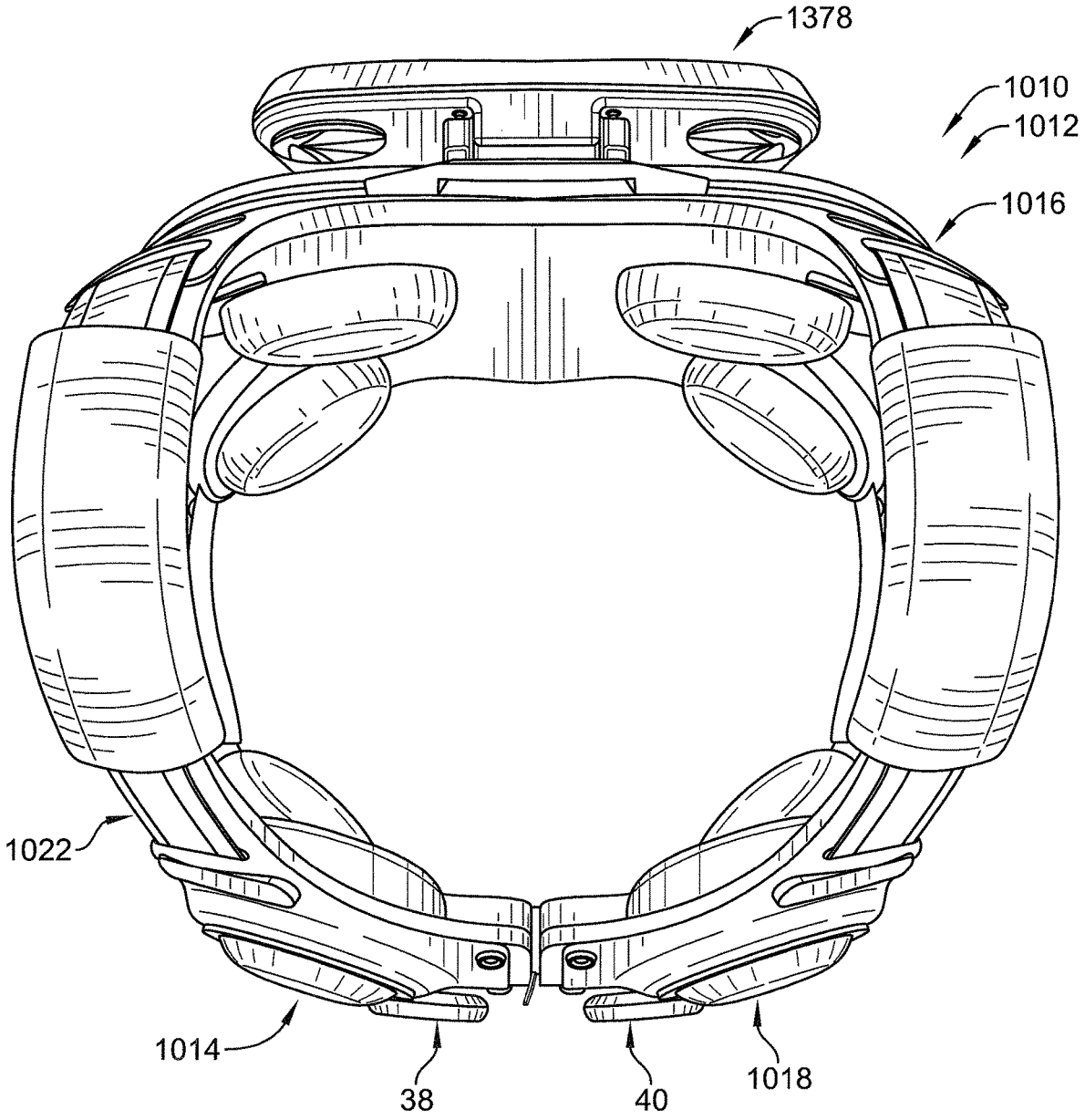
FIG. 83 is a top view of the percussion therapy device of FIGS. 73-82.
Figure 84:
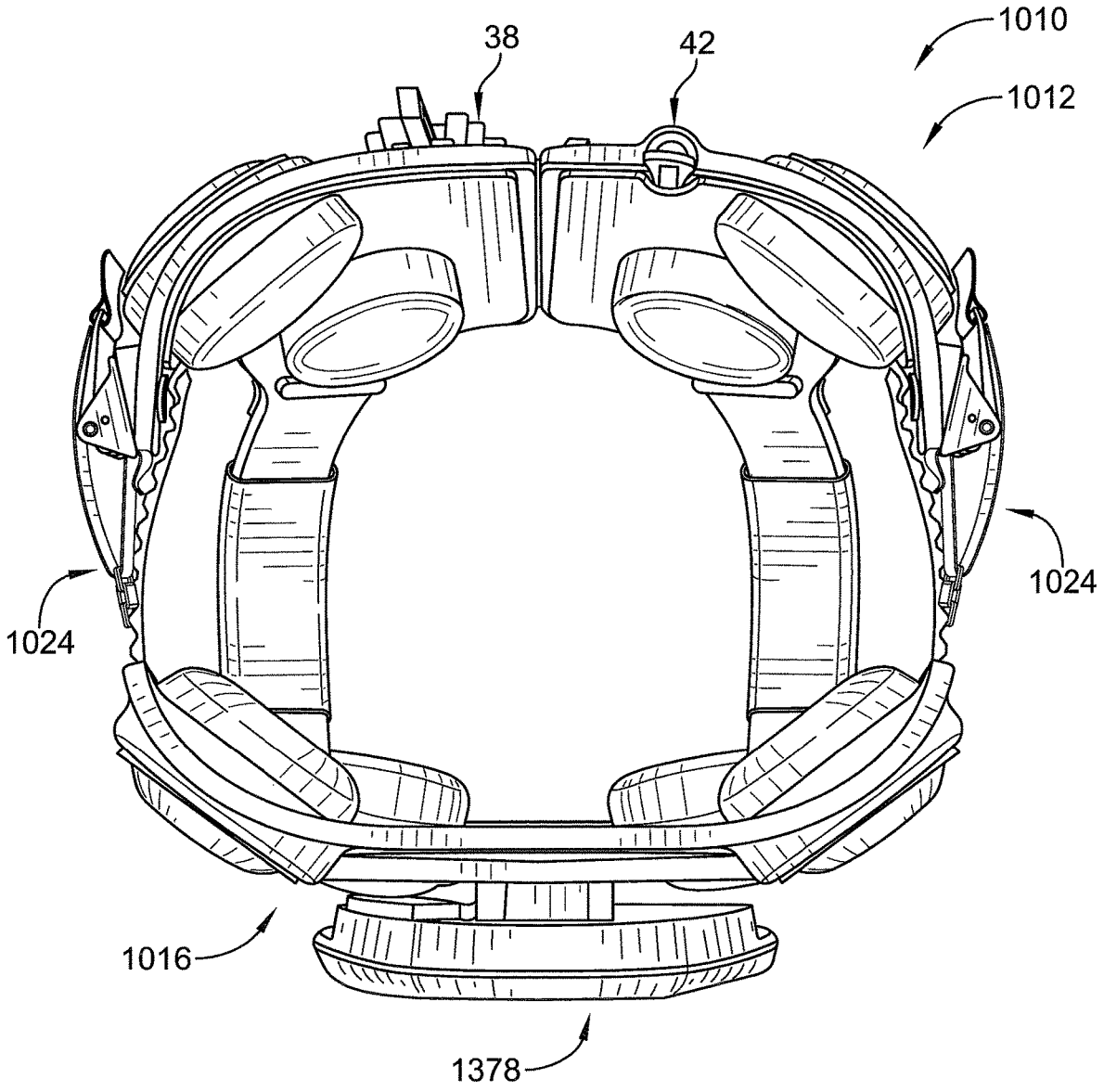
FIG. 84 is a bottom view of the percussion therapy device of FIGS. 73-83.

As shown in FIG. 79, the percussion therapy device 1010 is shown in a front view without the outer liner 1472 and without the outer cover 1372. In FIG. 80, the percussion therapy device 1010 is shown in a rear view without the outer liner 1472 and without the outer cover 1372. In FIG. 81, the percussion therapy device 1010 is shown in a left side view without the outer liner 1472 and without the outer cover 1372. In FIG. 82, the percussion therapy device 1010 is shown in a right side view without the outer liner 1472 and without the outer cover 1372. In FIG. 83, the percussion therapy device 1010 is shown in a top view without the outer liner 1472 and without the outer cover 1372. In FIG. 84, the percussion therapy device 1010 is shown in a bottom view without the outer liner 1472 and without the outer cover 1372.

Figures 85, 86:
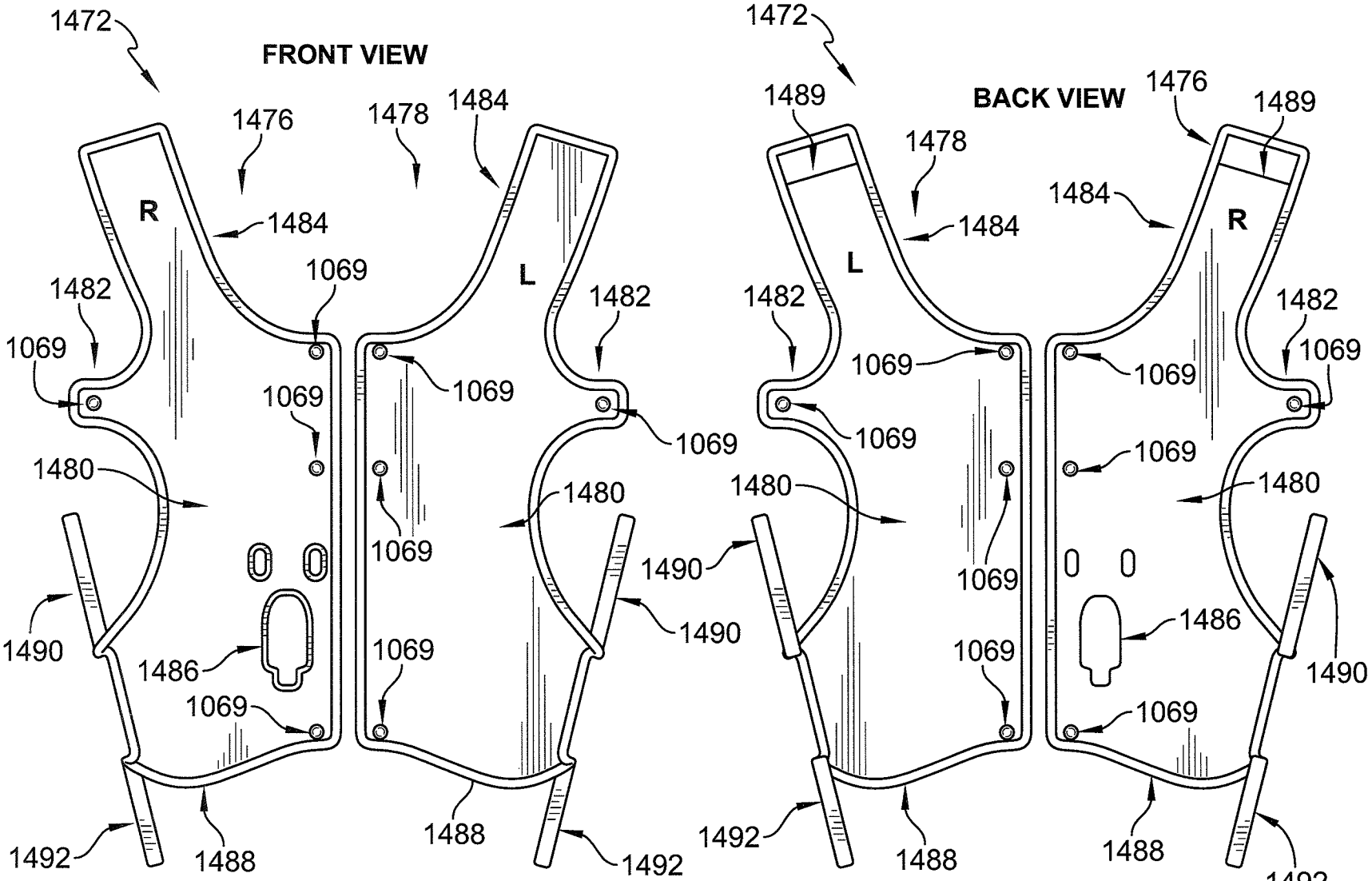
FIG. 85 is a front view of the outer liner of the percussion therapy device of FIG. 66 showing that the outer liner includes left and right sections and snaps for attachment to the front panel.
FIG. 86 is a rear view of the outer liner of FIG. 66 showing that the outer liner includes side leashes for coupling about the side strap assemblies.

As shown in FIGS. 85 and 86, the outer liner 1472 illustratively includes a right section 1476 and a left section 1478 respectively attachable to the right and left sections 1032, 1034 of the chest panel 1014. Each of the right and left sections 1476, 1478 illustratively include a panel section 1480 formed complimentary to the respective right and left sections 1032, 1034 of the chest panel 1014, a connection strap 1482 for securing to a portion of the respective left and right sections 1032, 1034, and a shoulder section 1484 for covering at least a portion of the shoulder straps 1022. The outer liner 1472 illustratively provide a protective covering to keep the chest panel 1014 clean from foreign substances, for example but without limitation medication from a nebulizer and/or expectorant mucous. The outer liner 1472 illustratively provides a removable substrate for customizable graphic design for pleasing visual and/or texture profiles.

As shown in FIGS. 85 and 86, the right section 1476 illustratively includes a set of holes 1486 for extension of the interface mount 1064 and cabling 1085 therethrough for mounting of the user interface 38. Each of the right and left sections 1476, 1478 illustratively include snap portions 1069 for engagement with the snaps 1067 of the chest panel 1014 to secure the outer liner 1472 thereto. In the illustrative embodiment, a number of snap portions 1069 are positioned near the medial intersection of the right and left sections 1476, 1478 respectively at the top, middle, and bottom of the panel section 1480 of each of the right and left sections 1476, 1478. A snap portion 1069 is illustratively positioned on the connection strap 1482 of each of the right and left sections 1476, 1478.

In the illustrative embodiment as shown in FIGS. 85 and 86, each of the left and right sections 1476, 1478 include a stretchable binding 1488 disposed on an outer edge thereof. The stretchable binding 1488 illustratively provides a resilient edging for easy securing of the outer liner 1472 to the covering 1012 with close fit. The panel section 1480 of the right and left sections 1476, 1478 illustratively includes side leashes 1490, 1492 at lower sides corresponding to the location of the side straps assemblies 1024. The side leashes 1490, 1492 illustratively comprise complimentary hook and unbreakable loop portions for releasably securing to each other around the respective side strap assembly 1024. As shown in FIG. 86, the shoulder section 1484 illustratively include hook and 60 able loop portions 1489 positioned at outer ends thereof for securing to the shoulder socks 1474.

Figure 89:
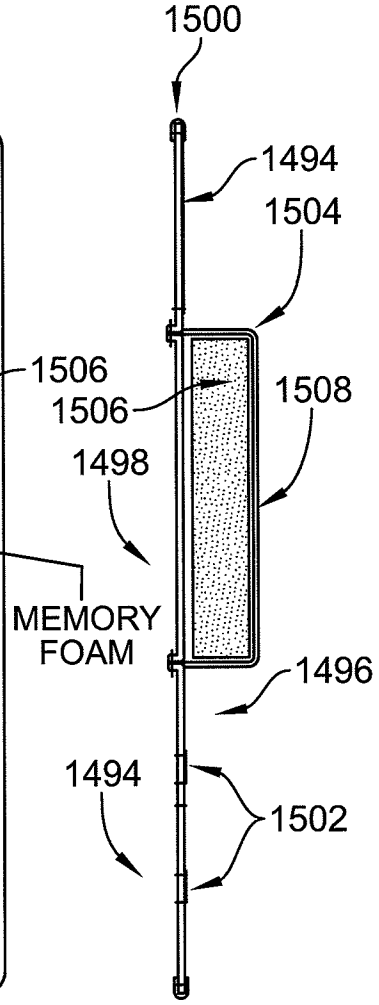
FIG. 89 is a cross sectional view of the shoulder sleeve of FIG. 88 taken through a centerline oriented along the long dimension of the shoulder sleeve.
Figure 88:
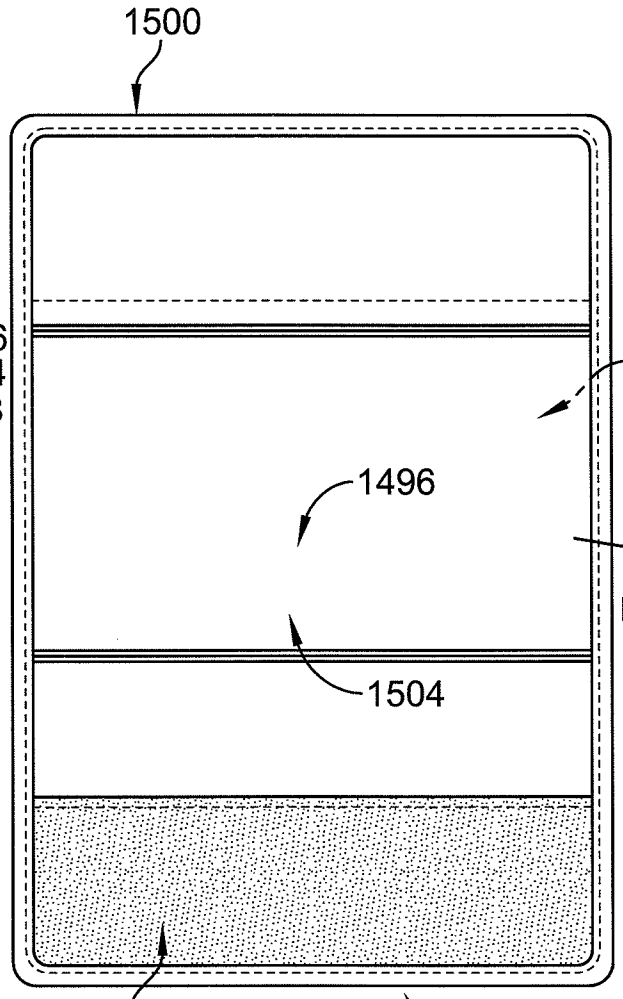
FIG. 88 is a bottom view of the shoulder sleeve of FIG. 87 showing that the sleeve includes a hook and unbreakable loops portion on the bottom end for joining with the hook and unbreakable loop portion on the top end of the other side of the sleeve.
Figure 87:
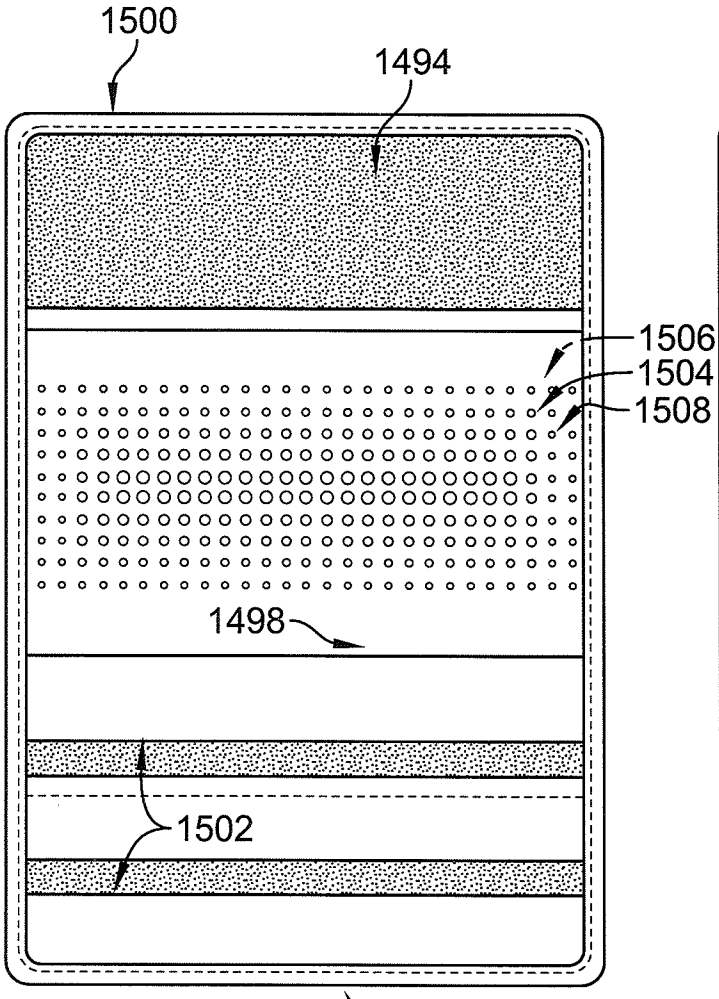
FIG. 87 is a top view of a shoulder sleeve of the percussion therapy apparatus of FIG. 67 showing that the sleeve includes hook and unbreakable loops portions on the top and bottom ends.

As shown in FIGS. 87-89, the shoulder socks 1474 each illustratively include complimentary hook and unbreakable loop fasteners 1494 for wrapping and securing around the shoulder straps 1022 and shoulder portions 1058, 1128. Each shoulder sock 1474 illustratively has a rectangular shape and is formed of fabric, and has an inner side 1496 and an outer side 1498. One of the complimentary hook and unbreakable loop fasteners 1494 is illustratively positioned on each of the inner and outer side 1496, 1498 at opposite ends 1500 of the shoulder sock 1474 such that wrapping and overlapping the opposite ends 1500 arranges the complimentary unbreakable loop fasteners 1494 into engagement with each other for releasable fastening. As shown in FIG. 87, the shoulder socks 1474 each illustratively include hook and unbreakable loop fasteners portions 1502 for engagement with respective complimentary hook and unbreakable loop fasteners portions 1489 of the outer liner 1472.

As best shown in FIG. 89, the shoulder socks 1474 each illustratively include a shoulder pad 1504 positioned beneath the shoulder straps 1022 and shoulder portions 1058, 1128 as the shoulder socks 1474 are secured thereon. The shoulder pad 1504 illustratively includes a padding 1506, illustratively formed of viscoelastic foam, enclosed within a pad housing 1508, embodied as fabric.

In the illustrative embodiments, the percussive devices 18 comprise magnets which move with the percussors and stationary actuators, but in some embodiments may include moving actuators and stationary magnets. The cabling 45, 47, 140, 188, 1045, 1047, 1085, 1140, 2084 illustratively provides electrical communications between the power and control circuitry 1412 and each of the respective percussive devices 18, 1018, 2018, 3018, 4018, the user interface 38, and the break button 40, 2040. The cabling 45, 47, 140, 188, 1045, 1047, 1085, 1140, 2084 as mentioned herein is distinguished numerically but in some embodiments each numerical designation may comprise some or all of the same cables and/or interconnected wiring as that of differently enumerated cabling. Disclosed hardware and/or software for computational communications and electrical power includes any style, number, and/or arrangement for performing the disclosed process. In some embodiments, the percussive devices disclosed herein can be applied without attachment to the coverings in a hand-held fashion and may be equipped with local battery power and/or power cable.

According to this disclosure, user interface 38 of percussion therapy apparatuses 10, 1010, 2010 stores one or more music files that are playable through the respective percussive devices 18, 1018, 2018, 3018, 4018, which comprise voice coils in some embodiments. Such music files are played, under the user's selective control, when devices 18, 1018, 2018, 3018, 4018 are not being used to perform percussion therapy, for example. Thus, user interface 38 includes volume controls, song selection controls, forward and reverse controls, pause controls, start and stop controls, and so forth. Alternatively or additionally, one or more other electronic devices link with the circuitry of apparatuses 10, 1010, 2010 to play music files through devices 18, 1018, 2018, 3018, 4018. Such other electronic devices link wirelessly with the circuitry of apparatuses 10, 1010, 2010 in some embodiments. Alternatively or additionally, such other electronic devices link with the circuitry of apparatuses 10, 1010, 2010 via a wired connection. The other electronic devices include, for example, smart phones, an iPods, tablet computers, smart watches, and MP3 players, just to name a few.

Although certain illustrative embodiments have been described in detail above, variations and modifications exist within the scope and spirit of this disclosure as described and as defined in the claims below.

The invention claimed is:

1. A percussion therapy apparatus for providing percussion therapy to a patient's body, the percussion therapy apparatus comprising:

a torso covering for securing to a patient's torso, the torso covering including a front panel having an interior side for engaging the patient's chest and a rear panel having an interior side for engaging the patient's back, a plurality of percussive devices coupled to the torso covering to provide percussive force to the patient's torso, a user interface couplable with the torso covering, the user interface configured to receive user input for adjusting operation of the plurality of percussive devices and for communication with the plurality of percussive devices to provide percussive force, and a break button attached to the torso covering and formed apart from the user interface, the break button arranged in communication with the plurality of percussive devices and configured to receive user input to pause operation of the plurality of percussive devices.

2. The percussion therapy apparatus of claim 1, wherein the front panel of the torso covering comprises a first section and a second section coupled to each other at a medial intersection.

3. The percussion therapy apparatus of claim 1, wherein the first and second sections are releasably coupled at the medial intersection by a zipper assembly having first and second zipper portions attached to the first and second sections, respectively.

4. The percussion therapy apparatus of claim 3, wherein the first and second zipper portions each having a top end and bottom end and each being angled between its respective top and bottom ends within the range of about 1 to about 5 degrees from the sagittal plane in opposite lateral directions.

5. The percussion therapy apparatus of claim 3, wherein the user interface is releasably coupled to the front panel.

6. The percussion therapy apparatus of claim 5, further comprising a power source releasably coupled to the rear panel.

7. The percussion therapy apparatus of claim 5, wherein the user interface is releasably coupled to the first section.

8. The percussion therapy apparatus of claim 7, wherein the break button is coupled to the second section.

9. The percussion therapy apparatus of claim 7, wherein a power port is coupled to the second section.

10. The percussion therapy apparatus of claim 1, wherein at least one of the front panel and the rear panel includes an inner pane, an outer pane, and a frame pane disposed between the inner and outer panes.

11. The percussion therapy apparatus of claim 10, wherein the inner and outer pane comprise a compression foam and the frame pane comprises a semi-rigid plastic.

12. The percussion therapy apparatus of claim 10, wherein at least one of the inner, outer, and frame panes includes a groove defined therein for receiving cabling between adjacent panes.

13. The percussion therapy apparatus of claim 1, wherein each percussive device includes a means for percussing a patient, means for housing the percussing means, means for moving the percussing means relative to the housing means, and spring means for connecting the percussing means to the housing means and further comprising shoulder strap means for coupling the front and rear panel together and for routing at least one cable; user interface means for adjusting percussive force of the percussive devices; means for coupling the percussive devices to the torso covering; side strap means for connecting the front and rear panels together; control pack means coupled to the rear panel for housing circuitry to send signals to the percussive devices; outer liner means for covering at least a portion of the front panel; means for coupling accessories to the front panel; and contact pad means for transferring percussive force to a patient from the percussive devices.

14. The percussion therapy apparatus of claim 1, wherein the break button is enclosed by a liner.

15. The percussion therapy apparatus of claim 14, wherein the break button is operable to receive user input through the liner.

16. The percussion therapy apparatus of claim 1, wherein the break button is configured to provide user-controlled impromptu pausing of percussive operation of the percussive devices during percussion therapy cycles.

17. The percussion therapy apparatus of claim 1, wherein the break button is configured to pause operation of the plurality of percussive devices to allow the patient to cough without experiencing percussive force of the percussive devices.

18. The percussion therapy apparatus of claim 1, wherein the break button is positioned on one of the plurality of percussive devices.

19. The percussion therapy apparatus of claim 18, wherein the one of the plurality of percussive devices is an upper percussive device.

* * * * *